US010758061B2

(12) United States Patent
McDonald et al.

(10) Patent No.: US 10,758,061 B2
(45) Date of Patent: Sep. 1, 2020

(54) PRODUCT PUSHER

(71) Applicant: DS Smith Packaging Limited, London (GB)

(72) Inventors: James McDonald, Edwalton (GB); Gert De Smedt, Heffen (BE); Fredrik Jacobsson, Saltsjobaden (SE); Andrew Thompson, Lincolnshire (GB); Erich Kreutzer, Hofstetten (AT)

(73) Assignees: DS SMITH PACKAGING LIMITED (GB); MONDELEZ UK R&D LIMITED (GB)

( * ) Notice: Subject to any disclaimer, the term of this patent is extended or adjusted under 35 U.S.C. 154(b) by 0 days.

(21) Appl. No.: 15/187,941

(22) Filed: Jun. 21, 2016

(65) Prior Publication Data

US 2016/0297600 A1 Oct. 13, 2016

Related U.S. Application Data

(63) Continuation of application No. 14/412,338, filed as application No. PCT/GB2013/051755 on Jul. 2, 2013, now abandoned.

(30) Foreign Application Priority Data

Jul. 3, 2012 (GB) ..... 1211787.5
Jan. 9, 2013 (GB) ..... 1300373.6

(51) Int. Cl.
*B65B 5/02* (2006.01)
*A47F 1/12* (2006.01)
(Continued)

(52) U.S. Cl.
CPC ..... *A47F 1/126* (2013.01); *B65B 5/026* (2013.01); *B65B 5/068* (2013.01); *B65D 5/28* (2013.01);
(Continued)

(58) Field of Classification Search
CPC .. A47F 1/126; B31B 1/00; B31B 1/90; B65B 5/026; B65B 5/068; B65D 5/48024; B65D 5/48042; B65D 5/724; B65D 83/0858
(Continued)

(56) References Cited

U.S. PATENT DOCUMENTS 1,593,532 A 7/1926 Hansen
1,718,572 A 6/1929 Marcuse
(Continued)

FOREIGN PATENT DOCUMENTS

AT 280878 4/1970
CN 2687060 3/2005
(Continued)

OTHER PUBLICATIONS

Intellectual Property Office of Great Britain Examination Report in connection with GB1211787.5 which dated Oct. 16, 2016.
(Continued)

*Primary Examiner* — Patrick H Mackey
(74) *Attorney, Agent, or Firm* — Clark Hill PLC; James R. Foley

(57) ABSTRACT

A product tray (20) comprising a product pusher (10), wherein the product pusher (10) is formed from a length of elastically stretchable fabric or material arranged to wrap behind and to the sides of products (22) contained within the tray (20) to apply a resilient bias force to the rear surface of those products (22) contained within the tray (20).

5 Claims, 94 Drawing Sheets

(51) Int. Cl.

| | |
|---|---|
| ***B65D 5/72*** | (2006.01) |
| ***B65B 5/06*** | (2006.01) |
| ***B65D 5/49*** | (2006.01) |
| ***B65D 83/08*** | (2006.01) |
| ***B65D 5/28*** | (2006.01) |
| ***B65D 5/64*** | (2006.01) |
| *B31B 120/00* | (2017.01) |
| *B31B 110/35* | (2017.01) |
| *B31B 50/81* | (2017.01) |
| *B31B 100/00* | (2017.01) |
| *B31B 50/28* | (2017.01) |
| *B65D 65/42* | (2006.01) |

(52) U.S. Cl.
CPC ..... *B65D 5/48024* (2013.01); *B65D 5/48042* (2013.01); *B65D 5/64* (2013.01); *B65D 5/724* (2013.01); *B65D 83/08* (2013.01); *B65D 83/0858* (2013.01); *B31B 50/28* (2017.08); *B31B 50/81* (2017.08); *B31B 2100/00* (2017.08); *B31B 2100/0024* (2017.08); *B31B 2110/35* (2017.08); *B31B 2120/00* (2017.08); *B65D 65/42* (2013.01)

(58) Field of Classification Search
USPC ..... 221/279; 206/805, 817
See application file for complete search history.

(56) References Cited

U.S. PATENT DOCUMENTS

| | | | | |
|---|---|---|---|---|
| 1,959,614 | A | 10/1933 | Coons | |
| 2,185,605 | A | 1/1940 | Murphy et al. | |
| 2,331,035 | A | 10/1943 | Lundstrom | |
| 2,634,855 | A | 4/1953 | Jacob | |
| 2,735,553 | A | 2/1956 | Lehman | |
| 2,774,467 | A | 12/1956 | Michiel | |
| 2,937,742 | A | 5/1960 | Michiel | |
| 3,122,236 | A | 12/1964 | Michiel | |
| 3,202,316 | A | 8/1965 | Silver | |
| 3,373,922 | A * | 3/1968 | Watts | B65D 5/3642 229/240 |
| 3,423,143 | A | 1/1969 | Bunger | |
| 3,591,049 | A | 7/1971 | Auriemma | |
| 3,647,114 | A | 3/1972 | Bleuer | |
| 4,020,946 | A | 5/1977 | Gardner et al. | |
| 4,588,093 | A | 5/1986 | Field | |
| 4,616,767 | A | 10/1986 | Seido | |
| 4,616,787 | A | 10/1986 | Kirsten | |
| 4,844,331 | A | 7/1989 | Oldfather | |
| 5,161,702 | A | 11/1992 | Skalski | |
| 5,197,631 | A | 3/1993 | Mishima | |
| 5,393,291 | A | 2/1995 | Wingerter | |
| 5,988,407 | A | 11/1999 | Battaglia | |
| 5,992,683 | A * | 11/1999 | Sigl | A47K 10/422 221/52 |
| 6,015,051 | A | 1/2000 | Battaglia | |
| 6,109,458 | A | 8/2000 | Walsh | |
| 6,193,067 | B1 | 2/2001 | McMahan | |
| 6,227,386 | B1 | 5/2001 | Close | |
| 6,454,107 | B1 | 9/2002 | Belanger et al. | |
| 7,048,464 | B2 | 5/2006 | Roennquist | |
| 7,284,662 | B2 | 10/2007 | Debusk et al. | |
| 7,481,313 | B1 * | 1/2009 | Kramedjian | B65D 5/5213 206/427 |
| 7,497,342 | B2 | 3/2009 | Hardy | |
| 7,896,172 | B1 | 3/2011 | Hester | |
| 7,997,427 | B2 | 8/2011 | Lowenbraun et al. | |
| 8,646,621 | B2 | 2/2014 | Zacherle et al. | |
| 8,997,997 | B2 | 4/2015 | Close et al. | |
| 9,889,962 | B2 | 2/2018 | McDonald et al. | |
| 2004/0178157 | A1 | 9/2004 | Tse | |
| 2005/0072747 | A1 | 4/2005 | Roslof et al. | |
| 2005/0161413 | A1 * | 7/2005 | Close | G09F 11/30 211/51 |
| 2007/0108083 | A1 | 5/2007 | Sonon | |
| 2009/0020548 | A1 | 1/2009 | Vandruff | |
| 2011/0294638 | A1 | 12/2011 | Tosevski | |
| 2013/0037562 | A1 | 2/2013 | Close | |
| 2015/0166249 | A1 | 6/2015 | McDonald et al. | |
| 2015/0284134 | A1 | 10/2015 | Kreutzer et al. | |
| 2016/0280407 | A1 | 9/2016 | Lindt et al. | |
| 2016/0280415 | A1 | 9/2016 | McDonald et al. | |
| 2016/0296040 | A1 | 10/2016 | McDonald et al. | |

FOREIGN PATENT DOCUMENTS

| | | |
|---|---|---|
| CN | 1932886 | 3/2007 |
| CN | 2882432 | 3/2007 |
| CN | 201026050 | 2/2008 |
| CN | 101484369 | 7/2009 |
| CN | 201422663 | 3/2010 |
| CN | 1956891 | 7/2010 |
| CN | 201948530 | 8/2011 |
| CN | 101658373 | 11/2011 |
| DE | 1554649 | 3/1970 |
| DE | 7510538 | 8/1975 |
| DE | 8328422 | 1/1984 |
| DE | G8328422.2 | 1/1984 |
| DE | 4443775 | 6/1996 |
| DE | 29908078 | 10/1999 |
| DE | 10314232 | 10/2004 |
| DE | 20316963 | 4/2005 |
| DE | 10352206 | 6/2005 |
| DE | 102004015701 | 7/2005 |
| DE | 102004015576 | 11/2005 |
| DE | 202006007162 | 12/2006 |
| DE | 102005056162 | 12/2007 |
| DE | 202007011163 | 2/2008 |
| DE | 102007034862 | 1/2009 |
| DE | 102007042764 | 3/2009 |
| DE | 102010053042 | 3/2012 |
| EP | 0520885 | 12/1992 |
| EP | 1462034 | 9/2004 |
| EP | 2917133 | 1/2018 |
| FR | 2646398 | 7/1992 |
| FR | 2628357 | 10/1994 |
| FR | 2762502 | 7/1999 |
| GB | 1432723 | 4/1976 |
| GB | 2407083 | 10/2005 |
| GB | 2503677 | 5/2016 |
| GB | 2503759 | 8/2016 |
| GB | 2527438 | 2/2017 |
| JP | 59128272 | 8/1984 |
| JP | S61137521 | 8/1986 |
| JP | 63031865 | 3/1988 |
| JP | 06255685 A * | 9/1994 |
| JP | H06255685 | 9/1994 |
| JP | H07291372 | 11/1995 |
| JP | 09224789 | 2/1997 |
| JP | H107129 | 1/1998 |
| JP | 2001017281 | 1/2001 |
| JP | 3171773 | 6/2001 |
| RU | 2052370 | 1/1996 |
| RU | 2243933 | 1/2005 |
| WO | 99/62382 | 12/1999 |
| WO | 01/65981 | 9/2001 |
| WO | 2010109411 | 9/2010 |
| WO | 2011067488 | 6/2011 |
| WO | 2010048680 | 10/2011 |
| WO | 2014006398 | 1/2014 |
| WO | 2014072701 | 5/2014 |
| WO | 2014074397 | 5/2014 |
| WO | 2015071326 | 5/2015 |
| WO | 2015071327 | 5/2015 |
| WO | 2017077289 | 5/2017 |

OTHER PUBLICATIONS

Intellectual Property Office of Great Britain Examination Report in connection with GB1515359.6 which dated Apr. 21, 2016.

(56) References Cited

OTHER PUBLICATIONS

Search Report under Section 17 issued on GB1300373.6; Jan. 29, 2014, pp. 1-2.
International Preliminary Report on Patentability and Written Opinion of the International Searching Authority for Intl. Appln. No. PCT/GB2013/051755, dated Nov. 28, 2013, pp. 1-5.
Patents Act 1977: Search Report under Section 17(5) for GB1414725.0, Intellectual Property Office, dated Sep. 5, 2014, pp. 1-5.
Patents Act 1977: Observations under Section 21 for GB1300373.6, Intellectual Property Office, dated Sep. 15, 2014, pp. 1-15.
Patents Act 1977: Search Report under Section 17(5) for GB1211787.5, Intellectual Property Office, dated Jul. 11, 2013, pp. 1-5.
Patents Act 1977: Observations under Section 21 for GB1211787.5, Intellectual Property Office, dated Sep. 26, 2014, pp. 1-8.
International Preliminary Report on Patentability and Written Opinion for PCT/GB2013/051755, International Searching Authority, dated Jan. 6, 2015, pp. 1-12.
Search Report which issued for German Utility model No. 20 2013 012 359.1 dated Aug. 13, 2018.
Search Report which issued for German Utility model No. 20 2013 012 351.6 dated Aug. 13, 2018.
Machine-generated translation of the Abstract from German to English for DE4443775.
Machine-generated translation of the Description from German to English for DE7510538.
Machine-generated translation of the Abstract from German to English for DE10314232.
Machine-generated translation of the Abstract from German to English for DE10352206.
Machine-generated translation of the Abstract from Germany to English for DE102004015701.
Machine-generated translation of the Abstract from German to English for DE102007034862.
Machine-generated translation of the Abstract from Japanese to English for JPH06255685.
Machine-generated translation of the Abstract from Japanese to English for JPH07291372.
Machine-generated translation of the Abstract from French to English for WO2011067488.
Office Action which issued for Russian App. No. 2017146618 dated Feb. 19, 2019.
Machine-generated translation of the Abstract from Russian to English for RU2052370.
Office Action which issued for Canadian App. No. 2,898,395 dated Mar. 14, 2019.
Office Action dated Apr. 20, 2017, for corresponding Australian application No. 2014350253.
Office Action dated Apr. 13, 2017 for corresponding Australian application No. 2014350254.
Office Action dated Nov. 26, 2018, for corresponding Australian application No. 2018205164.
Office Action dated Jun. 15, 2017, for corresponding Canadian application No. 2889476.
Office Action dated Oct. 12, 2016, for corresponding Canadian application No. 2889476.
Office Action dated Apr. 12, 2016, for corresponding Chinese application No. 201380056883.1.
Office Action dated Apr. 12, 2017, for corresponding Chinese application No. 201380056883.1.
Office Action dated Nov. 28, 2017, for corresponding Chinese application No. 201380056883.1.
Office Action dated Apr. 2, 2018, for corresponding Chinese application No. 201480062421.5.
Office Action dated Nov. 27, 2018, for corresponding Chinese application No. 201480062421.5.
Office Action dated Feb. 26, 2017, for corresponding Chinese application No. 201480062422.X.
Office Action dated Nov. 27, 2018, for corresponding Chinese application No. 201480062422.X.
Search Report for corresponding Singapore application No. 11201603785X, dated Nov. 2, 2016.
Search Report for corresponding Singapore application No. 11201603782X, dated Nov. 2, 2016.
Search Report for corresponding Singapore application No. 11201803448R, dated Jan. 21, 2019.
Russian Search Report dated Sep. 21, 2018, for corresponding application No. 2017146618.
English translation of Russian Office Action dated Sep. 21, 2018, for corresponding application No. 2017146618.
Russian Search Report dated Sep. 13, 2016, for corresponding application No. 2015112634.
Machine Translation of DE 20316963, Apr. 21, 2005.
English translation of Russian Office Action dated Sep. 13, 2016, for corresponding application No. 2015112634.
International Search Report for corresponding application No. PCT/US2018/032906, dated Jul. 31, 2018.
Machine Translation of DE 202007011163, Feb. 14, 2008.
Office Action dated May 19, 2016, for corresponding European application No. 13789382.2.
Machine Translation of FR 2762502, Oct. 30, 1998.
Office Action dated Feb. 21, 2013, for European application No. GB1219969.1.
Office Action dated Jul. 23, 2013, for European application No. GB1219969.1.
Office Action dated Aug. 16, 2016, for European application No. GB1511610.6.
Office Action dated Apr. 17, 2018, for Japanese application No. 2015-519351.
International Preliminary Report on Patentability for corresponding application No. PCT/EP2014/074397, dated May 17, 2016.
International Search Report for corresponding application No. PCT/EP2014/074397, dated Jan. 22, 2015.
English translation of Russian Office Action dated Feb. 6, 2017, for corresponding application No. 2015112634.
Written Opinion for corresponding application No. PCT/US2018/032906, dated Jul. 31, 2018.
Written Opinion for corresponding application No. PCT/EP2014/074397, dated Jan. 22, 2015.
International Preliminary Report on Patentability for corresponding application No. PCT/EP2014/074398, dated May 17, 2016.
International Search Report for for corresponding application No. PCT/EP2014/074398, dated Jan. 22, 2015.
Written Opinion for corresponding application No. PCT/EP2014/074398, dated Jan. 22, 2015.
International Preliminary Report on Patentability for corresponding application No. PCT/GB2013/051755, dated Jan. 6, 2015.
International Search Report for corresponding application No. PCT/GB2013/051755, dated Nov. 28, 2013.
Written Opinion for corresponding application No. PCT/GB2013/051755, dated Jan. 6, 2015.
International Preliminary Report on Patentability for corresponding application No. PCT/GB2013/052900, dated May 12, 2015.
International Search Report for corresponding application No. PCT/GB2013/052900, dated Jan. 24, 2014.
Written Opinion for corresponding application No. PCT/GB2013/052900, dated Jan. 24, 2014.
International Search Report for corresponding application No. PCT/US2017/059300, dated Jan. 23, 2018.
Written Opinion for corresponding application No. PCT/US2017/059300, dated Jan. 23, 2018.
Office Action which issued for CN201810344997.0 dated Jul. 17, 2019.
Office Action which issued for JP2018-154457 dated Jul. 2, 2019.

* cited by examiner

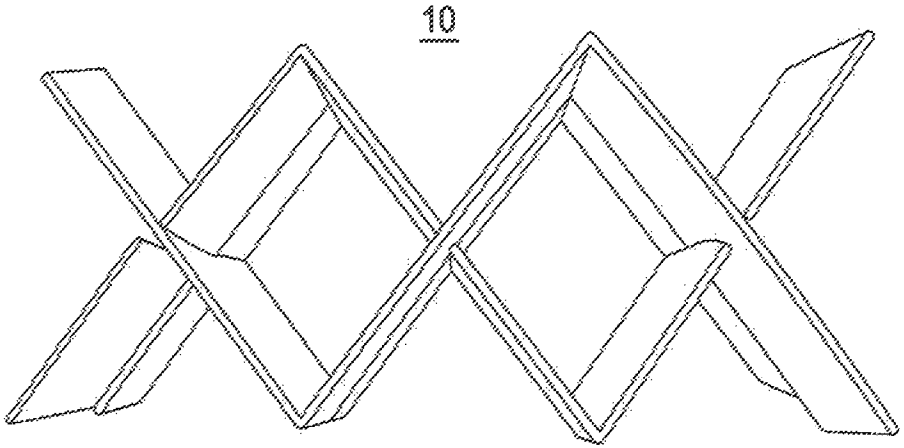
Fig. 5
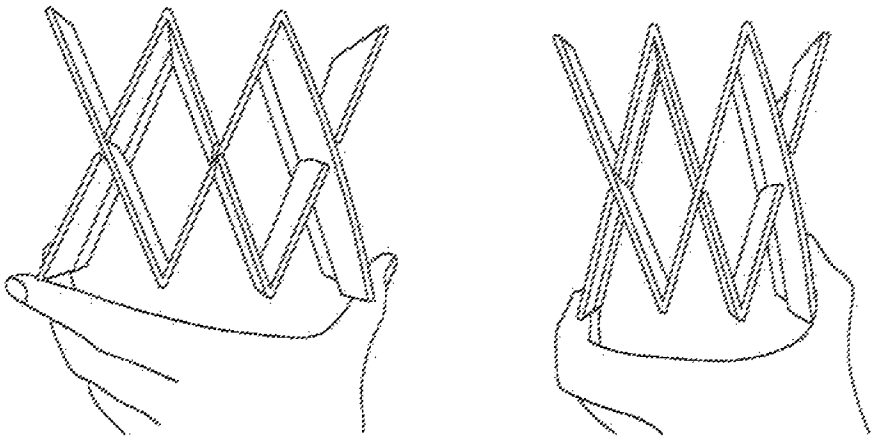
Fig. 6
Fig. 7
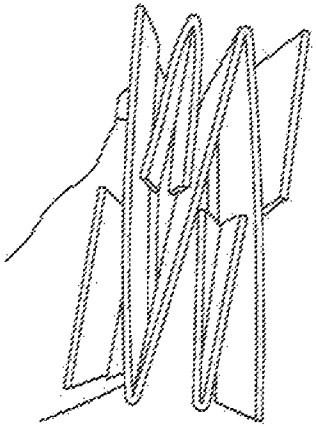
Fig. 8
How it looks...

Case filled and closed

Breaking back clamps
Glue zone to free the
pusher and SRP opening

Pusher in action

Case filled and closed with small flaps outside for Centering device

Breaking back clamps Glue zone to free the pusher and SRP opening

Pusher in action

PRODUCT PUSHER

PRIORITY

This application is a continuation of U.S. patent application Ser. No. 14/412,338, Product Pusher, which is a national-stage entry of PCT/GB2013/051755, which claims priority to GB1211787.5, filed Jul. 3, 2012, and GB 1300373.6, filed Jan. 9, 2013, the subject matter and specification of all of which are incorporated herein by reference.

FIELD OF THE INVENTION

The present invention relates to product pusher, a product tray or box comprising such a product pusher, and a process for the assembly of said product tray or box comprising said product pusher, for assisting with the proper display of items on shelves in supermarkets and in other shops.

It is well known to provide products that are intended for sale in shops, such as in supermarkets, on trays or in boxes for displaying those products on the shelves within the shop. However, there is a developing trend to display the products in those trays or boxes in an aesthetic manner, such that they are stacked towards the front of the shelf so as to maximise the ease with which consumers can identify and collect their products—products recessed towards the back of the shelves are harder to see and harder to collect.

Much of the time, this forward-stacking is carried out by an in-store shelf stacker, i.e. an employee, who manually moves the front-most product, and any products behind it, forwards, i.e. either to or towards the front of the shelf. However, in addition to manual arrangements, there is an increasing occurrence of automated stacking, i.e. products that self-stack towards the front of the tray or box, ready for removal from the tray or box. Such products often rely upon gravity, such as by using angled racks or shelves—consider, for example, herb bottle dispensers, or by relying upon the biasing effect of a resilient biasing means coupled to a pusher that is located behind the products—see, for example, DE20316963 or EP1462034, and napkin holders or cup dispensers found in fast food outlets. These prior art arrangements, however, can significantly increase the production cost of the tray or box due to the reliance upon complex manufacturing processes.

It would be desirable, therefore, to provide a tray or box that can automate the front-stacking of products, but in a very low cost manner.

SUMMARY OF THE INVENTION

The present invention provides a product tray comprising a product pusher, wherein the product pusher is formed from just a single fabric or material, and is arranged to apply a resilient bias force to the rear surface of products contained within the tray.

The term pusher is used throughout the specification to describe devices that can apply a resilient bias force to the products. However the term pusher is also intended to encompass devices which apply a resilient bias force to products via a catapult motion or likewise via a "pulling" motion. Thus a pusher can equally be described as a puller—the words being interchangeable in the present case's context.

The use of a single fabric or material simplifies the manufacturing process since the number of components made of different materials, used for assembling the pusher component, is reduced—no separate product pushing plate and no separate elastic bands or springs for driving it, are required to be connected or mounted together when assembling the pusher, whereby a reduced number of pieces of equipment are required in the assembly line.

The single fabric or material may be a length of resilient tape, such as a rubber, silicon or elastic strip. Preferably, the resilient tape is made of clear elastic or shirring elastic, e.g. knitted shirring elastic.

The single fabric or material may be attached at or towards its ends to a board or boards disposed at least partially alongside the sides of the tray. Preferably, the board or boards are inside the tray. In this way the product pusher can be retrofitted to conventional trays. Alternatively, or additionally, the single fabric or material may be attached at or towards its ends to the product tray, for example on the sides of the tray.

The parts of the product tray to which the ends are attached may be folded flaps, and are preferably flaps that will ultimately be folded outwardly and backwards from the sides. However, the flaps may also be folded inwardly and backwards from the sides. The flaps may be foldable along lines that are oblique, for example at 45 degrees, to respective edges of the tray between the sides and the base.

The folded flaps may be integral to the front of the tray. The front of the tray may be a flap integral to the base of the tray.

Preferably, the sides of the tray comprise folded flaps, and the single fabric or material is attached at or towards its ends to the insides or outsides of the folded flaps. The folded flaps may be integral to the rear of the tray. The rear of the tray may be a flap integral to the base of the tray. The single fabric of material may be attached at or towards the rear of the folded flaps. Preferably, the sides comprise further folded flaps, outside these folded flaps, and the single fabric or material is attached to these folded flaps between these folded flaps and the further folded flaps.

Preferably, the single fabric or material passes around the front ends of the flaps.

Preferably, the folded flaps are inner boards.

Preferably, the sides of the tray comprise inner and outer boards, and the single fabric or material is attached at or towards its ends to the insides of the outer boards.

Preferably, the single fabric or material passes around the front ends of the inner boards. The front ends of the inner boards may have a recessed portion at least the width of the single fabric or material to guide the single fabric or material.

Preferably, the outer boards are flaps integral to the front flap of the tray.

Preferably, the sides of the tray comprise inner and outer boards, and the single fabric or material is attached at or towards its ends to the insides of the inner boards.

Preferably the single fabric or material is applied to surfaces of the tray that at the time of application are lying in a common plane. Thereafter the surfaces can be folded backwardly relative to and against the sidewalls of the tray. The surfaces are preferably flaps that are integral to the sidewalls of the tray.

Preferably the surfaces are attached to the sidewalls upon folding them backwardly to secure them in place against the sidewalls. They might be folded inwardly or outwardly.

The parts of the product tray to which the single fabric or material is attached may be concealed by concealing flaps. This can be to make the single fabric or material non visible to the consumer, i.e. when removing a product from the tray, e.g. from the front of the tray, and while product is contained within the tray.

The attachment of the surfaces, flaps and/or single fabric or material could be using an adhesive or one or more staple, and is preferably done using the same means of attachment as used for holding other flaps of the tray, i.e. when folding/assembling the blank from which the tray is assembled. Alternatively, the flaps and/or single fabric or material could be secured by the use of a toggle such as a treasury tag or loop.

The flaps of the product tray to which the single fabric or material is attached may be folded back and held in position by a lid without the need for them to be adhered to the body of the tray.

The single fabric or material may be supplied from a roll.

The single fabric or material may be a length of elastically stretchable fabric or material, arranged to wrap behind and to the sides of products contained within the tray to apply the resilient bias force to the rear surface of those products.

Preferably it is applied to the tray by an automated tape feeding machine. The tape feeding machine can be located in line within a blank folding/tray erecting machine.

Preferably, the elastically stretchable fabric or material would have a backing material to act as a means of transfer to enable said material to be driven through a tape feeding machine without subjecting the tape to tensional forces.

In an alternative arrangement, the attachment of the pusher to the tray or box might be simply achieved by having clips on the ends of a length of elastic webbing, or some other such stretchy fabric or material. This would then facilitate for example a manual attachment by a customer, thus allowing a set of blanks and a set of pushers to be provided and assembled easily by the customer.

In another embodiment, the pusher may comprise two inter-engaged webs, each web comprising two hinge lines and three inter-engagement slots, the two hinge lines being oppositely bent and the three inter-engagement slots interlinking with the opposing inter-engagement slots on the other web. This pusher is preferably not attached to the tray, but instead simply sits within the tray.

Preferably the elasticity of the material or structure of the webs provides the resilient bias of the pusher.

Preferably the inter-engagement of the slots is provided with an interference fit upon compression of the pusher in a concertina fashion, whereupon the fit and material structure provides a resilient bias for the pusher.

Preferably the hinge lines provide a resilient bias.

No additional, separate, resiliently biasing means is provided—such as rubber bands or springs: due to the provision of two hinge lines on each web, rather than just one, and due to the bias provided by the inter-engagement of the inter-engaging slots, the material of the webs, and the structure of the webs, a sufficiently high biasing force is generated purely from the folded webs, to provide a product stacking effect as products are removed from the tray by a consumer, especially if the shop mounts the tray, on the shelf within the shop, with a raised back, such that gravity can also assist with the stacking effect. The additional biasing means of the prior art therefore becomes unnecessary.

Preferably the webs include folded sides so as to double the thickness of parts of the webs. This can improve the resilience of the webs.

Preferably one side that is folded extends the full length of the web. Preferably that side is the side spaced from the inter-engagement slots.

Preferably the side featuring the inter-engagement slots has folded portions between the slots, but no folded portions outside the outermost slots. The folded portions can provide additional resilience to the hinge lines, whereupon an additional biasing force can be provided to products within a box by the pusher.

Preferably the folded portions are adhered down although that is optional.

Preferably the pusher is formed from just two blanks. Preferably the two blanks are cut from a single sheet.

Preferably the pusher is formed from cardboard.

Preferably the pusher is formed from a corrugated material.

In a preferred configuration, the corrugations are oriented such that they run with their parallel axes extending perpendicular to the hinge lines. This configuration allows the corrugations to offer a sufficient bending stiffness for the pusher to this increase the bias-force provided thereby.

Preferably the tray is formed from one or more corrugated sheet of material. Preferably it comprises card, i.e. cardboard. It might alternatively be formed of plastic, corrugated plastic, non-corrugated cardboard or metal.

The tray may comprise a lid or top, which lid or top may be a separate component, and thus readily removable therefrom, or integral to the tray but perforated relative thereto for simple removal, or partial removal, therefrom.

The single fabric or material may be attached at or towards its ends to the lid or top and to the base of the tray.

A divider—a division—may be provided for the tray to divide the product area into more than one chamber. A separate pusher may be provided for each chamber, although a single resilient strip may bridge both chambers, thereby requiring no additional strip-end attachments compared to a non-divided tray arrangement.

The divider may be a separate component. Preferably it is inserted before the pusher is applied to the tray.

The present invention also provides a corrugated pusher as defined above, rather than specifically a tray or a box comprising such a pusher, and also a blank or a pair or blanks for forming the above corrugated pusher, and also a method of self-stacking of products comprising the provision of a tray or box as defined above, loaded with products.

According to the present invention, slots are formed in the base of the tray, preferably by flaps being formed integrally to the base of the tray. The slots reduce the friction between the products and the base of the tray, thereby allowing the products to slide more easily within the tray. The slots preferably extend in the forwards/backwards direction of the tray, preferably substantially parallel thereto. The flaps may fold inwardly or outwardly.

The inside surface of the base of the tray may be covered with a friction-reducing coating, such as starch—i.e. a food-safe coating. The coating may alternatively be a friction reducing coating such as PTFE, especially for non-food applications.

The present invention also provides a product tray comprising a product pusher, wherein the product pusher is formed from a length of elastically stretchable fabric or material, and is arranged to wrap behind and to the sides of products contained within the tray to apply a resilient bias force to the rear surface of those products contained within the tray.

This tray can additionally comprise other features as described above, e.g. wherein the single fabric or material is provided as the length of elastically stretchable fabric or material.

Preferably, the product pusher or the tray further comprises a pusher board to be provided behind the products contained within the tray. The board may be provided behind the length of fabric or material, attached thereto, or it may be provided in front of the length of fabric or material, and may be attached thereto. The board can provide a more consistent push to the back of the products contained within the tray than the length of fabric or material alone. The pusher board may have a recess in its bottom edge. The recess reduces the contact area, thus reducing slide resistance against the base of the tray. The pusher board may alternatively, or additionally, have recesses in its sides. The product pusher may align into those recesses to guide the length of fabric or material.

Although the "behind" and "bottom" are used, other orientations of the pusher board and other elements are also possible.

According to a further aspect of the present invention there is provided a product tray comprising a product pusher, wherein the product pusher comprises a) an element that is formed from a fabric or material that is arranged to apply a resilient bias force to the products contained within the tray, and b) a pusher board to be provided behind the products contained within the tray. The product tray may have any of the features of the previous aspect.

The tray of either aspect may have a recessed portion along the front edge of its base. This allows the front product to be more easily picked up from the base of the tray.

The present invention also provides a method of assembling a tray having a product pusher, comprising:

folding a blank to form at least part of a tray, feeding a resilient web across a face thereof, and inserting products into the tray such that the web wraps partially around the products in a stretched state.

After applying the web, the blank may then be further folded to complete the forming of the tray, assuming that the initial folds did not already do so, and/or additional parts can be applied to complete the tray, or to add a lid or an outer wrapping therefor. This might occur either before or after inserting the products, the timing generally being dependent upon the design thereof.

Preferably the face is a front face. In another embodiment it is preferably a top face. The face is typically one for receiving or removing products therethrough. For example it can be an open face, or it may be partially open, or it may even be a closed face, e.g. with a removable section. Alternatively it may define a barrier for products, whereby products are resisted from further advancement upon being biased thereagainst. Products may then be inserted or removed through a different face.

Preferably the web is applied to the face of the tray in a minimally tensioned, or non-tensioned condition, such that it gets put into the stretched state by the insertion of the products.

Preferably the web is applied to the face of the tray via one or more foldable tab. Preferably the one or more foldable tab holds the web during insertion of the products.

The present invention also provides a method of assembling a tray having a product pusher, comprising:

providing a blank for forming at least part of a tray, feeding a resilient web across a face thereof, folding the blank to form at least part of the tray; and inserting products into the tray such that the web wraps partially around the products in a stretched state.

After folding the blank, the blank may then be further folded to complete the forming of the tray, assuming that the initial folds did not already do so, and/or additional parts can be applied to complete the tray, or to add a lid or an outer wrapping therefor. This might occur either before or after inserting the products, the timing generally being dependent upon the design thereof.

A folding step may also occur prior to the feeding of the web across the face of the blank, e.g. to displace a tab out of the plane of the blank. The folded part may present the face ready for receiving the web.

Preferably the face is a front face. In another embodiment it is preferably a top face.

Preferably the web is applied to the face of the blank in a stretched condition. Preferably this arrangement is such that it gets relaxed at least to a certain degree upon folding the blank to form at least part of the tray.

Preferably the web is attached to the blank via one or more foldable tab. Preferably the one or more foldable tab holds the web during the folding of the blank so as to cause the web to remain in a stretched condition after folding the blank to form at least part of the tray. This second stretched condition is likely to be slightly relaxed compared to the initial stretched condition.

In either method, one or more glue bead may be applied to the blank before feeding the web. The glue bead or beads may be for securing the web, or for securing folded parts of the blank.

Preferably the web, in the stretched state, wraps behind the products. In another embodiment in the stretched state it wraps under the products.

Preferably the products are generally cuboid, i.e. each having a front, a back, a top, a bottom, a left side and a right side, i.e. six sides, or the products have a section having four sides. Preferably that section is generally square, generally rectangular or generally trapezoidal. Products with other sections, e.g. triangular or round or multi-sided, e.g. with more than four sides to its sectional shape, or with non-consistent or non-regular sectional shapes, are also anticipated to be useable with the present invention.

Preferably the web wraps around three sides of the product.

Preferably the or each product has between one and four sides in a section defined by the approximated line followed by the wrapped web. The sides need not be flat, i.e. they may be curved.

Preferably a length of resilient web is drawn from a roll mounted on a motorized shaft by a pair of mechanical grippers.

Preferably, the length of resilient web is attached to the front of the tray, or to the blank, by means of a transfer device.

Preferably, prior to inserting the products into the tray, the resilient web is stretched around the inside (e.g. left and right sides, and the back wall) of the tray with a tension guide. Preferably, the tension guide is withdrawn from the loaded tray after inserting one or more product.

Preferably, the products are side loaded into the tray. Alternatively they might be top or bottom loaded into the tray.

Preferably, a lid or top is fitted to the tray. The lid or top may be an integral part of the blank, or it may be formed separately. If formed separately, it might be glued to the blank. Depending upon the design, that could occur either before or after the folding, or at some point mid-way through the tray (or box) forming process.

Preferably the lid or top is separable from the tray or box, e.g. by having severable glue attachments (e.g. small glue beads) or simply through a friction fit, or via severable perforations in the material of the blank or lid (or top).

Preferably removal or separation of the top or lid from the tray or box releases at least one tab, thus releasing the web to allow it to resiliently bias towards a more relaxed condition, thus applying a biasing force against one or more of the products.

Preferably the blank is folded to form a front for the tray after the products are inserted.

The present invention also provides a method of assembling a tray having a product pusher, comprising:

providing a blank for forming at least part of a tray, folding the blank to form at least part of the tray;

wrapping a resilient web in a stretched state around the back and at least partially around the sides of products to be inserted into the tray, and inserting the products into the tray such that the web remains partially wrapped around the products in a stretched state to bias the products towards a face of the tray.

The wrapping step may occur before the folding step.

The resilient web may be attached at each end to separate boards, and a step of splitting a board into the two separate boards along a perforation may occur before the wrapping step.

Although the terms above may refer to the two sides and the back of a product, the terms "sides" and "back" may equally apply to the "front and back" and "bottom" of the products, or the "top and bottom" and "back" of the products, respectively, simply upon a reorientation of the axes of reference. After all, a cuboid has six sides, and the back is simply the side facing away from the point of reference. As such, the present invention also provides:

a) a method of assembling a tray having a product pusher, comprising:

providing a blank for forming at least part of a tray, folding the blank to form at least part of the tray;

wrapping a resilient web in a stretched state around the back and at least partially around the top and bottom of products to be inserted into the tray, and inserting the products into the tray such that the web remains partially wrapped around the products in a stretched state to bias the products towards a face of the tray; and b) a method of assembling a tray having a product pusher, comprising:

providing a blank for forming at least part of a tray, folding the blank to form at least part of the tray;

wrapping a resilient web in a stretched state around the bottom and at least partially around the front and back of products to be inserted into the tray, and inserting the products into the tray such that the web remains partially wrapped around the products in a stretched state to bias the products towards a face of the tray. The methods as applied above may be used to provide the trays of the first and second aspects of the invention, or may be carried out using such trays.

The present invention also provides a blank for a product tray, the blank comprising a product pusher, wherein the product pusher is formed from a length of elastically stretchable fabric or material to wrap behind and to the sides of products contained within the tray to apply a resilient bias force to the rear surface of those products contained within the tray.

The length of elastically stretchable fabric or material may be attached at or towards its ends to the blank.

The length of elastically stretchable fabric or material may be attached at or towards its ends to flaps.

The length of elastically stretchable fabric or material may be attached to the blank at two or more sites of attachments along its length.

The blank may be formed from one or more corrugated sheet of material.

The blank is typically for forming a product tray. As such it typically comprises at least one flap or tab for forming the product tray.

Typically the blank comprises at least one pair or set of parallel fold lines, and more preferably two (or more) pairs or sets of parallel fold lines. These can form flaps, e.g. for forming sides of a tray, or tabs, e.g. for joining adjacent sides together.

The fold lines may be score lines. In other examples, they may be spaced perforations. In other examples they may be compressions or indentations or pre-folded creases.

One fold line in a pair of fold lines may be spaced at an opposing end of a panel, or of a line of panels, of the blank, from the other fold line of the pair of fold lines.

At least one pair of parallel fold lines may be a symmetrical pair of parallel fold lines—i.e. one of the fold lines in the pair corresponds in size and length to the other fold line in the pair, but is spaced at an opposing end of a panel, or of a line of panels, of the blank.

The blank may comprise a panel bordered by a first pair of fold lines—for defining a base (the panel) and two sides, and a further pair of fold lines—for defining a front and back of the blank. Preferably the two pairs are perpendicular to one another such that the base is generally rectangular or square.

The blank may comprise pairs of fold lines at ends of at least two panels thereon, which panels may define two sides of a tray, such a left or right side or a front or back of a container such as a box or tray, the pair of fold lines defining tabs for securing the blank in an assembled form.

The pusher may be attached to the blank using glue.

The pusher may be attached to the blank using at least one staple.

The pusher may be attached to the blank using at least two staples.

The pusher may be attached to at least two panels, tabs, flaps or sides of the final container to be formed using blank.

The pusher is typically attached to a pair of panels, to a pair of tabs, to a pair of flaps or to a pair of sides of the blank.

One of the panels or sides may be provided with a cut-out portion for defining a partially open side of the container. The pusher may be arranged to extend across that cut-out portion.

The blank may comprise a pusher board.

The length of elastically stretchable fabric or material may be attached to the pusher board.

The blank may define both a tray and a lid, or a separate blank may be provided for the lid. Preferably though the lid is an integral part of the blank. The blank may then comprise perforations or slot-cuts to allow the lid to be a tear-off lid—the perforations or slot-cuts facilitate the separation of the lid from the tray after the packaging therein of products.

Preferably the blank comprises fold lines for defining both a tray and a lid that is to be formed from the blank upon folding the blank about those fold lines.

Preferably the blank comprises perforations within the lid to define a tear off strip or flap within the lid.

The length of elastically stretchable fabric or material may be in a tensioned state on the blank. For example, it could be in a tensioned state while the blank is substantially or completely unfolded. In another example it may become tensioned upon undertaking one or more folding step on the blank. However, in other examples it might only be come tensioned either upon loading products into the assembled container/tray, or only upon displacing a pusher board relative to other parts of the blank.

The blank may be provided to a customer in a completely unfolded state. In other circumstances, the blank may be provided to a customer in an at least partially folded state, e.g. with one or more panel or flap folded relative to another. Preferably in this at least partially folded state, the blank is still substantially flat, e.g. so that it can be baled and shipped as a stack.

Some customers, however, may want the blank fully assembled into a container form at the time of delivery such that it is ready for loading with products.

The present invention also provides a stack of blanks comprising as defined above.

The present invention also provides a method of forming a blank for product tray, comprising:

providing a blank for forming at least part of the tray, providing a product pusher, wherein the product pusher is formed from a length of elastically stretchable fabric or material to wrap behind and to the sides of products contained within the tray to apply a resilient bias force to the rear surface of those products contained within the tray.

The blank may be as described above.

Any of the preferable features mentioned above with respect to a product tray or a method of assembling a tray are also applicable to the blank for a product tray and the method of forming a blank for a product tray mentioned above without the blank having been formed into the product tray.

BRIEF DESCRIPTION OF THE DRAWINGS

These and other features of the present invention will now be described in further detail, purely by way of example, with reference to the accompanying drawings, in which:

FIG. 5 shows the assembled arrangement in an expanded configuration;

FIGS. 6 to 8 show the pusher being compressed into a collapsed configuration—the configuration it will adopt when located within a tray or box during transportation of products to a retail outlet;

DETAILED DESCRIPTION OF THE ILLUSTRATED EMBODIMENTS

Figure 9:
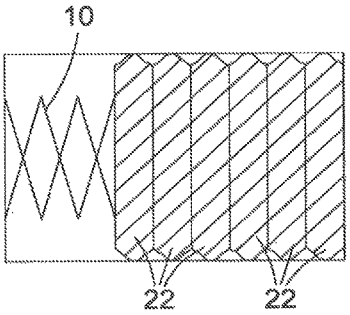
FIGS. 9 to 11 show the pusher of the present invention in use, pushing products forwards within a product delivery box.
Figure 10:
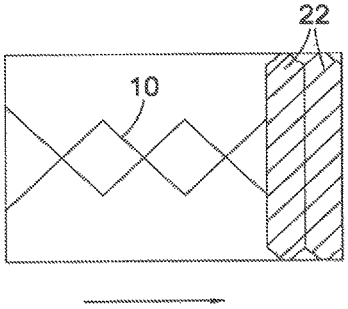
Figure 11:
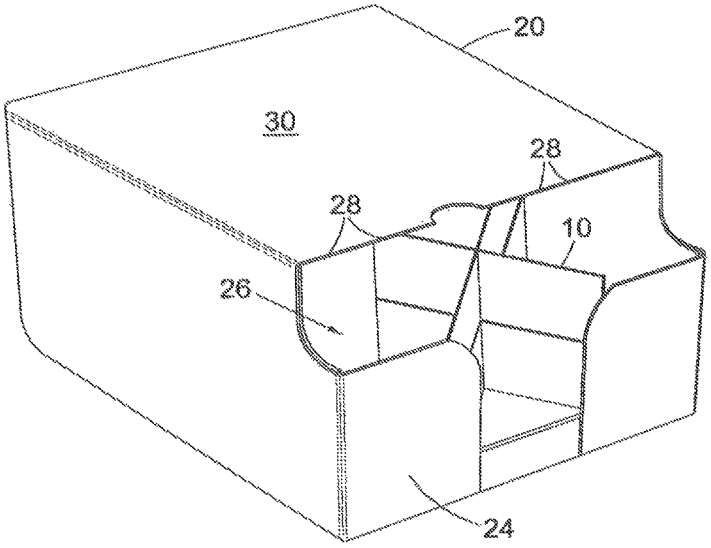

Referring first of all to FIGS. 1 to 12, this first embodiment of the present invention relates to a corrugated pusher for insertion into a product tray such as that shown in FIGS. 9 to 11. Other forms of box or tray will also be suitable for accommodating the pusher.

The tray 20 is sized to accommodate numerous products 22, in this case chocolate bars. The products 22 are arranged within the tray in an edgewise vertical orientation such that they stack backwardly towards a corrugated pusher 10 located behind them and within the tray 20. The pusher 10 thus is able to push the products 22 towards the front 24 of the tray 20.

Towards the front 24 of the tray 20, an opening 26 is provided. This opening is provided by means of a rip-off part of the lid (not shown since it has been removed) which was perforated along its edge for simplified removal from the tray 20. That perforation is evidenced by the remaining tags 28 on the leading edge of the top 30 of the box or tray 20. See FIG. 11.

Referring again to FIG. 1, two blanks for forming the corrugated pusher 10 are shown. These blanks are a first blank 32 and a second blank 34, which blanks are mirror copies of each other.

Each blank comprises two hinge lines 14, three inter-engagement slots 16 and various fold lines 36 by means of which the finally folded portions 18 can be folded over the webs 12 to double the thickness of the receiving parts of the webs 12.

Along one edge of the two webs 12, the folded portions 18 extend along the full length of the webs, whereas along the other edges of the webs, the folded portions 18 extend only partway along the length of the webs 12.

Figure 1:
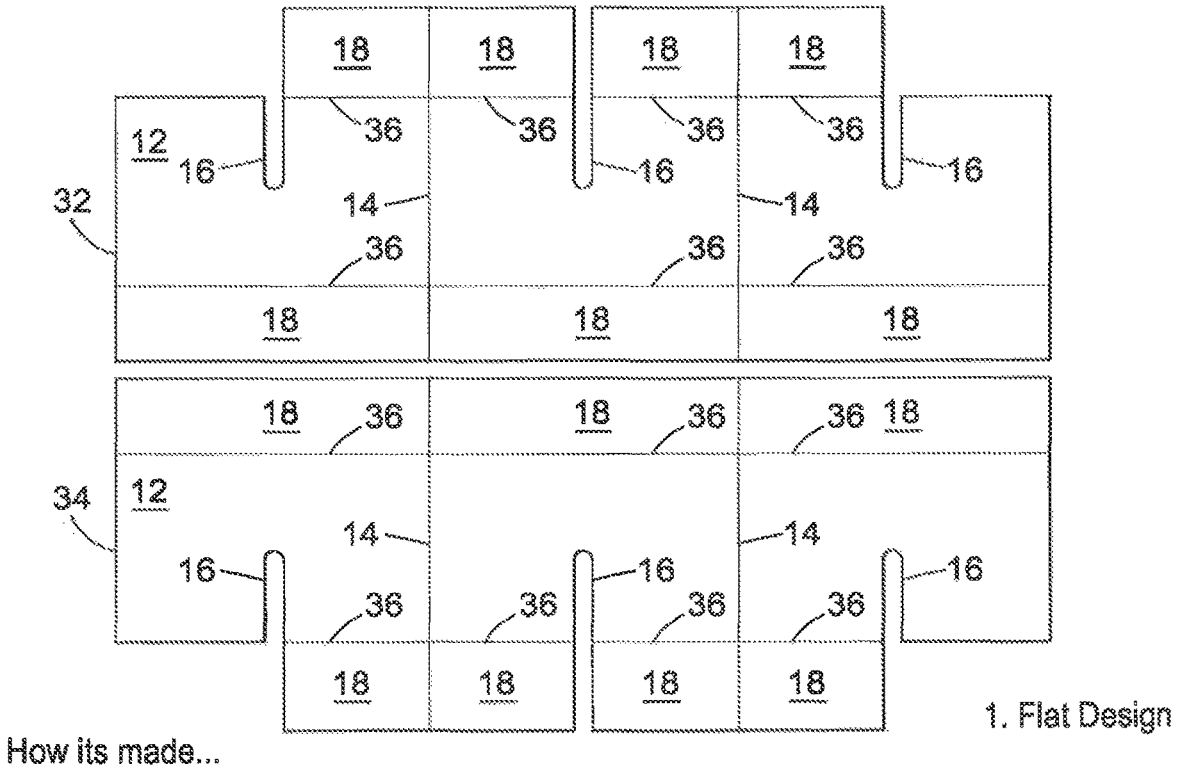
FIG. 1 shows in plan view two blanks for forming the two webs of the pusher of the present invention.
Figure 2:
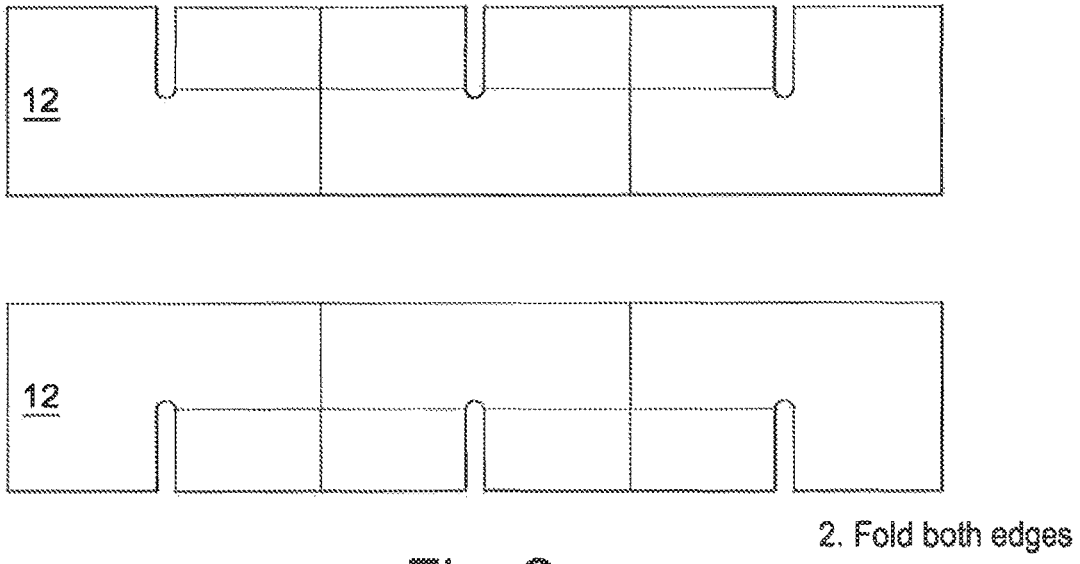
FIG. 2 shows the two blanks after folding edges thereon.

FIG. 2 shows the two webs 12 in their initial folded condition—with the two folded portions 18 now folded over the central length of the webs 12. The two webs 12 are still mirror versions of each other.

Figure 3:
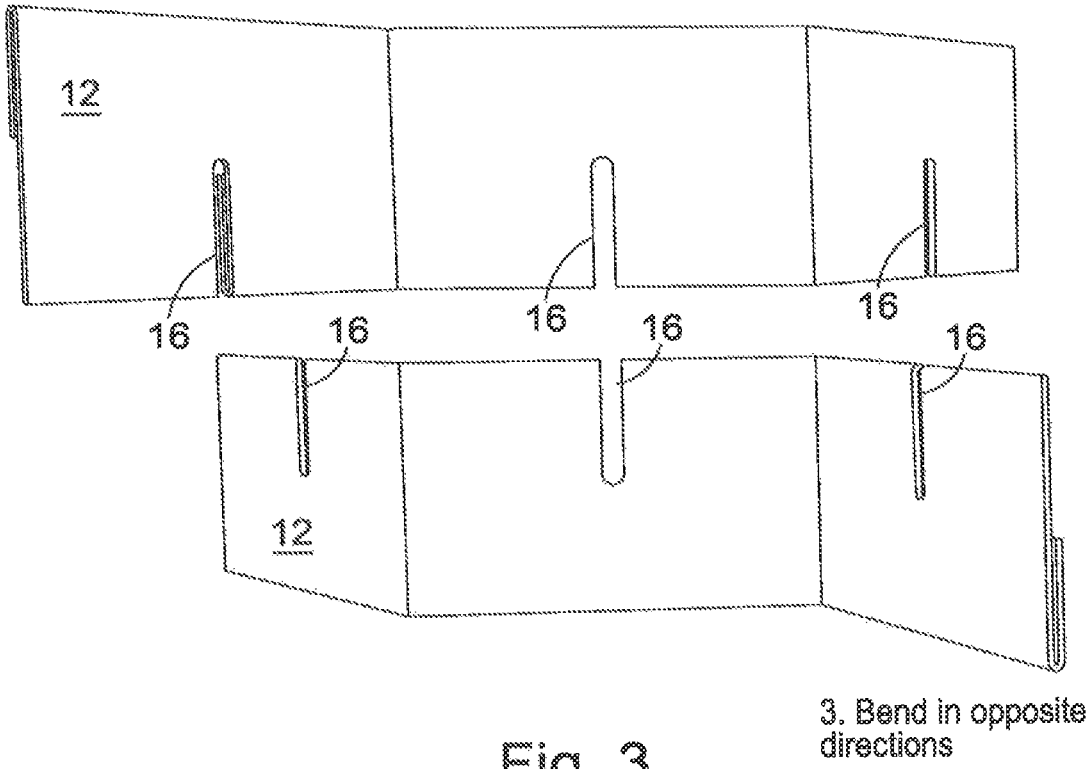
FIG. 3 shows the two webs bent at their hinge lines ready for inter-engagement.
Figure 4:
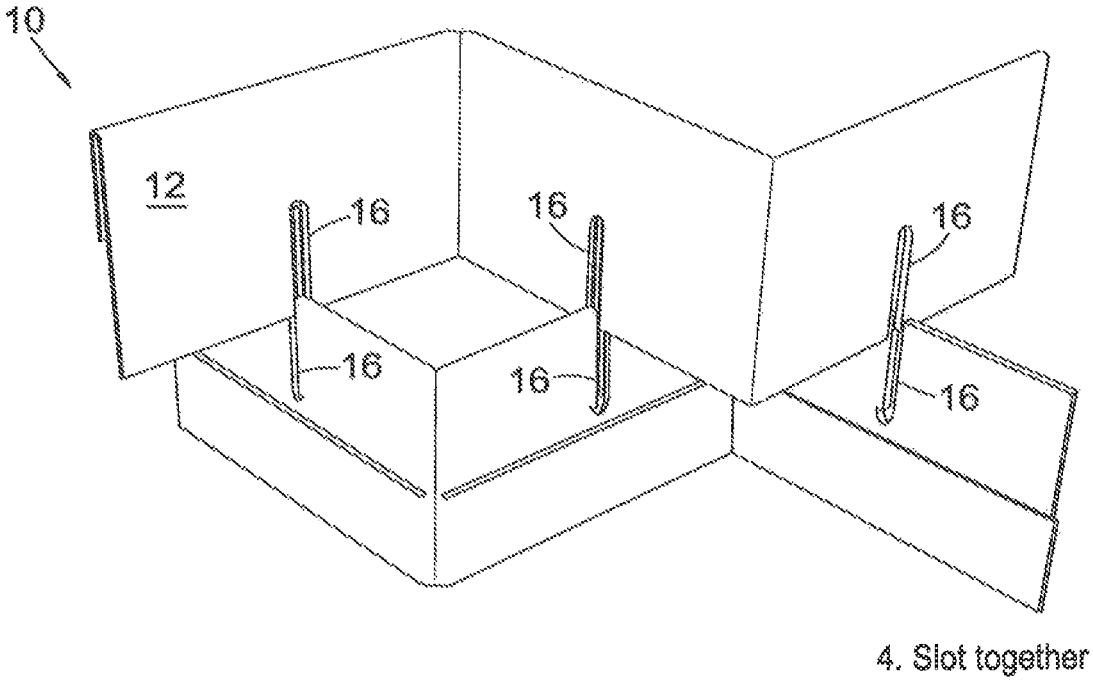
FIG. 4 shows the commencement of the inter-engagement of the respective slots on the two webs.

FIG. 3 then shows the two webs 12 upon folding them about their hinge lines, again in a mirror like fashion such that the inter-engagement slots 16 of each web 12 can intermesh as shown in FIG. 4 to form a concertina arrangement. FIG. 4 also clearly shows the corrugation of the material from which the webs 12 are made—look within the inter-engagement slots 16. This corrugated structure of the webs is helpful for providing resilience to the corrugated pusher 10 upon completion of the assembly thereof as shown in FIGS. 5, 6, 7 and 8, and to achieve the best effect, the direction of the corrugation should be perpendicular to the inter-engagement slots, as shown in FIG. 12 by the cutaway triangle 38.

Figure 12:
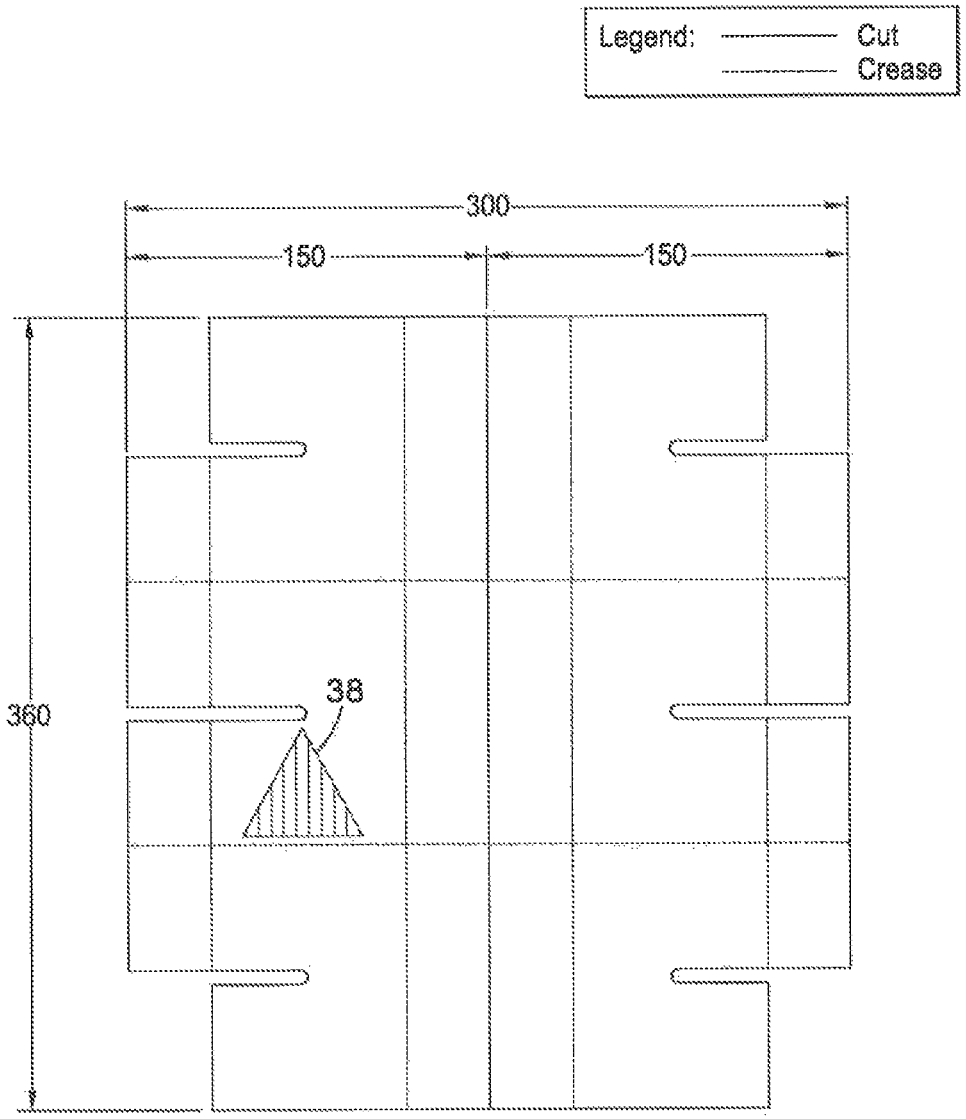
FIG. 12 shows a cut and crease layout for forming the two webs of the present invention from a single sheet of material.
Figure 13:
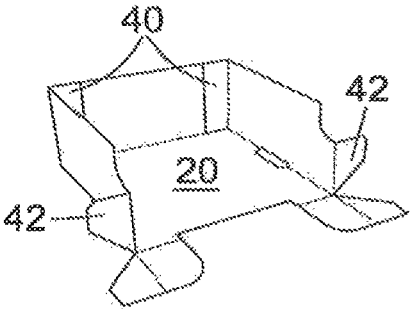
FIGS. 13 to 21 show a further embodiment of the present invention in which the pusher takes the form of an elasticated tape and the products are side-loaded into the tray.
Figure 14:
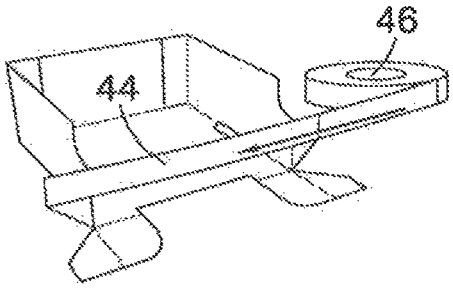
Figure 15:
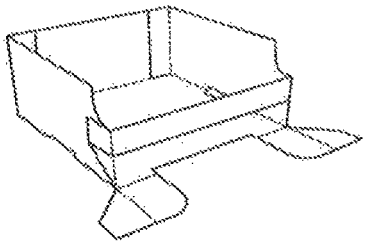
Figure 16:
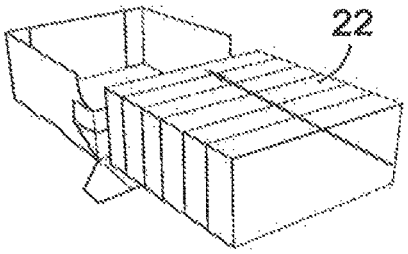
Figure 17:
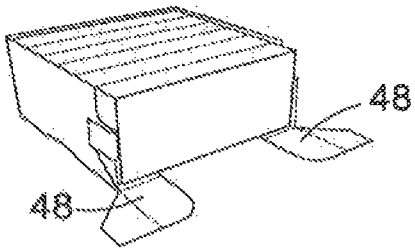

FIG. 12 also shows preferred sizes for the corrugated pusher 10 in mm, although other sizes would of course be possible, for example where longer or smaller pushers are wanted. Even longer pushers can be provided by providing a longer web, and additional inter-engagement slots and hinge lines—such longer webs may be more preferred to scaling up the relevant dimensions.

For a pusher with an at least 20% longer effective reach, the corrugated pusher might comprise four inter-engagement slots on each web and three hinge lines, and more such inter-engagement slots and hinge lines can be provided to make the pusher even longer, although the thickness of the compressed pusher will correspondingly increase too. Nevertheless, the additional concertinas resulting therefrom will increase the effective resiliently biasing reach.

From the above, it will be appreciated that there is one less hinge line than inter-engagement slots on each web. Further, the pusher should not have fewer than two hinge lines and three inter-engagement slots so as to ensure an effective resilient bias can be provided for the intended reach of the pusher.

Referring next to FIGS. 13 to 21, a further embodiment of the present invention is shown. In this embodiment, again a tray 20 is provided and in FIG. 13 it is shown to be already partially assembled, with the side walls and back wall already folded upright and glued at their jointing tabs 40. For that purpose it is usual that a hot-melt glue is used for the attachment. However, other adhesives or joining means, such as staples, are also able to be used.

The front of the tray 20 is not yet assembled, and although the tray is not fully assembled, flaps 42 arranged near the front of the tray 20 are shown part folded so as to lay in a common plane with respect to one another.

The flaps 42 provide forward facing surfaces onto which the pusher of this second embodiment can be mounted. This pusher 44 of this embodiment takes the form of a web of resilient material, such as a silicon strip or an elastic ribbon, and preferably it is a band, strip or web of very stretchy fabric that has been cut from a reel 46 thereof, e.g. shirring elastic.

For achieving the mounting of the pusher, the tape or web or the like is fed across and glued or otherwise attached to the flaps 42, e.g. by an automated arm on the assembly machine. As with the first embodiment, no other components are required for forming the pusher—it just consists of the tape or web. Preferably, the tape is of an appropriate or predetermined length chosen so that once affixed to the tray there is minimal slack or droop in the tape. However, it may be envisaged that for product trays of a significant depth, thus requiring a significant degree of stretch or length in the web to allow the web to fully extend into the back of the tray, or when the product may itself be relatively deep, thus requiring less web travel from its rearmost location to push a rearmost product to the front of the tray, the tape might be affixed to the tray with a certain degree of slackness. This then assists in ensuring that the web will stretch adequately around the inserted products, even if a less stretchy material is used—i.e. one that can stretch only to a lesser percentage of its initial relaxed length, many of which materials can provide a greater elastic return force per unit percentile extension.

The end of the tape or web is then cut and the flaps are folded backwards and are attached to the sides of the tray, such as again by gluing. See FIG. 15.

Other adhesives, staples, treasury tags and the like are also able to be used instead.

By folding the flaps backwards, some of the tensional force is taken by the body (around the crease) of the tray rather than purely by the adhesive holding the tape to the flap. This can improve reliability from breakage of the bond between the tray and the tape.

Figure 18:
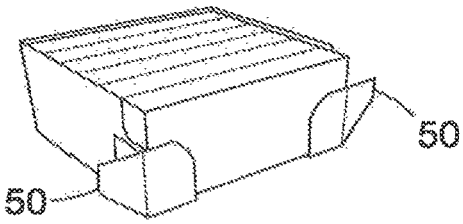

Products 22, in this case six boxed items, are then pushed into the tray 20 so as to stretch the resilient, highly elastic tape that forms the pusher 44. The tape or web extends around the back of, including around the left and right sides of, the products 22 so as to assume the condition of FIG. 17. The front flaps 48 are then folded up relative to the base of the tray so as to retain the products 22 within the tray 20, as shown in FIG. 18.

Figure 19:
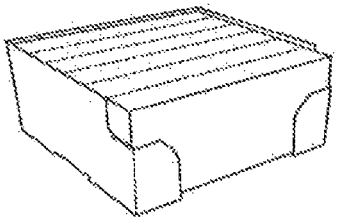

Sides 50 of the front flaps 48 are then folded back and attached to the flaps 42, and also to the ends of the pusher 44 that are attached thereto, preferably again by gluing. That then conceals the ends of the pusher 44, as shown in FIG. 19. This presents a tidy finish to the assembled tray.

Figure 20:
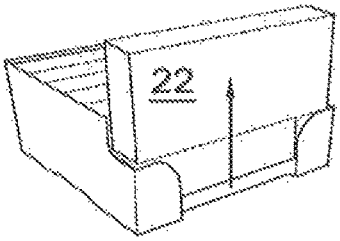
Figure 21:
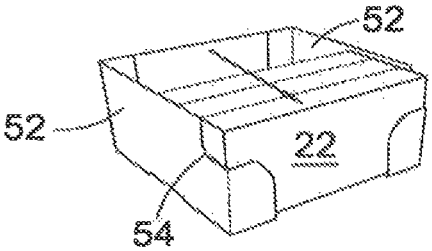
Figure 22:
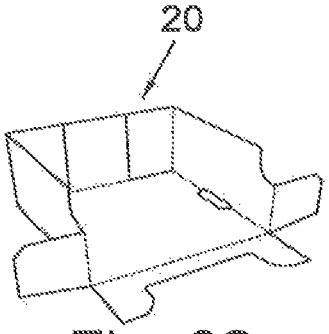
FIGS. 22 to 29 show a variant of the embodiment over FIGS. 13 to 21, but in which a divider has been inserted into the tray.
Figure 23:
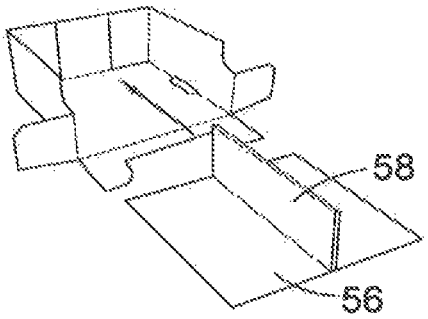

From this completely assembled tray, a front product 22 can be removed as shown in FIG. 20 which results in the more rearward products being advanced by means of the tension in the elastic of the pusher 44. FIG. 21 shows the condition arrived at after three products have been removed.

In this embodiment, the side walls 52 of the tray 20 have cut-out front top corners 54, as shown in FIG. 21. This is to facilitate the grasping of a front most product 22 by a consumer. It is similar to the removed corners of the first embodiment, but is prefabricated in this second embodiment, rather than the result of ripping off a part of the top.

Referring next to FIGS. 22 to 27, a very similar arrangement to that of FIGS. 13 to 21 is shown, but before the elasticated tape is applied across the front of the tray 20, a divider 56 is inserted into the tray. The divider 56 comprises a folded blank of material, again preferably corrugated cardboard, like the tray. It is folded so as to have two base surfaces having a total size and shape corresponding to the size and shape of the inner product-receiving base of the tray 20, and an upstanding central wall 58 for providing a division of the product space of the tray 20. In this case, the division is a central division, although other dividers are also possible, including multiple wall dividers, or unequal divisions, subject to the width of the tray being suitable for such arrangements for the multiple divisions, given the elasticity (or stretchability) of the material used for the pusher—the pusher needs to be able to elastically stretch back and around the products in each product-receiving slot as the products are pushed into the tray, and without damaging the products or the web.

Figure 24:
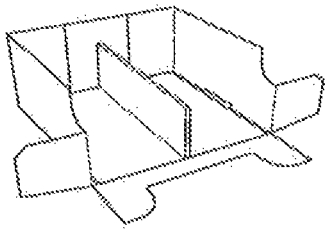
Figure 25:
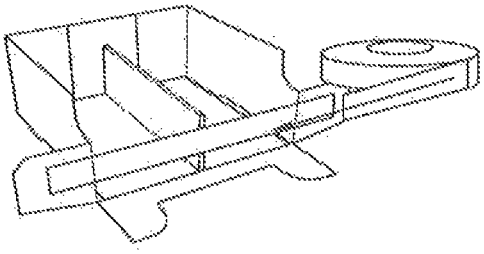
Figure 26:
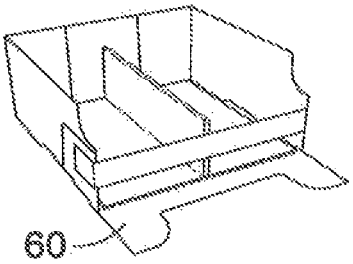
Figure 27:
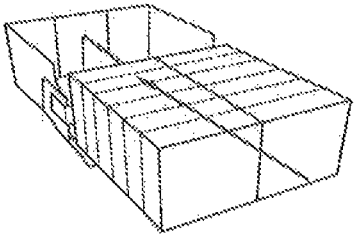
Figure 28:
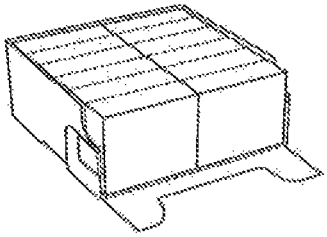

Once the divider is located within the partially assembled tray, as shown in FIG. 24, the elastic or stretchy tape can then be mounted across the front of that divided tray, as shown in FIG. 25. Product can then be inserted into the tray, either by hand or machine, as shown in FIG. 27, before folding up the front wall ready for distribution, as shown in FIG. 29.

Figure 29:
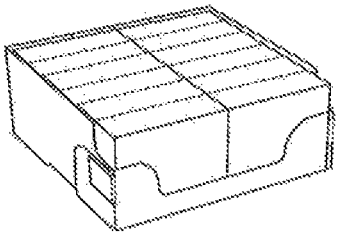

In the embodiment shown in FIG. 29, the front wall 60 of the tray would be taped into its upright, product restraining, position since retention flaps are not provided for gluing it in an upright position. Flaps may instead be provided.

Figure 30:
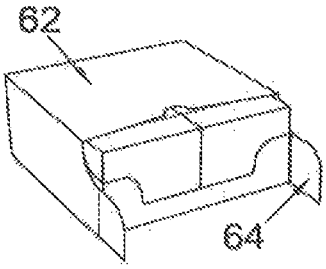
FIGS. 30 and 31 show a variant of the embodiment over FIGS. 22 to 29 in which a lid covers the product box and conceals the side flaps and resilient tape, similar to the box in FIG. 11.
Figure 31:
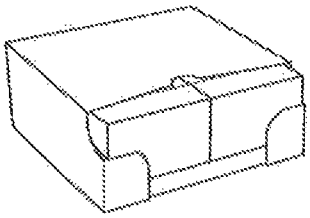
Figure 32:
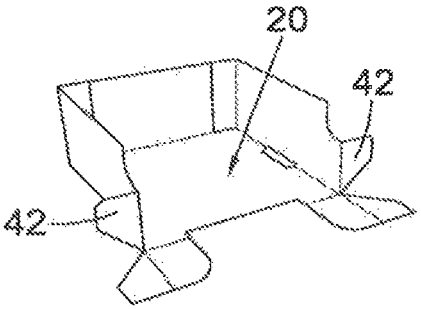
FIGS. 32 to 39 the same embodiment of the product tray shown in FIGS. 13 to 21, but in which pusher tension is established prior to product loading.
Figure 33:
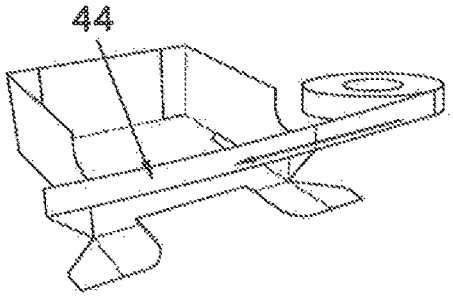
Figure 34:
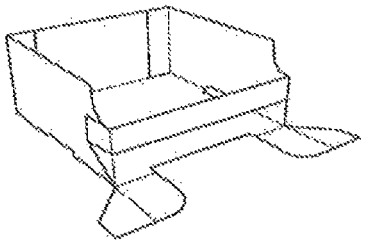

In the further modified embodiment of FIGS. 30 and 31, a lid or casing 62 is additionally provided. It has front flaps 64 and an upper letterbox opening—possibly one formed using a rip-off portion defined by perforations. As shown in FIGS. 30 and 31, the front wall 60 could be maintained in its upright position simply by the flaps 64 of the lid, i.e. without the need for its own securement flaps or taping.

Still referring to FIGS. 30 and 31, the covering lid 62 could be used to partially enclose the product tray so that only one product unit from each product row is on display to the consumer.

The illustrated covering lid is of a shape and size which complements the shape and size of the product tray to ensure a close fit. A semi-circular indent 66 at the front edge of the top face of the covering lid 62 facilitates the grasping of the front most product by a consumer, and is an extension of the letterbox opening.

FIG. 30 shows the partially constructed covering lid 62 placed over the product box with the hinged front flaps 64 in an open position. The lid can be just as seen, with no base under the tray. However, the lid may be a covering, i.e. a box, with a base under the tray, such that the tray is slotted into the box, rather than adapted just to receive the lid over the top of it.

As shown in FIG. 31, after putting the lid over the tray the front flaps are then folded and stuck to the front wall 60 of the tray to secure the covering lid 62 in position.

In embodiments where the tray possesses a covering lid, the flaps 42 to which the pusher 44 is adhered might not be glued or otherwise attached to the body of the tray as they could be held in place by the side walls of the lid.

Referring next to FIGS. 32 to 39 a very similar arrangement to that of FIGS. 13 to 21 is shown. In this embodiment, products, in this case six boxed items 22, are top-loaded into the tray 20.

Figure 35:
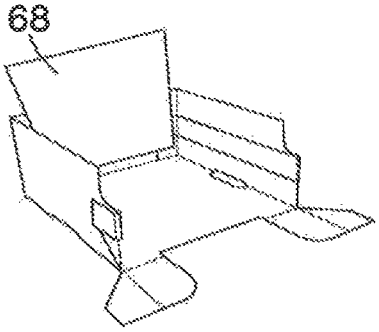

Once the pusher or tape or web 44 has been applied to the front of the tray it is pushed or stretched to the back of the tray under tension with the aid of a tension guide device 68. As shown in FIG. 35, the guide device 68 is a plate with a total width corresponding to the size of the back wall 70 of the tray 20. It might be replaced with two fingers for stretching the web back to the back corners of the tray, or by some other guide device for moving the web back to that displaced location. The front flaps 48 are then folded up relative to the base of the tray and sides 50 of the front flaps 48 are then folded back and attached to the flaps 42, and also to the ends of the pusher 44 that are attached thereto, preferably again by gluing. The order of these steps is not critical.

Products 22 can then be top-loaded into the tray, either by hand or by machine, so that the pusher 44 sits around the back of the products 22. The tension guide device 68 is then removed, i.e. once the products have been loaded, for example by lifting it upwards. However, holes or slots can be provided in the tray to allow the guide device to function through other directional movements, especially if provided in the form of two fingers.

Figure 36:
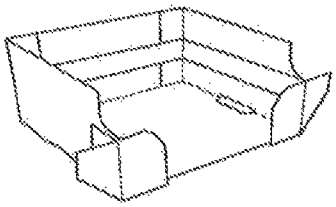
Figure 37:
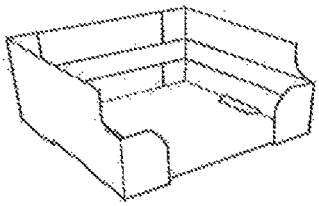
Figure 38:
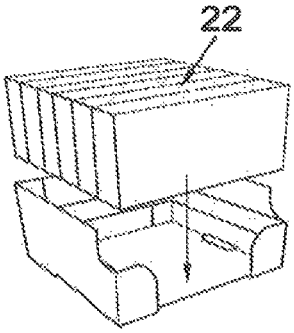
Figure 39:
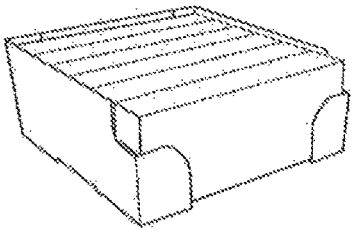

The tension guide is not shown in FIGS. 36 to 38 to allow the web to be seen.

FIGS. 40 to 50 show another embodiment of the invention. In this embodiment, the pusher is applied prior to forming the tray, i.e. it is applied to a blank prior to folding it into the shape of a tray.

The tray has a lid which can be torn off, along a line of perforations, to reveal the encased products. Further, the pusher tape is retained behind a holding clamp in the form of a tab 124, the holding clamp being released by removal of a tear off portion 128 in the back wall of the tray.

Figure 40:
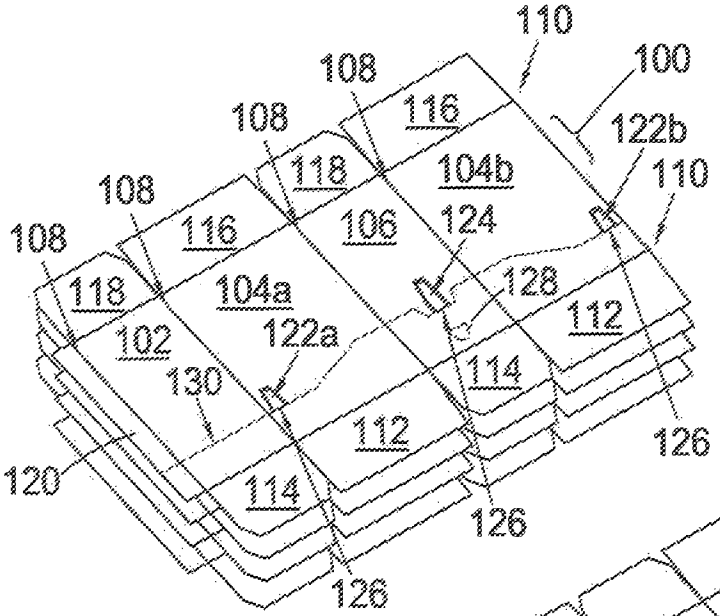

FIG. 40 shows a magazine of cardboard blanks 100 that form the product trays of this embodiment. Referring to FIG. 40, each cardboard blank comprises four walls 102, 104*a*, 104*b*, and 106, four hinge lines 108, various fold lines 110, eight flaps 112, 114, 116 and 118, and a jointing tab 120. Walls 104*a* and 104*b* correspond to the side walls and are mirror images, wall 106 is the back wall, wall 102 is the front wall, flaps 112 and 114 form the base of the tray and flaps 116 and 118 form the top of the lid.

Two tabs (lateral clamps) 122*a* and 122*b* are located in walls 104*a* and 104*b*, respectively, towards edges distal to wall 106. A tab (back clamp) 124 is centrally located along the width of wall 106. These clamps are cut into the plane of the blank 100 and are hingedly attached to the blank at hinge lines 126.

Adjacently below tab 124 is the tear-off tab (back clamp glue zone) 128.

A line of perforation 130 transects the blank along its length to define the line of attachment between the lid and the tray.

Figure 41:
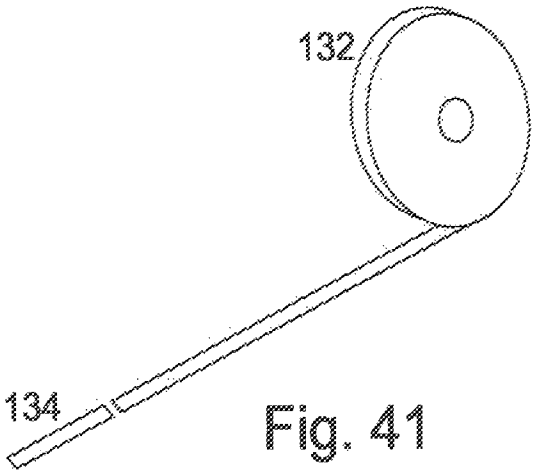
FIGS. 40 to 50 show another embodiment of the present invention in which the pusher tape is retained by a holding clamp, the holding clamp being released by removal of a tear off portion in the back wall of the tray, and in which the tray has a removable lid, connected by a line of perforation.

As shown in FIG. 41, a length of pusher tape is unravelled from a reel 132 without stretching the tape, e.g. by an automated tape feeding device, and a length of that pusher tape 134 is cut. Preferably, the tape may have a backing layer to prevent stretching during the unwinding/cutting process.

Figure 42:
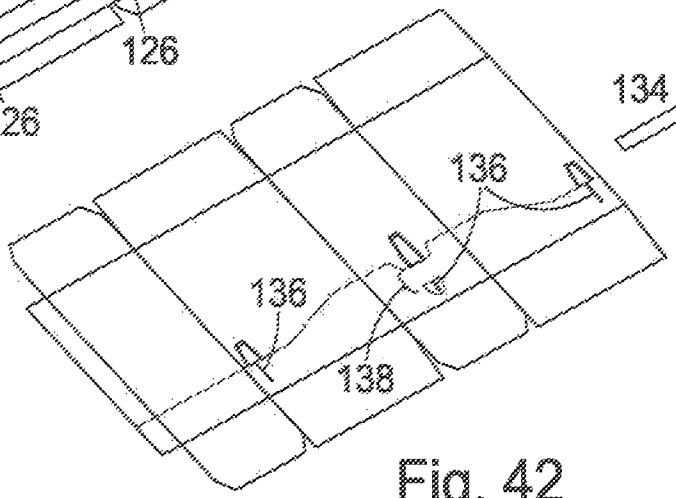

Prior to mounting of the pusher onto the blank, beads of glue 136 are deposited, for example by a glue gun (not shown), adjacently below hinge lines 126 of lateral clamps 122*a* and 122*b* and to back clamp glue zone 128 (FIG. 42).

To achieve mounting of the pusher 134, the tape is first stretched under tension to a suitable length. This may be done using a pair of grippers. Upon stretching it to the desired length, its ends can be adhered to the beads of glue 136 beneath hinge lines 126 of the lateral clamps 122*a* and 122*b*.

Figures 43, 44:
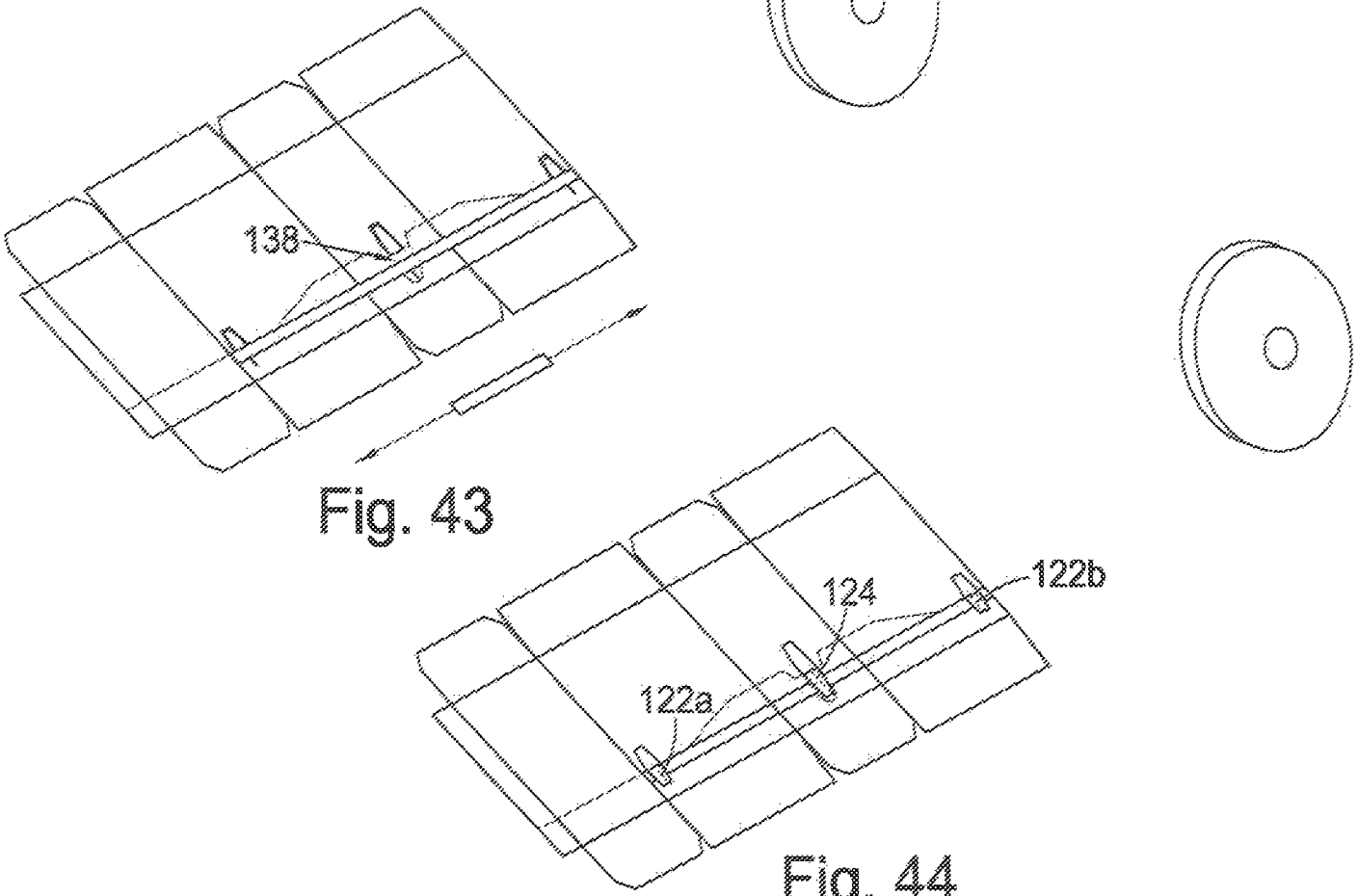

The center of the pusher tape is arranged in this embodiment to run through a channel 138 residing between the hinge 136 of back clamp 124 and the back clamp glue zone 128 (FIG. 43). This channel is absent of perforations, and as such is able to offer a reasonable degree of resistance to breakage—sufficient to restrain the pusher in a stretched condition towards the back of the folded tray, once assembled.

Referring now to FIG. 44, the two lateral clamps 122*a* and 122*b* and the back clamp 124 are then folded downwardly to lay flat over the material of the stretched pusher, with the central back clamp extending over to the tear off tab 128. There they overlie the applied glue 136 so that they adhere to their respective glued area to assist in securing the tape/web/pusher in place.

Figure 45:
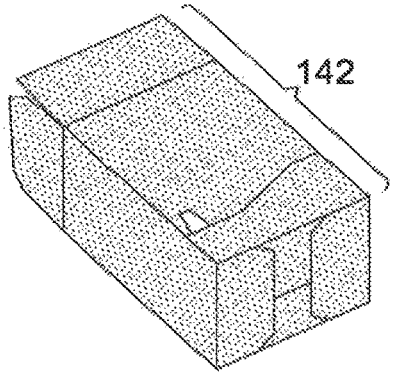

As shown in FIG. 45, the box or tray is then partially assembled by folding the blank about hinge lines 108, e.g. around a hollow mandrel. Jointing tab 120 is adhered to the inner surface of wall 104*b*, such as by gluing to hold the four sides in their rectangular-sectioned arrangement and length flaps 112 are folded inwardly followed by width flaps 114, which are adhered to flaps 112, such as again by gluing, to form the base of the box or tray.

Figure 46:
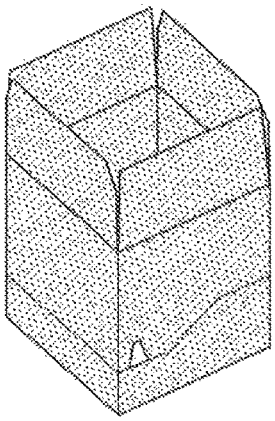
Figure 47:
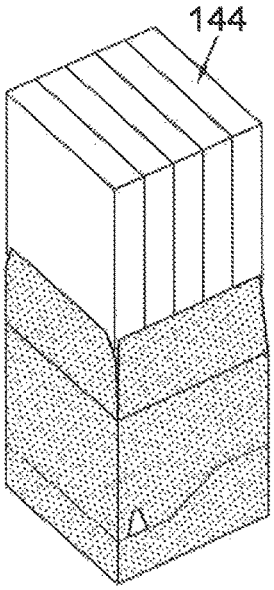

At this stage the partially assembled case 142 may be ejected from an automated assembly line and introduced to an automated tray filling machine. As shown in FIG. 46, for that purpose the box may be rotated to put the open end uppermost.

Products, in this case five rectangular boxes 144, may then be inserted into the tray via the opening in the top of the tray. See FIG. 47.

In an alternative arrangement, this filling process may be side-loading instead of top-loading, or it might even be bottom loading, e.g. with the box itself being pushed down onto product.

Figure 48:
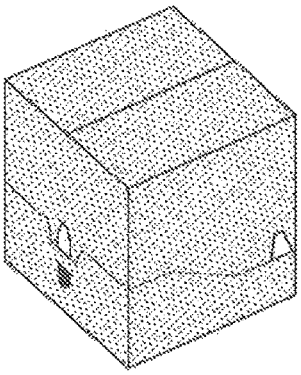

As shown in FIG. 48, the top of the case is then sealed by folding flaps 118 inwardly followed by flaps 116, which are adhered by glue. The box is thus then a loaded box ready for delivery to the shop shelves.

Figure 49:
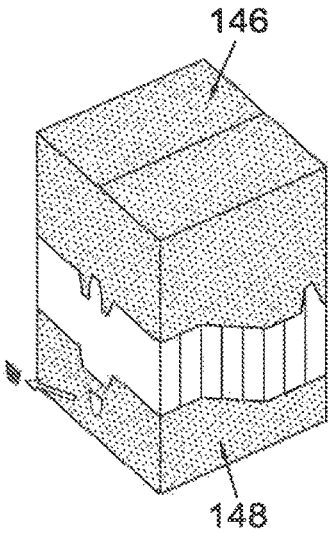
Figure 50:
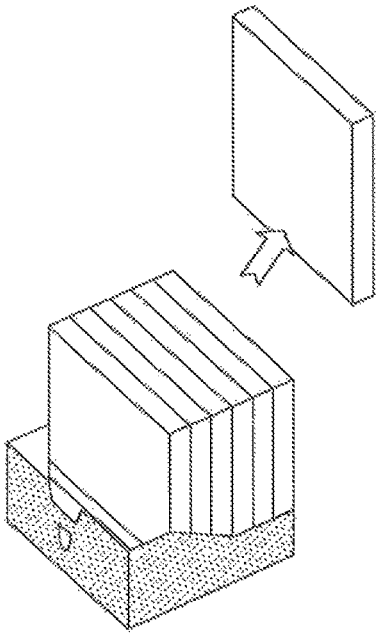

FIG. 49 next shows a process for the removal of the lid 146 from the tray of the box.

The lid can be torn off from the tray 148 by perforating the joint along the line of perforations 130. Once the lid is so removed, this allows the consumer to gain access to the products 144 contained therewithin—see FIG. 50.

In addition to removing the lid, the pusher tape 134 will want to be released from its restraint. To achieve that, the back clamp glue zone tab 128 is removed (see FIG. 49) by tearing it off along its perforated border. The tape or web 134 that forms the pusher is thus no longer held in restraint by the back clamp 124 and thus the pusher is free to apply a resilient bias force to the rear surface of products contained within the tray. The pusher will thus cause the products to front load automatically as a front product is removed therefrom. See FIG. 50.

FIGS. 51 to 63 show a further embodiment, similar to that of FIGS. 40 to 50, but wherein the tray and lid are not integrally constructed from a single blank. The tray and the lid are still interconnected, for example by slotting together, and potentially by way of glue as well (e.g. small dabs thereof, but this embodiment differs from the former embodiment either way by the lid not being connected to the tray by a line of perforations.

Figures 51, 52, 53:
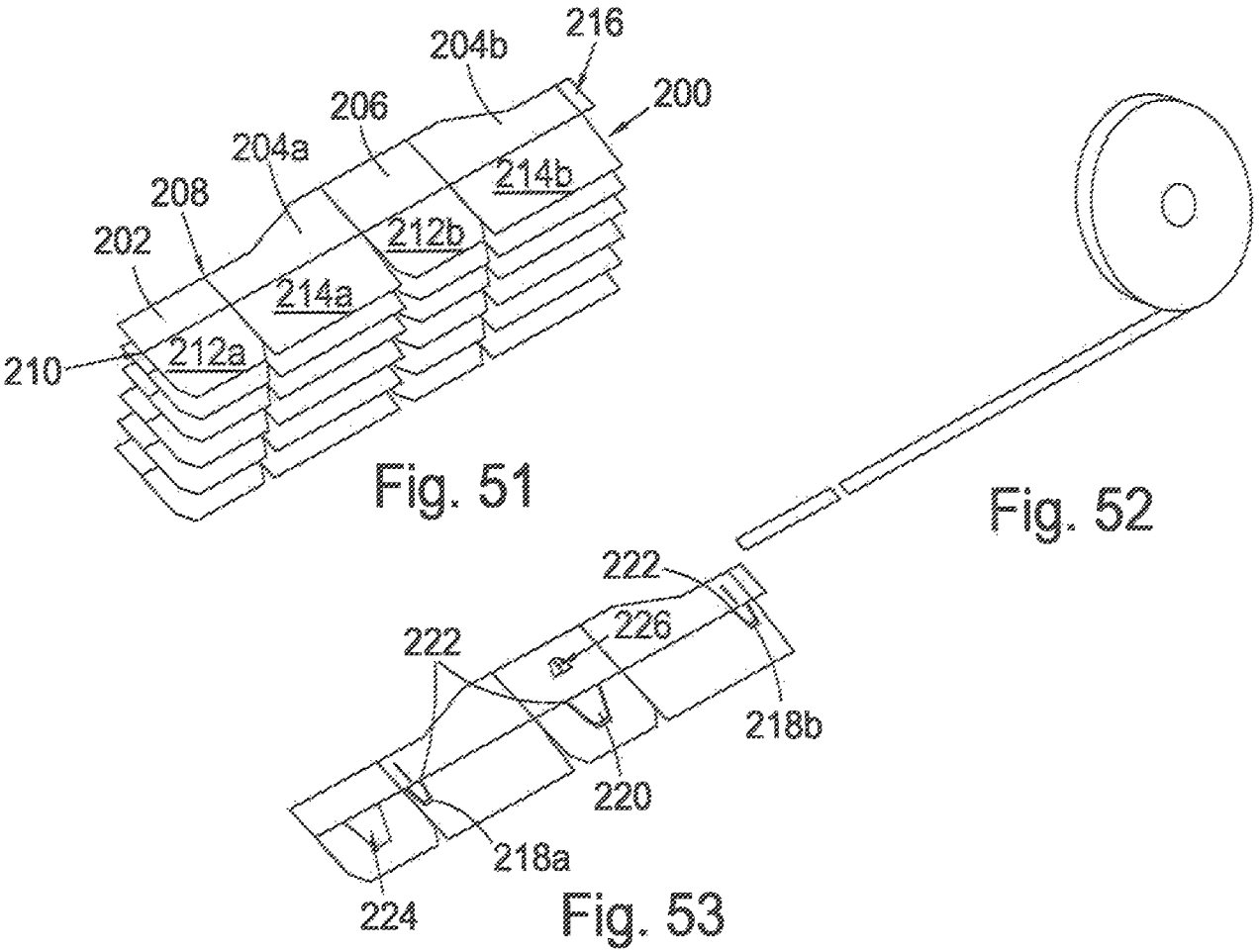
FIGS. 51 to 63 show a variant of the embodiment over FIGS. 40 to 50 in which the removable lid is separate to the tray.

FIG. 51 shows a magazine of cardboard blanks 200 for forming the product tray. Referring to FIGS. 51 and 53, each cardboard blank comprises, four walls, 202, 204*a*, 204*b*, 206, four hinge lines 208, various fold lines 210, four flaps 212 and 214, and a jointing tab 216. Walls 204*a* and 204*b* correspond to the left and right side walls and are mirror images of one another. Wall 206 forms the back wall. Wall 202 forms the front wall. Flaps 212*a*, 212*b*, 214*a* and 214*b* form the base of the tray. Flaps 214*a* and 214*b* are mirror images of one another.

Two tabs (lateral clamps) 218*a* and 218*b* are located in flaps 214*a* and 214*b*, respectively, near edges distal to flap 212*b*. A tab (back clamp) 220 is centrally located along the width of flap 212*b*. The clamps 218*a*, 218*b* and 220, as before, are formed to lie in the plane of the blank 200 and are hingedly attached to the blank at hinge lines 222, which correspond to fold lines 210.

Flap 212*a* contains a trapezoidal cut-out section 224, the base of trapezoid corresponding to fold line 210. Other shapes are possible too. However, the shape is ideally designed to correspond with an element in the top, as will be described later. This, however, is not essential.

FIG. 51 does not show the clamps and cut-out sections to simplify the drawings.

Adjacently above the hinge 222 of tab 220, located centrally in wall 206, is a tear-off tab (back clamp glue zone) 226. This is much like the previous embodiment as well.

FIG. 52 shows the tape dispenser, again much like in the previous embodiment.

Figures 54, 55, 56:
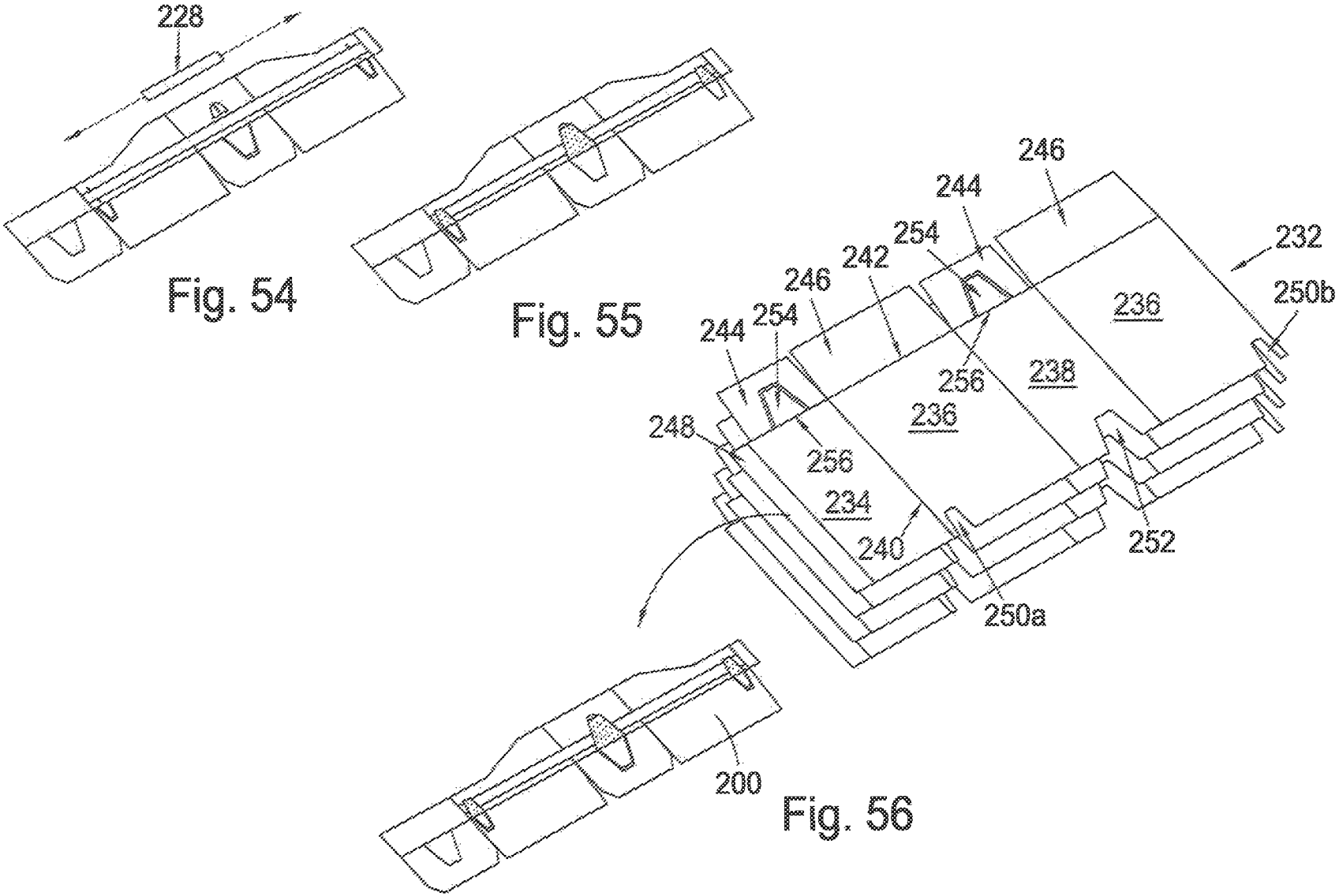

Referring to FIGS. 54 and 55, a cut length of pusher tape 228 is applied to the blank 200 as in the previous embodiment for forming the element that will be the pusher.

Once again, prior to mounting the pusher, beads of glue 230 are deposited on the surface of walls 204*a* and 204*b*, adjacently above the hinge 222 of lateral clamps 218*a* and 218*b* and to back clamp glue zone 226. Lateral clamps 218*a* and 218*b* and back clamp 220 are then folded, upwardly in this illustration, to adhere to their respective glued area.

FIG. 56 shows a magazine of blanks 232 corresponding to the removable lid. They are for applying to respective blanks for the trays, i.e. one per each tray blank.

Each of these cardboard blanks for the lids comprises four walls, 234, 236*a*, 236*b*, 238, four hinge lines 240, various fold lines 242, four flaps 244 and 246, and a jointing tab 248. Walls 236*a* and 236*b*, corresponding to the side walls of the lid, are mirror images. Wall 238 corresponds to the back wall. Wall 234 corresponds to the front wall. Flaps 244 and 244 form the top of the lid.

A pair of trapezoidal cut-out sections 250*a* and 250*b* are located at the base of walls 236*a* and 236*b*, respectively, at edges distal to back wall 238. Further, a trapezoidal cut-out section 252 lies at the center of the base of wall 238. The areas of these cut-out sections 250*a*, 250*b* and 252 correspond to the areas of the lateral clamps 218*a* and 218*b* and the back clamp 220, respectively, of the blank for the tray. As a result, the blank for the lid can overlay the blank for the tray in a locating fashion, and without unnecessarily stacking to a third thickness of blank material (i.e. the folded parts of the blank for the tray are not sandwiched between the two blanks, but are instead accommodated into the plane of the overlying blank by virtue of the corresponding cut-outs therein.

Two further tabs 254, located in flaps 244, lie in the plane of the blank 232 and are hingedly attached to that blank 232 at hinge lines 256, which are coaxial to fold lines 242.

Figure 57:
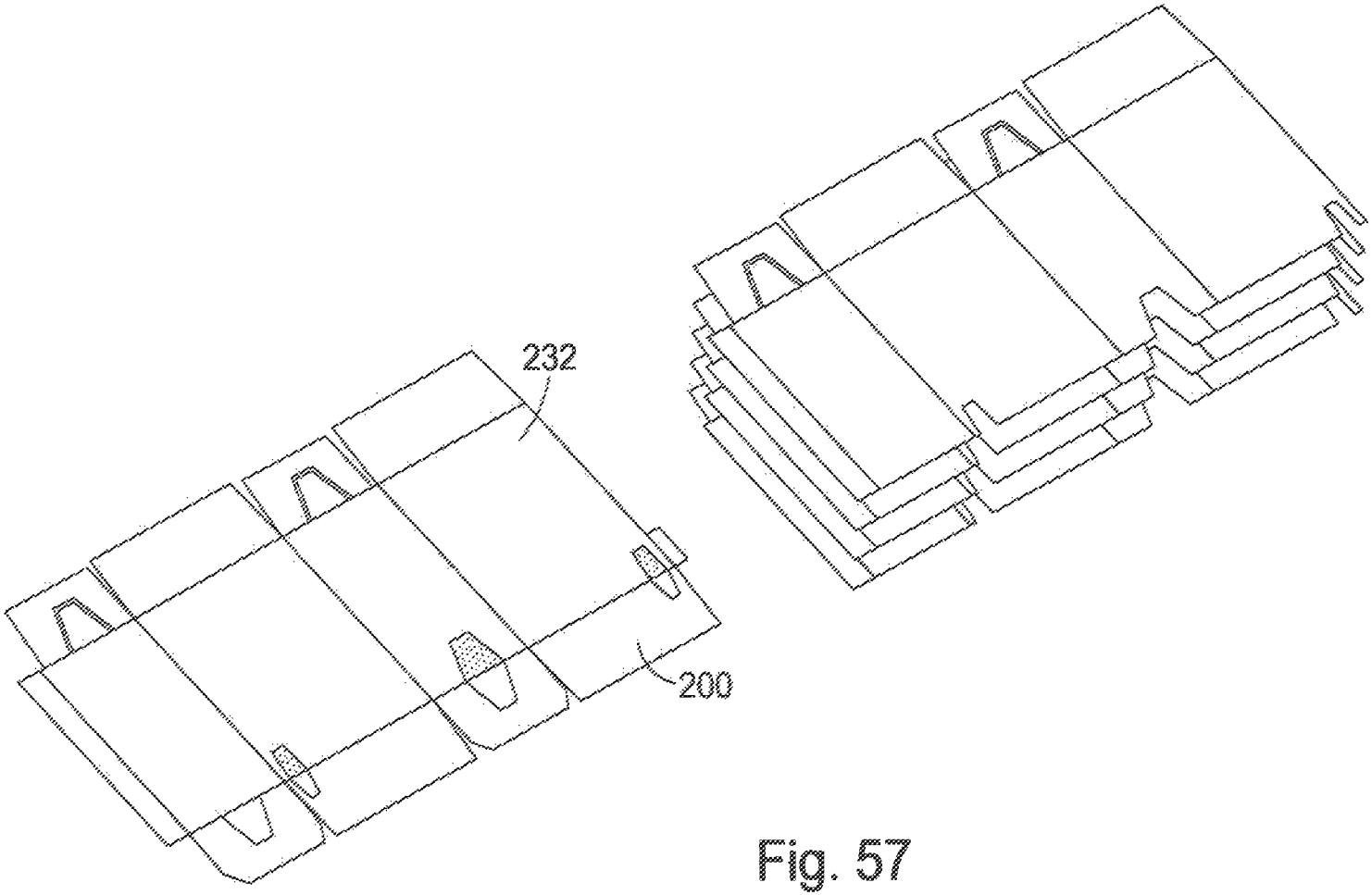

Referring next to FIG. 57, an uppermost lid blank 232 has been removed from the magazine of said lid blanks and has been placed on top of the tray blank 200 so that the cut-out sections 250*a*, 250*b*, and 252 align with the folded over clamps 218*a*, 218*b* and 220, respectively. The pusher tape 228 is now sandwiched between both blanks.

Figure 58:
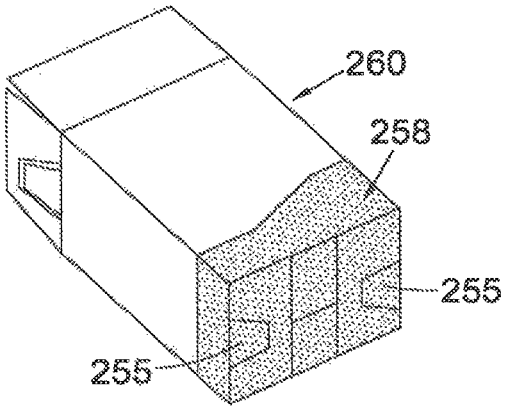

Like in the previous embodiments, the resulting assembly (here overlapped blanks, rather than the integral lid and tray) is folded about hinge lines 208 and 240 around a mandrel—e.g. a hollow one—and the length flaps 214*a* and 214*b* and then the width flaps 212*a* and 212*b* are folded inwardly to effect closure of the tray base (see FIG. 58).

Jointing tab 216 is adhered to the inner surface of wall 234 and jointing tab 248 is adhered to the inner surface of wall 236*b*, such as by gluing, to hold this assembled shape together. The removable lid 260 thus now appears to be slotted into the tray 258.

Figure 59:
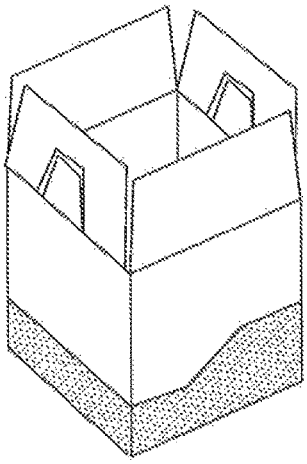
Figure 60:
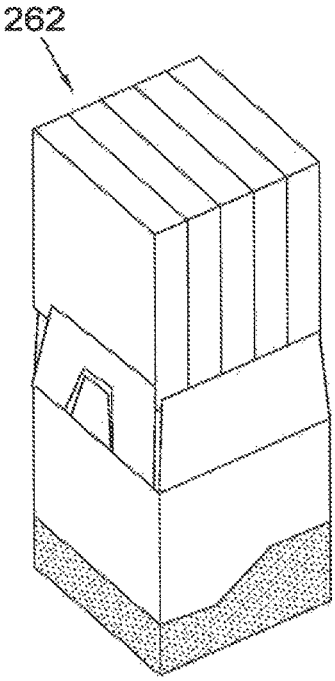
Figure 61:
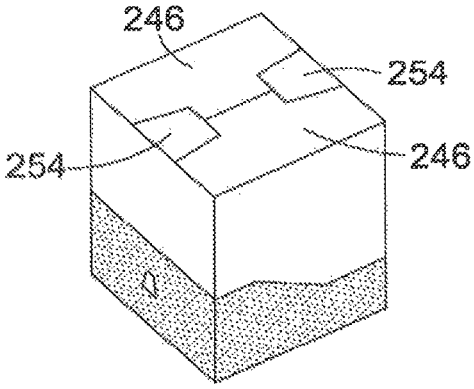

Referring next to FIGS. 59 and 60, the products 262 are loaded into the case as per the previous embodiment.

To close the top of the lid, firstly width flaps 244 are folded inwardly. Hinged tabs 254 are then pulled upwardly by at least 90° to allow length flaps 246 to be folded inwardly on top of flaps 244. Flaps 246 need not be adhered to flaps 244. Lastly, tabs 254 are folded inwardly and adhered, for example with glue, to the top surface of flaps 246 so as to hold down the top of the lid, resulting in the fully assembled product case 262 (see FIG. 61).

The tabs 254 are slightly raised above the surface of the top of the lid formed by flaps 246, which allows the cases 262 to be stacked centrally, one on top of another, as these raised portions can interlock with the corresponding depressions 255 on the base of the tray (see FIG. 58), formed by the trapezoidal cut-out sections 224 on flaps 212*a* and 212*b*. Other shapes for these inter-engaging elements are possible, but the trapezoidal shape conveniently provides an interlock with a tendency to increasingly resist lateral sliding, e.g. in the event that such lateral sliding is likely to occurs.

Figure 62:
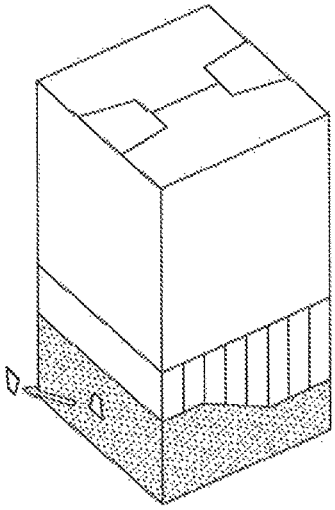
Figure 63:
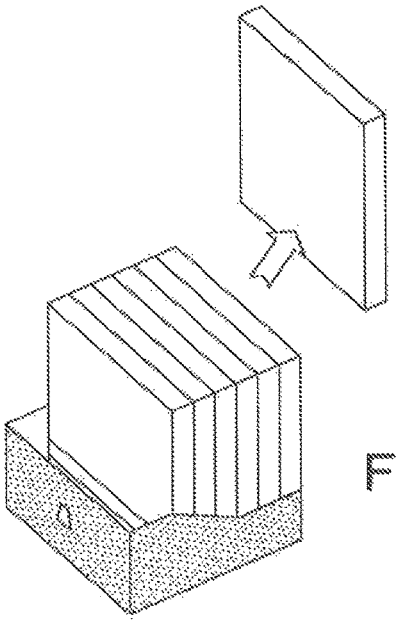

Unless the lid and the tray are glued together, the lid 260 can then be simply lifted off the tray to display the products contained therewithin (FIGS. 62 and 63).

Unlike the previous embodiment of FIGS. 40 to 50, which may have a tendency for the lid or tray to be damaged as the perforations are broken, the lid and tray of this further embodiment is more readily reusable since damage is less likely. Further, the lid can easily be placed back over the tray if so desired.

As before, the back clamp glue zone 226 is broken off along the lines of perforation to release and activate the pusher. See FIG. 62.

Referring next to FIGS. 64 to 76, there is shown a preferred embodiment of the present invention relating to a method of assembling a product tray containing products, such as chocolate bars.

Figure 64:
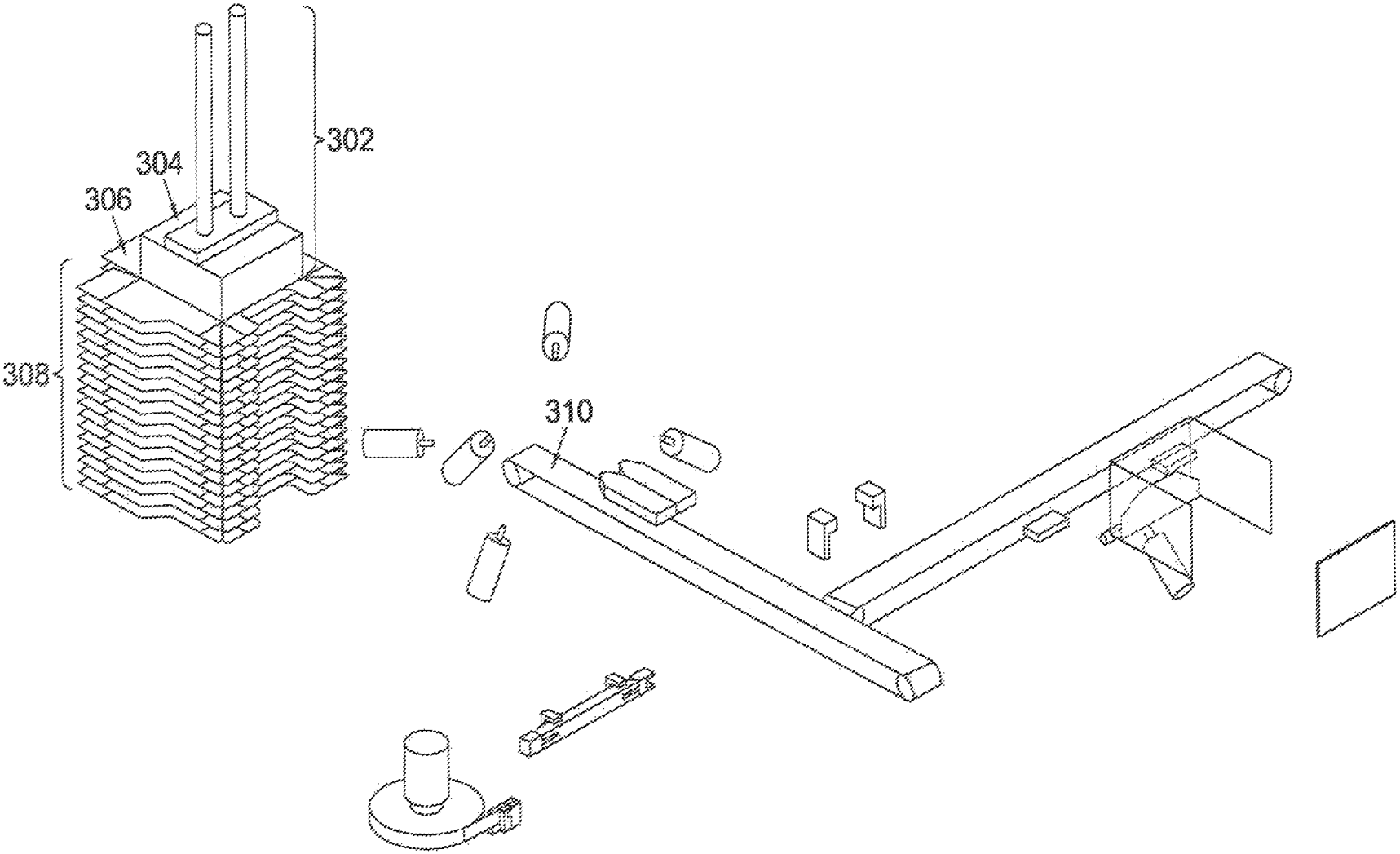
FIGS. 64 to 76 show a method of assembling a product box/tray comprising a product pusher which takes the form of an elasticated tape wherein products are side-loaded into the box.

As shown in FIG. 64, which is at the start of the process, an automated transfer device 302 having a transfer block 304, extracts the uppermost cardboard blank 306 from a stack 308 of said blanks and feeds that blank to a processing conveyor. The base of the transfer block can have a surface area corresponding to the surface area of the base of the product tray blank, as shown. Blank 306 is the same as used to make product trays shown in FIGS. 13 to 39. The blank 306, once transferred to and positioned on a conveyer belt 310 (FIG. 65), is further processed. At this stage the joining surfaces of the blank 306 may be coated with an adhesive substance, such as hot-melt glue. The joining surfaces may instead be already pre-coated with an adhesive substance, e.g. a two-part touch activated adhesive.

Figure 66:
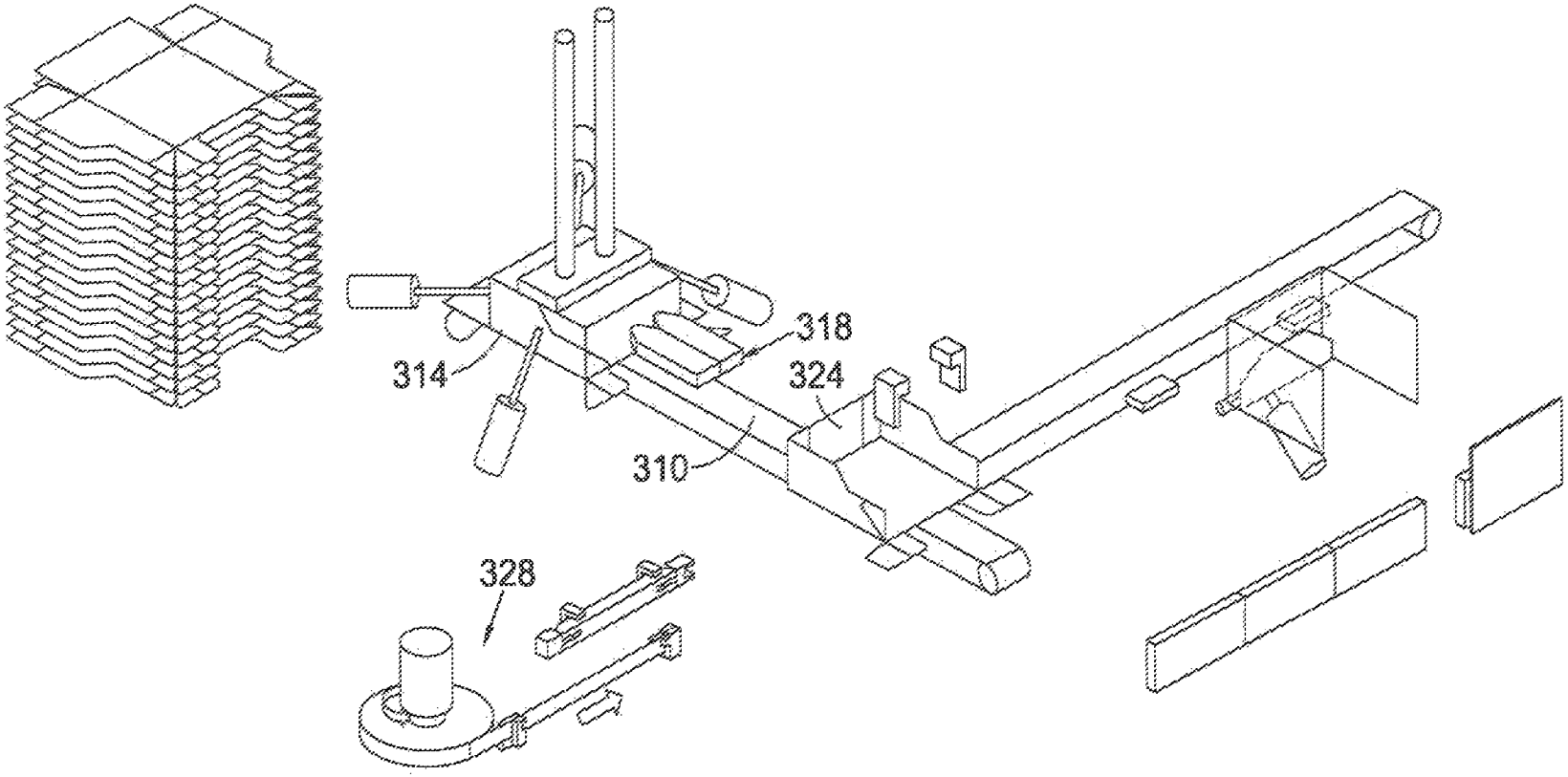
Figure 67:
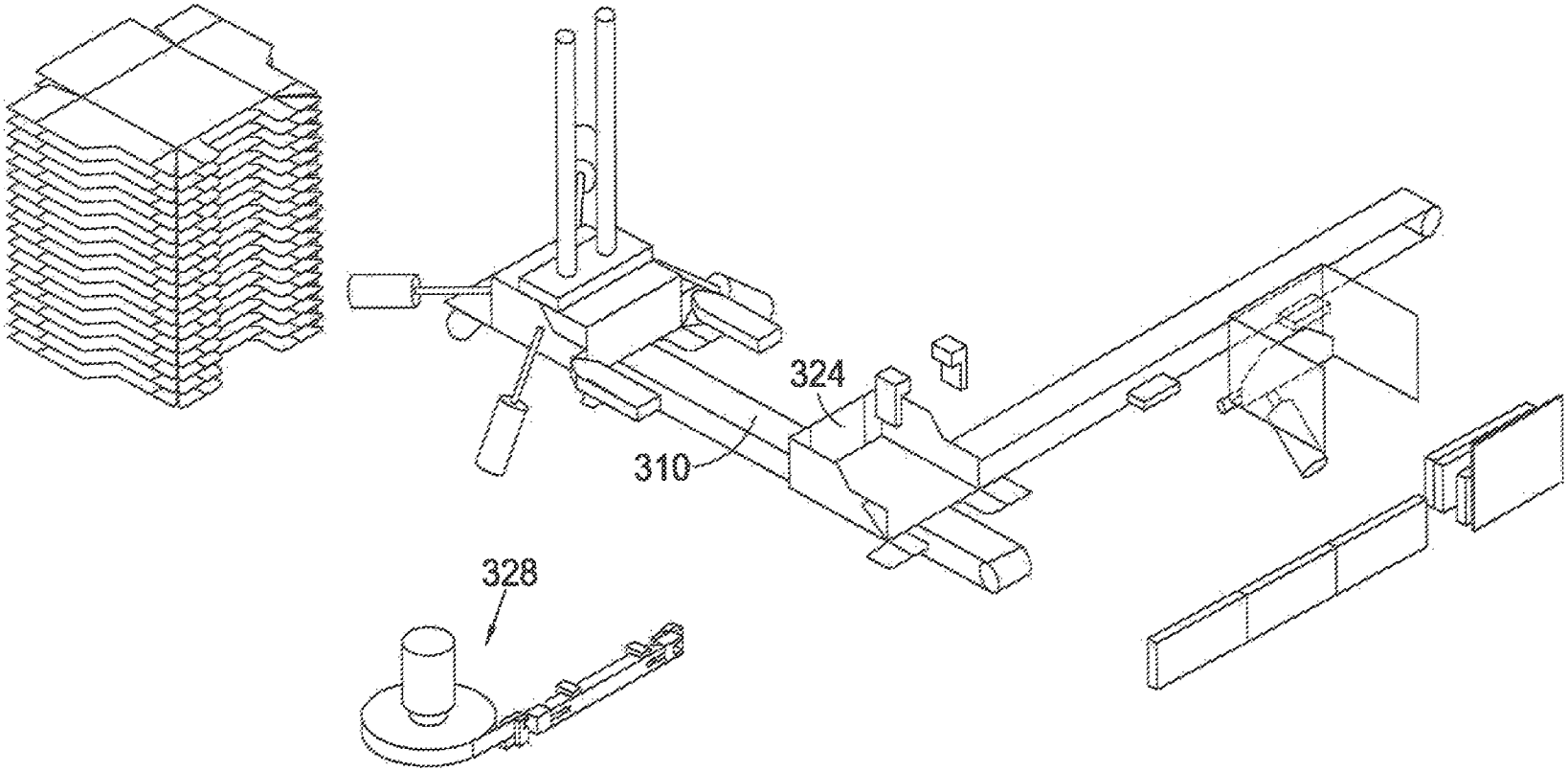

A series of pistons 312 then partly assembles the product tray around the transfer block 304—by being the same size, the transfer block can be the mandrel. Firstly, as depicted in FIG. 66, the depth flaps 314 are folded upright to form the sides of the tray and the jointing tabs 316 are pushed inwardly. A pair of pushing members 318 then fold the flaps 320 outwardly so that they adhere to their respective depth flaps 314 (see FIGS. 67 and 69).

The back of the tray is formed by a piston upwardly pushing the back flap 322 into contact with the adhesive surface of the jointing tabs 316.

At this stage, the transfer block 304 is then withdrawn from the partly assembled tray (see FIG. 70) and is free to collect another blank from the stack.

The partly assembled tray 324 is moved along by the conveyor belt 310 into a position to receive the pusher 326.

The pusher of this embodiment takes the form of a web of resilient material; preferably a tape made of clear elastic tape or knitted shirring elastic. Clear elastic may be elastic manufactured from polyurethane and may be capable of being stretched to 4 times its original length in a preferred embodiment. Furthermore, by being elastic in nature, it retains its original length after being subjected to tensional stresses.

Figure 65:
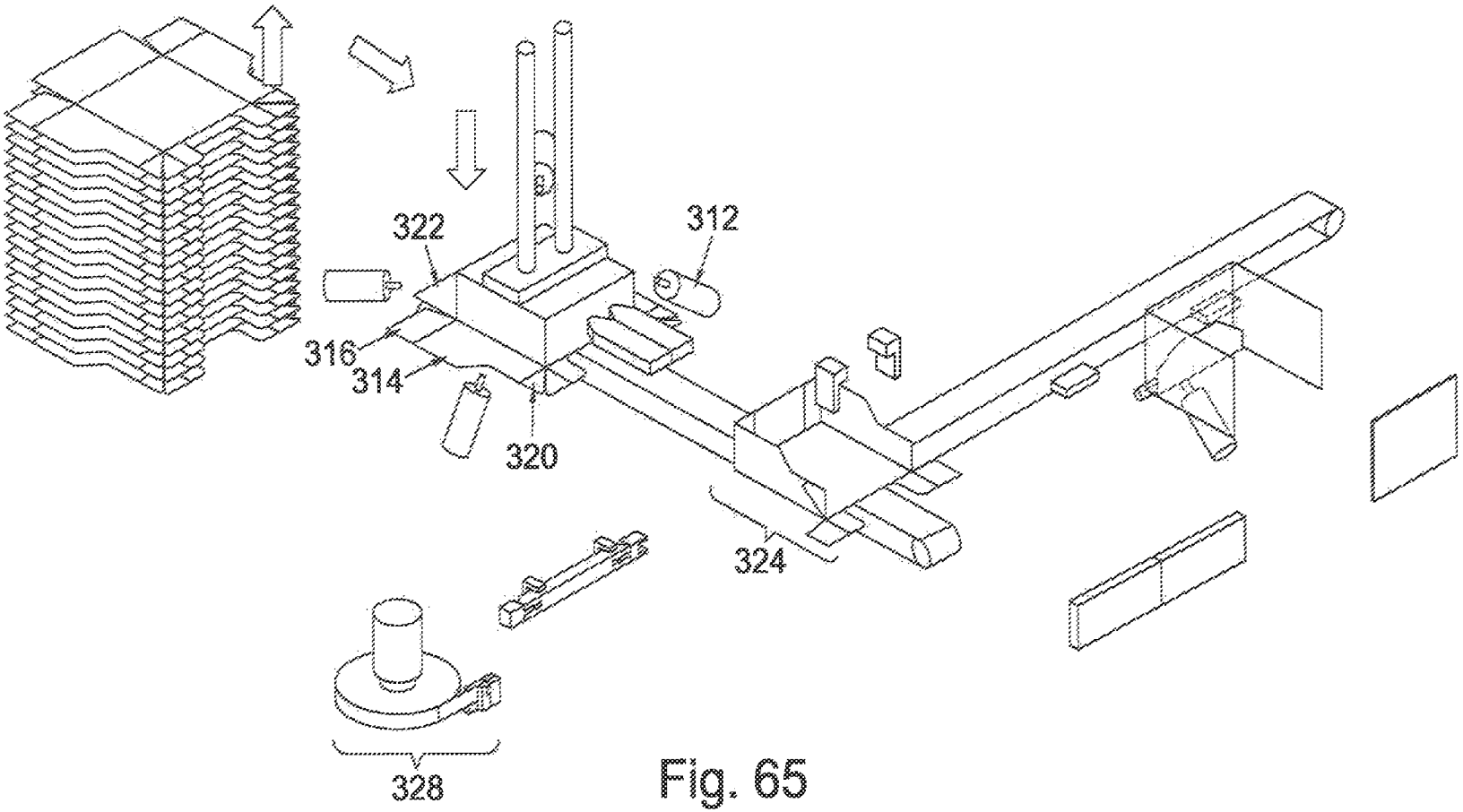

The pusher tape is dispensed from an automated tape feeding device 328 as shown in FIGS. 65 to 70. The reel of tape 330 is mounted on a motorized shaft 332 through its central core—see FIG. 68 for a more detailed view of this preferred arrangement. A pair of interconnected grippers 334*a* and 334*b* is located at the end of the tape. FIG. 65 shows the end of the tape sandwiched between two interconnected grippers. The tape is clamped between the side walls of the gripper 334*b* but not between the side walls of gripper 334*a*. To unravel a length of tape, the motorized shaft 332 rotates in an anti-clockwise direction (although a clockwise direction would also be suitable) and the gripper 334*b* moves tangentially away from the roll at a rate consistent with the rotational speed of the motorized shaft, thus unravelling the tape without subjecting it to significant tensional forces, until a desired length of pusher material is dispensed (FIG. 66).

Figure 68:
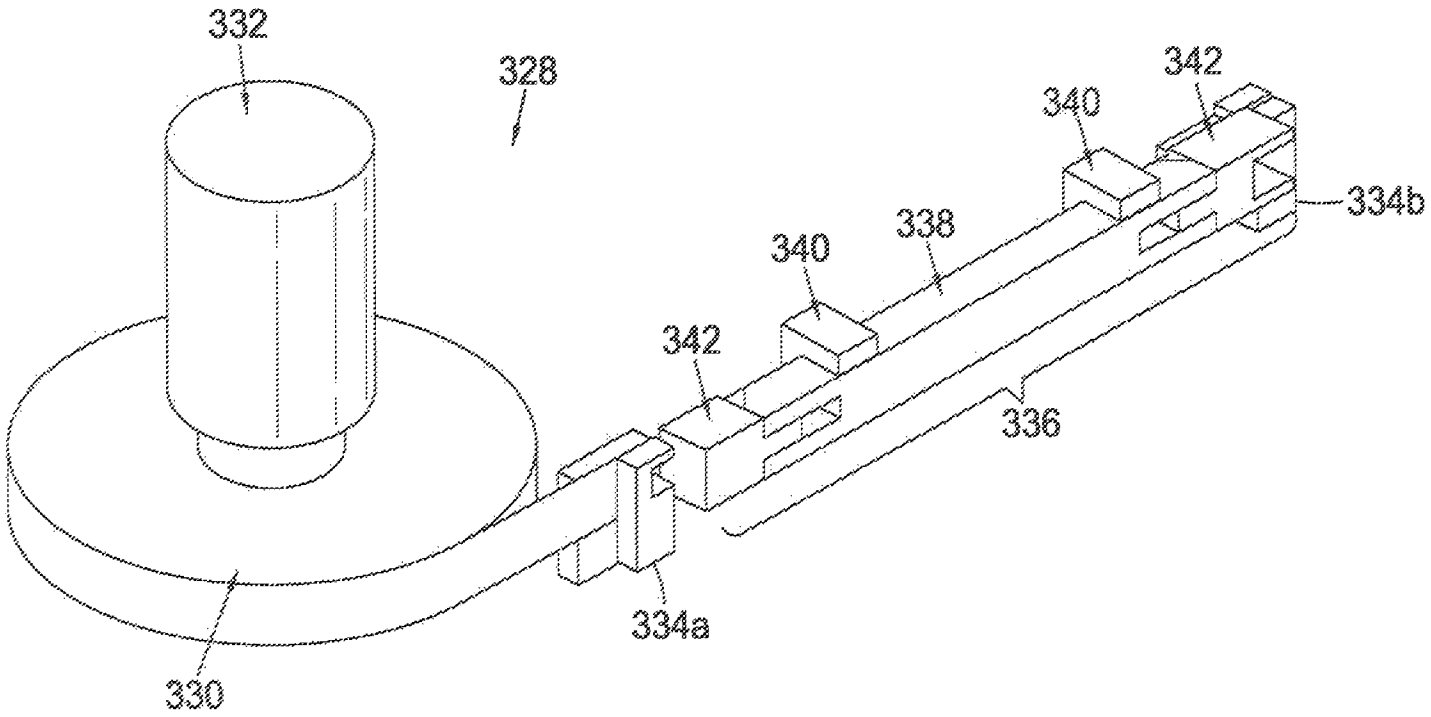

The pusher tape is then collected by a tape transfer device 336. Referring to FIG. 68, the device according to this embodiment consists of a bar 338 with two clamps 340 positioned along its length and two end blocks 342, capable of generating a suction force, pivotally attached at either end of the bar 338. The tape transfer device aligns itself with the length of pusher tape and collects it using the clamps 340. The tape is then cut to release it from the gripper 334*a* and the terminal end of the tape is released from gripper 334*b*. The ends of the length of pusher tape are held to the end blocks 342, preferably by suction force. The mobile gripper 334*b* then moves back into interconnection with gripper 334*a* and its sides close together to grip the end of the reel of tape left exposed by cutting the length of pusher tape adjacent to gripper 334*a*.

Figure 69:
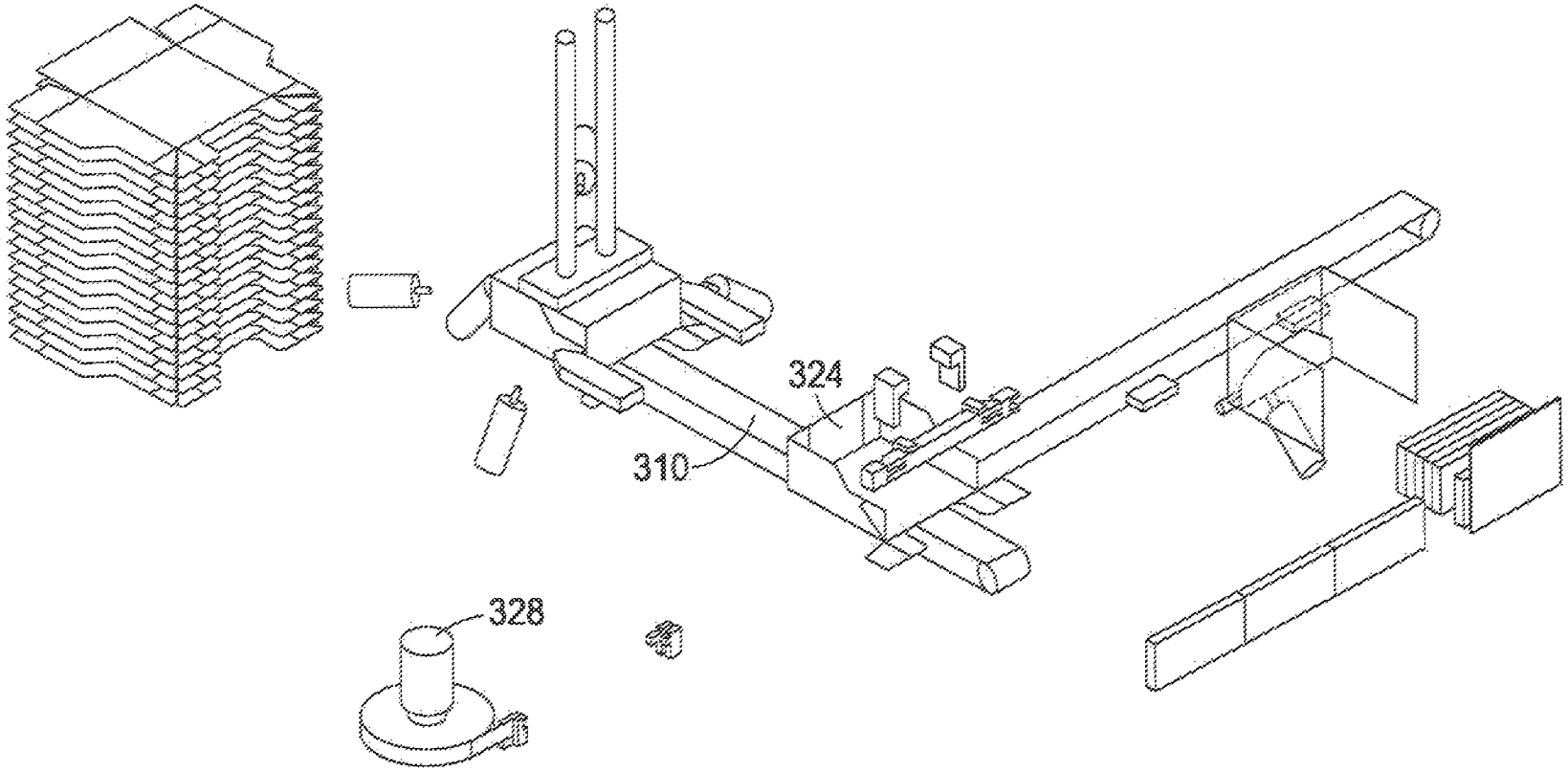
Figure 70:
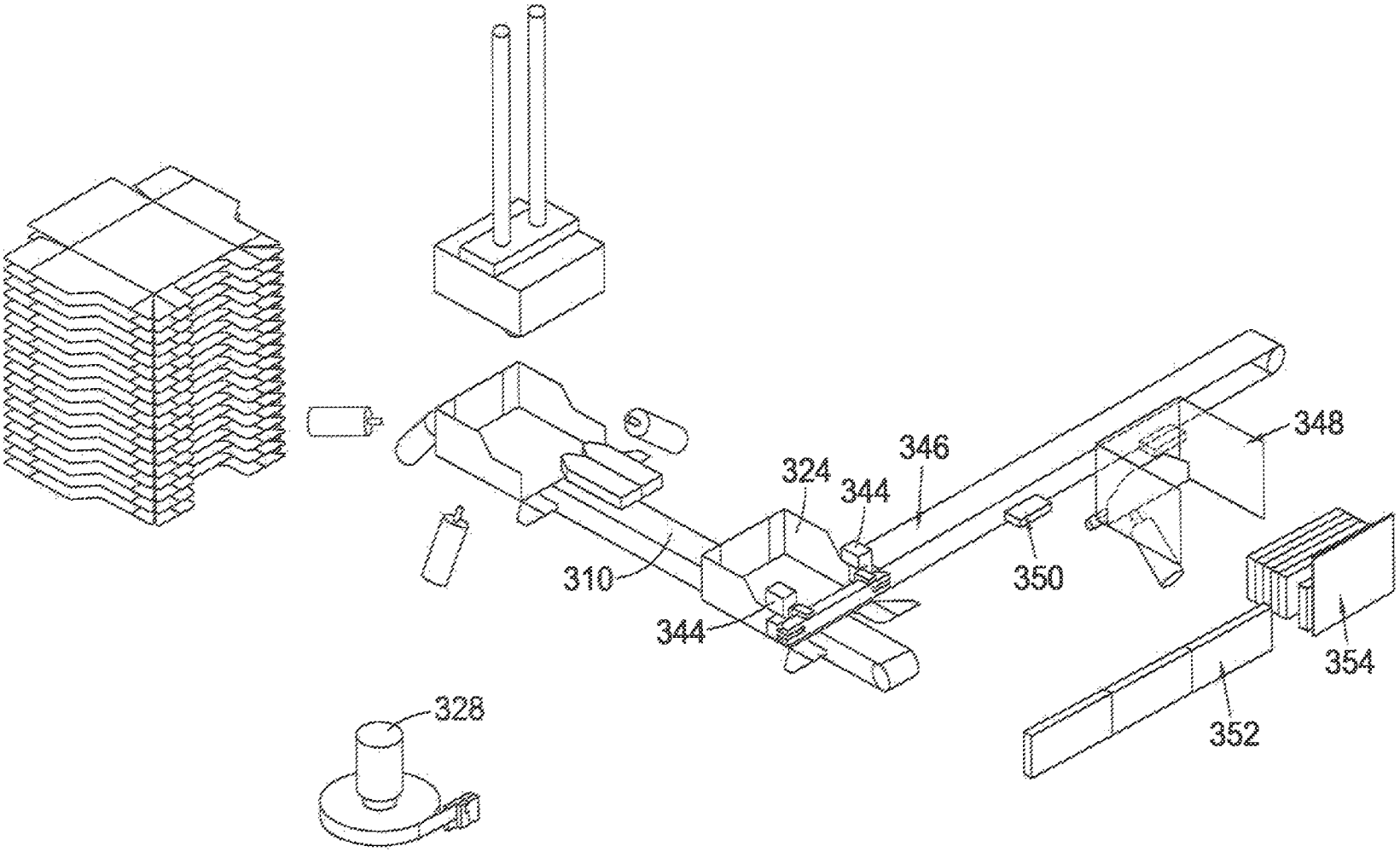

To achieve mounting of the pusher, the tape transfer device 336 is brought into alignment with the partly assembled product tray at the height of the flaps 320 (compare FIG. 69 with FIG. 70). The end blocks 342 of the device 336 are then rotated inwardly approximately at right angles about their pivot so that the ends of the tape can be glued or otherwise attached to the flaps 320. Upwardly moveable support members 344 are also inserted into tray behind the position of the flap 320 to provide support to the sides of the tray to prevent them from buckling inwards (see FIG. 70). They are then lifted out again—see FIG. 71.

The partly assembled tray with the pusher attached is then transported along the conveyor belt 346, in this case one that is perpendicular to the last, although this is optional (although it helps to avoid the need for a rotation of the tray in a compact assembly line).

Figure 71:
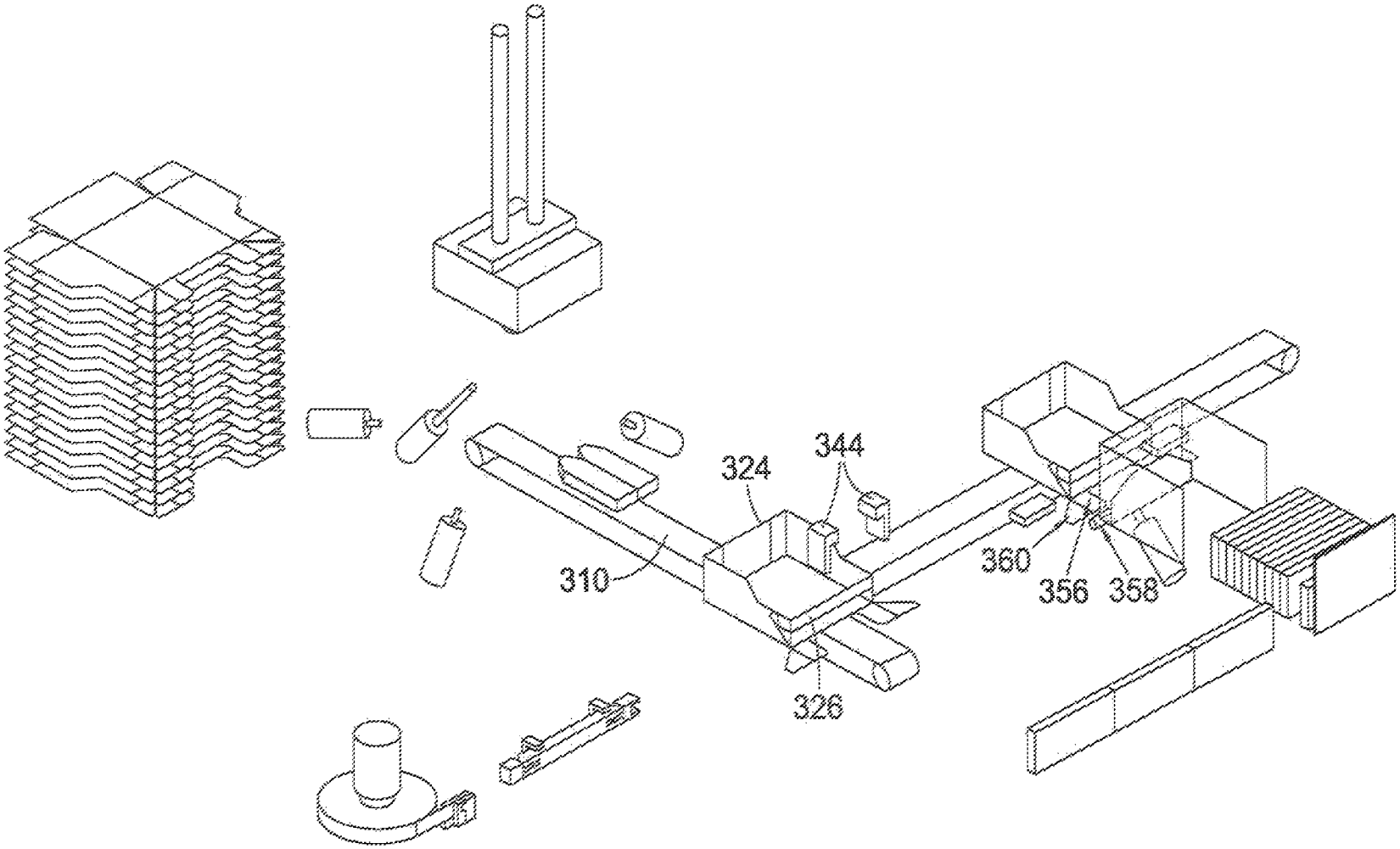
Figure 72:
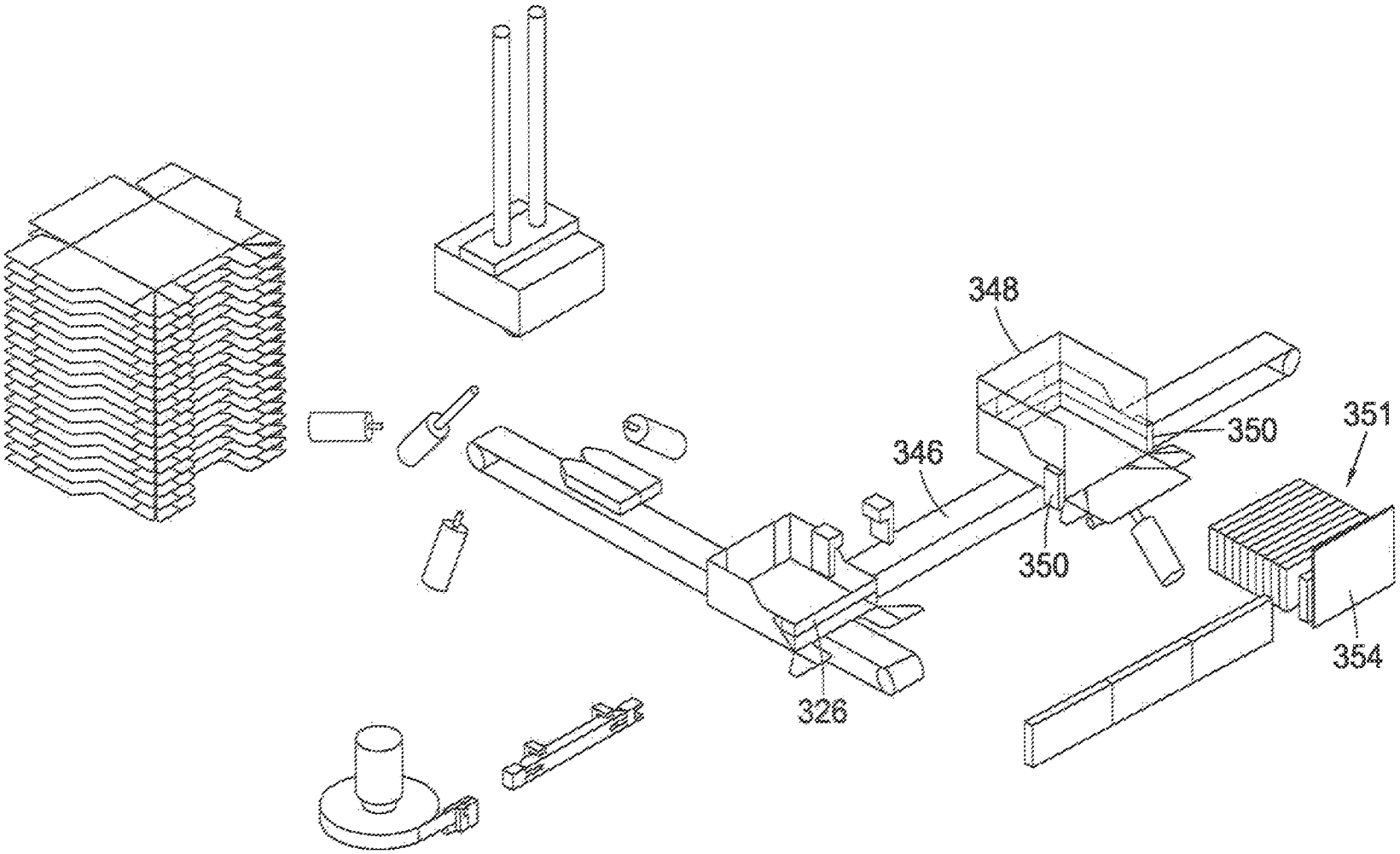
Figure 73:
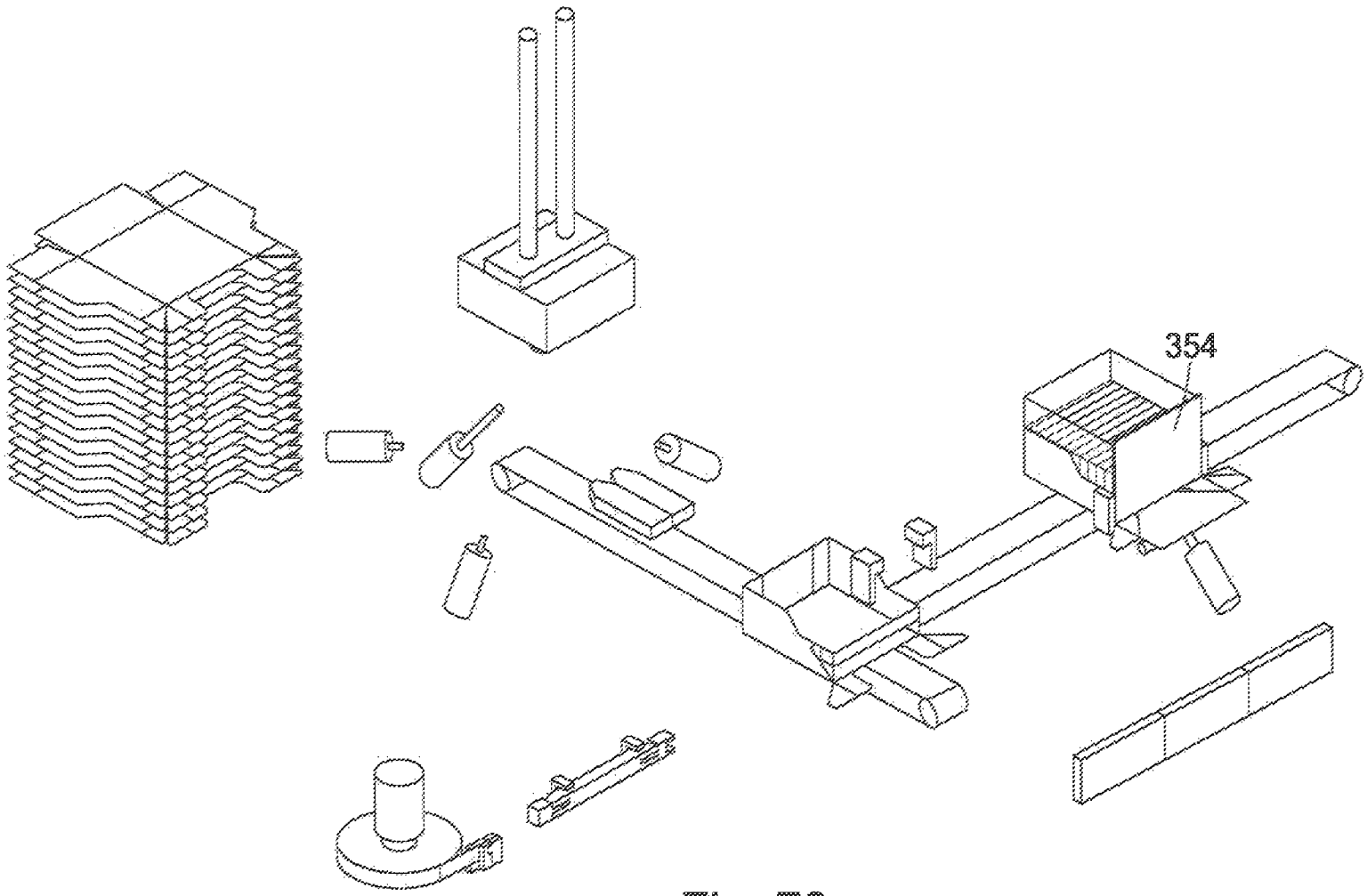
Figure 74:
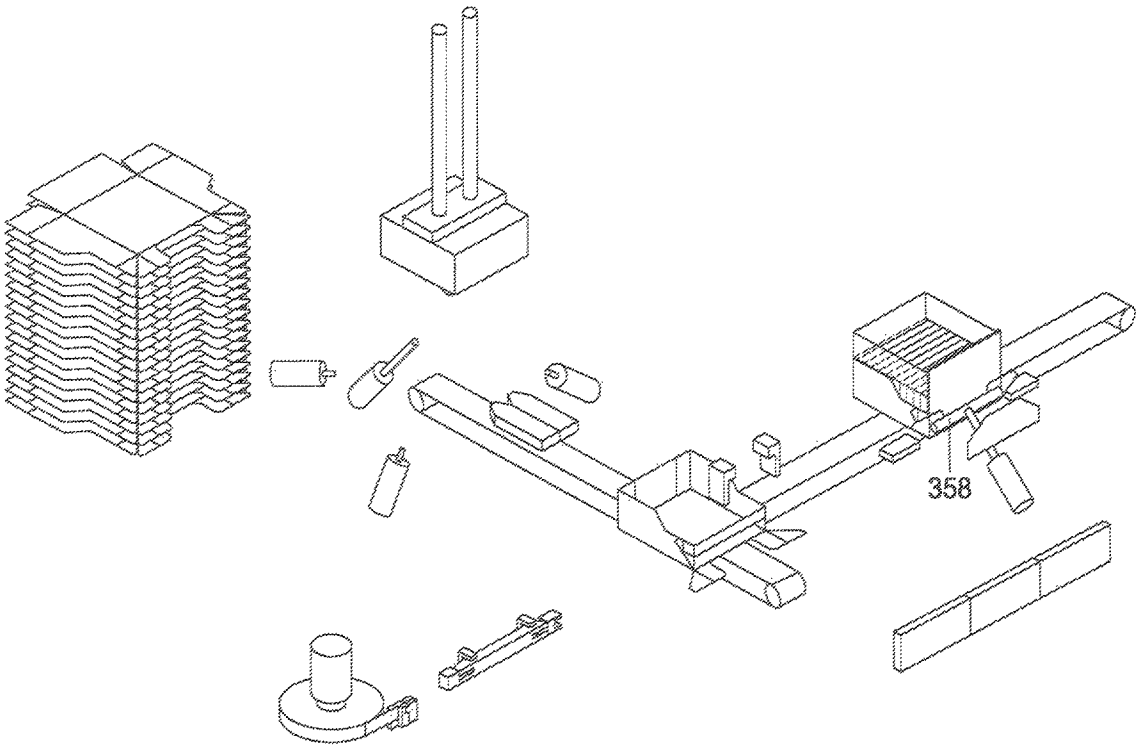

At the next station therealong, a tension guide 348 having approximately the same width and depth dimensions as the internal width and depth dimensions of the tray is inserted into the tray to establish pusher tension (FIGS. 71 and 72). Further, usually prior to insertion of the tension guide 348, support blocks 350 are pressed against the flaps 320, at the ends of the pusher tape, to prevent the ends becoming detached upon establishment of pusher tension. They can be rotated upwardly into those supporting positions, or they may be otherwise so positioned (e.g. in the manner of the support members 344, and vice versa).

Figure 79:
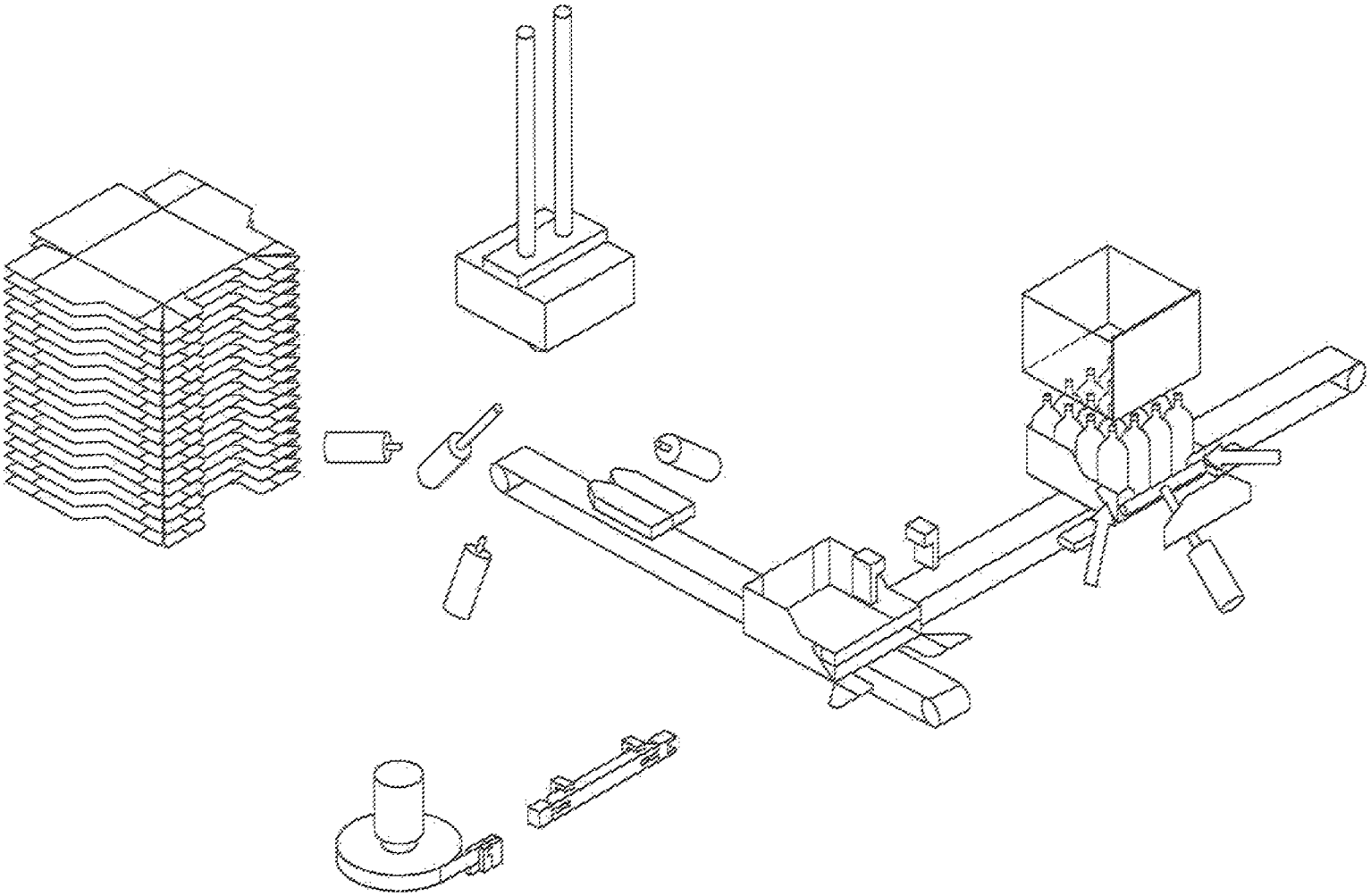
Figure 80:
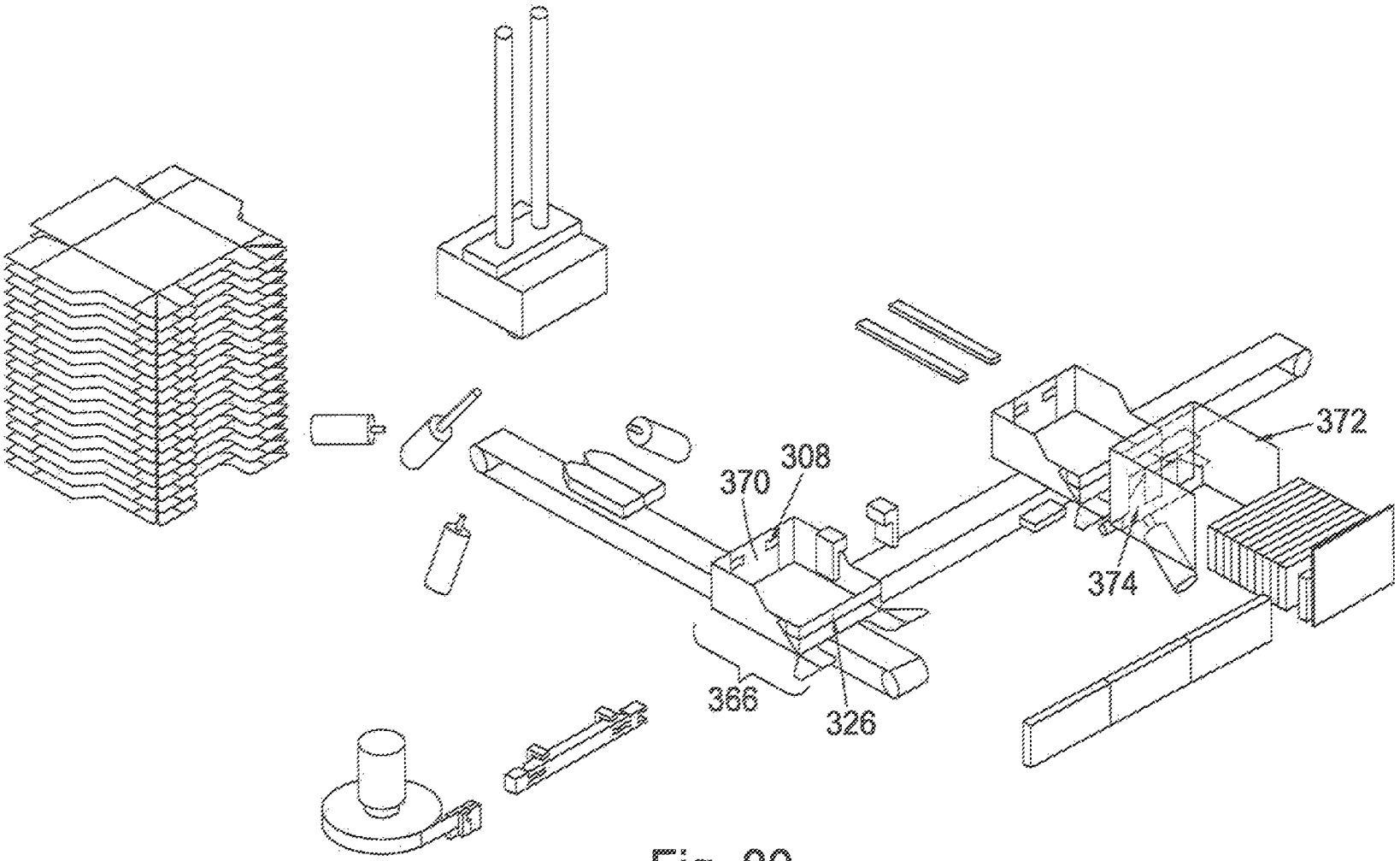
FIGS. 80 to 85 show a variant of the embodiment over FIGS. 64 to 76 which prevents the upward movement of tape upon removal of a tension guide insert.

Products 352 to be loaded into the tray are meanwhile fed into a product holding bay 351 and are stacked up in a back-to-back fashion against a plate 354. The product units are then pushed forwards into the tray by the plate 354 as shown in FIG. 79.

Figure 75:
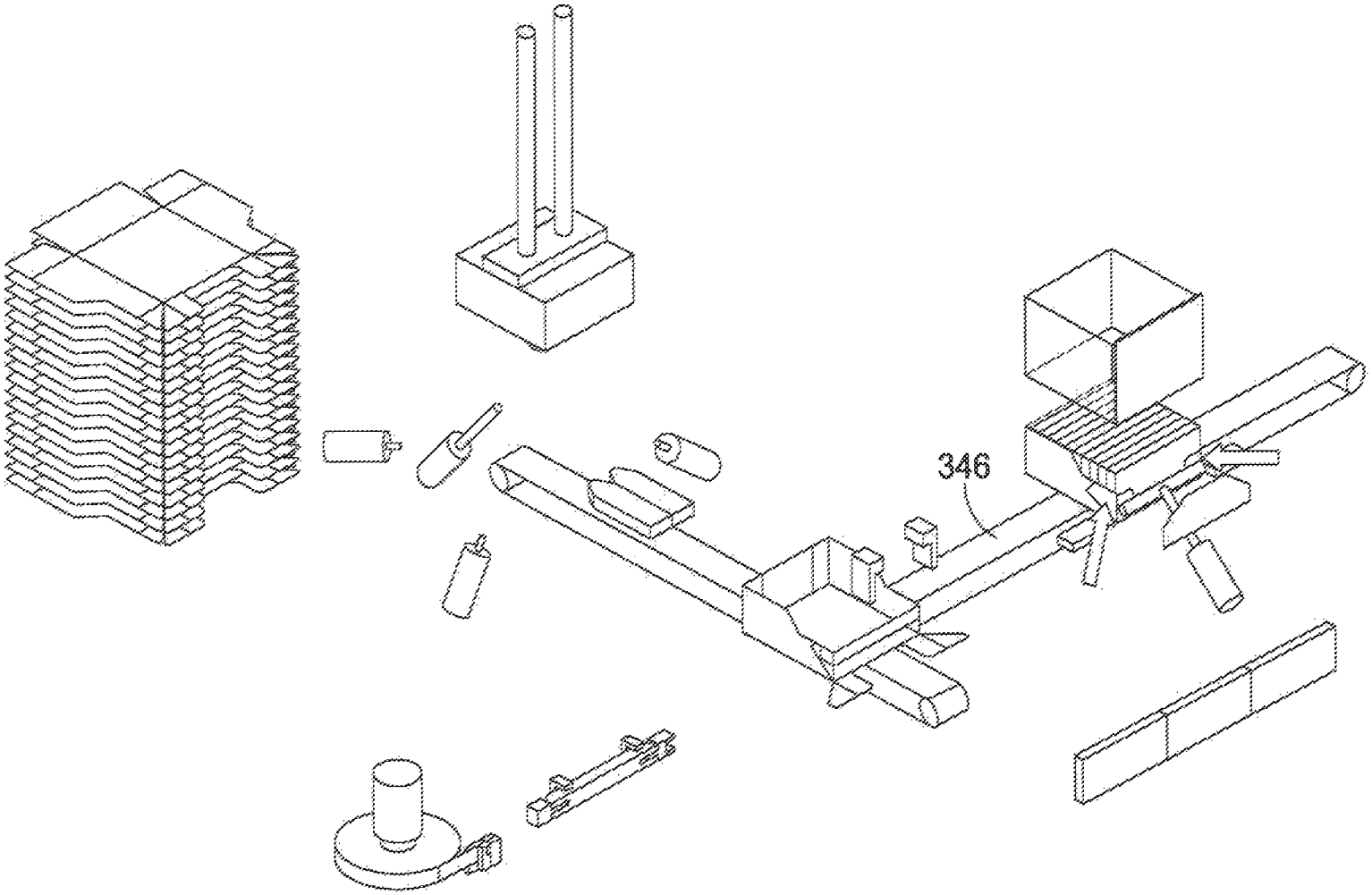

The support blocks 350 can then be retracted and the front flaps 356 are folded up relative to the base of the tray with the aid of a pushing rod 358. The side flaps 360 are folded backwards and attached to the flaps 320, and also to the ends of the pusher that are attached thereto, preferably again by gluing. That conceals the ends of the pusher tape, as shown in FIG. 75.

Figure 76:
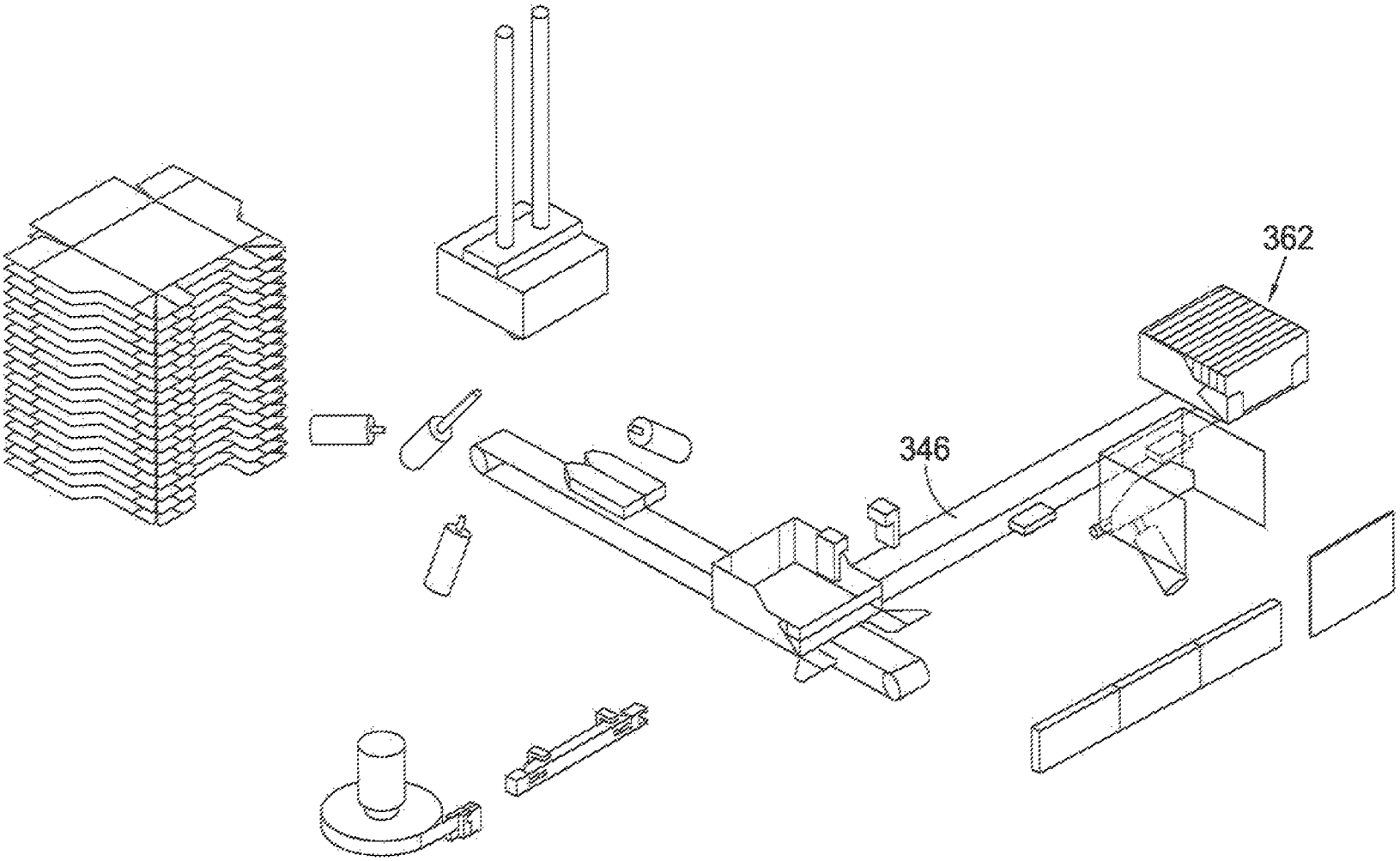

The tension guide 348 and plate 354 are then retracted or lifted to leave the fully loaded tray 362, which tray is ready for removal from the conveyor belt 346 (FIG. 76).

The process could also be envisaged to include additional steps which serve to attach a covering lid, of the type depicted in FIGS. 30 and 31, to the product tray. Further, the direction of the conveyor 346 can be different, and the direction of feeding of the products can likewise be different.

Figure 77:
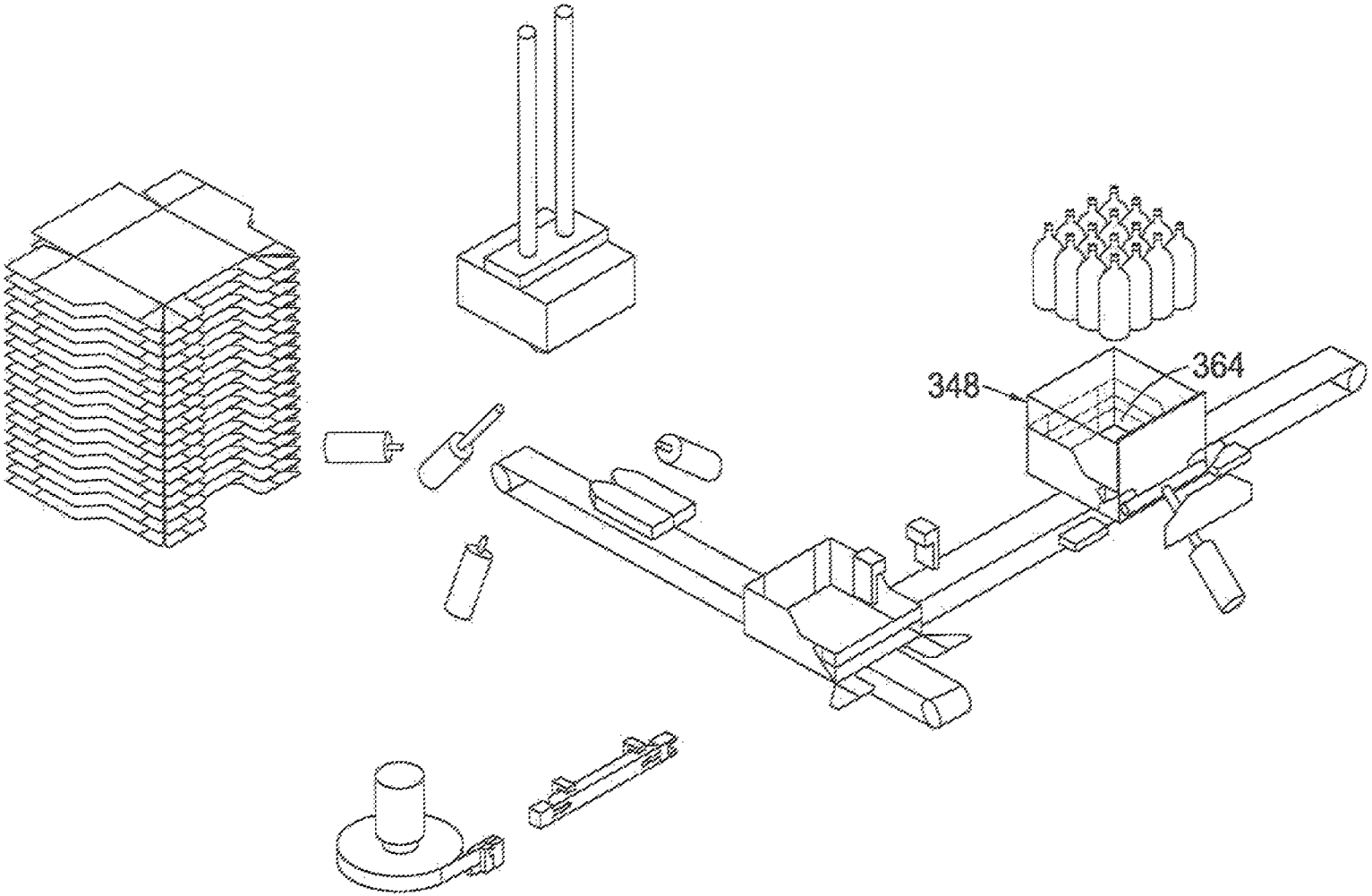
FIGS. 77 to 79 show a variant of the embodiment over FIGS. 64 to 76, but in which the products are top loaded into the box/tray.
Figure 78:
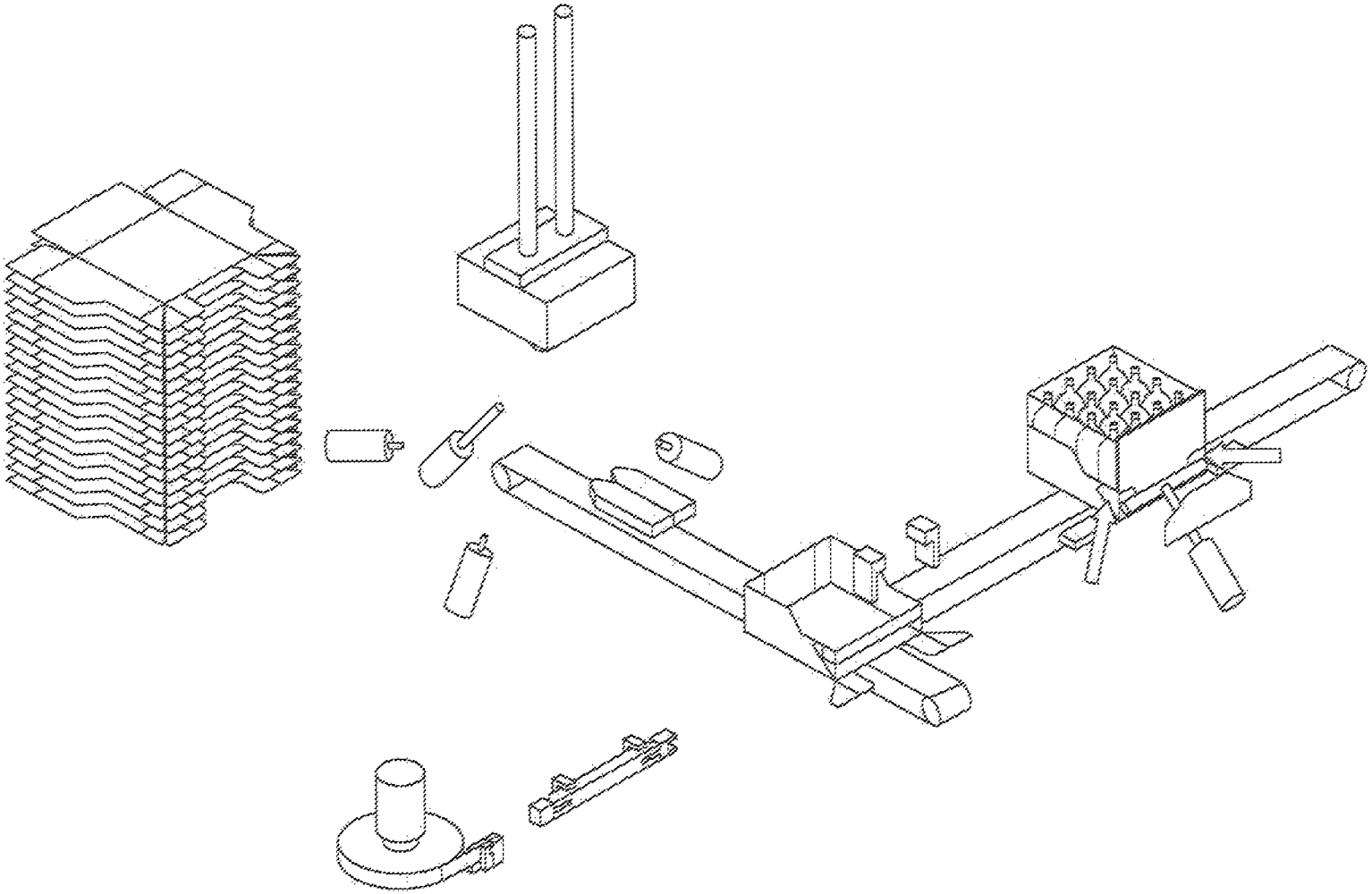

FIGS. 77 to 79 depict an alternative product loading method where the direction of feeding of the products is different—it is now a top-loading arrangement. This top-loading method is beneficial where the products are difficult to pack by the side-loading method of FIGS. 72 to 76. For example, ordered rows of glass bottles will not necessarily keep formation if pushed from their side, but they are readily grasped by cap-holders and moved vertically.

Referring to FIG. 77, a tension guide 348 is again inserted into the partially assembled tray to establish pusher tension. A plate 354 is then again positioned at the frontward edge of the tray, but this time without pushing products therewith. Further the front flaps 356 are folded up relative to the base of the tray with the aid of a pushing rod 358. The products, in this case, 16 bottles in a 4.times.4 arrangement, are however instead lowered into the cavity created by the tension guide 348 and the front plate 354.

In this embodiment the side flaps 360 are then folded back and attached to the flaps 320 as described for the side-loading method (FIG. 78). The timing of these folds, however, is not critical. For example, it may have occurred prior to loading the bottles. Then, referring to FIG. 79, the plate and tension guide are lifted out of the tray.

Referring next to FIGS. 80 to 85, a further embodiment of the present invention is shown. The process is very similar to before. However, in this embodiment the product tray 366 has two slots 368 located in the back wall 370, positioned at a height just above that at which the pusher tape 326 is attached to the side flaps 320. Further, the tension guide 372 has two rectangular channels 372 rising upwards from the base of its back wall, each having a height that corresponds to the height from the base of the back wall 370 to the top edge of the slots 368. The heights are not important, so long as they are no less high than this.

Figure 81:
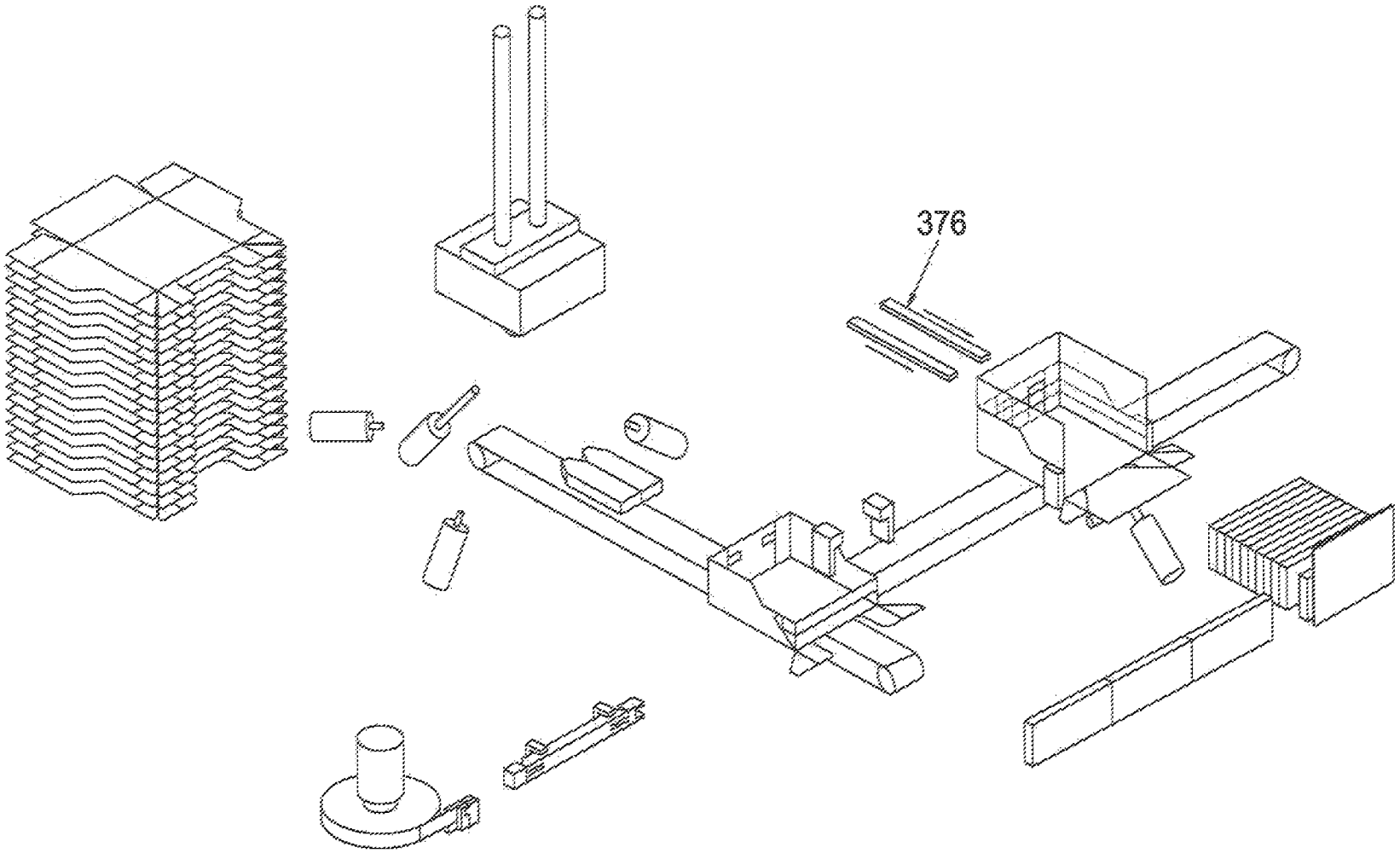
Figure 82:
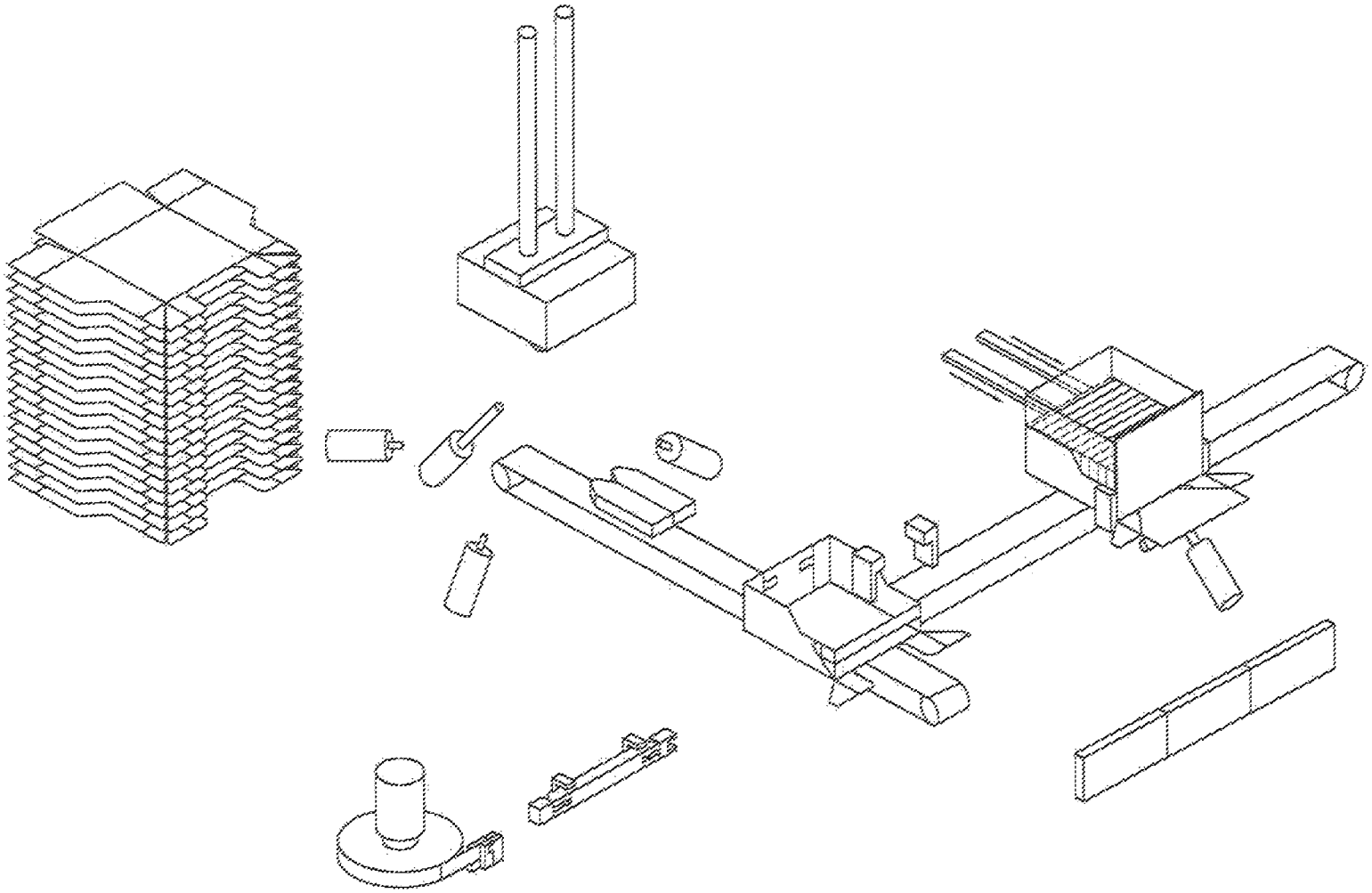
Figure 83:
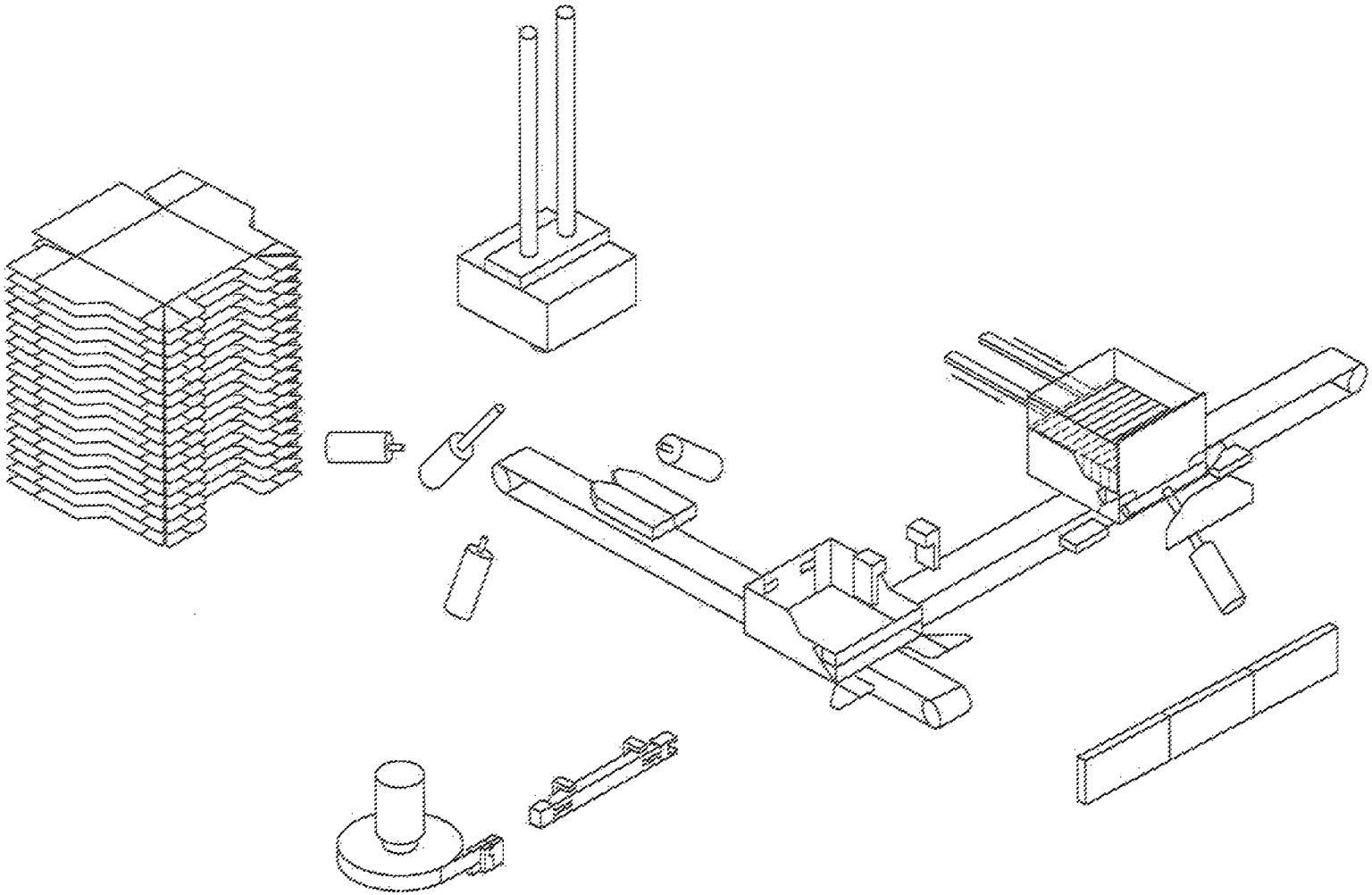
Figure 84:
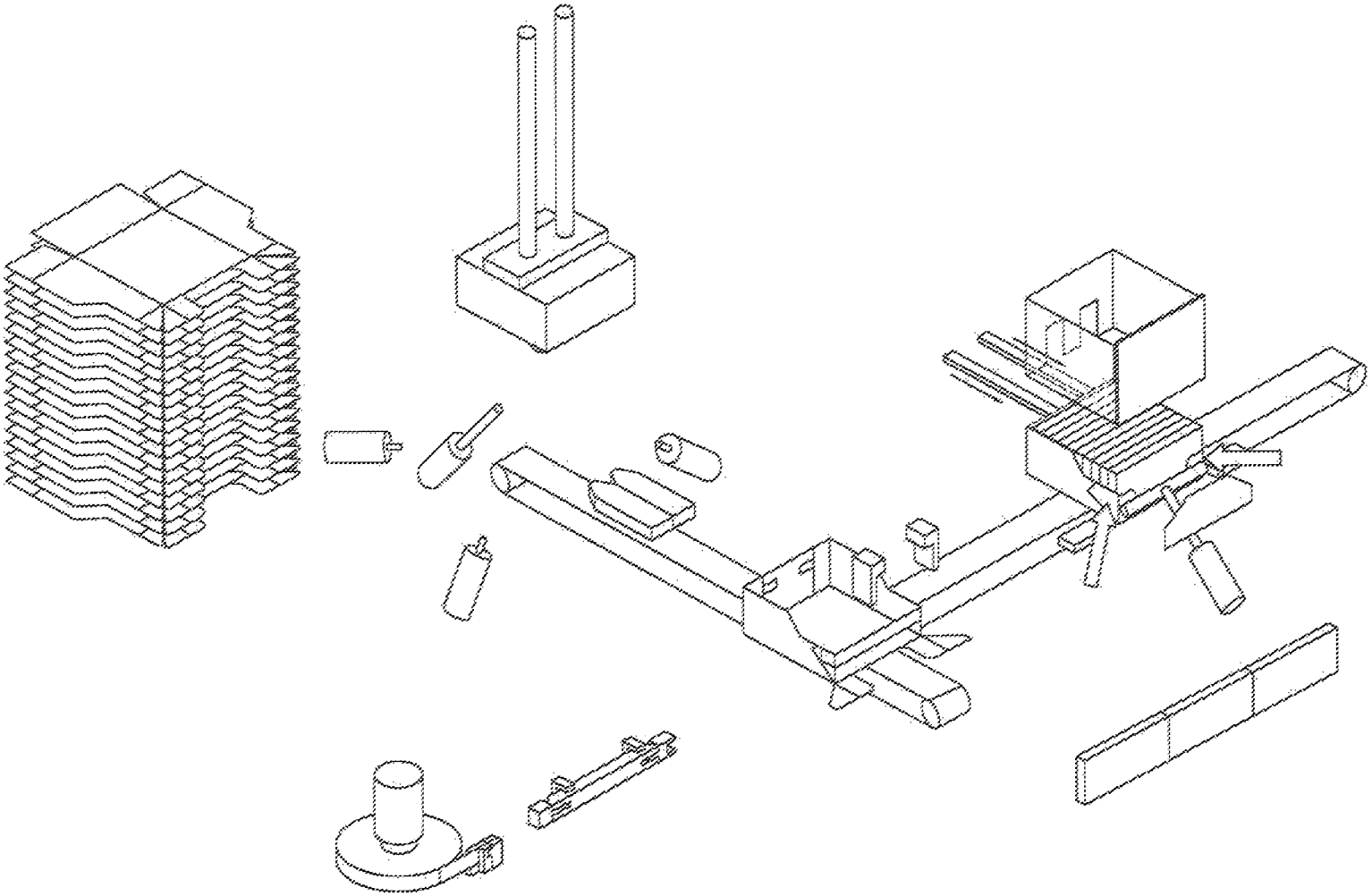
Figure 85:
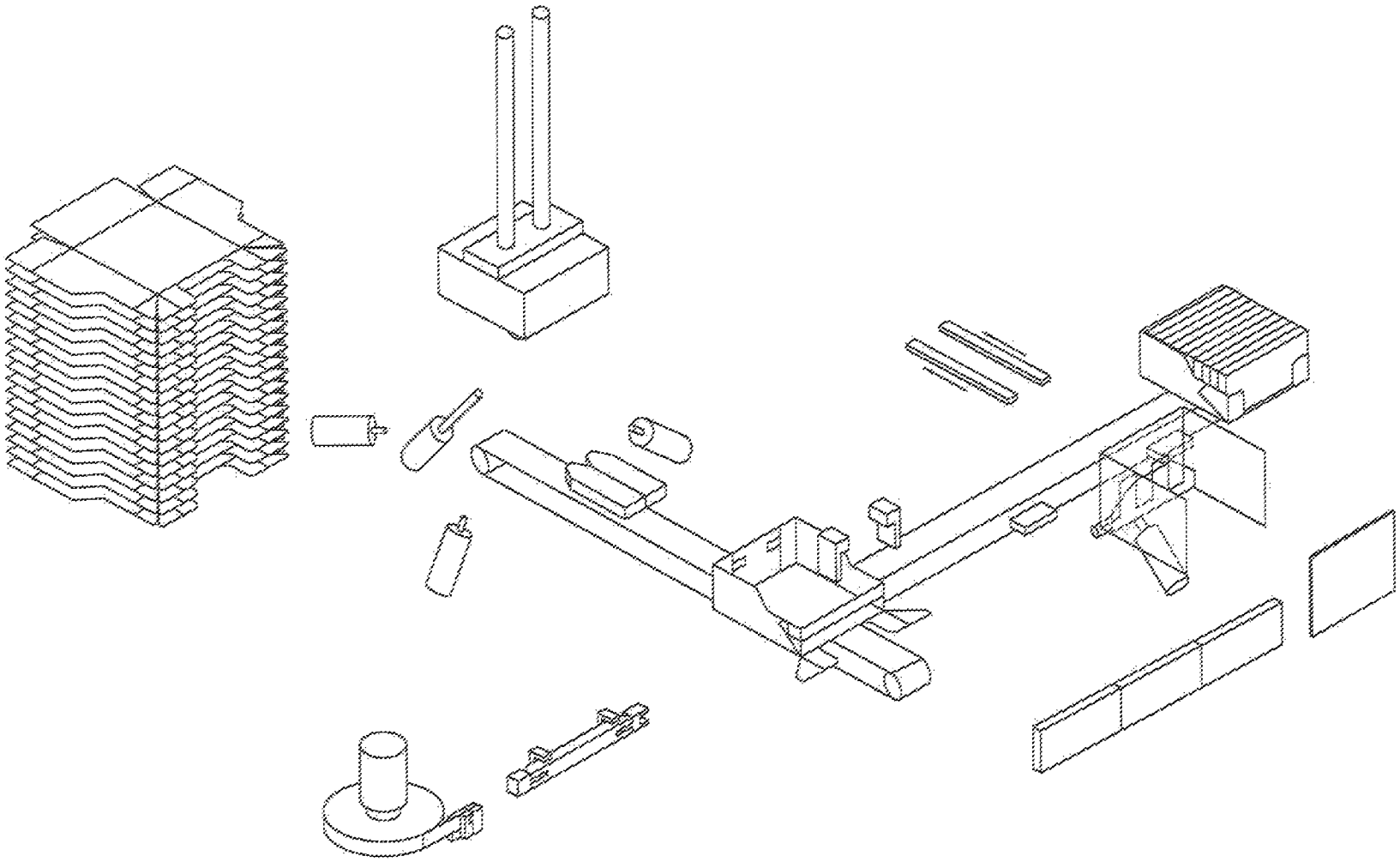

As before, this tension guide is inserted into the tray to establish pusher tension. However, these channels are positioned so that in this location they eclipse, either partially or totally, the slots 368 in the back wall 370 of the partially assembled product tray 366 (FIG. 81).

Once products have been side-loaded into the tray and the front flaps 356 have been folded up relative to the base of the tray, (or before this), two rods 376 are moved from behind the tray such that they are inserted through each of the slots 364 so that their ends do (or will) apply a slight positive pressure to the rearmost product in the tray.

Thus the rods locate above the pusher. As a result, upon withdrawal of the tension guide 372, the rods 376—due to their positioning directly above the pusher tape 326—prevent the pusher tape from being dragged in an upwards direction by the tension guide, which could otherwise potentially twist or displace the tape of the pusher so as to prevent it from functioning as intended.

Figure 86:
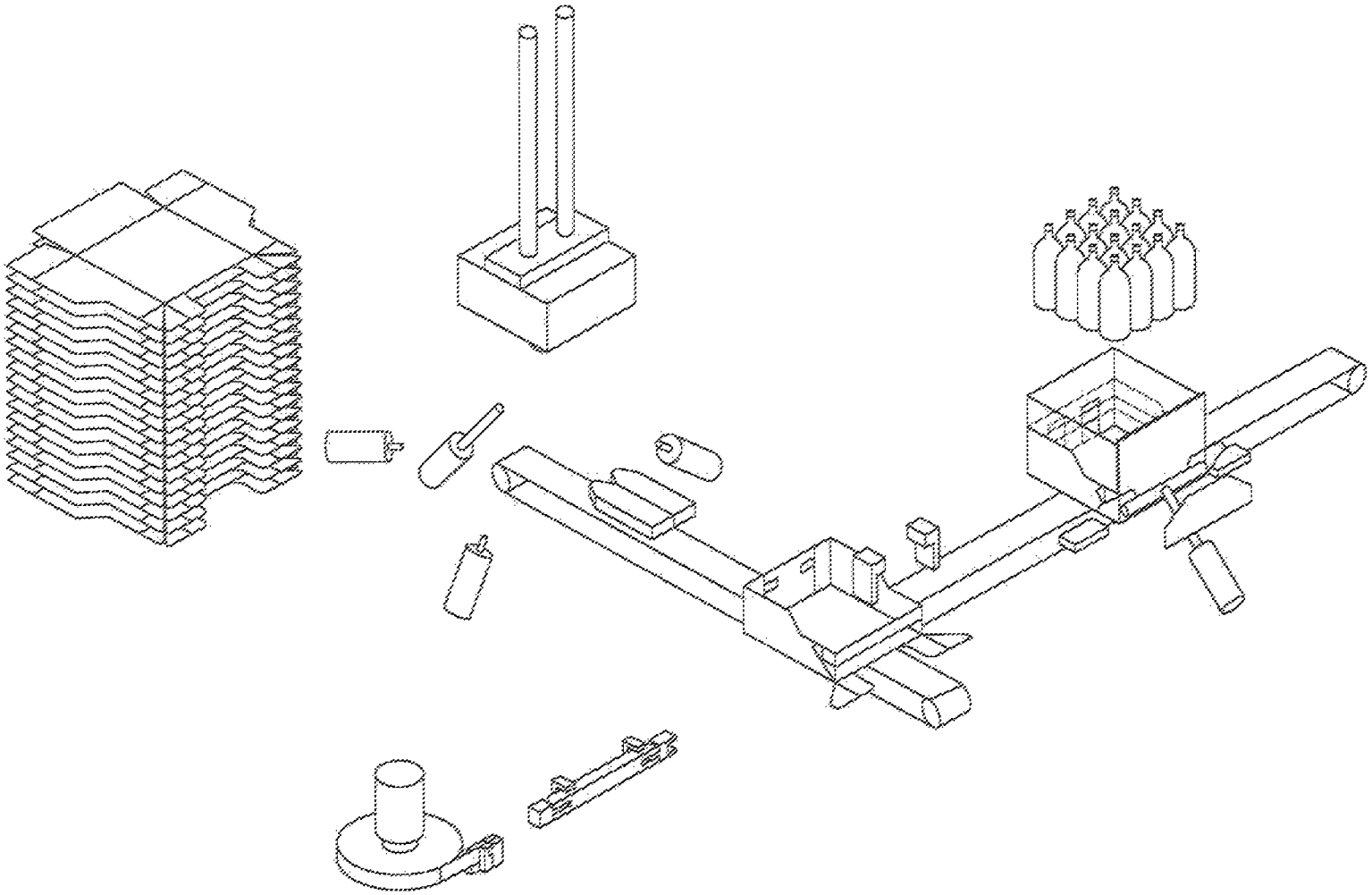
FIGS. 86 to 88 show a variant of the embodiment over FIGS. 80 to 85, but in which the products are top loaded.
Figure 87:
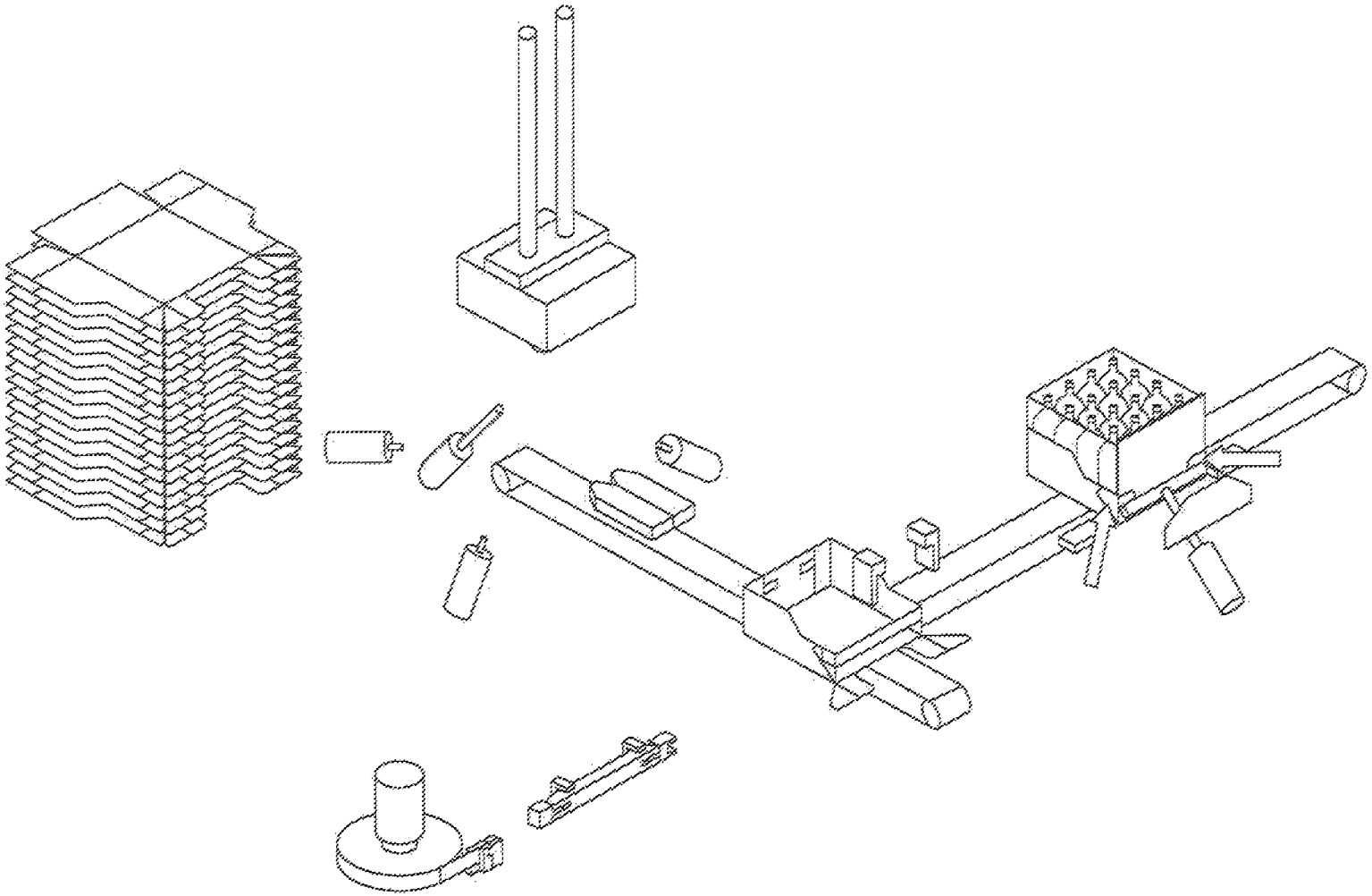
Figure 88:
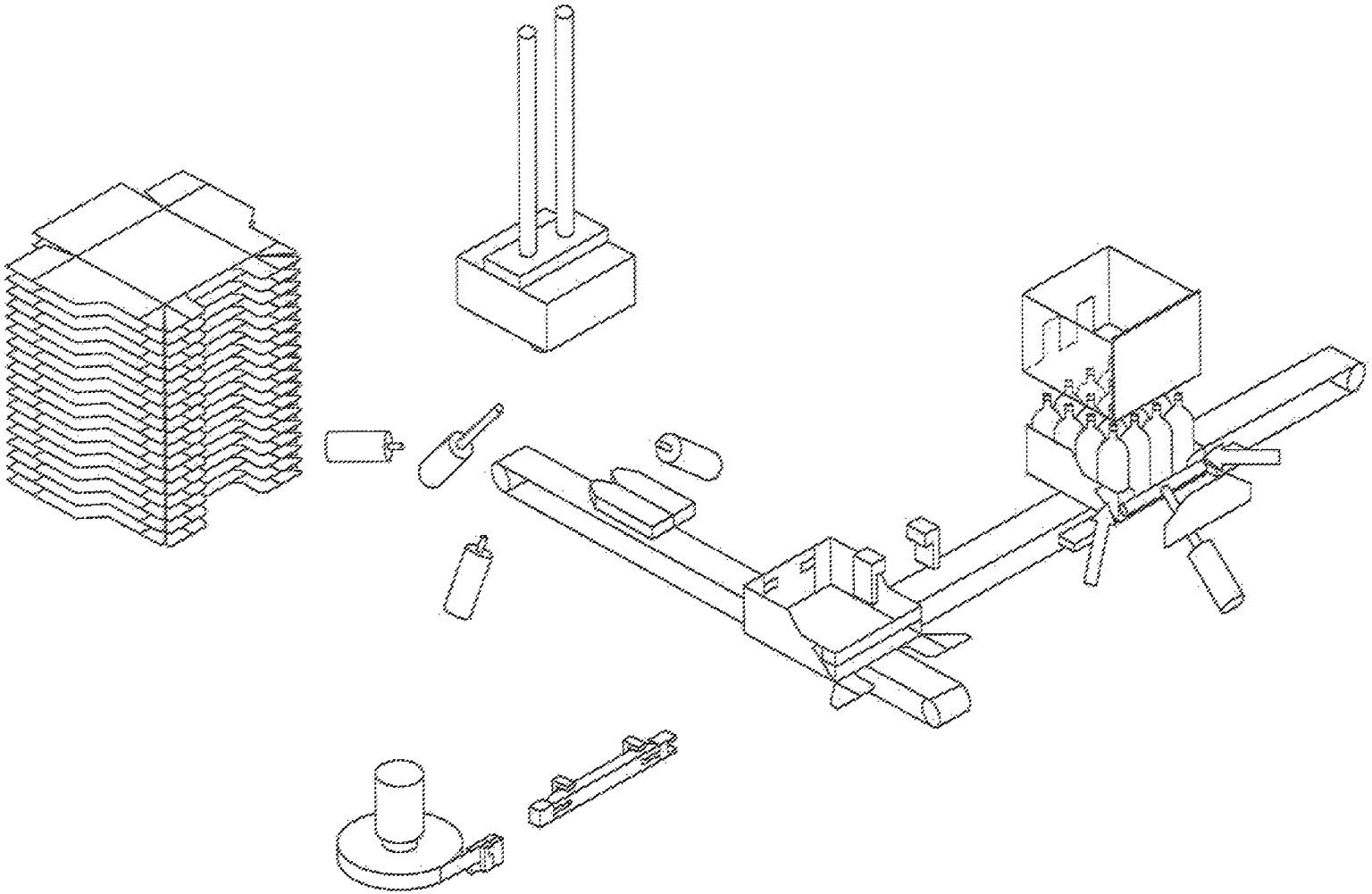
Figure 89:
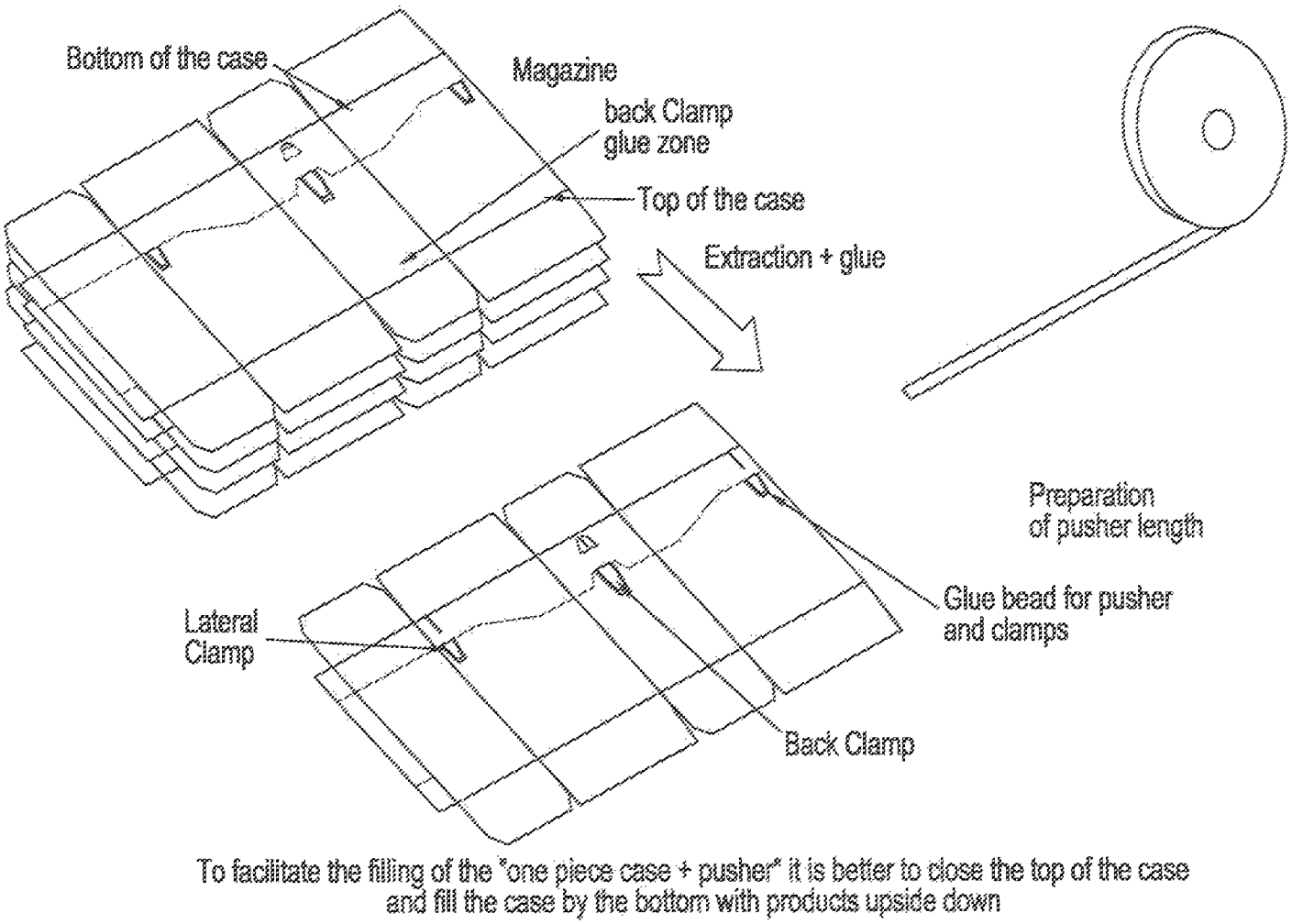
FIGS. 89 to 100 show a variant of the embodiment over FIGS. 40 to 50, using a U shaped device to expand a pusher tape or web.
Figure 90:
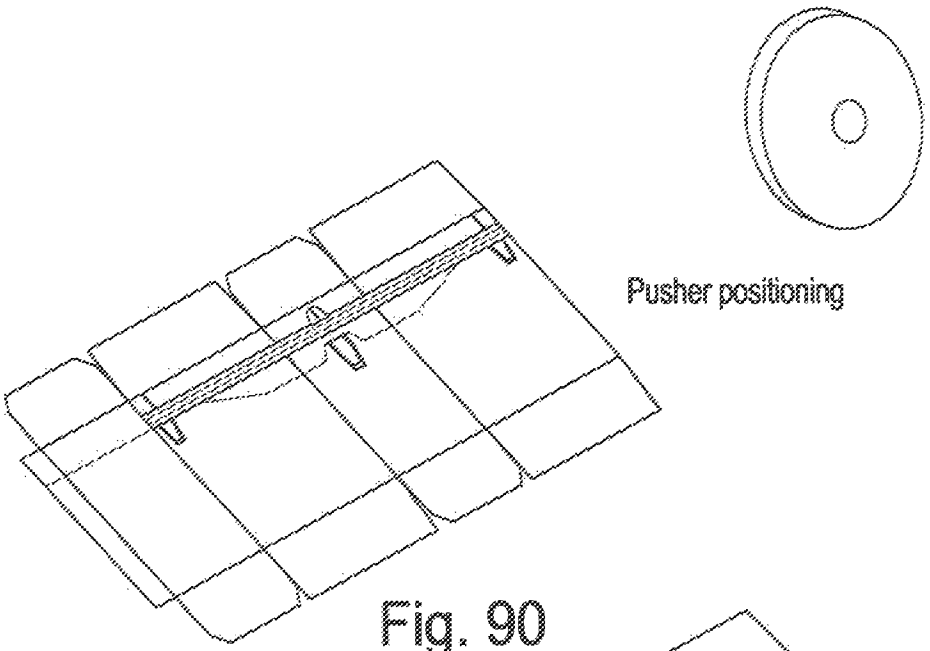
Figure 91:
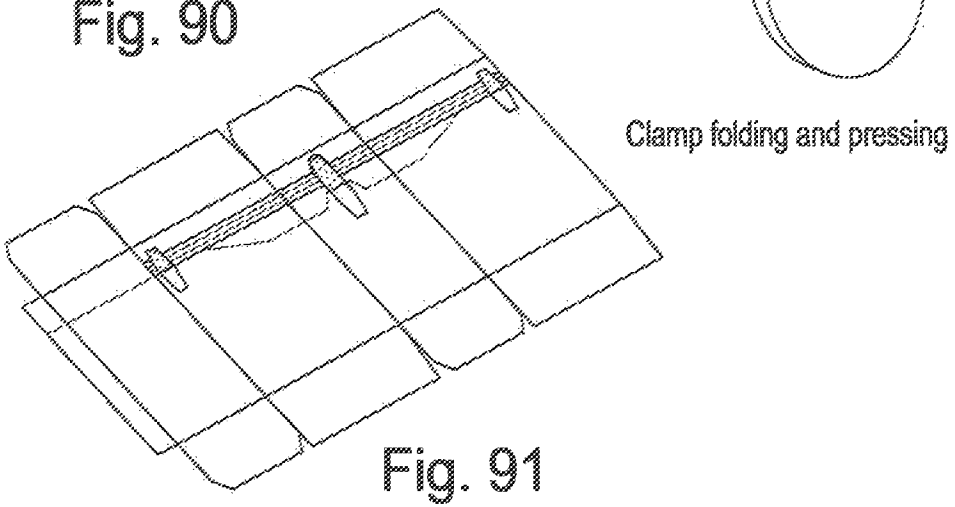

FIGS. 86 to 88 show an alternative arrangement to the embodiment shown in FIGS. 80 to 85 in which the products are top-loaded into the product tray, e.g. as per FIGS. 77 to 79.

Figure 92:
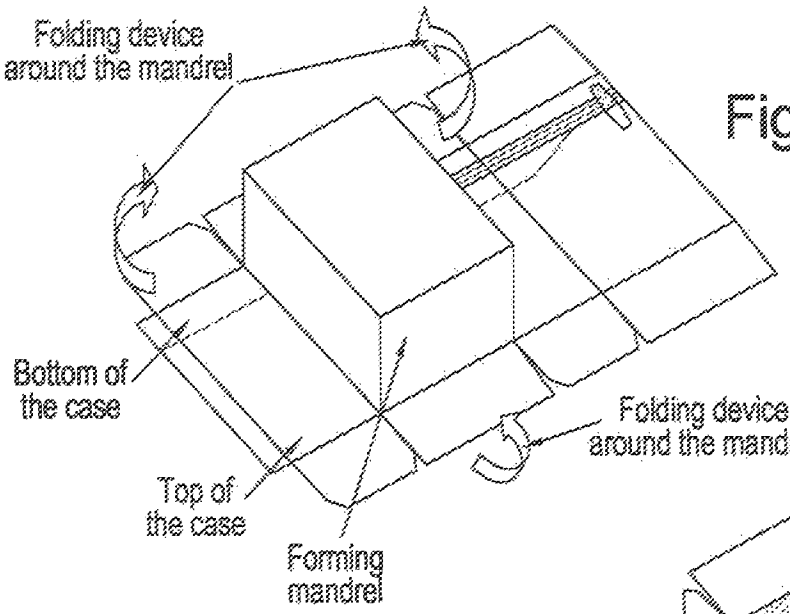
Figure 93:
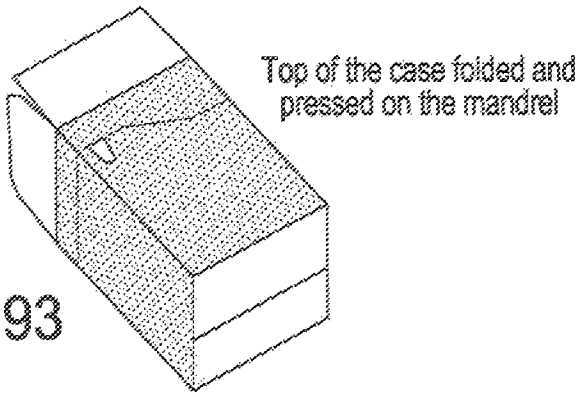
Figure 94:
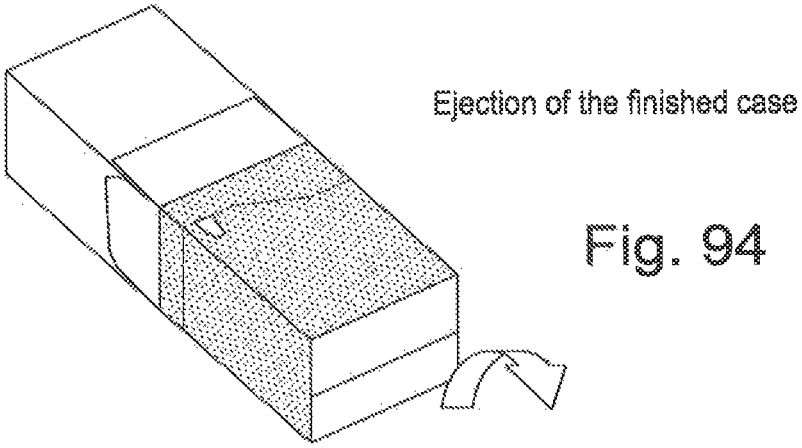
Figure 95:
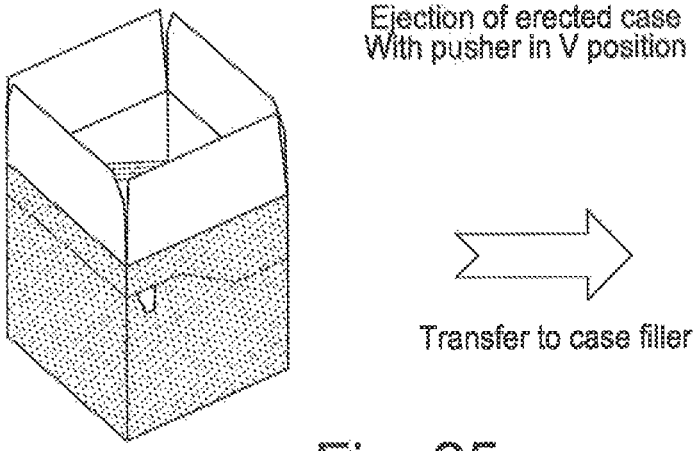

Referring next to FIGS. 89 to 100, they show a variant of the embodiment of FIGS. 40 to 50. The blanks are rotated 180° with respect to that earlier embodiment since in this embodiment the top of the case is closed and the case is filled via the bottom with the products upside down. The clamps, perforations and flaps are otherwise as before. However, FIG. 92 shows the mandrel for forming the general box shape. Here it is not hollow, and it is ejected (removed or extracted) after folding the sides and top of the case, but not the bottom. In this arrangement, the pusher is V shaped in section, when viewed from the bottom (i.e. through the top as shown in FIG. 95, which top will be the final bottom of the loaded tray. The box here is then transferred to a box filler.

Figure 96:
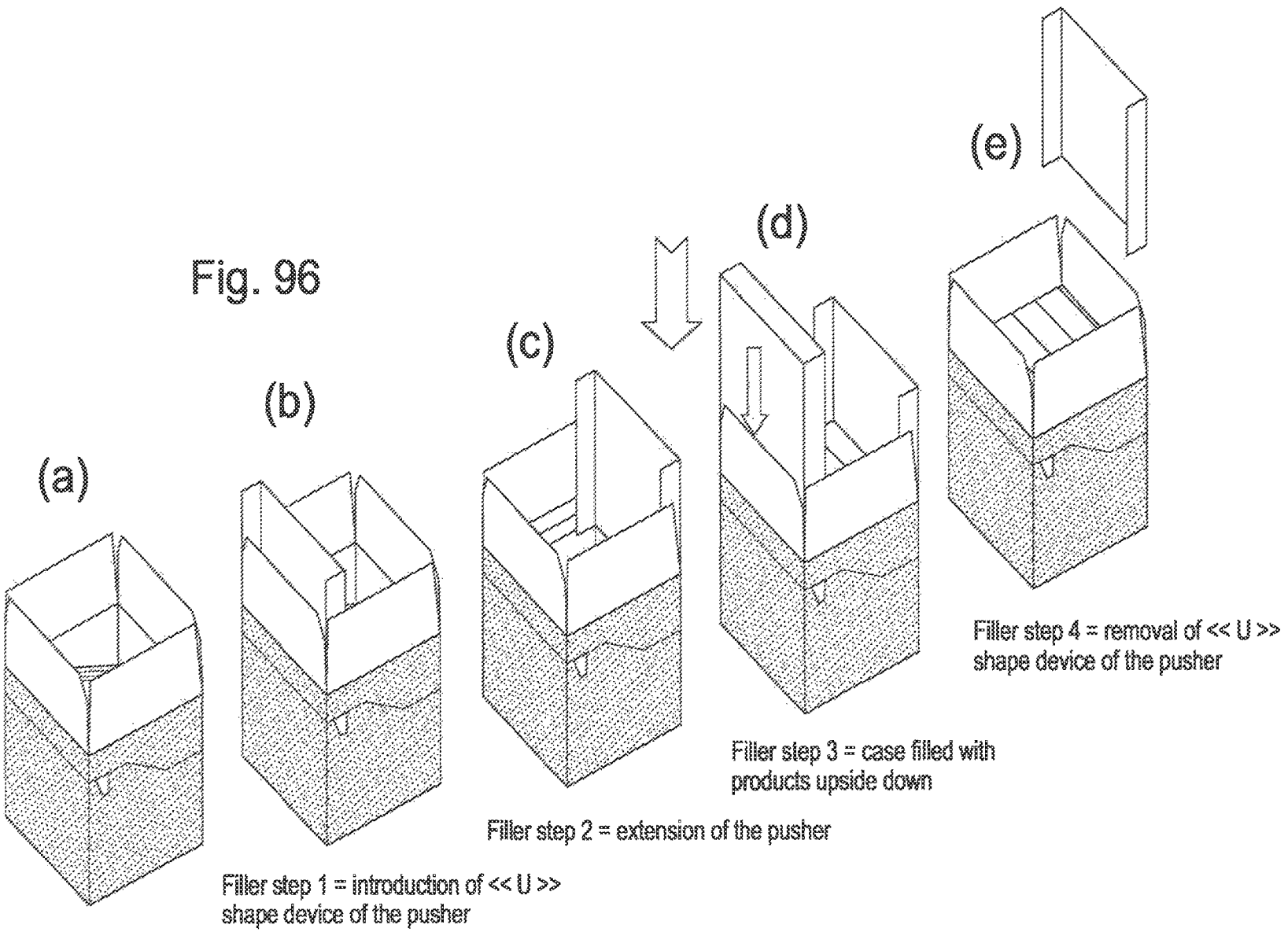
Figure 97:
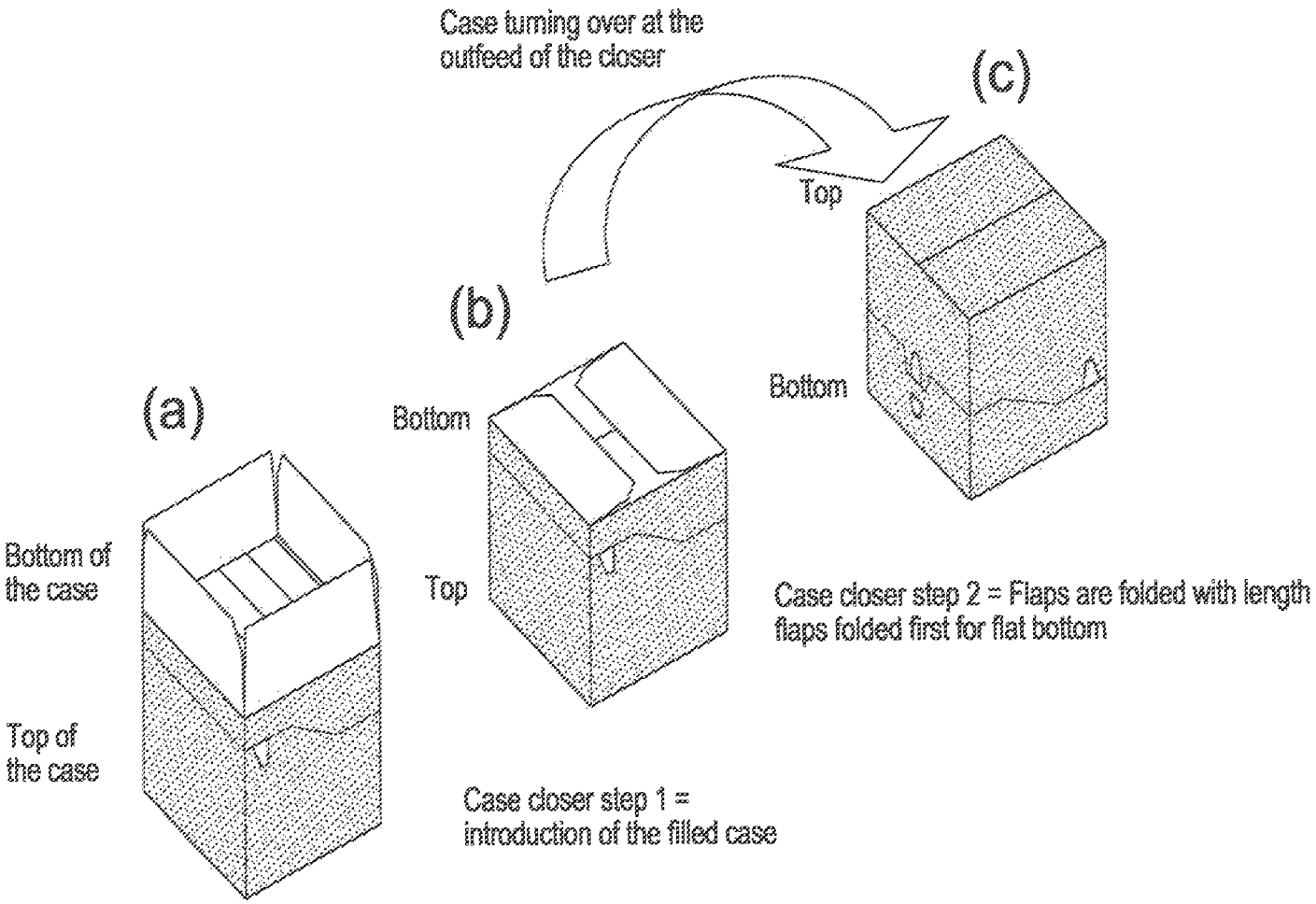
Figure 98:
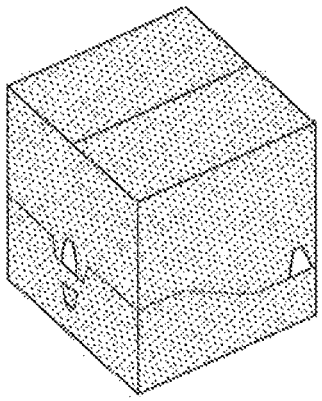

The processes of this preferred box filler is illustrated in FIG. 96. Step a) is where the open box is received. Step b) is where a U shaped device is used to expand the pusher tape or web by inserting it at the top of the V. The U shaped device then expands the pusher back towards the point of the V so as to form an open U shape in the pusher ready for receiving the products, as shown in step c). The products are then loaded or "stuffed" into the tray through the open bottom (top as shown in step d)) before the U shaped device is extracted in step e).

Figure 99:
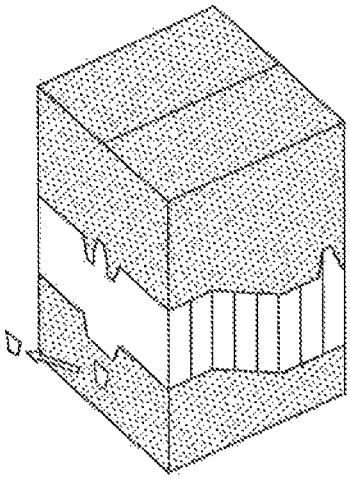
Figure 100:
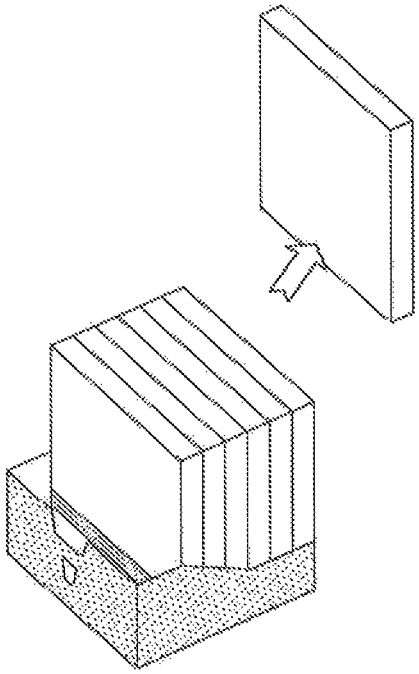
Figure 101:
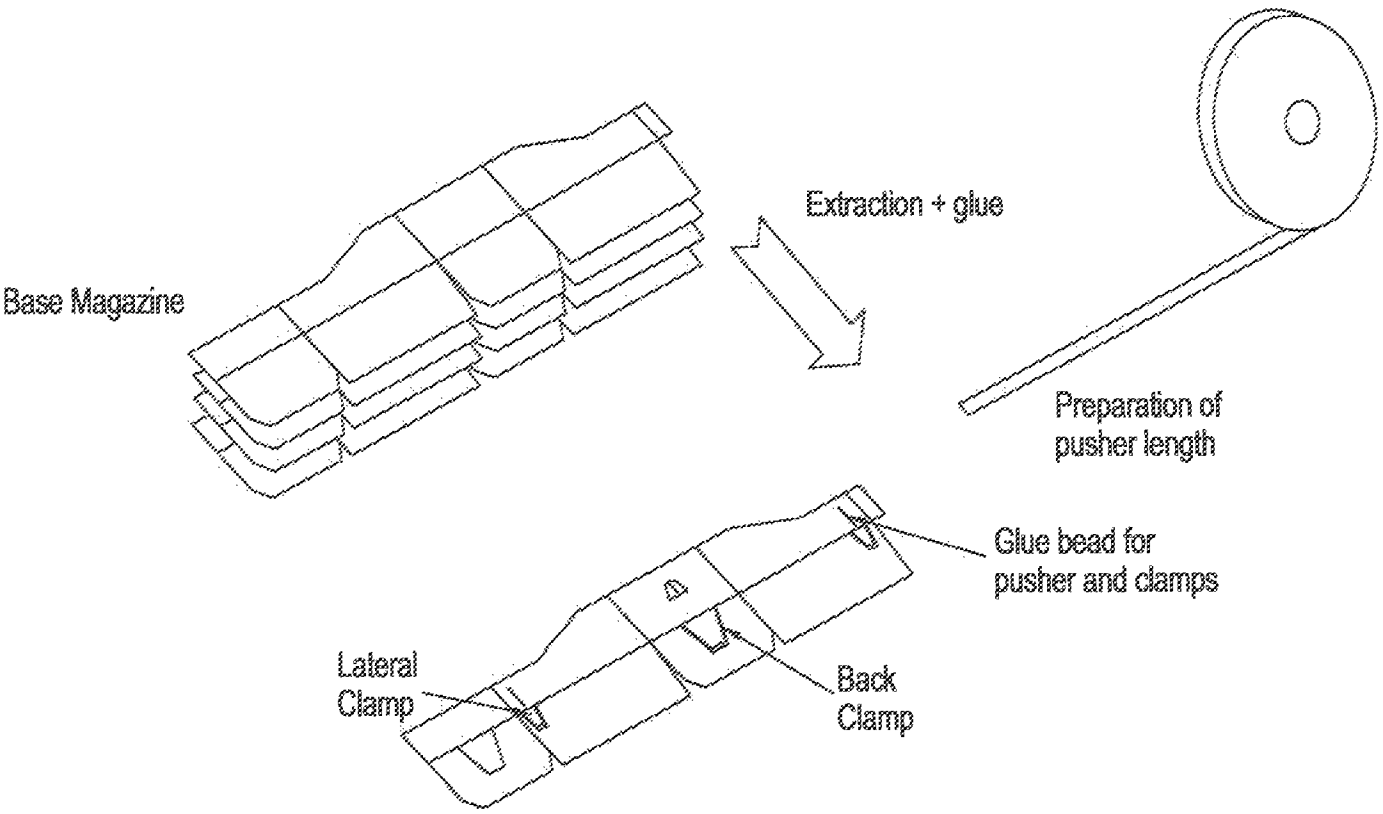
FIGS. 101 to 113 show a variant of the embodiment over FIG. 40 to 50, or 89 to 100, in which a lid is formed from a separate blank, and integrated into the folding/loading process.
Figures 102, 103, 104:
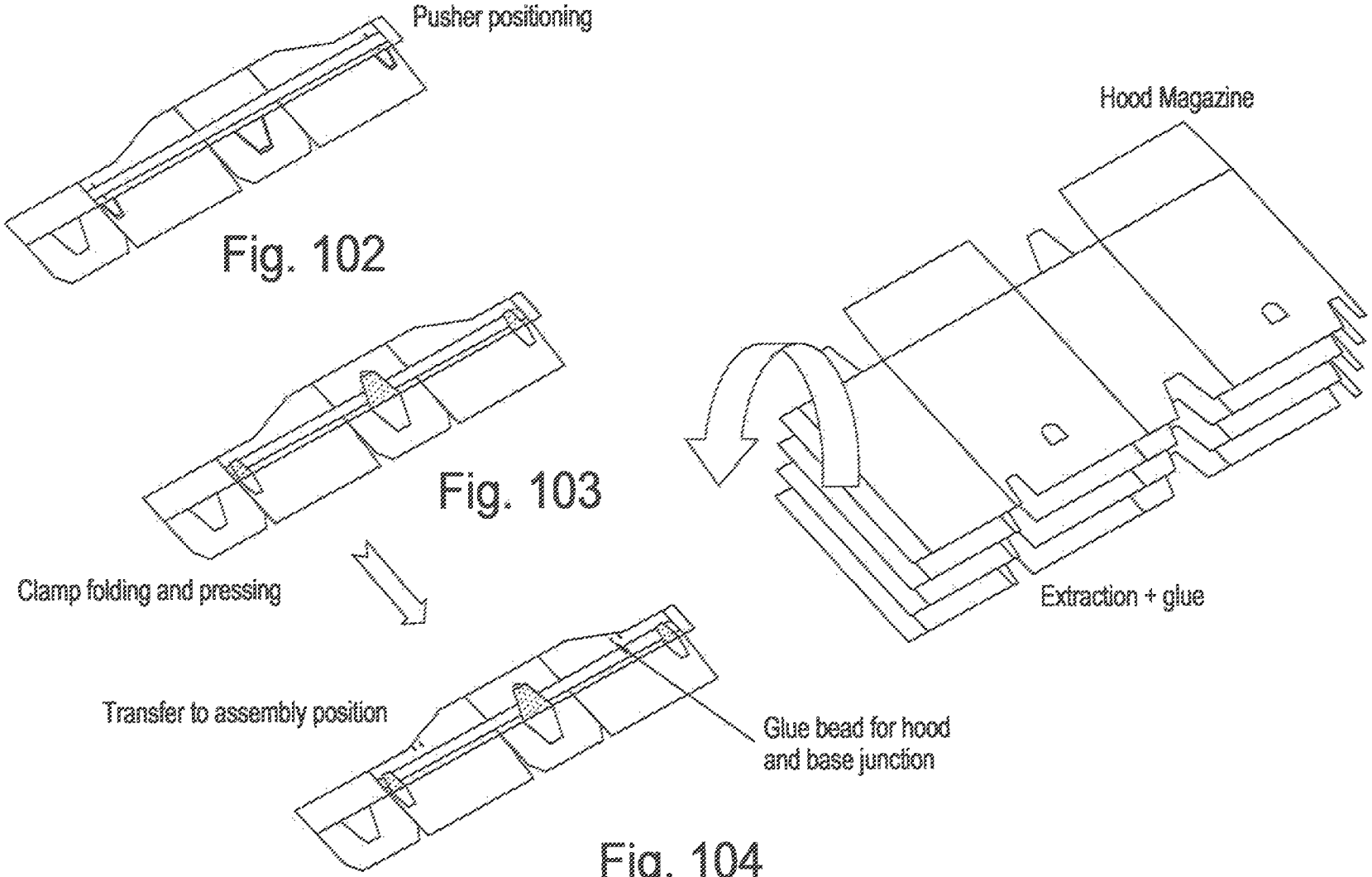

The loaded tray or box is then closed by folding the flaps at the bottom (top as shown) thereof. The flaps are glued down and the box is then rotated to put the bottom to the top as shown in FIG. 97*c* ready for shipping—FIG. 98. The box can be opened by perforating along the line between the tray and the lid, as shown in FIG. 99, and the tab can be removed to release the pusher. The products can then be removed by a customer as shown in FIG. 100, with the products automatically restacking towards the front of the tray—to the right in FIG. 100.

Figure 105:
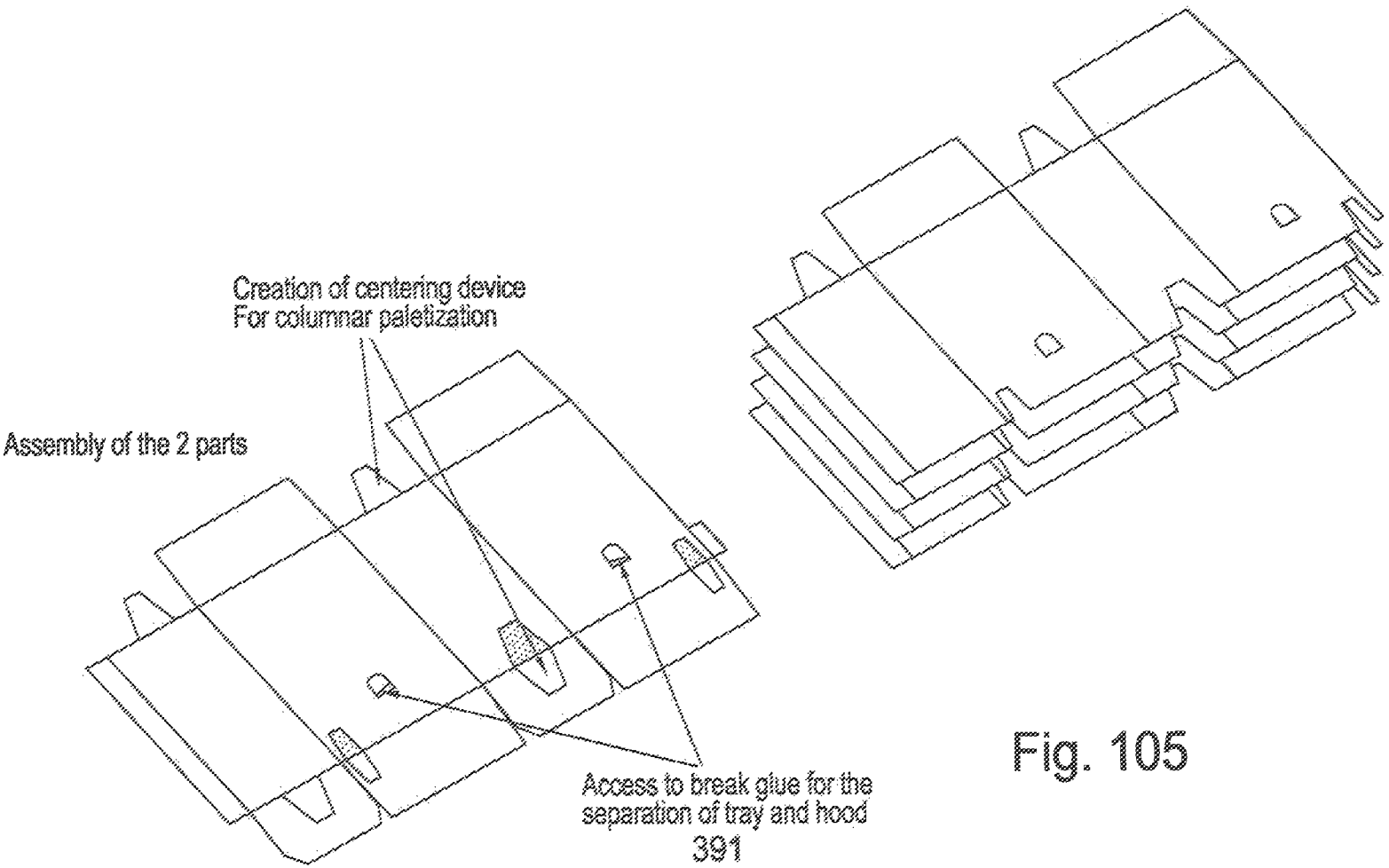
Figure 106:
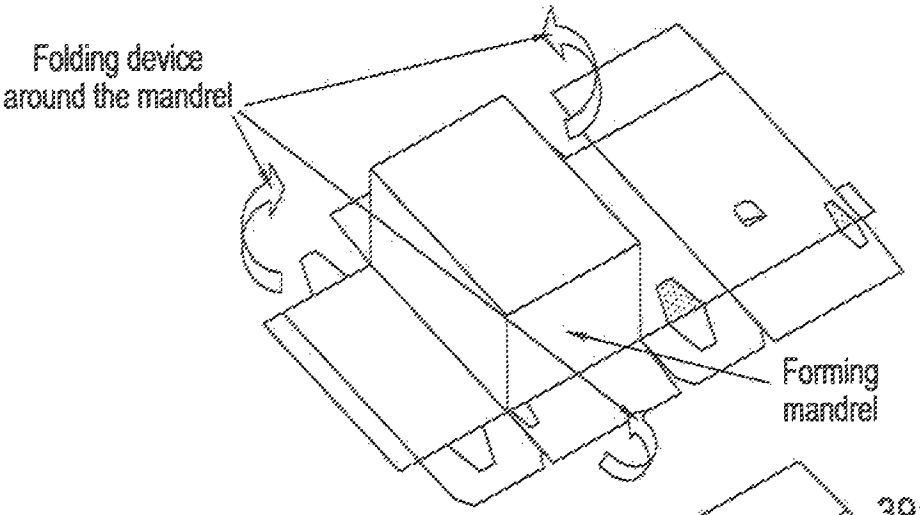
Figure 107:
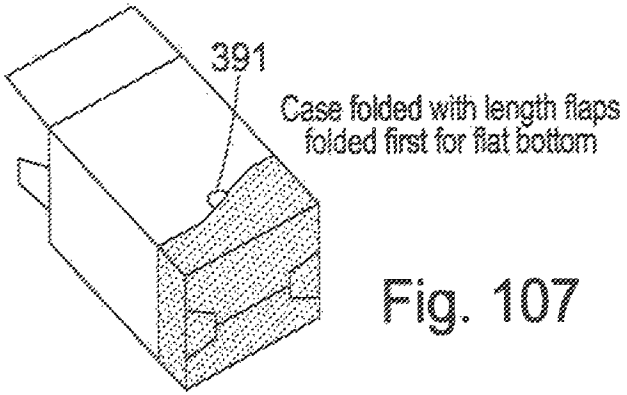
Figure 108:
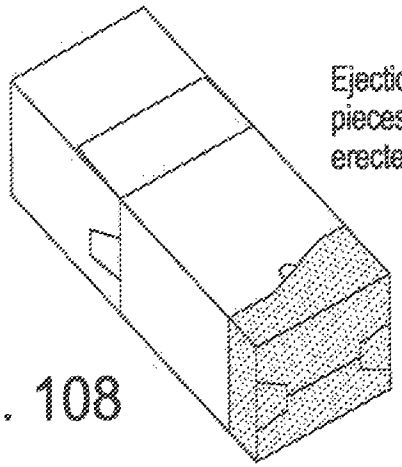
Figure 109:
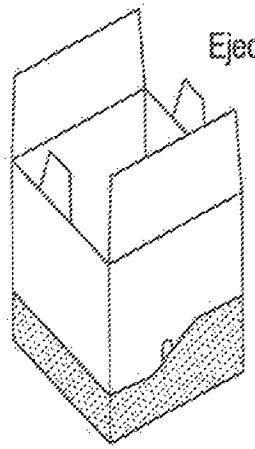
Figure 110:
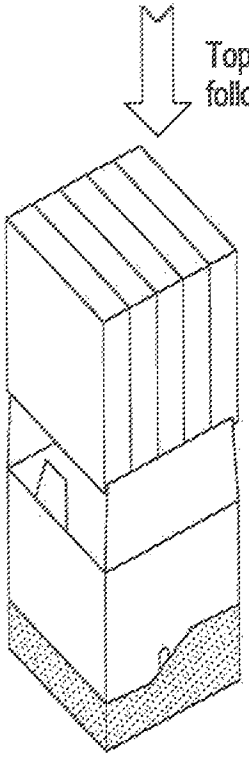
Figure 111:
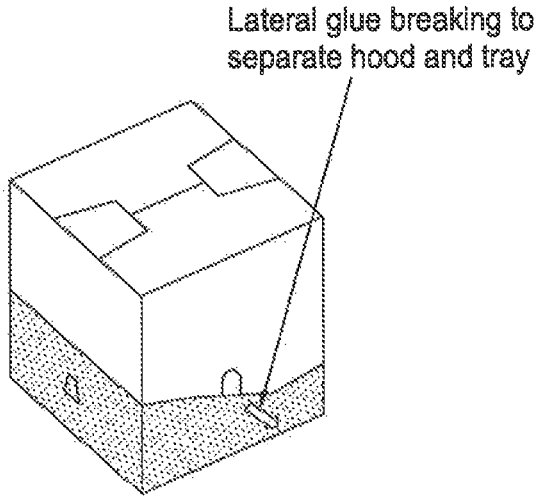
Figure 112:
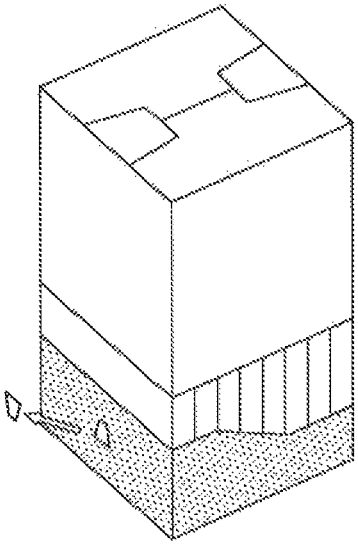
Figure 113:
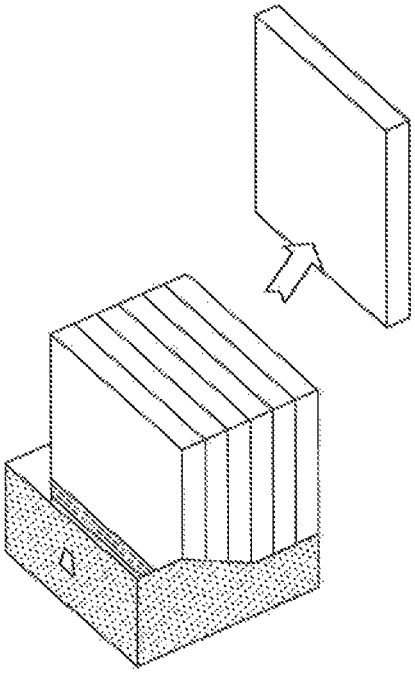

FIGS. 101 to 113 then show a variant of the embodiments of FIG. 40 to 50, or 89 to 100, in which a lid is formed from a separate blank, and integrated into the folding/loading process, as per FIGS. 51 to 63. Different to that of FIGS. 51 to 63, this embodiment has access ports 391, as shown in FIG. 105, for breaking the glue bond between the top and the tray.

The assembled pair of blanks (including a lid blank and a tray blank) are again folded around a mandrel, and the flaps form the depressions in the base of the tray as before—for controlled stacking of the finished articles. See FIG. 107 for the depressions. This figure also shows that the ports 391 in the lid blank are aligned with the edge of the tray in this part assembled condition (and later once fully assembled). This means that the port provides an easy means for grasping the edge of the tray relative to the side of the lid to allow any glue joint therebetween—provided for example by dabs of glue in the vicinity of those ports—to be readily broken. The glue may even be on the tabs, with the tabs being part cut and part perforated to allow them readily to be broken out of the wall of the lid, thus releasing the joint between the lid and the tray.

Referring next to FIGS. 114 to 129, a variant of the embodiment of FIGS. 13 to 21 is shown. This variant is similar to the embodiment of FIGS. 13 to 21 and thus the following description will concentrate mostly on the more pertinent differences.

Figure 114:
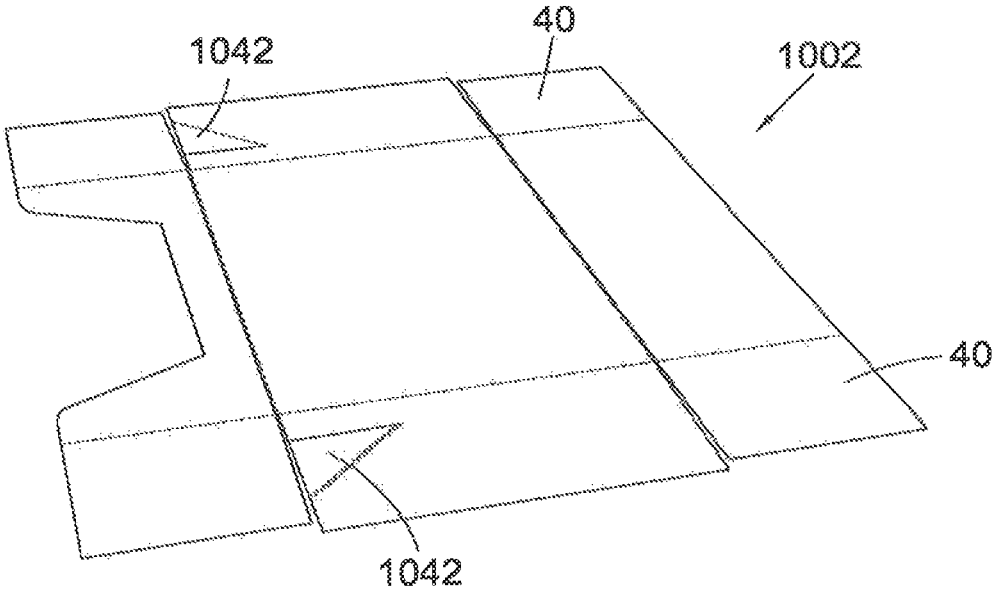
FIGS. 114 to 129 show a variant of the embodiment of FIGS. 13 to 21, but in which the flaps are folded inwardly and backwards from the sides, at an angle.

Again, a tray 20 is provided and FIG. 114 shows a blank 1002 for forming that tray 20. A blank 1001 corresponding to the lid 1062 of the tray 20 is also provided. See FIGS. 124 and 126. As with the embodiment of FIGS. 13 to 21, the pusher 44 takes the form of a web of resilient material. According to this variant, the pusher 44 is glued or otherwise attached to the blank 1002 before it is assembled into the tray 20. See FIG. 115. This may occur at the blank manufacturing facility, or later—e.g. it may be done by the end user of the blank (e.g. on a packing line at a later 'Product Manufacturing Company'). As with the other embodiments, the resilient material might be provided from a roll of such material by an automated applying machine and gluer.

Figure 115:
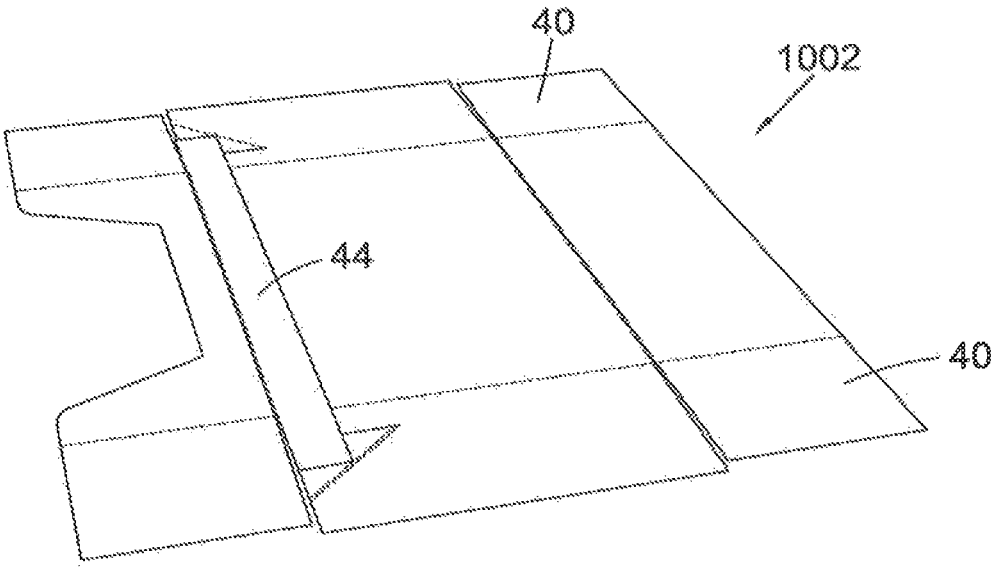

FIG. 114 shows the basic blank 1002, whereas FIG. 115 shows the blank 1002 with the pusher 44 applied thereto. It is applied onto the blank 1002 such that its ends overlie two foldable flaps 1042, each having a 45° angular crease, and which flaps are integral to the side walls 1003*a* and 1003*b*. The tray 20 can then be assembled.

Figure 116:
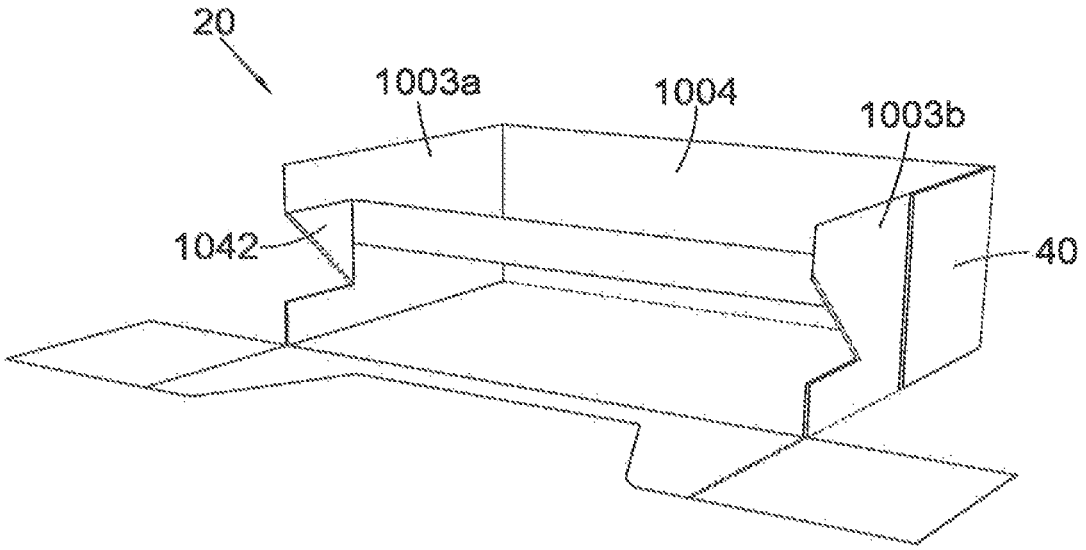

Referring to FIG. 116, there is shown the tray in a partially assembled configuration, with the side walls 1003*a* and 1003*b* and back wall 1004 folded upright and glued at their jointing tabs 40. The front of the tray 20 is not yet assembled. However, the pusher 44 that is attached to the flaps 1042 has been folded inwardly, upwardly and backwards by folding the flaps about their angled crease. This takes the flaps out of plane with the side walls 1003*a, b*, but they are folded back to be parallel thereto and facing thereagainst.

Because the flaps 1042 are foldable along crease lines that are 45 degrees to respective edges of the tray 20 between the side walls 1003*a, b* and the base 1005 of the tray 20, this folding brings the pusher into an upright configuration, i.e. perpendicular to the base of the tray, whereas it was applied to the blank in an orientation that was parallel to the base of the tray.

As the flaps 1042 are integral to the side walls 1003*a, b*, the lines along which the flaps 1042 are foldable are within the respective planes of the side walls 1003*a, b*. FIGS. 114 and 115 show that the provision of the lines at 45 degrees means that, when the flaps are folded inwardly and backwards from the position shown in FIG. 114, the orientation of the pusher 44 is changed. Specifically, the pusher 44 moves from being disposed substantially in a horizontal plane to being disposed substantially in a vertical plane.

Figure 117:
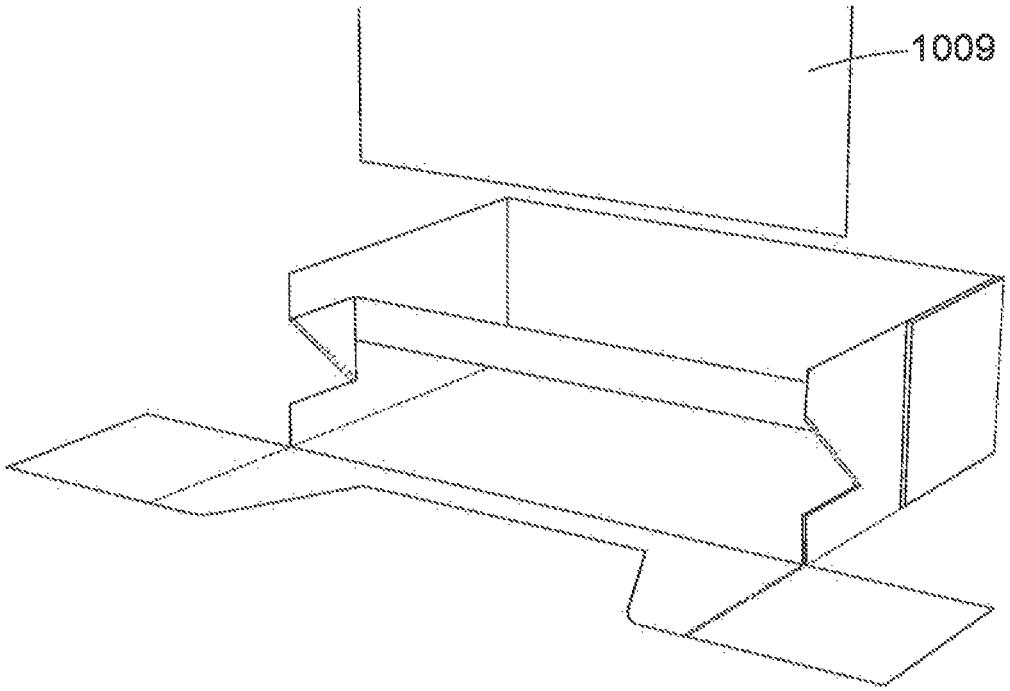
Figure 118:
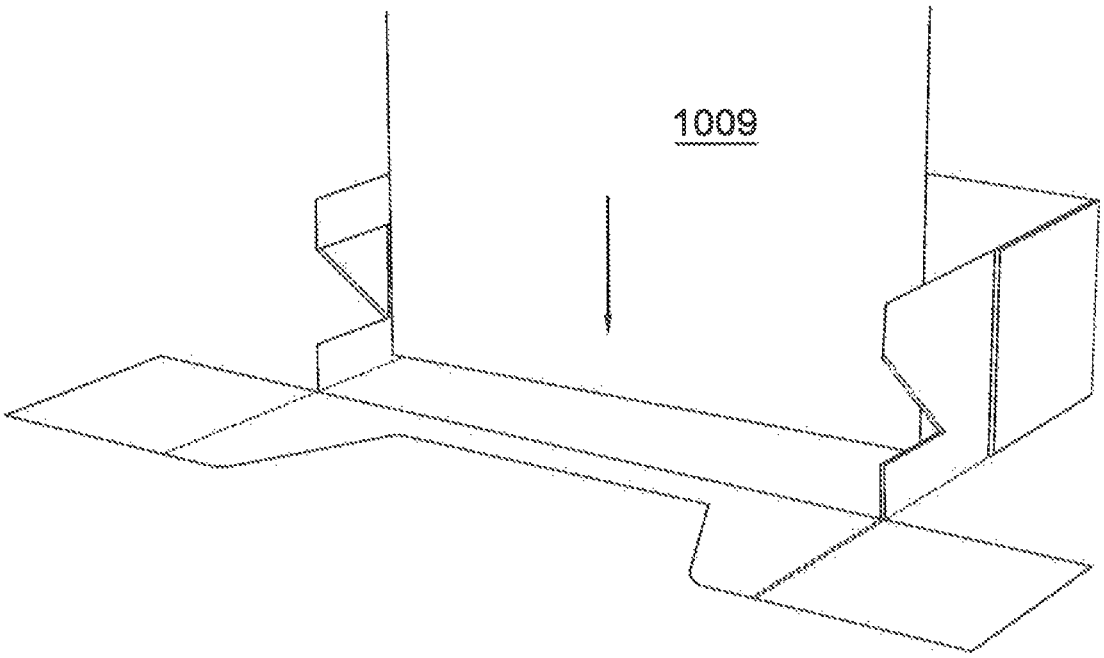
Figure 119:
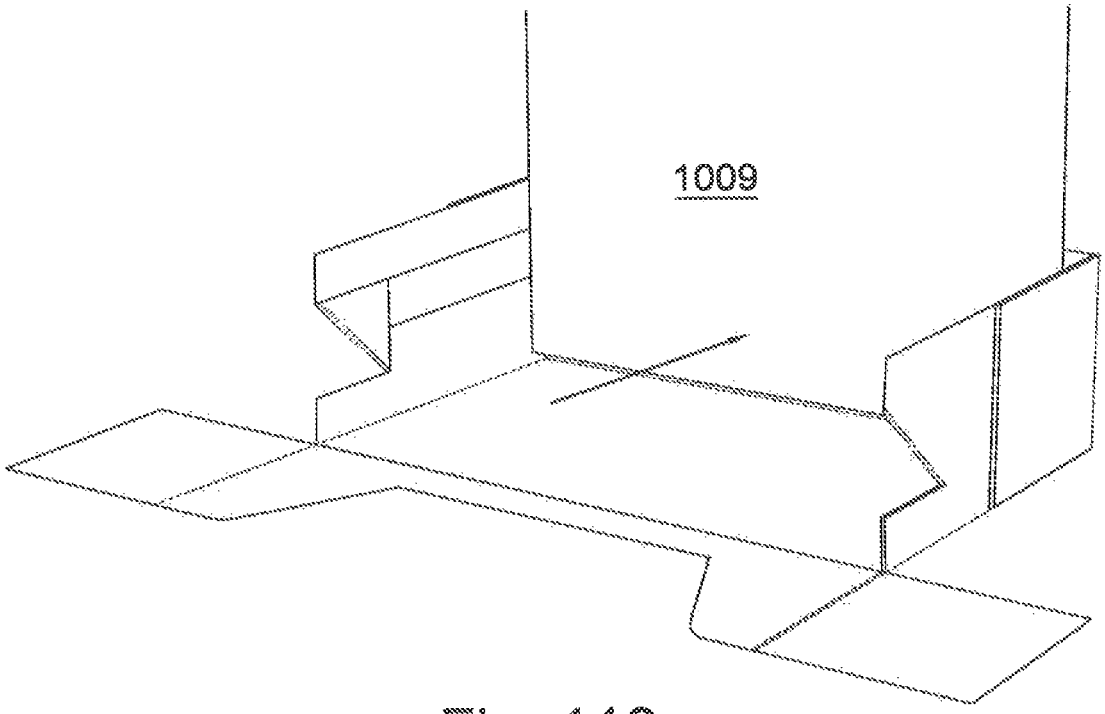
Figure 120:
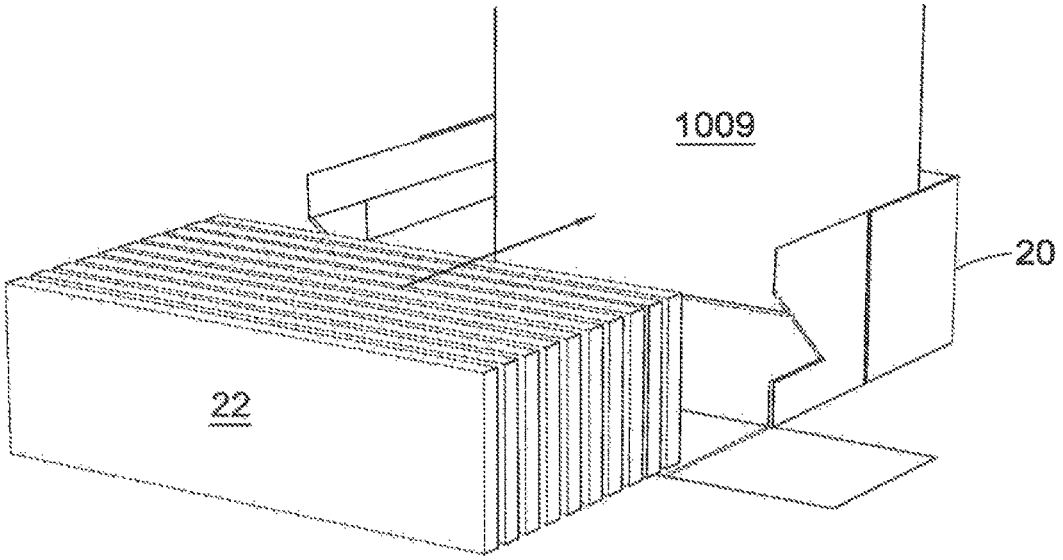
Figure 121:
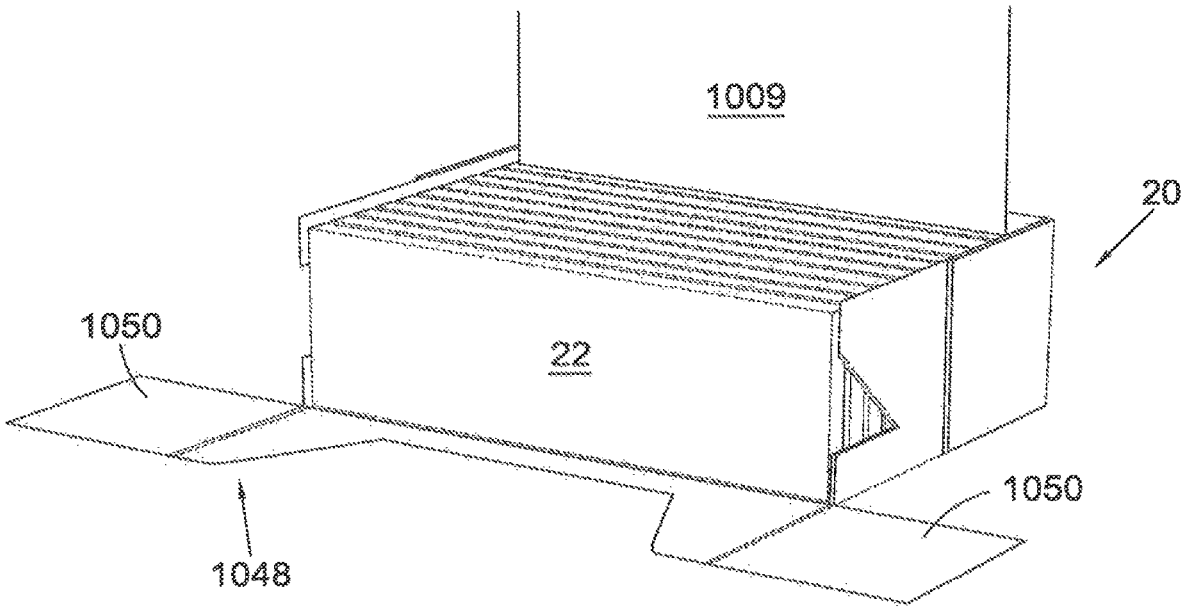
Figure 122:
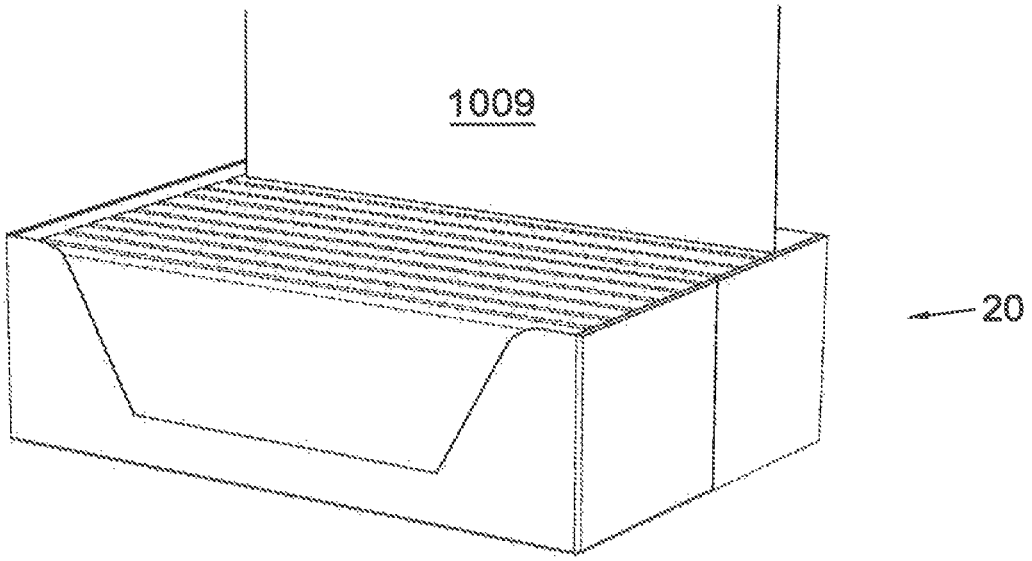
Figure 123:
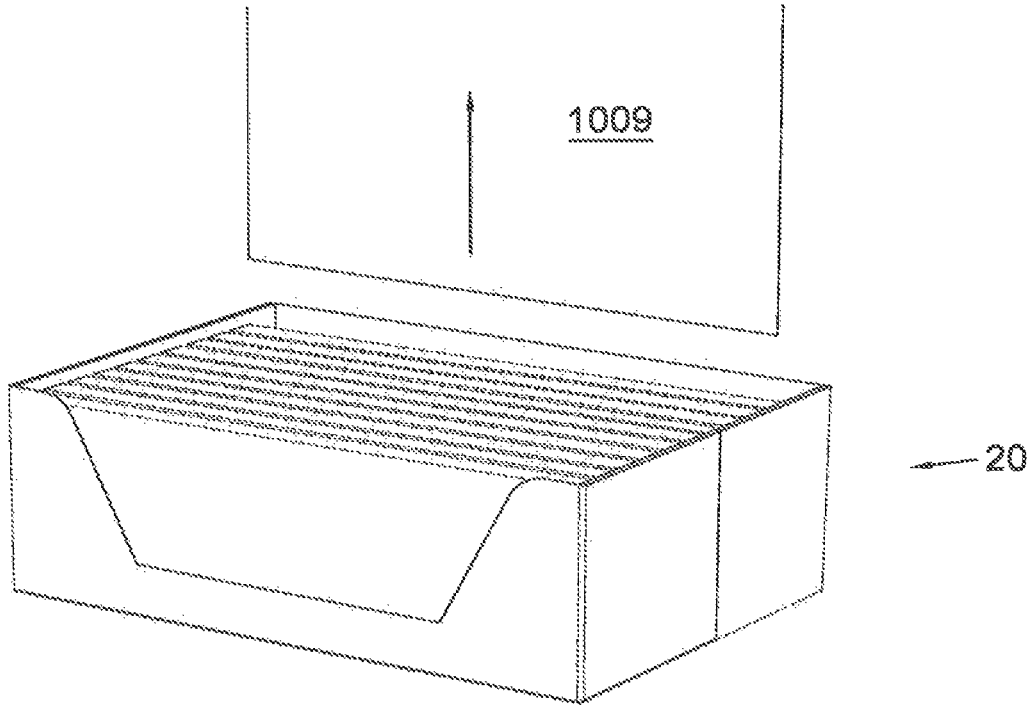
Figure 181:
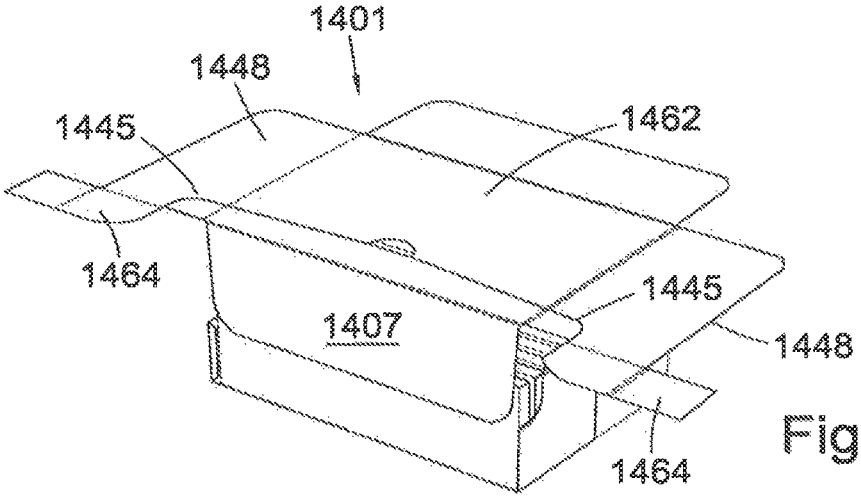
Figure 182:
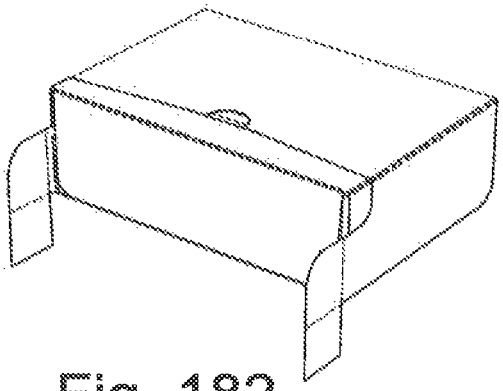
Figure 183:
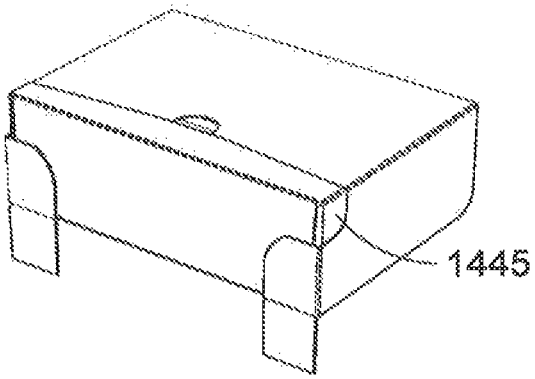
Figure 184:
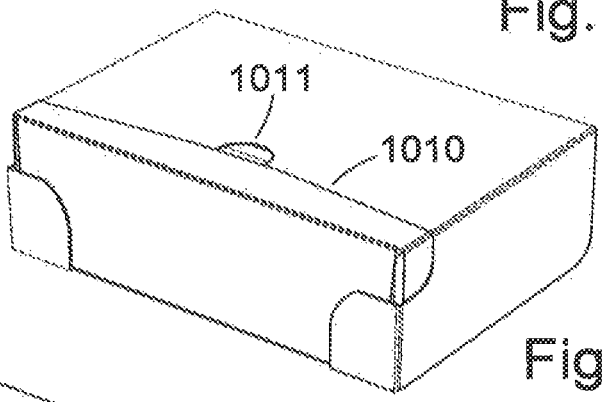
Figure 185:
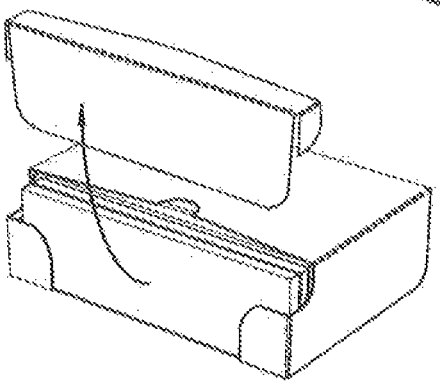
Figure 186:
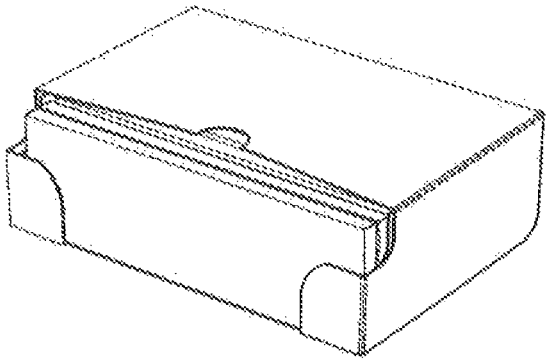

Products 22 can then be pushed into the tray 20 so as to stretch the resilient, highly elastic tape that forms the pusher 44, whereupon the tape or web extends around the back of, including around the left and right sides of, the products 22. In this variant, and the variants of FIGS. 123 to 181, "left" and "right" refers to the sides when viewed from the front of the tray 20. Thus the tape or web extends between the side wall 1003*a* and the left hand side of the products 22, and the side wall 1003*b* and the right hand side of the products 22. The front flaps 1048 can then be folded up relative to the base 1005 of the tray so as to retain the products 22 within the tray 20. However, according to the illustrated process, an automated machine is used for loading such that instead the machine draws back the web/pusher, as shown in FIGS. 117 to 119, prior to insertion of the products—FIGS. 120 and 121. This process involves the use of a packing plate 1009 which can be dropped down in front of the pusher 44 and then be used to draw back the pusher 44 to the back wall of the tray. At that time, products 22 can be front loaded (FIG. 120) into the tray 20, or top loaded if preferred. The front of the tray is then folded and glued in place (FIG. 122) by folding up the front flap 1048 and then folding the sides 1050 of the front flaps 1048 backwards and attaching them to the sides walls 1003*a, b* of the tray. This then secures the products 22 within the tray 20 and the packing plate 1009 can then be extracted upwardly out of the tray 20 (FIG. 123). The lid can then be formed over the top.

Figure 124:
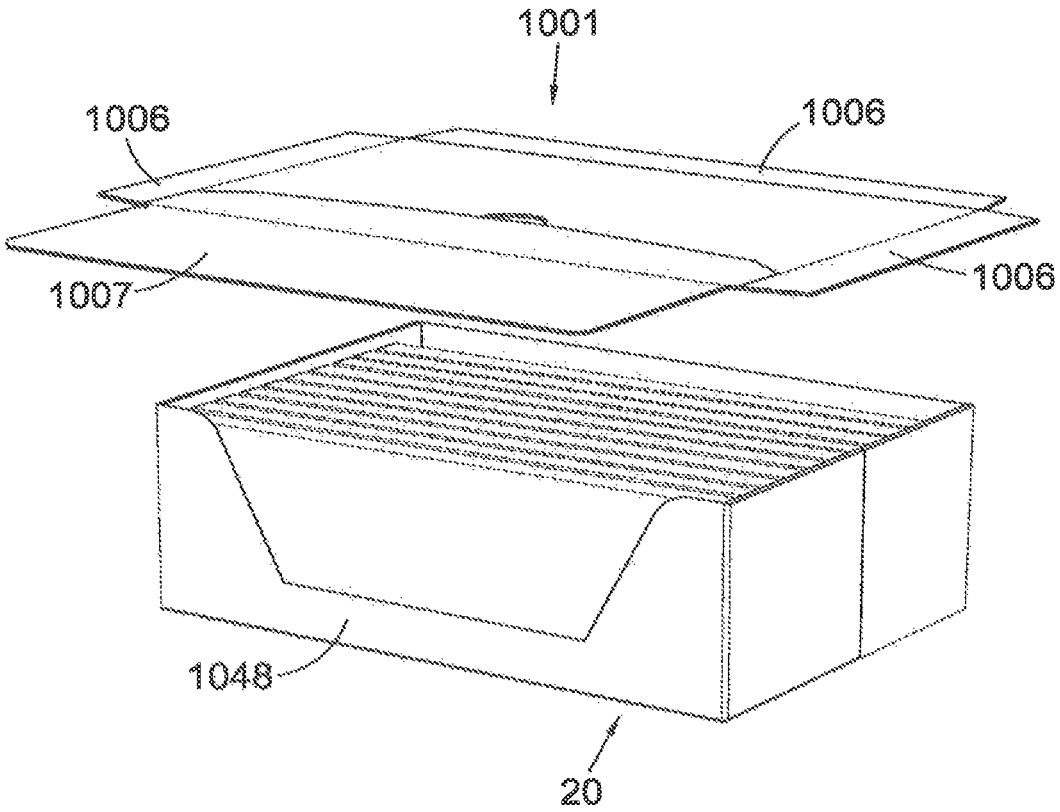
Figure 125:
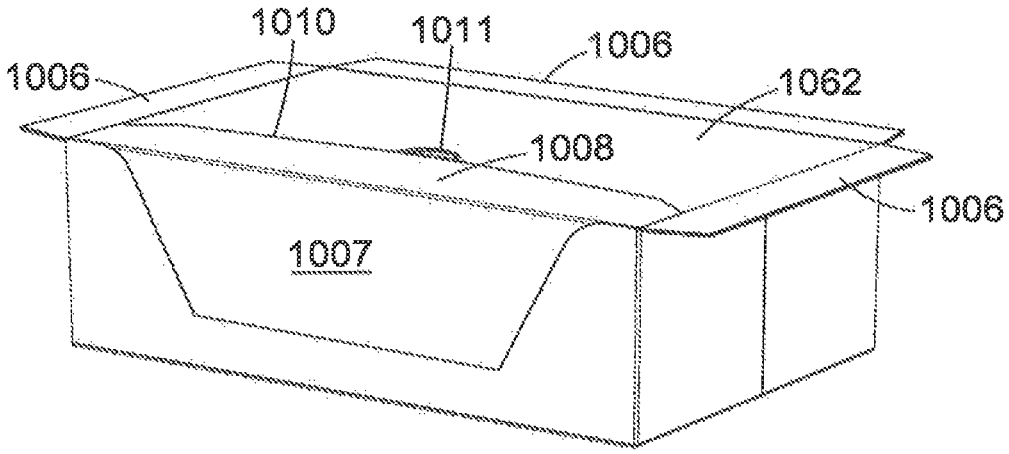

As shown in FIGS. 124 and 125, the blank 1001 for the top is folded so that a front flap 1007 can be received behind the front flaps 1048 and tabs 1006 can be received outside the side walls 1003*a, b* and the back wall 1004. The front flap 1007 is integral to portion 1008, which in turn is attached along a perforated line 1010 to the front of the lid 1062. A finger cut-out 1011 can also be provided to facilitate a removal of the front flap and portion 1008 when the closed box wants to be opened. That opening occurs by breaking apart the top about the perforated line, as will be discussed below.

Figure 126:
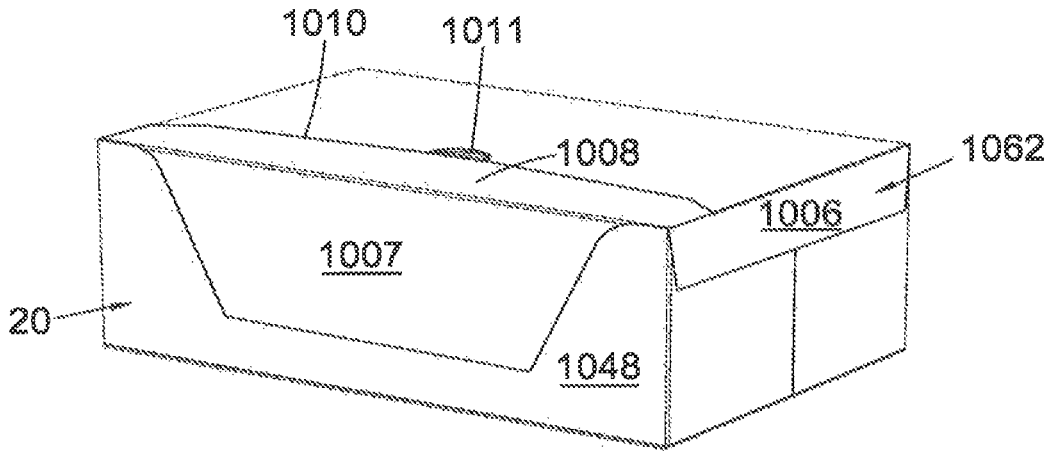
Figure 127:
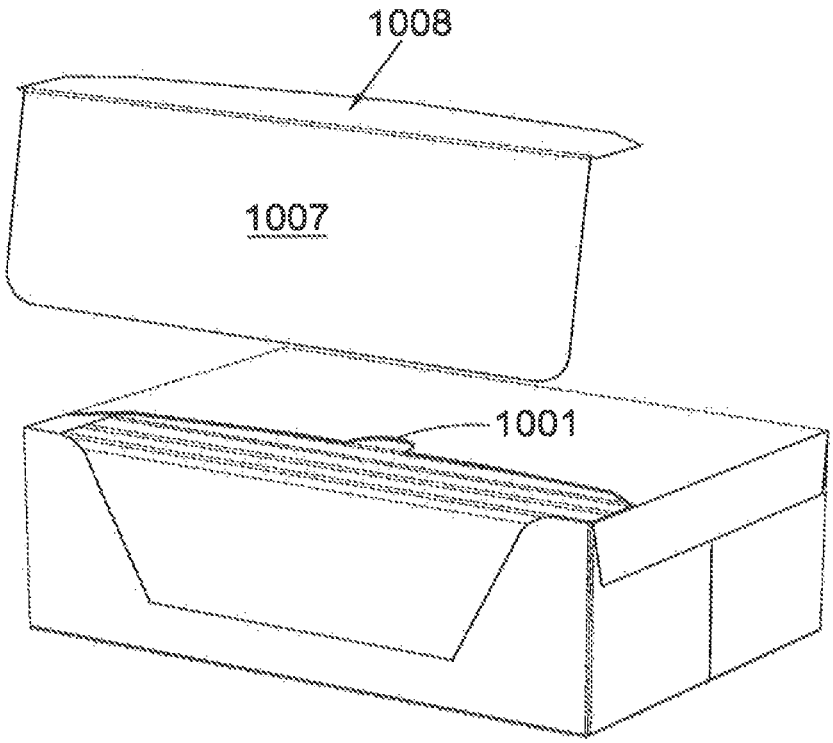
Figure 128:
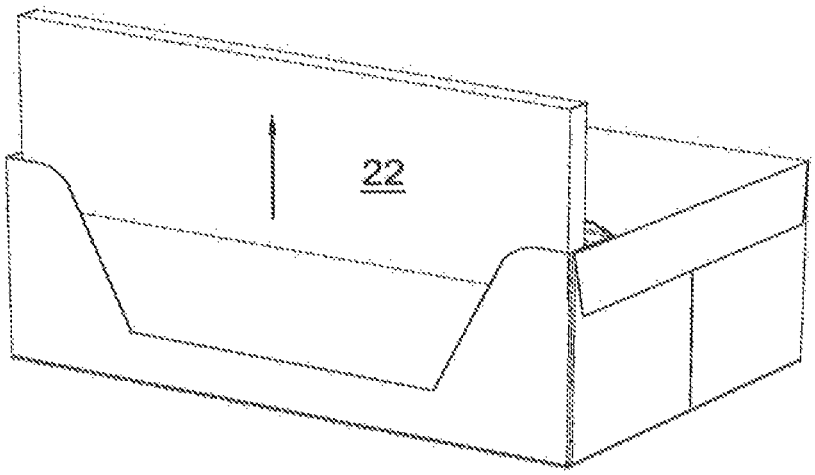
Figure 129:
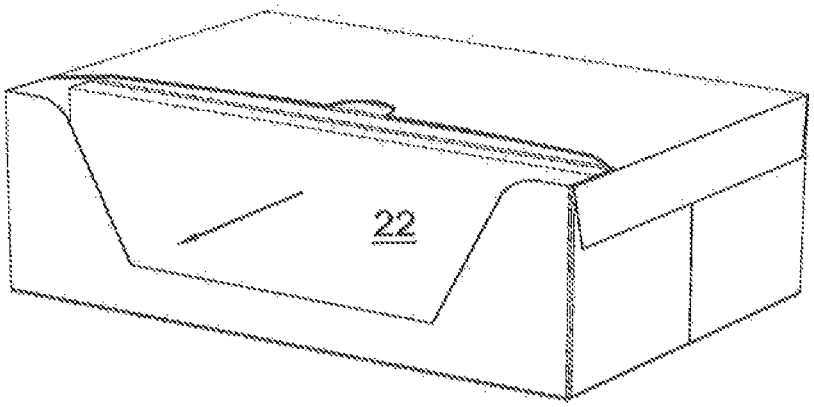

FIG. 126 shows one of the tabs 1006 glued in position and the front flap 1007 received behind the front flap 1048. Portion 1008, and front flap 1007, can then be detached from the rest of the lid 1062 along the perforated line 1010 to reveal the products 22, as shown in FIG. 127. This then allows the front most product 22 to be removed from the box by lifting it out of the front of the box, as shown in FIG. 128, and the pusher then biases the remaining products towards a forwards position, thus self-stacking the foremost remaining product 22 to the front of the tray 20, as shown in FIG. 129.

Referring next to FIGS. 130 to 146, a further variant of the embodiment of FIGS. 13 to 21 is shown.

Figure 130:
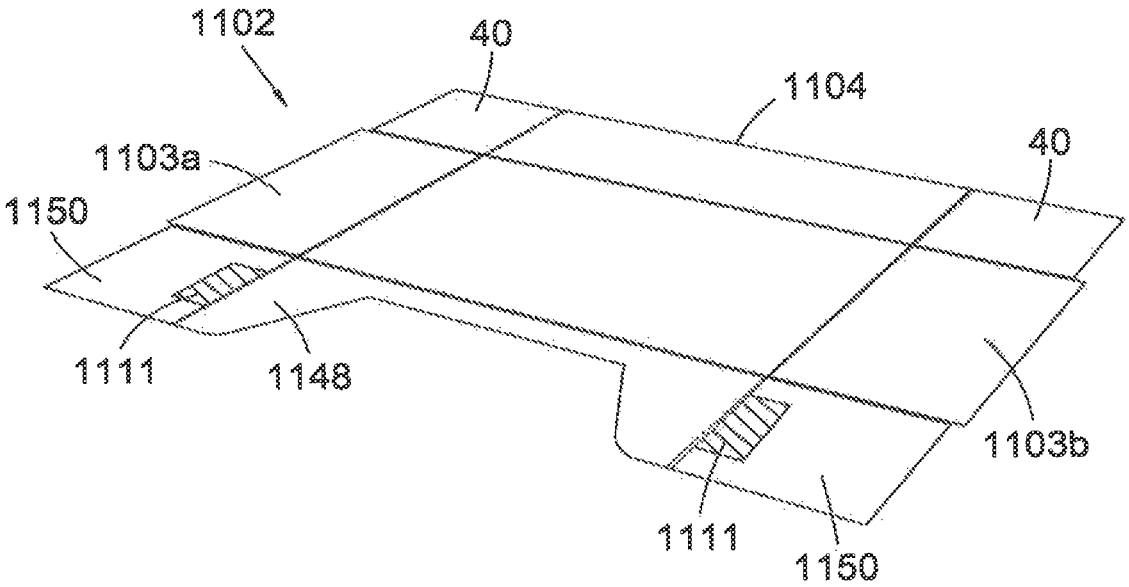
FIGS. 130 to 146 show a variant of the embodiment of FIGS. 13 to 21, but in which the folded flaps to which the ends of the elasticated tape are attached are integral to the front of the tray.
Figure 131:
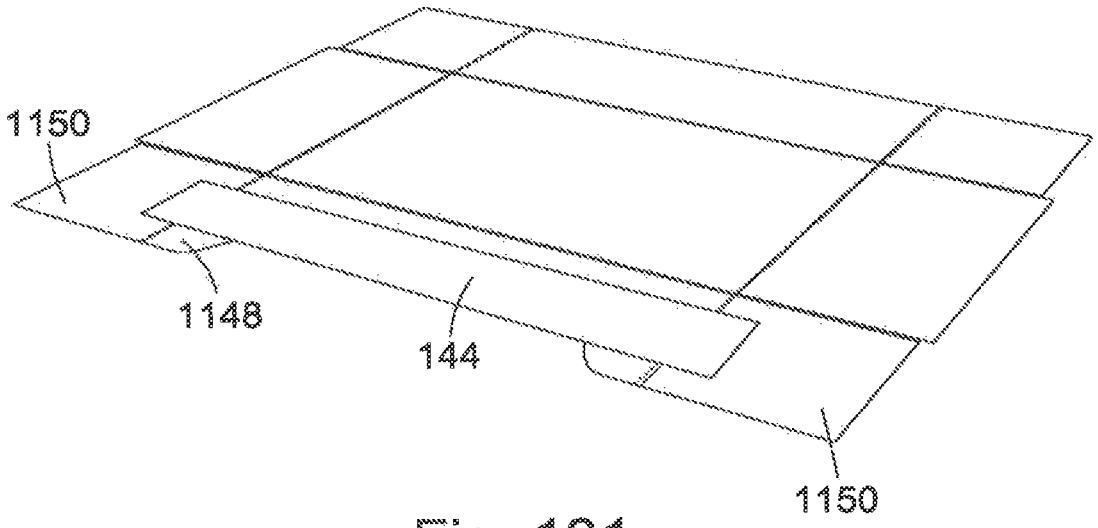

Again, a tray 20 is provided and FIG. 130 shows a blank 1102 for forming that tray 20. As with the embodiment of FIGS. 13 to 21, the pusher 44 takes the form of a web of resilient material. According to this variant, the pusher 44 is glued or otherwise attached to the blank 1102 before it is assembled into the tray 20. It is attached to the front flap, as shown in FIG. 131, with glue in this example at the areas shown by the shading 1111 in FIG. 130. The pusher 44 is thus attached to the blank 1102 of the tray 20 by being attached to sides 1150 of the front flaps 1148 such that it extends across the front flap 1148 bridging two sides thereof, and extending across a dropped front of the eventual tray, as provided for improving visibility of the products therein. The previous embodiment likewise had the pusher 44 in a similar position, albeit displaced rearwardly from the front of the tray by the length of the folded tabs 1042.

Figure 132:
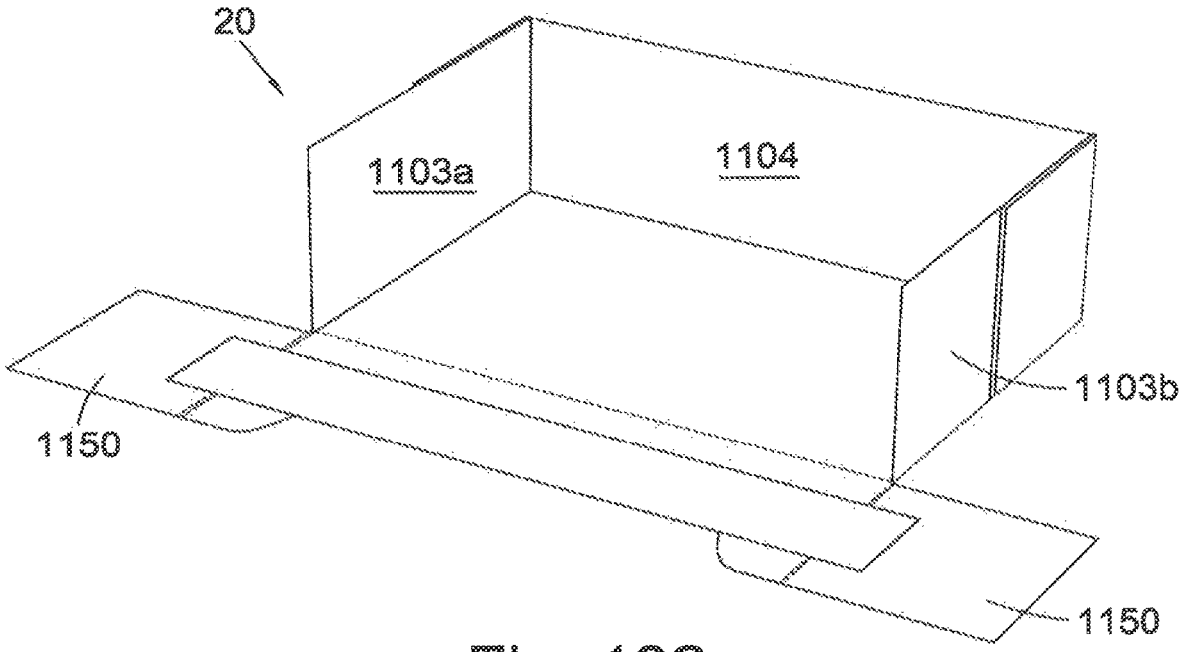
Figure 133:
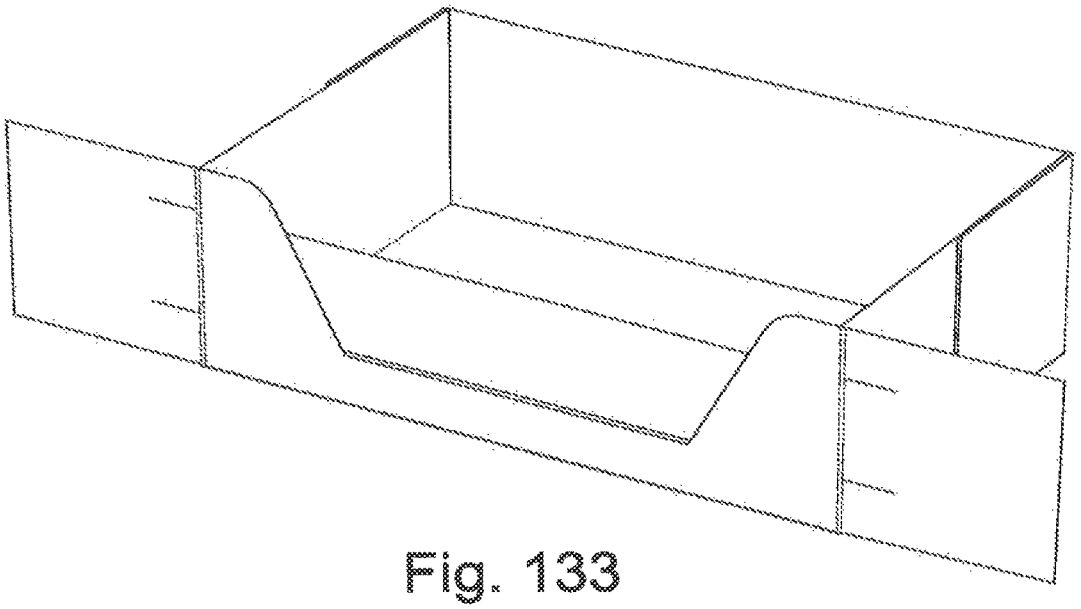

Much of the assembly process is similar to the previous embodiment so the full disclosure will not be repeated again, but FIG. 132 shows the tray 20 partially assembled, with the side walls 1103*a* and 1103*b* folded upright and the back 1104 likewise folded upright and glued or otherwise attached at its jointing tabs 40 to the side walls 1103*a, b*. The front is not yet assembled into an upright configuration. That occurs next—see FIGS. 133 and 134.

Figure 134:
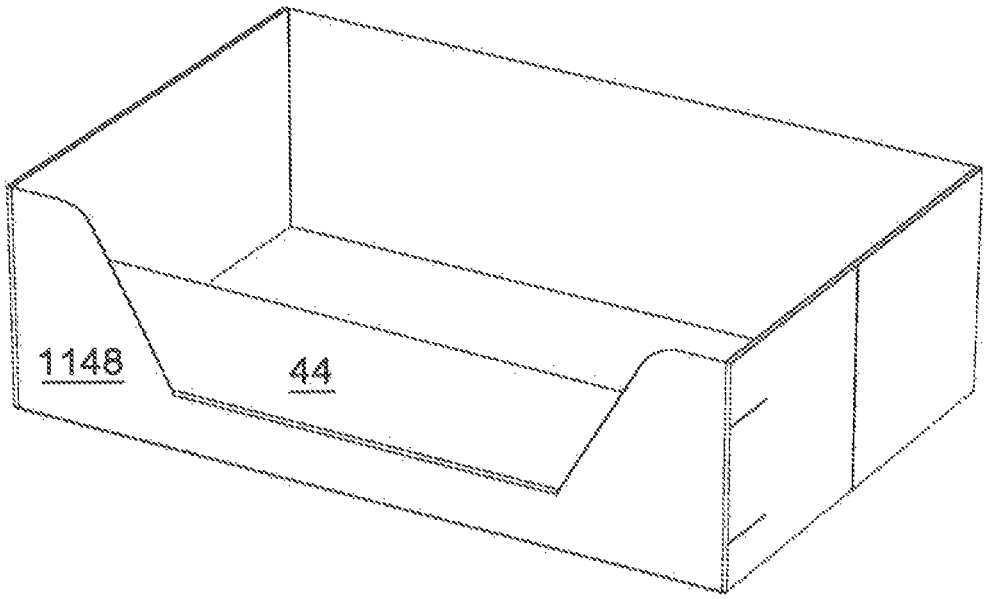

Whereas in the previous embodiment the front was folded after loading, in this embodiment, the front is folded prior to loading since the pusher needs to be in its correct orientation before the loading occurs. Folding the front 1148 and folding and gluing its sides 1150 in place on the outside of the sides of the tray achieves that reorientation of the pusher 44, as can be seen in FIG. 134.

Figure 135:
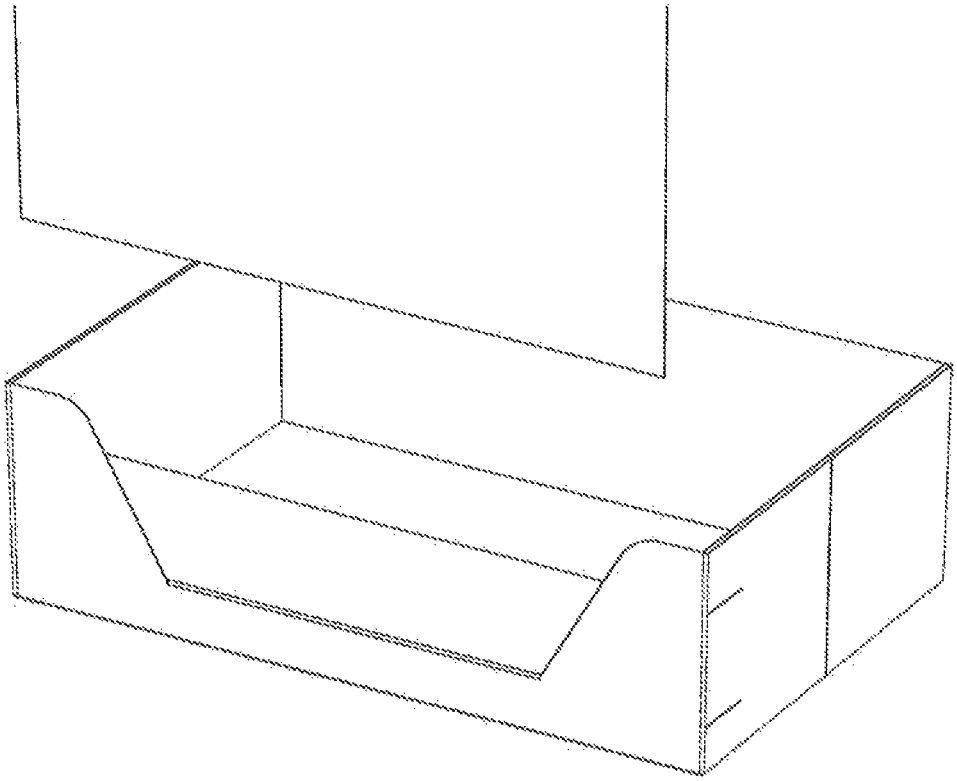
Figure 136:
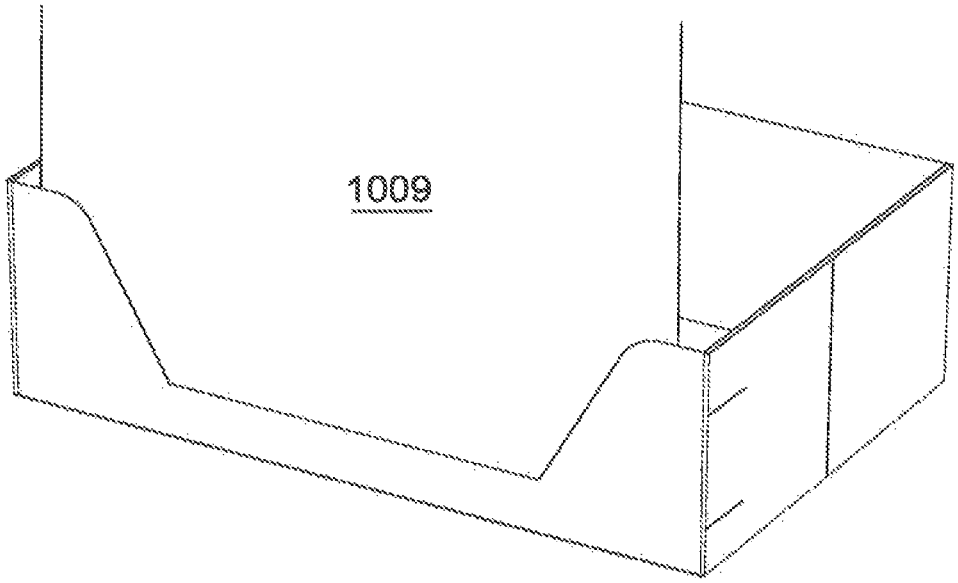
Figure 137:
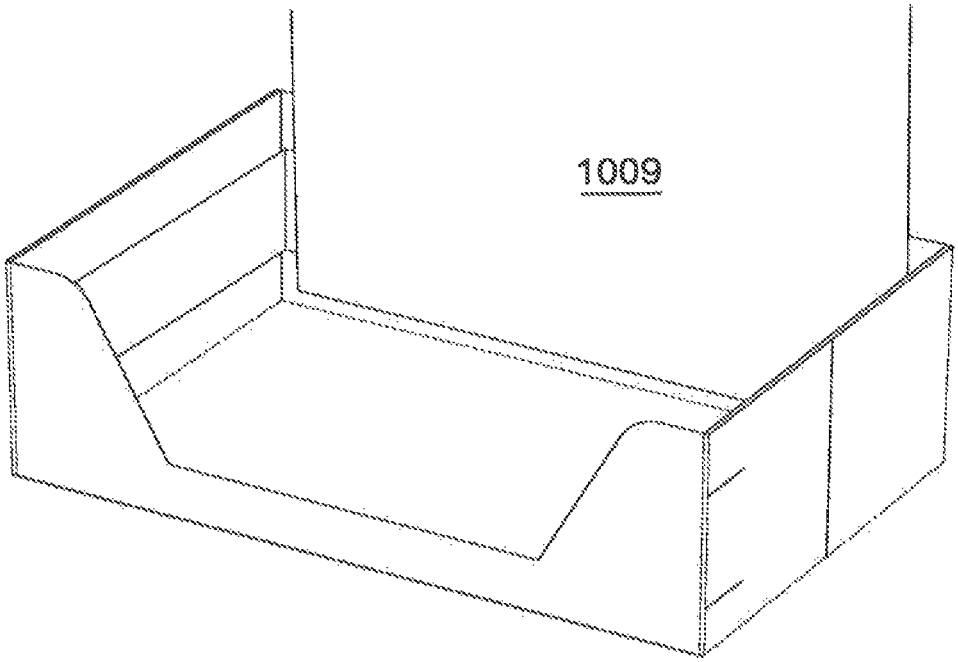

In FIGS. 135 to 137, the next steps can be seen to be the stretching of the pusher 44 backwards in the tray 20 using a packing plate 1009 of a loading machine so that products 22 can be top-loaded into the tray 20; in this variant, products cannot be front-loaded because the pusher 44 is attached to the sides 1150 of the front flap 1148 and the front flap 1148 is needed to be folded into place before loading to allow the pusher 44 to be in its correct position for pretensioning to the rear of the tray 20. This thus closes the front.

Figure 138:
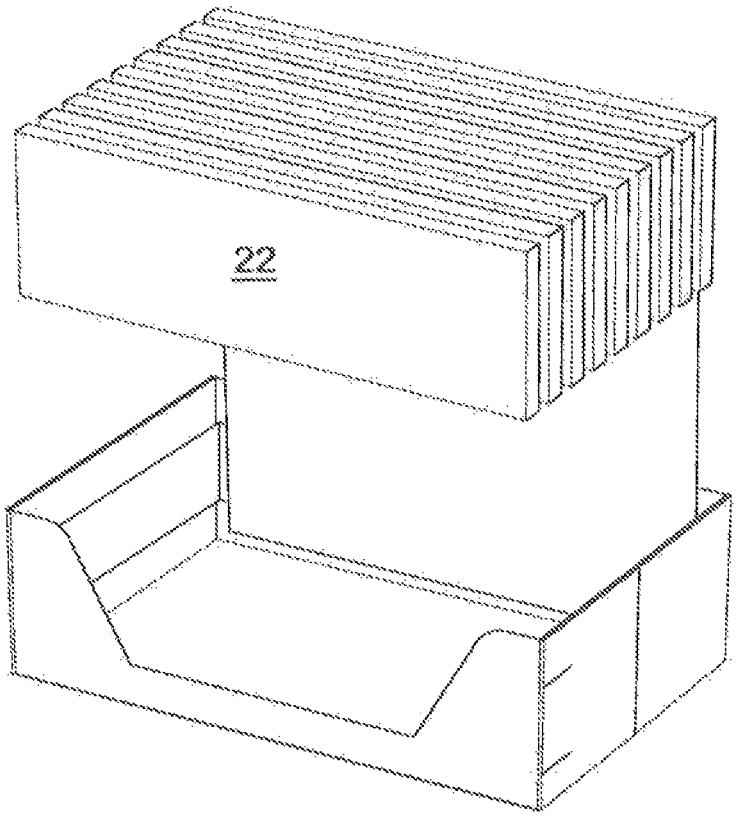
Figure 139:
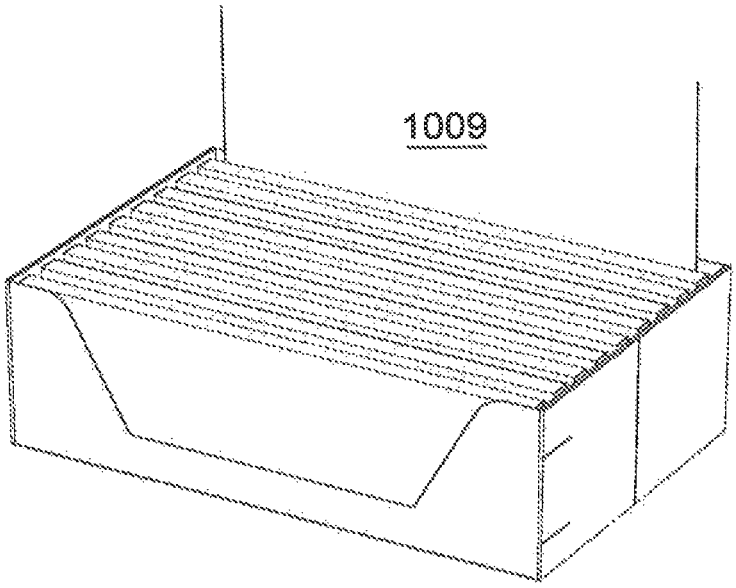
Figure 140:
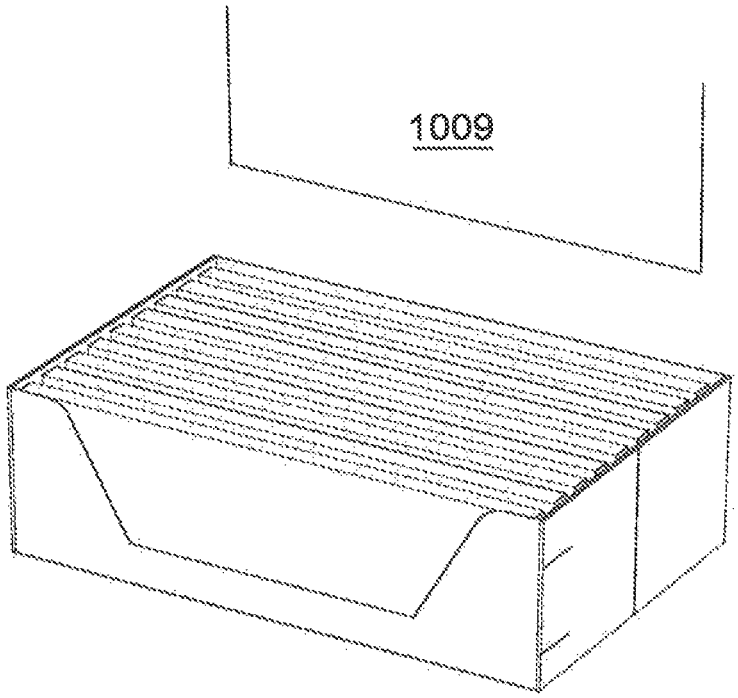
Figure 141:
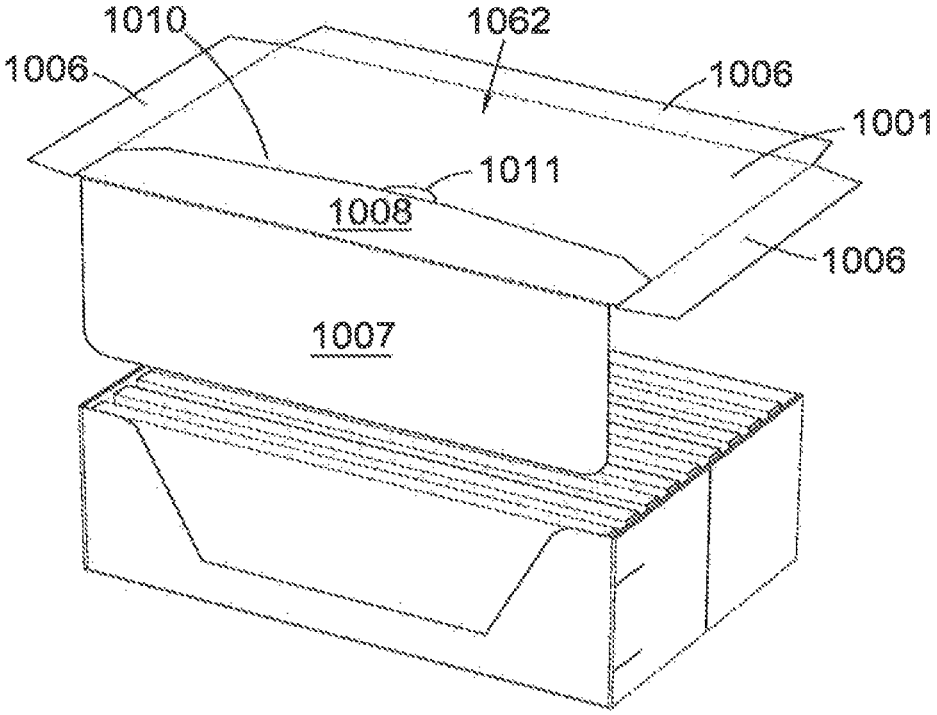
Figure 142:
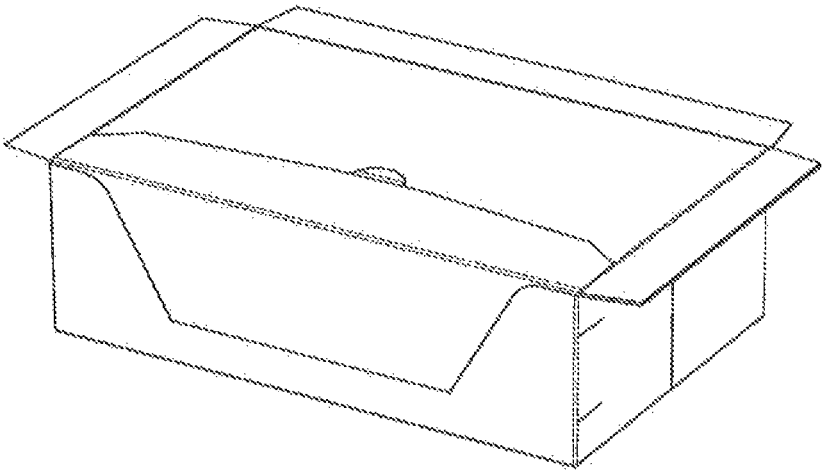
Figure 143:
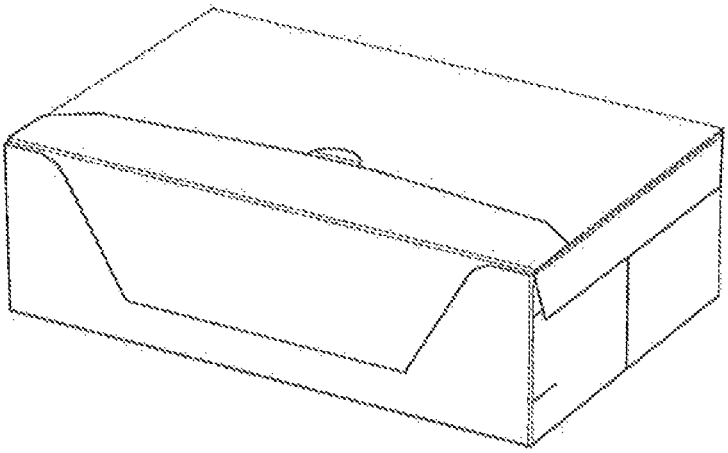
Figure 144:
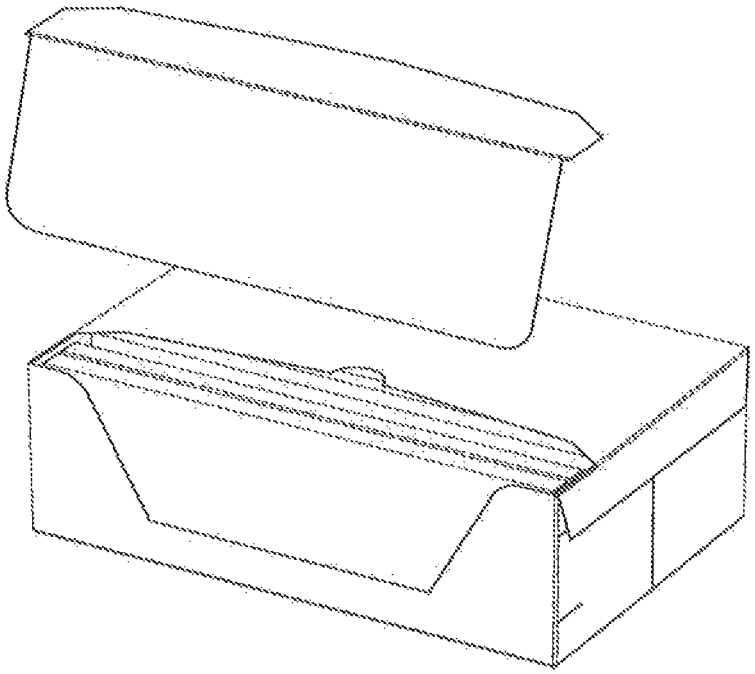
Figure 145:
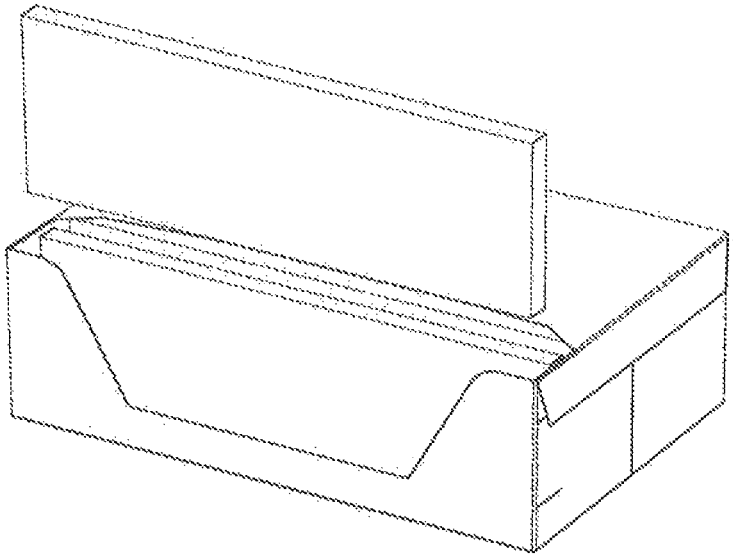

Once loaded, as is occurring in FIGS. 138 and 139, and once the packing plate 1009 has been extracted (FIG. 140), a top can optionally be added. The top was also optional in the previous embodiment. The top here is as per the previous embodiment, and thus it will not be described again.

Figure 146:
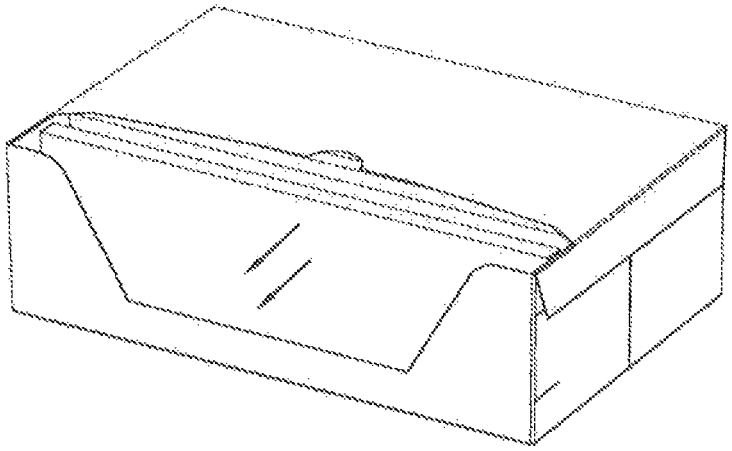

Upon ripping the front 1007 of the top off the box, the products can be removed, and the pusher's bias causes automated product stacking to the front of the box, as shown in FIG. 146.

Figure 147:
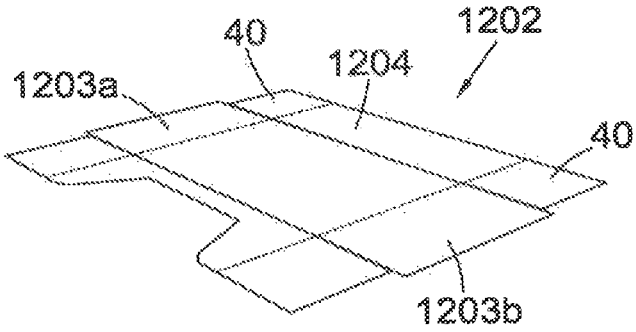
FIGS. 147 to 160 show a variant of the embodiment of FIGS. 13 to 21, but in which the ends of the elasticated tape are attached to separate boards for positioning alongside and inside the sides of the tray.
Figure 148:
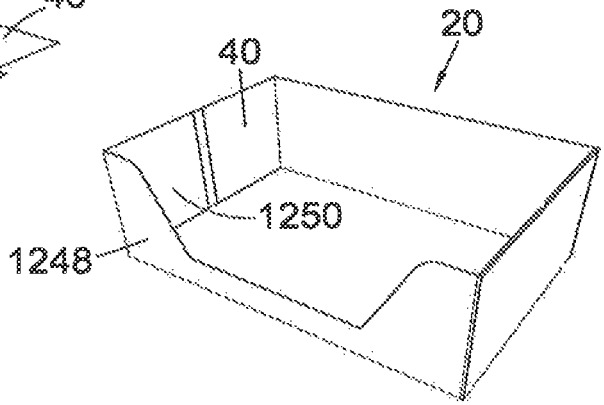

FIGS. 147 to 160 show a further embodiment, Again, a tray 20 is provided and FIG. 147 shows a blank 1202 for forming the tray 20. The tray is shown in the assembled state in FIG. 148. It has side walls 1203*a* and 1203*b* and a back wall 1204 all folded upright and glued at their jointing tabs 40. Here the jointing tabs 40 are internal of the sidewalls. They might alternatively be external. The same applies to the other embodiments, but since in the other embodiments a smoother rear part for the inside facing wall of the sidewalls is helpful for ensuring minimal resistance to forward stacking of products by the pusher, in the earlier embodiments it was preferred to have the jointing tabs external of the sidewalls. In this current embodiment, however, the external appearance is preferred to be clean, so the jointing tabs are internal. The reason for this will become clearer once the pusher 44 is described.

The front of the tray 20 is likewise assembled, with its front flap 1248 folded upright and its side tabs 1250 attached to the inside of the side walls 1203*a, b*. This maintains the clean external wall appearance, but is again optional, i.e. they may be externally affixed.

As with the previous embodiment, the pusher 44 takes the form of a web of resilient material. However, in this variant, the pusher 44 is provided separately to the blank 1202 for the tray.

Figure 149:
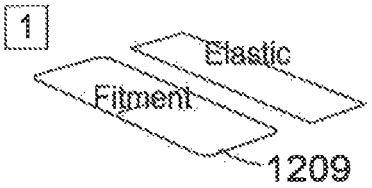
Figure 150:
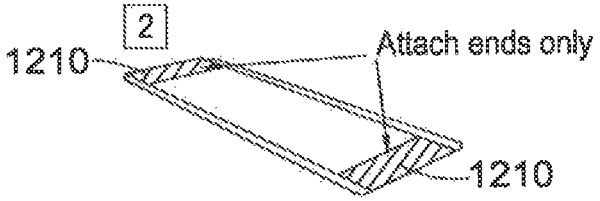
Figure 151:
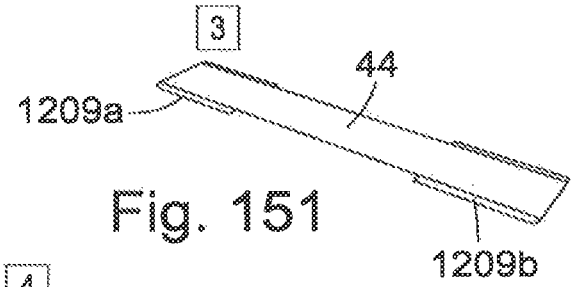

FIGS. 149 to 153 shows the pusher being assembled around products. Referring to FIGS. 149 and 150, a web for forming the pusher 44 is attached at each of its end to a board 1209 such that it is disposed along the length of the board 1209. FIGS. 149 and 151 show that the board 1209 consists of two boards 1209*a, b* of equal length joined along a perforated line. As shown in FIG. 151, the boards 1209*a, b* can be detached from each other along the perforated line. Since the web is attached at the ends 1210 of the boards only, as shown schematically in FIG. 150, the web has a substantial length that can be stretched.

Figure 152:
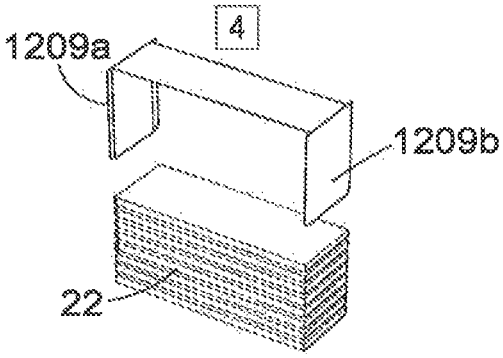
Figure 153:
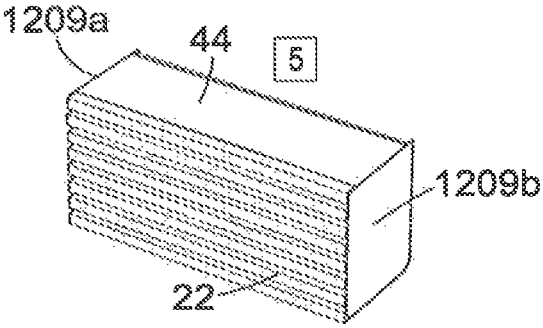

FIGS. 152 and 153 show the pusher 44 being stretched around the top and sides (ends) of a stack of products 22 with the boards 1209*a, b* being disposed at either side (end) of the products 22. Although not shown, a plate may be used for stretching the web, such that it retains the shape shown in FIG. 152, rather than just extending in a straight line between the two ends 1210 at which the web is attached to the boards 1209*a, b*.

The ends of the boards 1209*a, b* to which the pusher 44 is attached are held below the ends to which the pusher is not attached and are dropped onto the stack of products.

Figure 154:
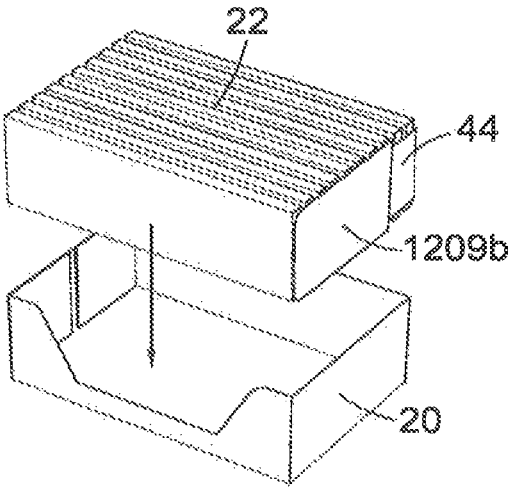
Figure 155:
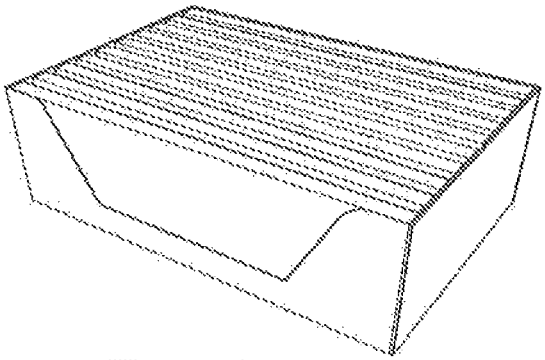
Figure 156:
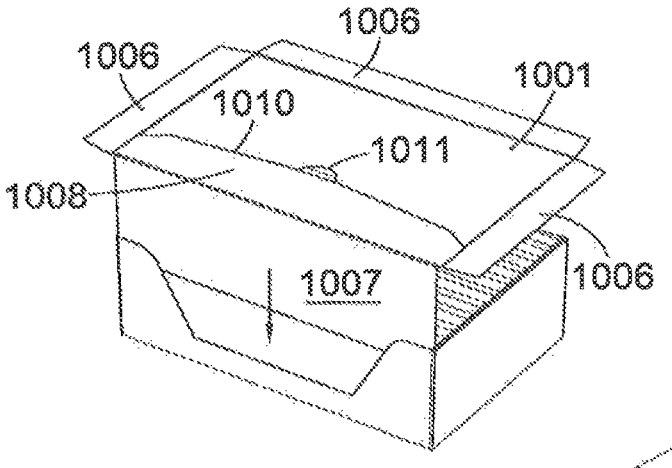
Figure 157:
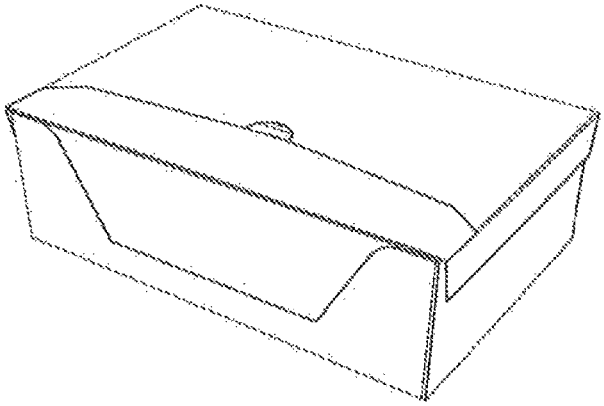
Figure 158:
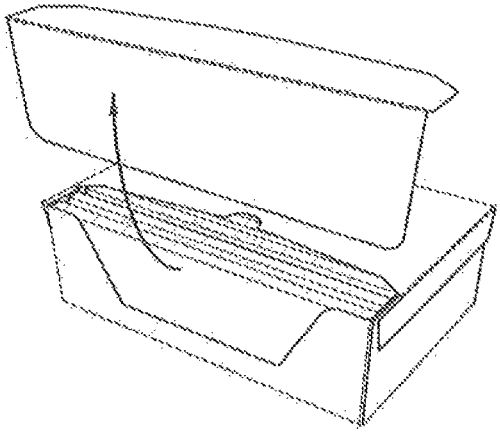
Figure 159:
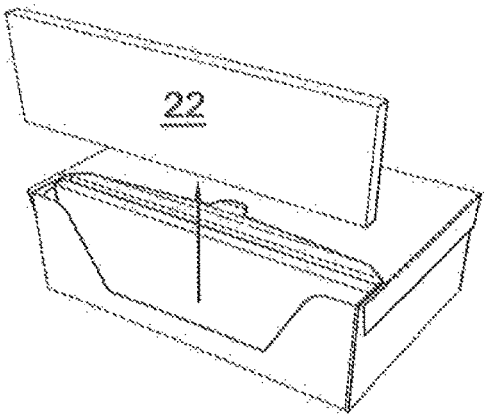

Next the stack of products 22 with the pusher 44 stretched around it in this manner is top-loaded into the tray 20, as shown in FIG. 154, so that the pusher 44 remains stretched around the back of the products 22. FIG. 155 shows the loaded tray with an array of products 22 therein. The boards are no longer visible once within the tray, but they extend across the sides of the tray. Because the pusher 44 has its own sides 1209*a*, 1209*b*, which have their own smooth internally facing surfaces contacting the products 22, the inside of the sides of the tray are less critically smooth. Therefore, the external walls of the sides of the tray can be made the smooth surface for an approved appearance for the tray 20.

Figure 160:
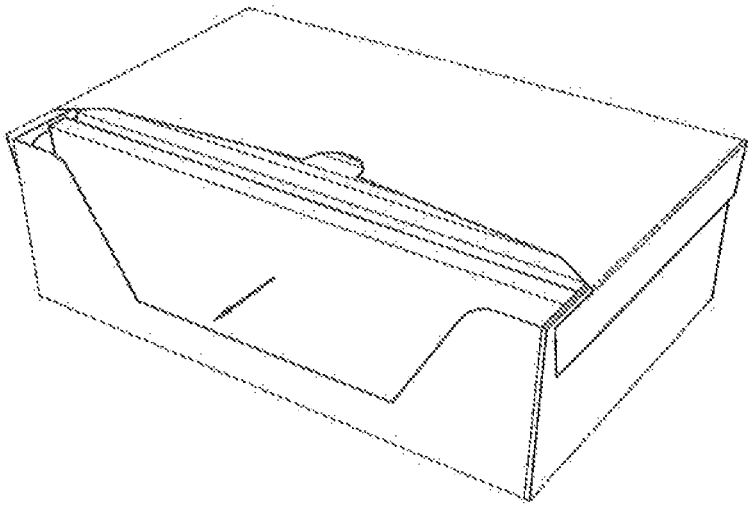

Once loaded, a top formed from the previously disclosed blank 1001 can be applied and used as before. See FIGS. 156 to 158. Further, because of the pusher, upon removing a front product 22, see FIG. 159, the remaining products can self-stack to a forward position, as shown in FIG. 160.

Figure 161:
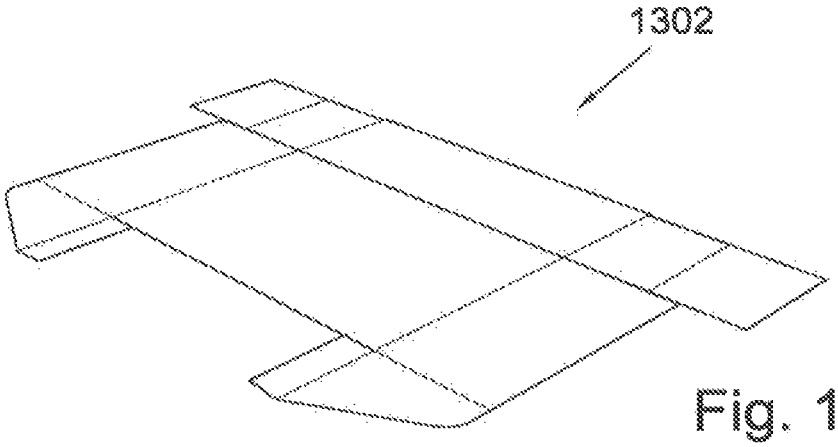
FIGS. 161 to 173 show a variant of the embodiment of FIGS. 13 to 21, but in which the ends of the elasticated tape are attached to the sides of the tray via folded flaps integral to the tray.

Referring next to FIGS. 161 to 173, a further variant is shown. This variant again involves a tray 20, and FIG. 161 shows a blank 1302 for forming the tray 20. As before, the pusher 44 takes the same form of a web of resilient material.

In this further variant, the pusher 44 is glued or otherwise attached to the blank 1302 before the blank is assembled into the tray 20. However, some preliminary folding of the blank occurs first. As such, this variant might be particularly suitable for situations where the end user of the blank applies the web. Nevertheless, it can also be applied at the time of manufacture of the blank, if preferred.

Figure 162:
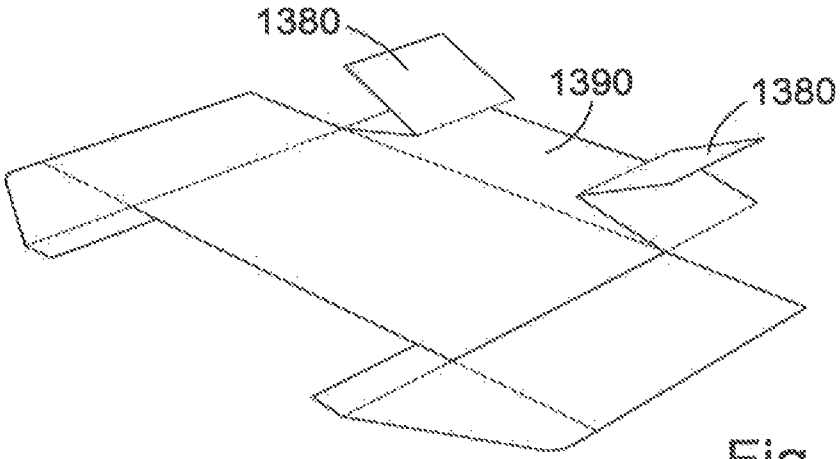
Figure 163:
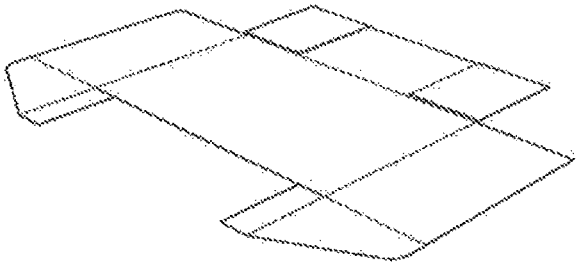
Figure 164:
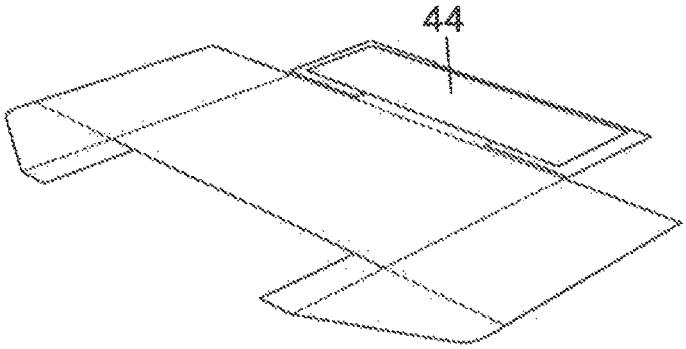
Figure 165:
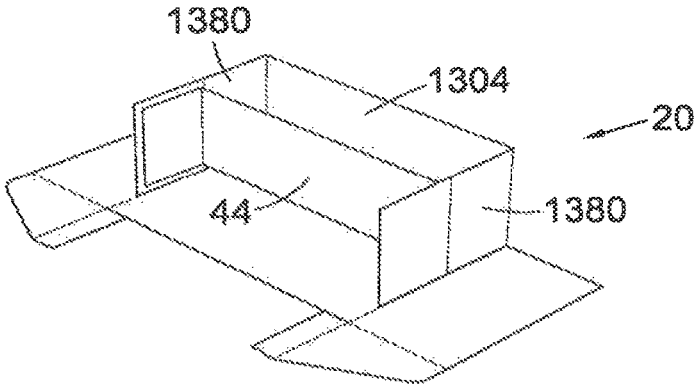

As shown in FIG. 162, the blank 1302 has a rear flap 1390 and rear side flaps 1380 formed integral to each end of the rear flap 1390. The rear flap 1390 when folded upright forms the rear wall 1304 of the tray 20, as shown in FIG. 165. The rear side flaps 1380, however, each consist of two flaps of the same length, and as shown in FIG. 162, these two flaps are each folded over the rear flap 1390, and then backwards in half, one half over the other, and all that is held substantially flat as shown in FIG. 163 prior to application of the web 44 as per FIG. 164. The rear flap 1390 of the blank is then folded upright to form the rear 1304 of the tray 20, and the rear side flaps 1380 are unfolded into a perpendicular position in a plane extending parallel to the finals sides of the tray. This stretches the pusher 44 across the gap between the two rear side flaps 1380, ideally towards the front of the tray 20. See FIG. 165.

The web is glued in this example over substantially the full face of the foremost half of each rear side flap 1380, but it might instead be affixed or glued only at or near the free ends of those rear side flaps if the pusher is wanted to push to further than the illustrated half-way point across the tray.

Figure 166:
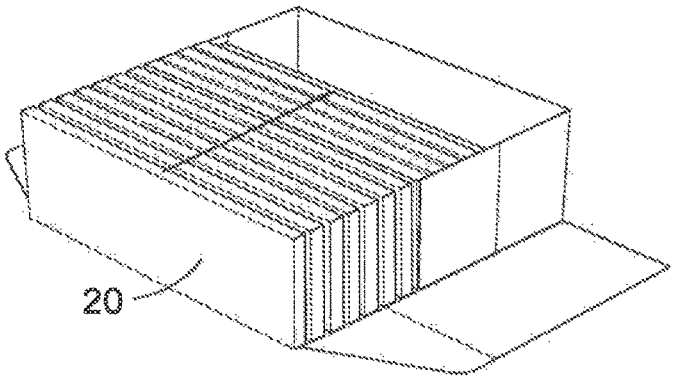

As shown in FIG. 166, the products can then be inserted into the tray 20, with the pusher 44 extending between the free ends of the rear side flaps 1380 being pushed back and around the products 22 so that the pusher 44 stretches to the rear 1304 of the tray, passing between the rear side flaps 1380 and the sides of the products, and around the backside of the rearmost product. The pusher this becomes disposed to either side of the stack of products 22, along the insides of the rear side flaps 1380, and along the back of the stack of products 22. The rear flap 1390 provides the back-stop. This is shown in the illustrated drawing as being done by a front loading process, although it might also be done in other ways, such as by taking the tray 20 to a vertical stack of products and pushing the tray down thereon such that the pusher 44 is disposed down the vertical sides of the products and along the top of the stack of products 22.

Figure 167:
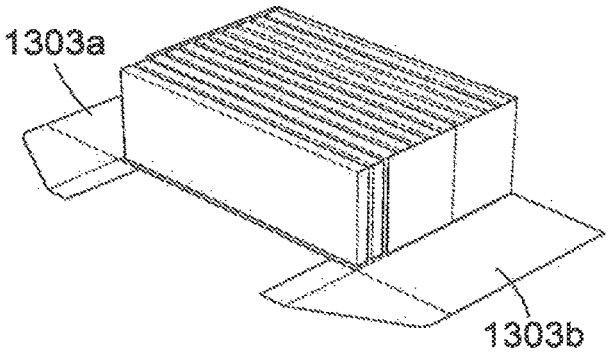

Once fully loaded, as shown in FIG. 167, the side walls 1303*a, b* of the tray are formed by folding appropriate flaps of the blank into position over the outsides of the rear side flaps 1380. Thus the rear side flaps form inner boards and the side walls 1303*a, b* form outer boards.

Figure 168:
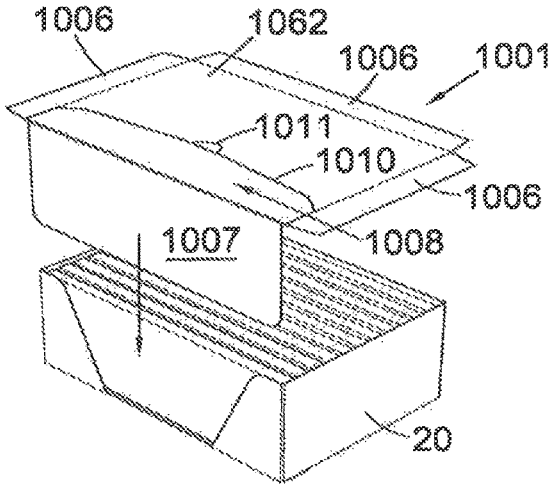
Figure 169:
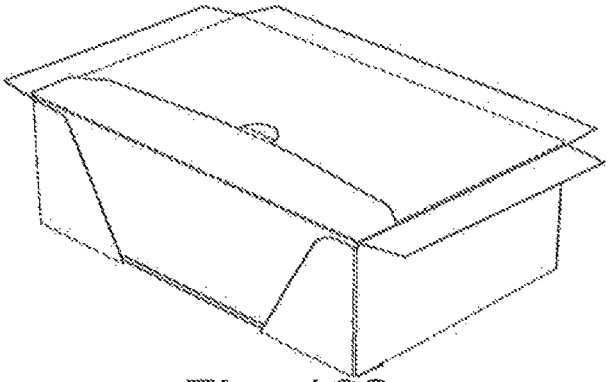

See FIG. 168. This then achieves a clean finish to the outer sidewalls of the tray 20. See FIG. 168.

Then, referring to FIGS. 168 to 173, a top formed from the previously disclosed blank 1001 can be applied and used as before.

Figure 170:
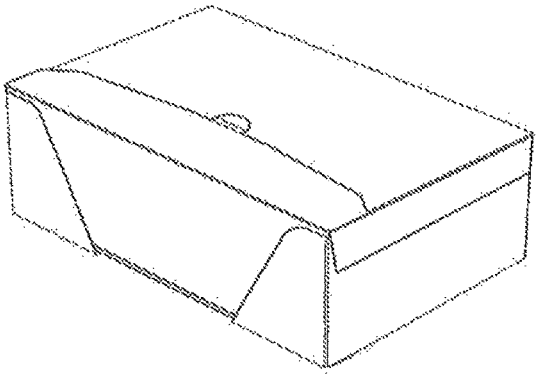
Figure 171:
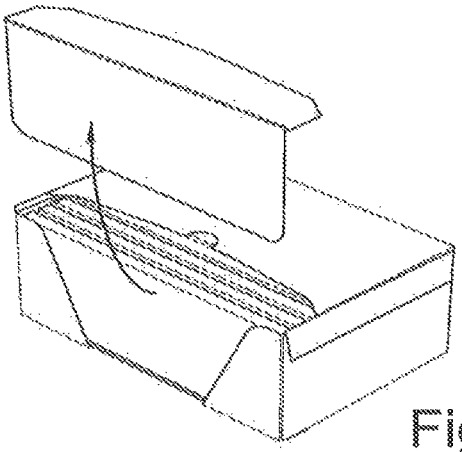
Figure 172:
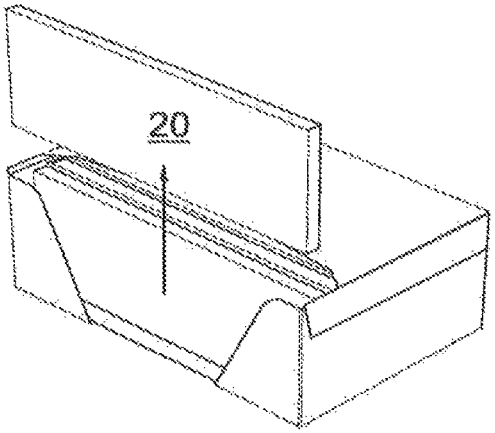
Figure 173:
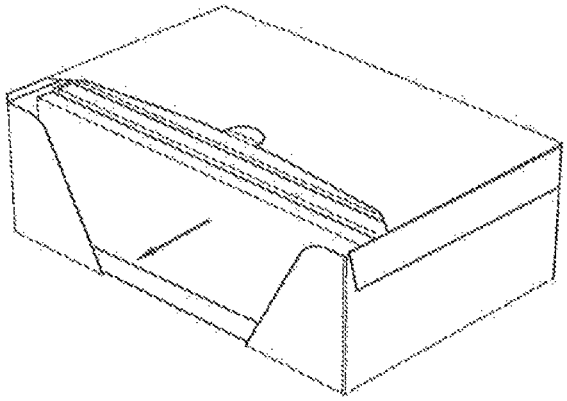

Once fully assembled-FIG. 170, as before the front of the lid can be removed (FIG. 171) and the front most product 20 can be removed (FIG. 172). Then, because of the pusher 44, upon removing a front product 22, the remaining products can self-stack to a forward position, as shown in FIG. 173.

Figure 174:
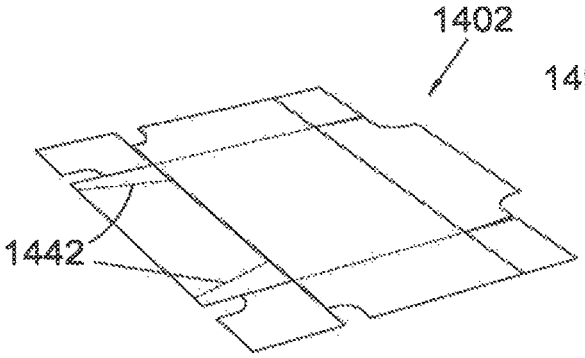
FIGS. 174 to 188 show a variant of the embodiment of FIGS. 13 to 21, but in which the ends of the elasticated material are attached to outer boards, rather than flaps, and a separable pusher member.

Referring next to FIGS. 174 to 188, a further variant is shown. This variant again provides a tray 20 (see FIG. 178) that is formed from a blank 1402 (see FIG. 174) onto which a top, also formed from a blank 1402 (see FIG. 181), can be applied. The tray 20 again has a pusher 44, and the pusher 44 takes the form of a web of resilient material. Further, the pusher 44 is glued or otherwise attached to the blank 1402 that forms the tray before that blank is assembled into the tray 20.

Figure 176:
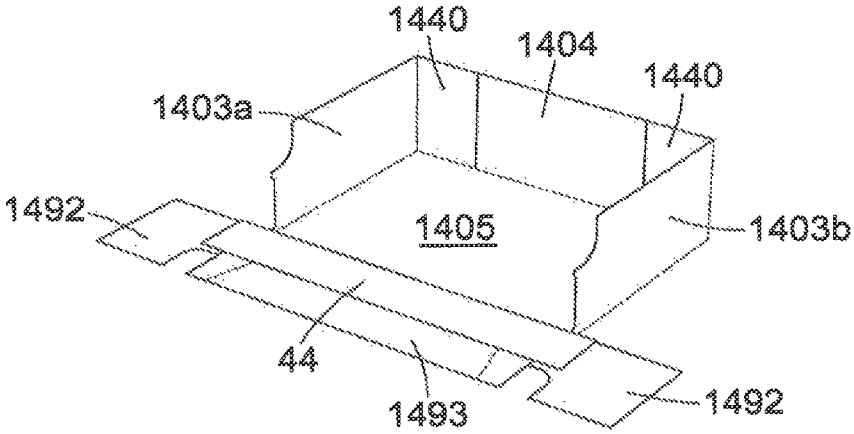

FIG. 176 shows the tray 20 partially assembled, with the side walls 1403*a* and 1403*b* and back wall 1404 folded upright and glued at their jointing tabs 1440, although this time the jointing tabs 1440 are located on the side flaps rather than the rear flap. The other blanks can be likewise arranged, or the jointing tabs 1440 could instead be provided on the sides of the rear flap. The illustrated arrangement is preferred, however, since it provides clean surfaces for the inside of the side walls, thus providing a clean surface for the products to be pushed along by the pusher 44.

Figure 175:
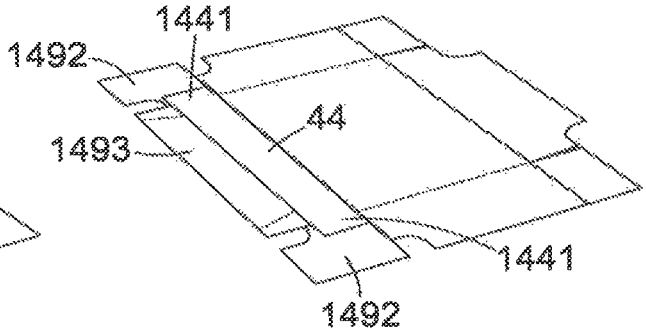

The front end of the tray 20 is not yet assembled in FIG. 176, but from that figure, and FIG. 175, it can be seen that the ends 1441 of the pusher 44 are attached to front side boards 1492, which are in turn attached to ends of a pusher board 1493 by perforated lines. The pusher board 1493 is also attached to the front edge of the base 1405 of the tray 20 along another perforated line.

Angled crease lines 1442 are also provided on the pusher board, although these are optional. For example, they may be curved, they may be perpendicular to the edges, rather than angled, or they may be omitted completely. Their presence, however, assists with the final positioning and movements of the pusher board within the tray once the products are therein too, as will be explained further below.

Figure 177:
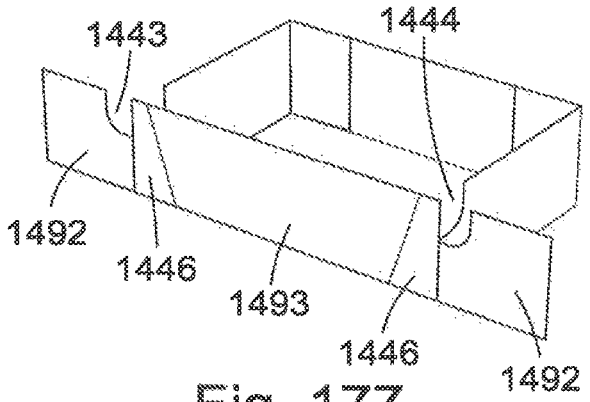

In FIG. 177 the pusher board 1493 has been folded upright, along with its attached two front side boards 1492. This positions the pusher 44 inside the tray—it is no longer visible from the front since no cut-out is needed or desired for the pusher, although a cut-out can be provided if desired.

Figure 178:
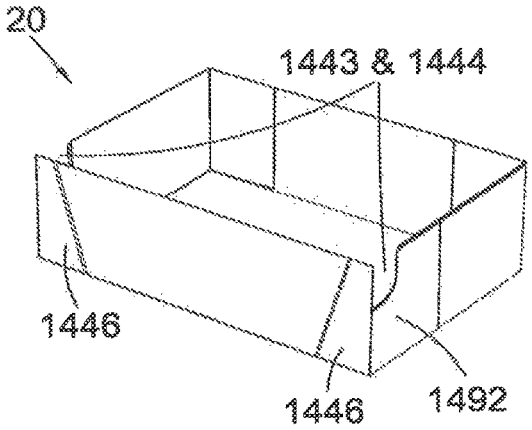
Figure 179:
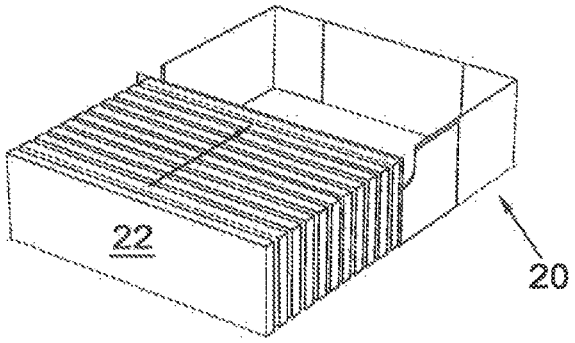

The front side boards 1492 are then folded towards and attached to the side walls 1403*a, b* of the tray, as shown in FIG. 178. As can be seen, cut-outs 1443, 1444 are provided in both the front side boards and the side walls of the trays, and these overlie one another upon making this fold, or the inside ones retract behind the outside ones so that the outside ones provide a clean appearance, rather than a double-thickness appearance. See FIG. 178. These cut-outs also cooperate with a similarly shaped pair of perforations 1445 in the lid—see FIGS. 181 and 183. See later on for a further discussion of this.

As shown in FIG. 178, the pusher board 1493 commences its life within the tray 20 at the front of the tray. However, upon front loading products 22 into the tray 20, the pusher board can be easily detached from the front side boards 1492 and the base 1405 of the tray 20 by breaking the joints provided by the perforated lines mentioned above. The pusher board thus travels with the products 22 as the products are front loaded into the tray 20. This also then stretches the pusher 44, whereby the pusher board separates the pusher 44 from the rear surface of the products, although the pusher 44 does engage or extend next to the sides of the products.

As previously mentioned, the pusher board 1493 has flaps 1446 at each end, attached along oblique or angled lines or creases. These enable the pusher board to flex slightly, e.g. due to the compressibility of the corrugate and the loading from the pusher 44, to allow the pusher board to fit into the gap between the sides of the tray 20 more readily, thus being able to slide more freely.

Figure 180:
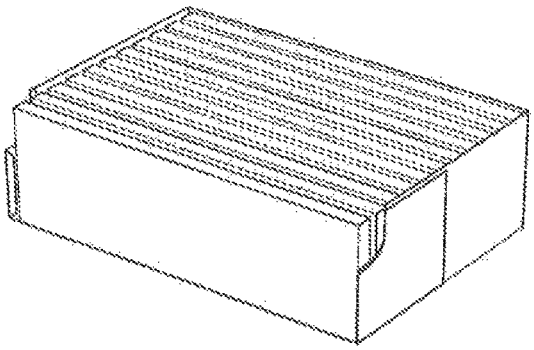

Once the tray 20 is filled with products 22—see FIG. 180, with those products being in front of the stretched pusher 44, a lid 1462 formed from the blank 1401 can be placed on top of the tray 20. The lid for this embodiment is shown to have a front center flap 1407 and it is folded downwards so that it is disposed across the front of the tray 20. However, the tray itself does not have a front wall or front flap anymore. Thus the tray itself cannot restrain that front center flap. Instead, the lid 1462 has additional flaps—front side flaps 1464—for forming a front for the tray 20. Those front side flaps 1464, which extend from front edges of side flaps 1448 of the blank 1401 are thus folded inwards and under the tray once the side flaps 1448 have been folded down over the sides of the tray 20 so that the front center flap 1407 is disposed behind the front side flaps 1464. The front side flaps 1464 have further flaps attached thereto that attach to the bottom of the base of the tray 1405, thus holding everything in place, e.g. through the application of an adhesive. See the steps of FIGS. 181 through to 184.

Once assembled in this manner, the product is fully enclosed by the box, comprising both the tray and the lid. See FIG. 184.

As with many of the previous embodiments, the lid has a removable front—see the perforations 1010 and finger hole 1011. However, it additionally has the previously mentioned perforations 1445. Thus, upon pulling off the front the perforations to the sides also rupture, thus providing an easy edge to grip on the products for removal of the products. The other embodiments might be likewise modified to have the cut-outs in the appropriate positions.

Figure 187:
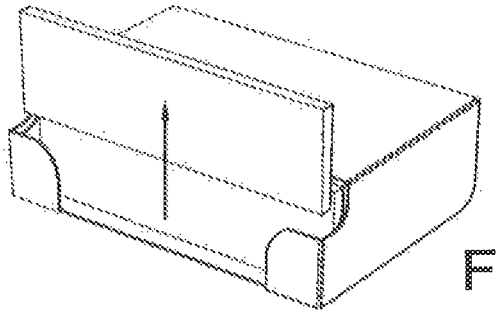
Figure 188:
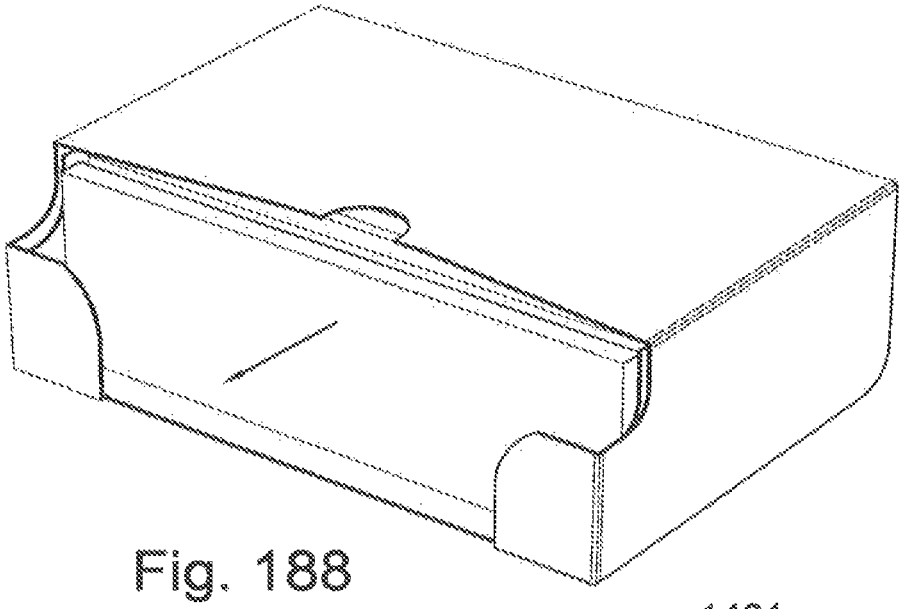

As before, due to the pusher 44, upon removing a front product 22, see FIG. 187, the remaining products can self-stack to a forward position, as shown in FIG. 188.

Figure 189:
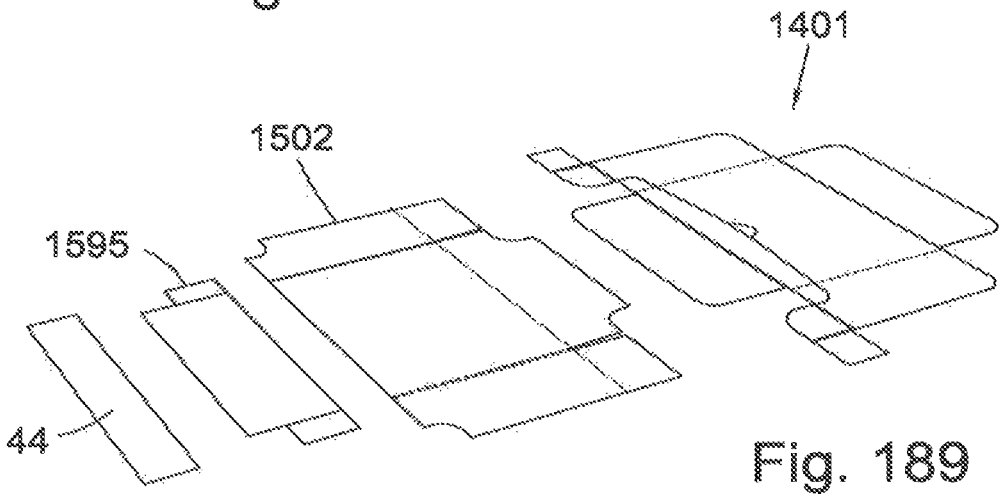
FIGS. 189 to 203 show a variant of the embodiment of FIGS. 13 to 21, but in which the ends of the elasticated material are attached to a separate blank to the tray, which blank has flaps for attaching to the inside of the sides of the tray, and a separable pusher member.
Figure 190:
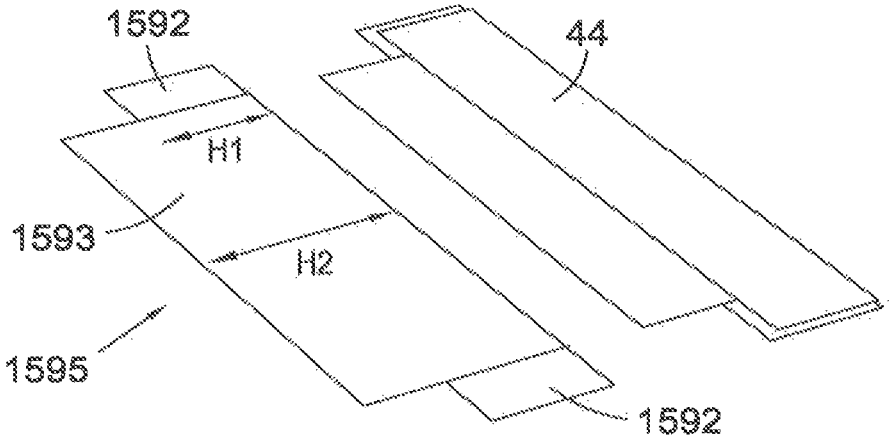
Figure 191:
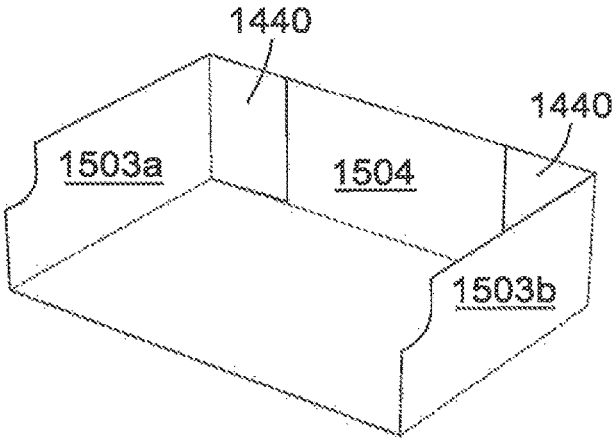
Figure 192:
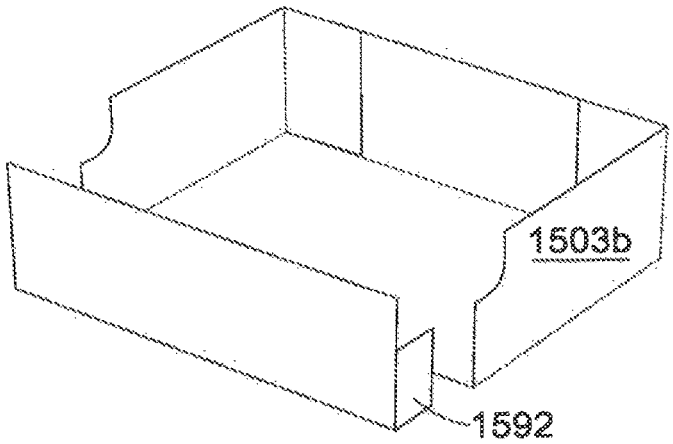
Figure 193:
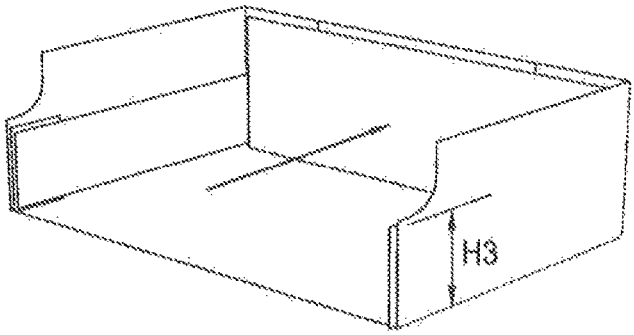

Referring next to FIGS. 189 to 203, a further variant is shown. This variant again provides a tray 20 and lid and FIG. 189 shows a blank 1401 for forming the lid, which lid is corresponding to the lid 1462 from the previous embodiment, and a blank 1502 for forming the tray 20. Again the pusher 44 takes the form of a web of resilient material, but like the embodiment of FIGS. 147 to 160 the pusher 44 is glued or otherwise attached to a separate blank 1595, rather than to an integral part of the blank 1502 for the tray 20.

Although the web is shown as a distinct piece, as with some of the other embodiments disclosed above, it is possible again to take this web from a roll of web material.

This variant is similar to the variant of FIGS. 174 to 188 but differs in that pusher board 1593 and front side boards 1592 are provided on a separate blank 1595 to the blank 1502 for the tray 20. As such, there are still the perforations between the front side boards and the pusher board, but no joint is needed between the separate blank 1595 and the blank 1502 for the tray 20.

The web for the pusher 44, however, is still attached to the front side boards, and may be attached also to e.g. the middle of the pusher board. The same can be the case for that earlier embodiment.

Whereas the earlier embodiment had cut-outs 1443 in the front side boards, this embodiment has squared recessed edges on its front side boards, thus defining two distinct heights for the blank—H1 and H2. Since this embodiment may have its front side boards located internally of the sides of the tray, they should be arranged to be minimally visible or invisible from the outside of the tray. This improves the appearance of the tray. The first height—for the front side boards 1592 is this preferably less than the height of the sides remaining once the cut-outs are made in those side walls, i.e. H3 in FIG. 193.

In this variant, once the side walls 1503*a* and 1503*b* and back wall 1504 have been folded upright and joined, using jointing flaps 1440 as per the previous embodiment (see FIG. 191), the front side boards 1592, to which the ends of the pusher 44 are attached, are attached by gluing or otherwise to the front insides of the side walls 1503*a, b*. See FIG. 192. Then, in a similar manner to the previous embodiment, the pusher board 1593 can be easily detached from the front side boards 1592 by breaking the joins along the perforated lines that join them. The pusher board 1593 and the pusher 44 can then be pushed towards the back of the tray 20 to stretch the pusher 44. See FIG. 193. This might be achieved with a pusher plate 1009, as per the earlier embodiments, or by hand. The prior embodiments can also be done by hand or pusher plate 1009.

Figure 194:
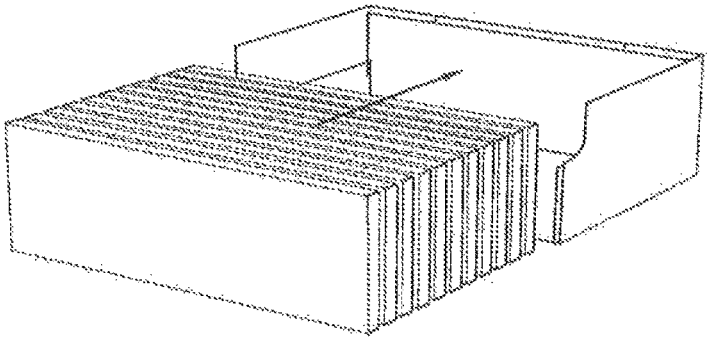
Figure 195:
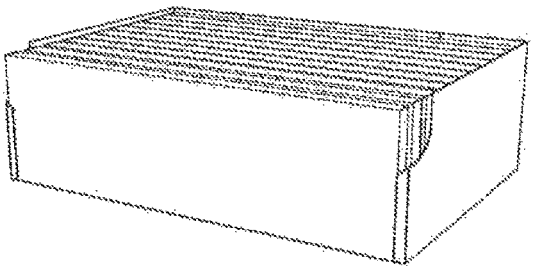
Figure 196:
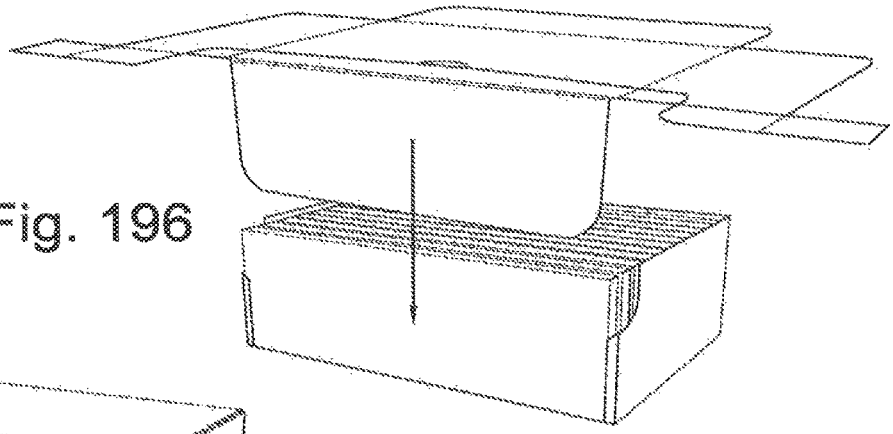
Figure 197:
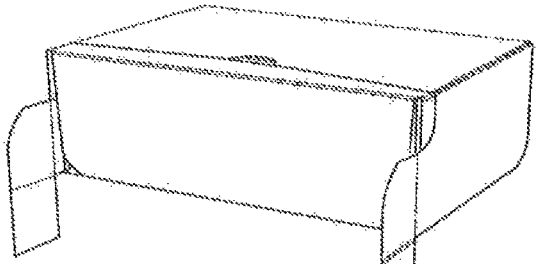
Figure 198:
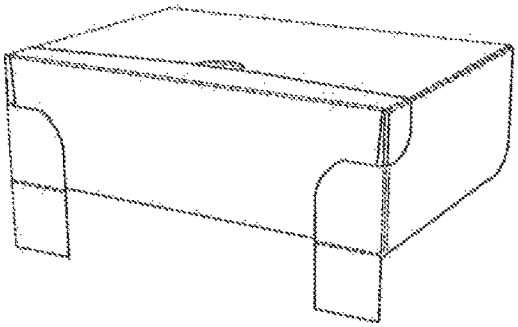
Figure 199:
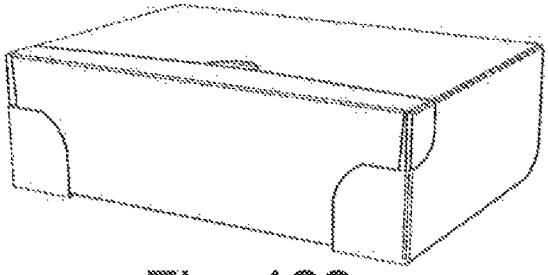
Figure 200:
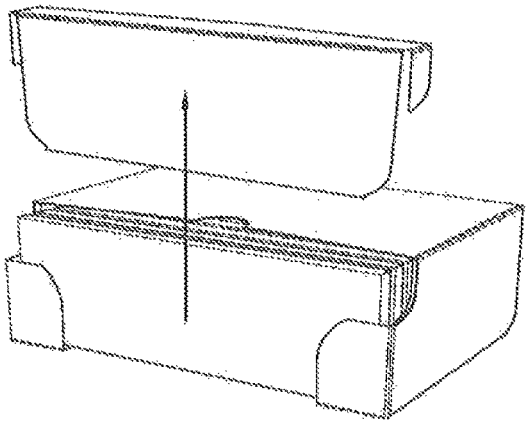
Figure 201:
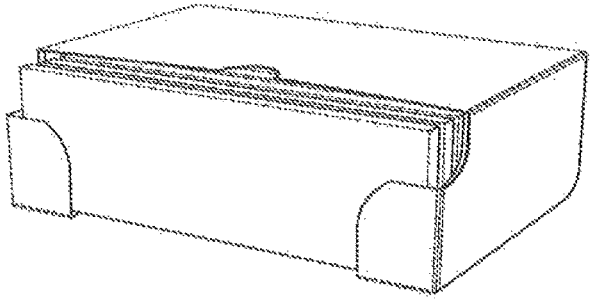
Figure 202:
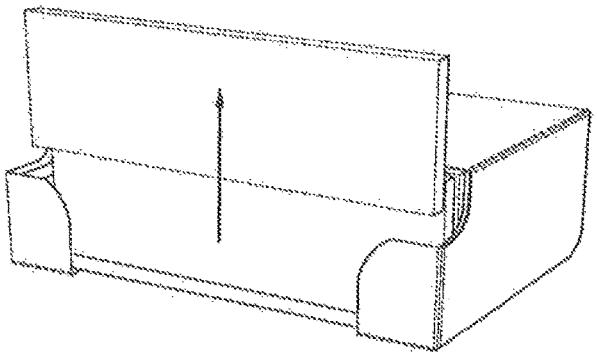
Figure 203:
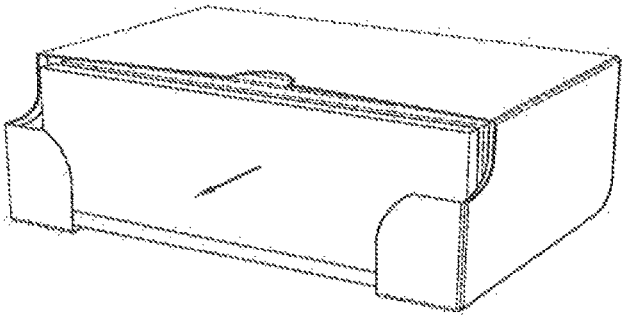
Figure 204:
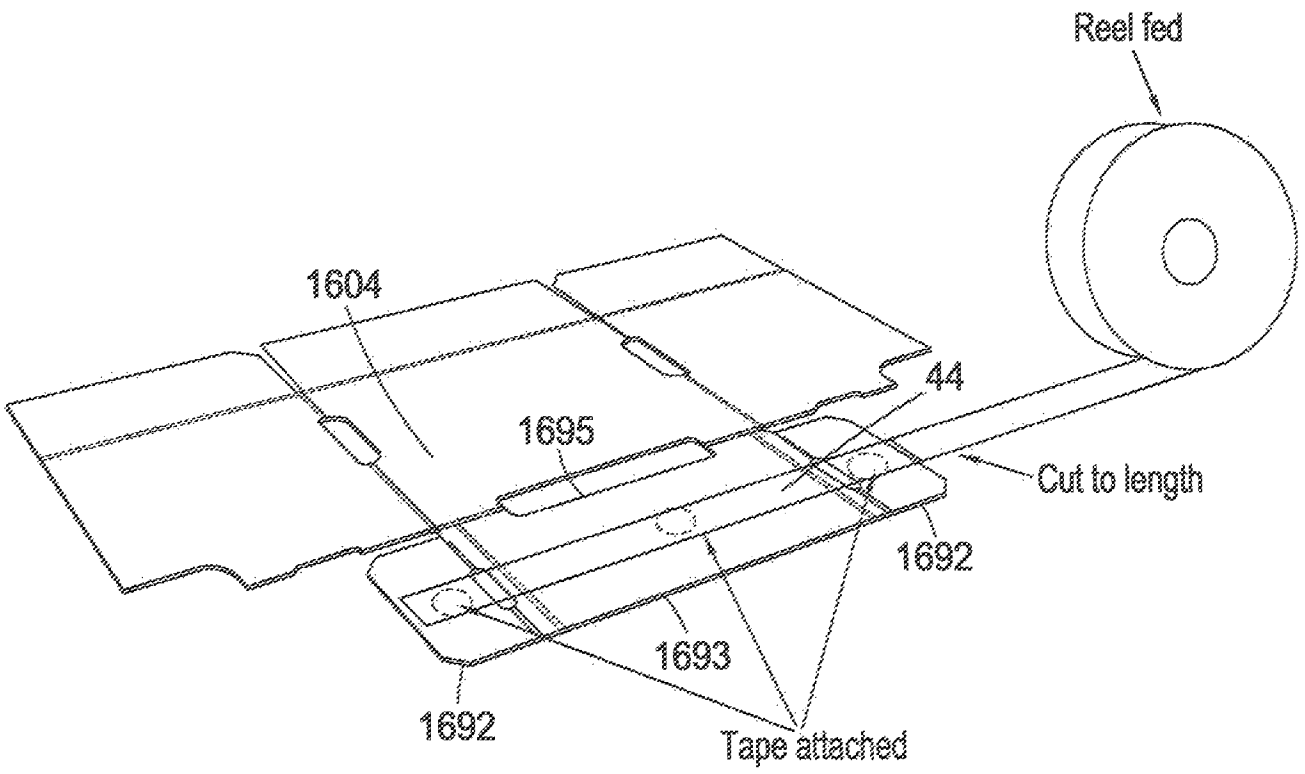
FIGS. 204 to 221 show a variant of the embodiment of FIGS. 13 to 21, similar to that of FIGS. 174 to 188.

FIG. 194 then shows the tray being filled with products 22, and FIG. 195 shows the tray full of products. The lid 1401 from the embodiment of FIG. 181 can then be applied as before. See FIGS. 196 to 199. This completed box can then be used as per the earlier embodiment by opening its front and unloading products therefrom, with remaining products then auto front stacking as before. See FIG. 203.

Referring next to FIGS. 204 to 221, a further variant of the embodiment of FIGS. 174 to 188 is shown. In this variant, the pusher 44 is a web or tape that is drawn off a feed reel, and which is then attached to the front side boards 1692 (outer boards) and also to the pusher board 1693. In this instance the crease lines in the pusher board are perpendicular to the top and bottom edges of the pusher board, rather than oblique.

Figure 205:
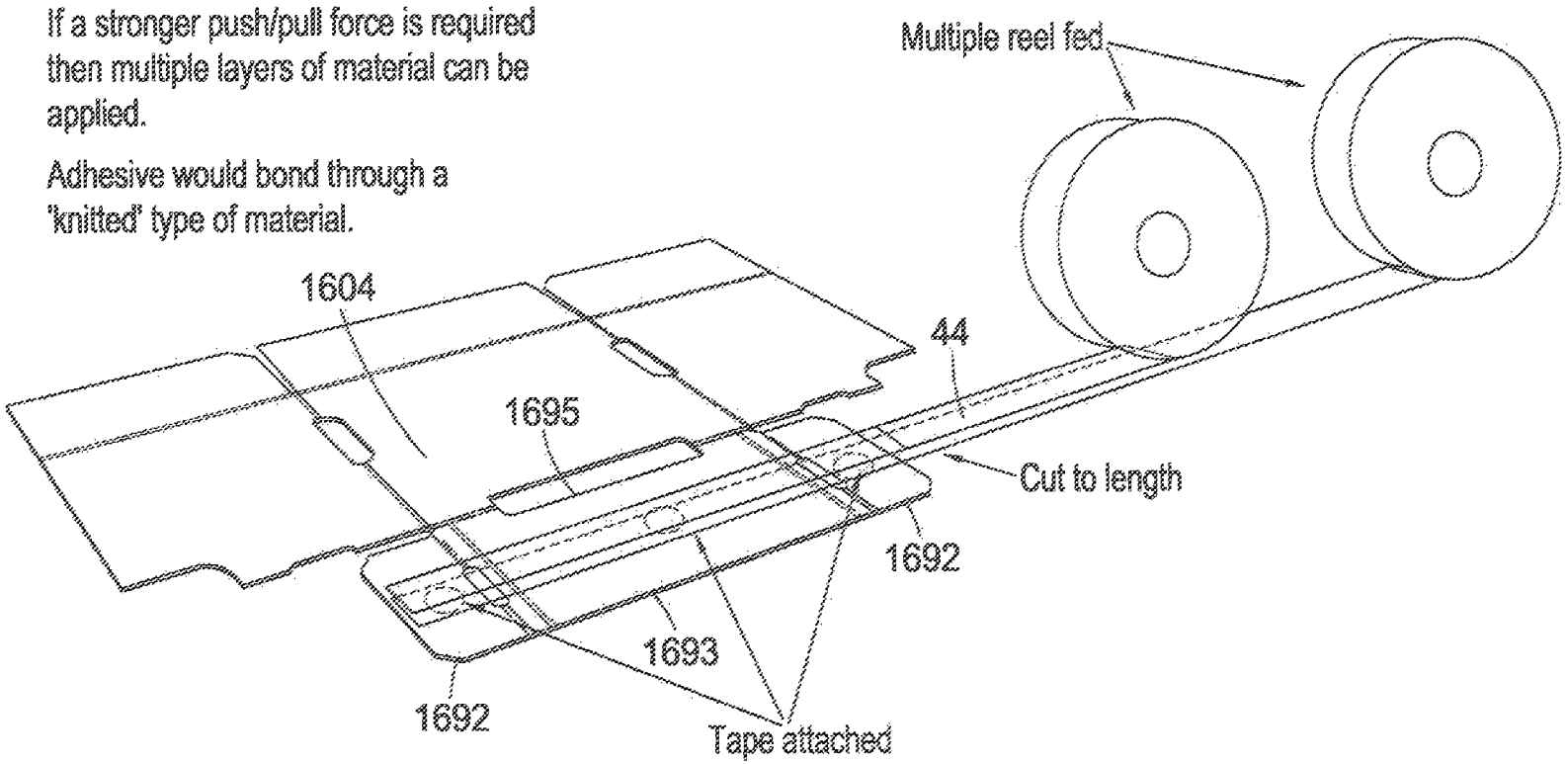
Figure 206:
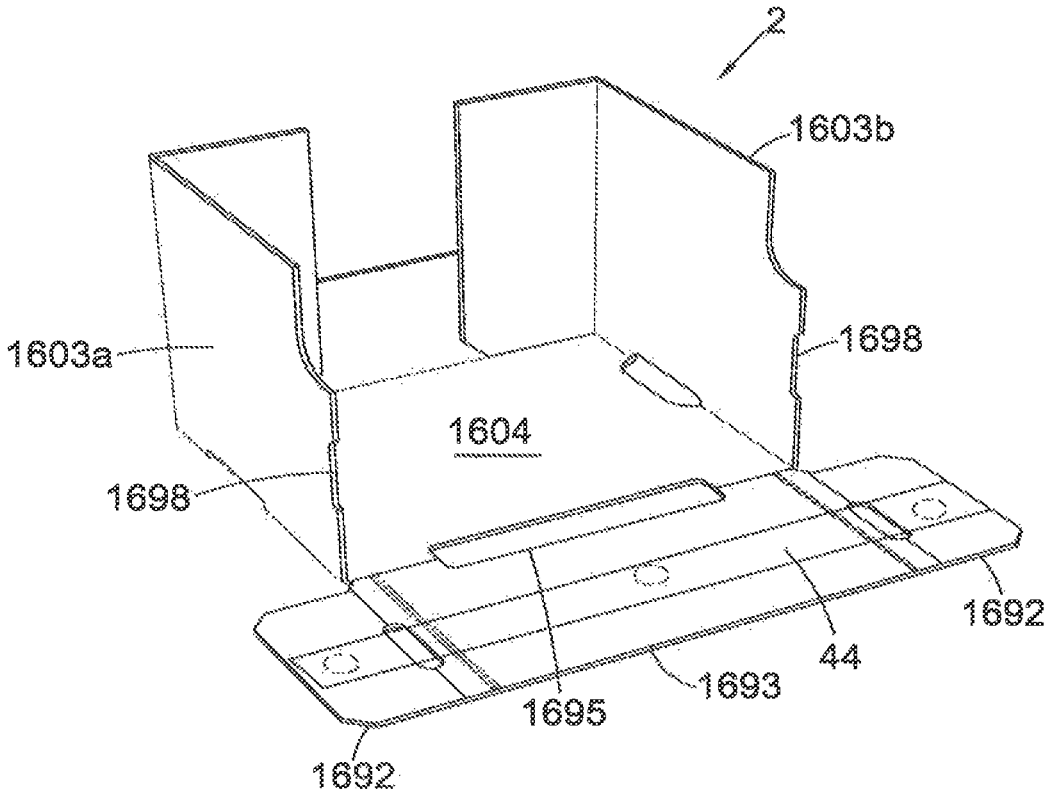
Figure 207:
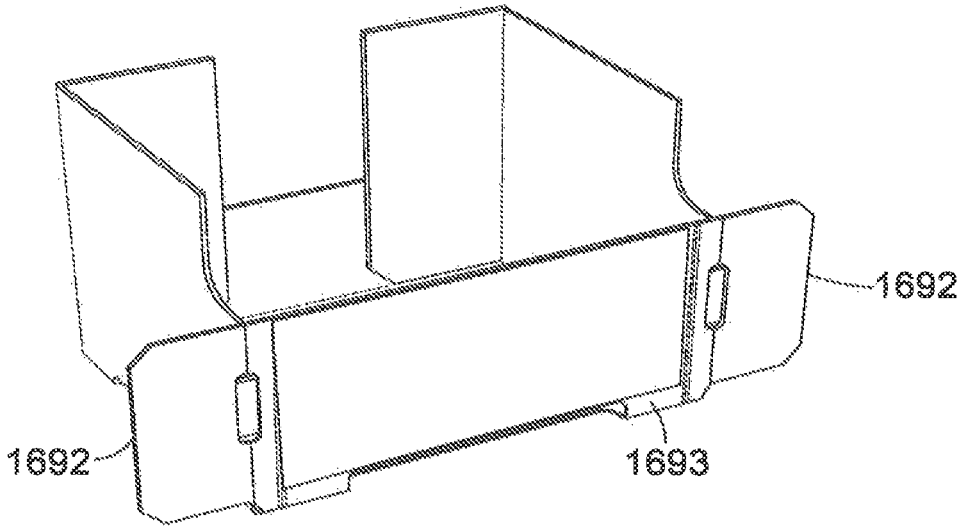
Figure 208:
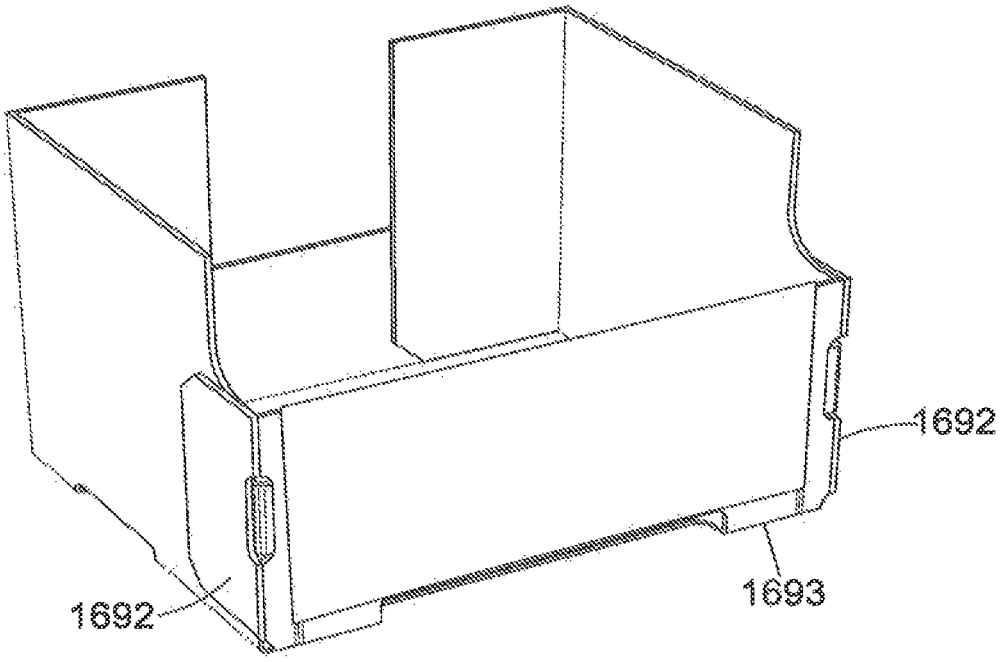

FIG. 205 shows how two layers of tape can be used to form the pusher 44, if required. More than two layers is also possible. Multiple layers can apply a stronger pushing force to the products within the tray 20 than a single layer. If the tape is a woven material, such as shirring elastic, the adhesive can pass through the adjacent layer(s) of tape to bond with the outer layer of tape. The layers can overlie each other with co-terminal edges, or may be displaces relative to one another. They are shown spaced apart in the drawing since the layers are not yet pushed down onto the blank.

The pusher board 1693 is joined to the base 1604 of the tray by a perforated line. Along the perforated line the pusher board 1693 has a recessed portion 1695 where there is no join. This is formed by a cut-out in the blank. The cut-out also extends into the front edge of the base of the tray. The function of this cut-out is thus two-fold: firstly, the cut out in the front edge of the base of the tray allows a product within the assembled tray to be picked up more easily by the user from the inside of the tray 20; secondly, it reduces the length of the line of friction between the board 1693 and the base 1604 of the tray 20. Since the board 1693 is pulled along the base 1604 of the tray 20 by the puller 44, that reduced length of contact allows it more easily to slide on that base.

The tray is assembled in much the same way as the earlier embodiment, in that the sides walls 1603*a, b* and the back are folded upwards. See FIG. 206. Further, the board 1693 is folded up into the front position (FIG. 207) and the side flaps 1692 are folded back. In this embodiment, they are folded back on the outside of the sidewalls. See FIG. 208. However, whereas the previous embodiments had a relatively flat tray configuration, the tray of this embodiment has a different overall shape—it is taller since the side walls are taller. Further, the back has an opening in it. Other shapes of tray are also achievable, for example by changing the proportions of the various panels and flaps of the blank.

The same applies to the other embodiments.

Figure 209:
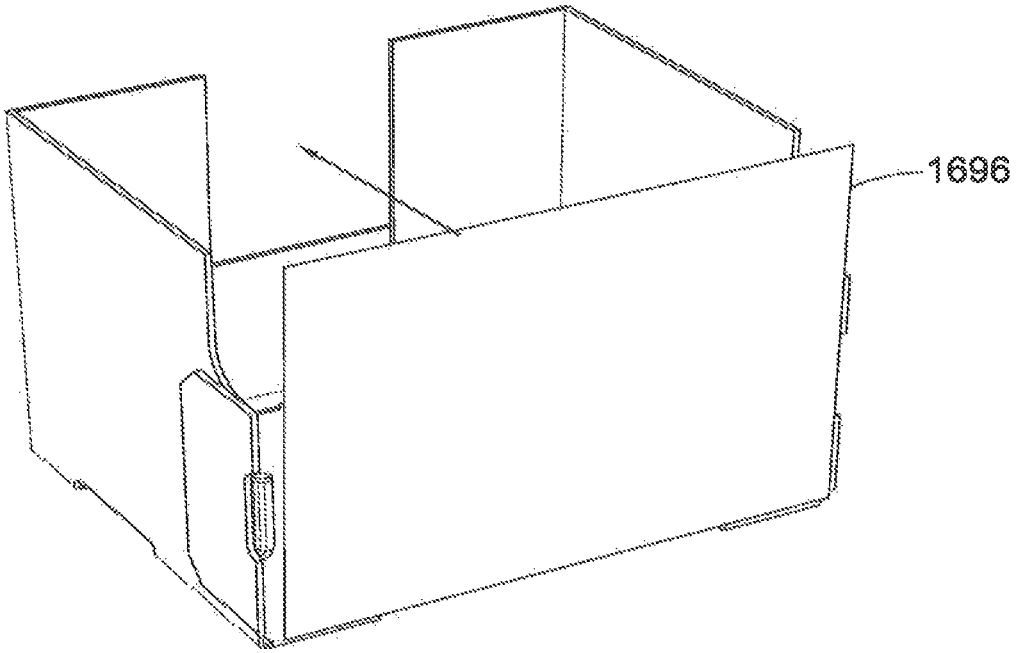
Figure 210:
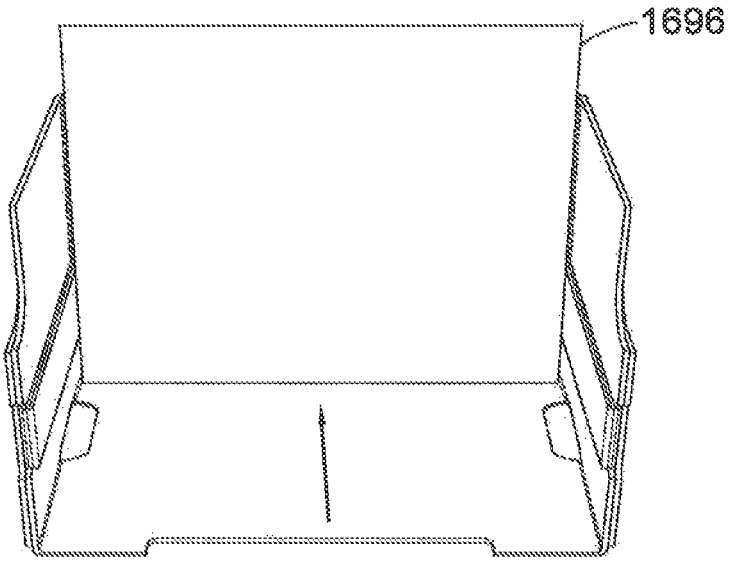

In this variant, for preparing the tray for loading, as shown in FIGS. 209 and 210 a first auxiliary board 1696 is used to push the pusher board 1693 towards the back of the tray 20. This breaks the perforations at the sides and base of the pusher board 1693. This auxiliary board 1696 can be a manually applied board to make it easier for the user to hold the pusher board 1693 in position at the back of the tray, or it could be a plate in an automated machine. Holding the pusher board at the back of the tray enables the loading of products 22 without the counter-force of the pusher 44.

Because the first auxiliary board 1696 is sized to extend above the side walls 1603*a, b* and the products, it is easy to remove after insertion of the products. However, the opening at the back would also allow the auxiliary board to be removed if it was shorter—it can still be accessed despite the presence of products.

Figure 211:
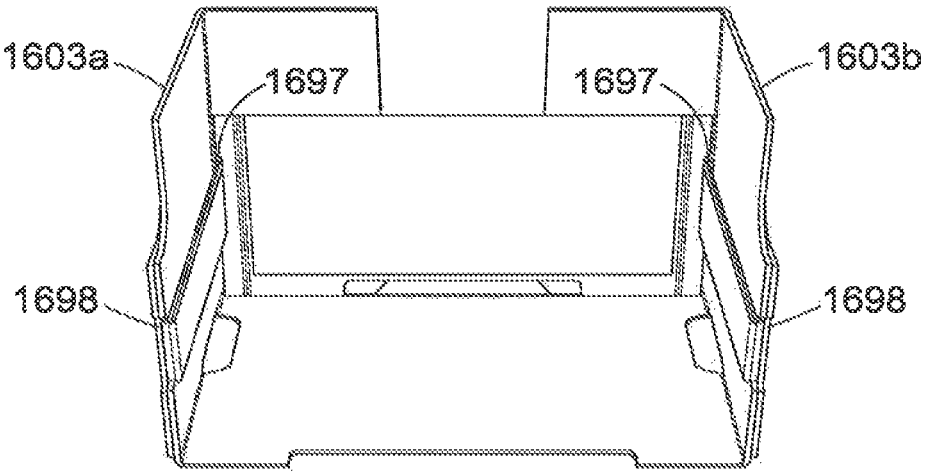
Figure 212:
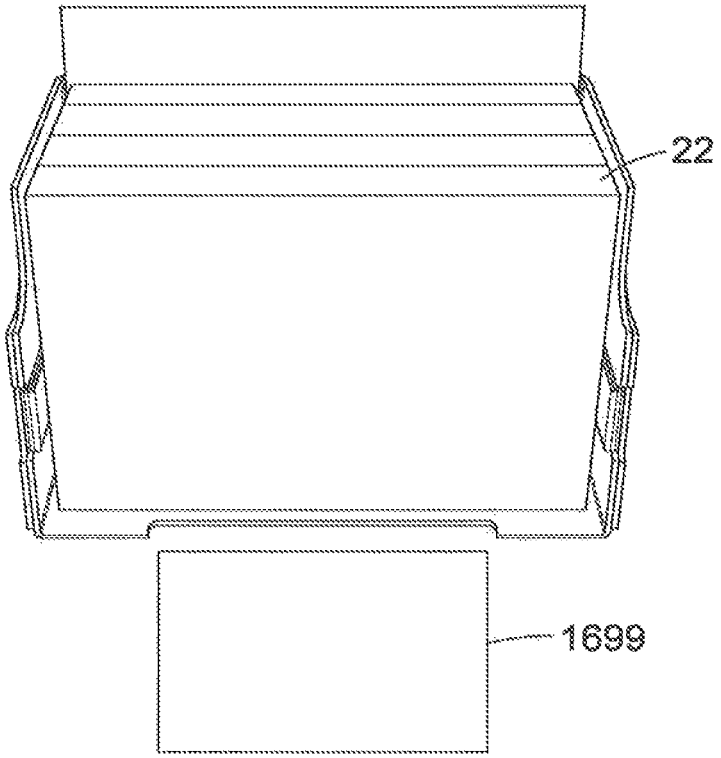
Figure 213:
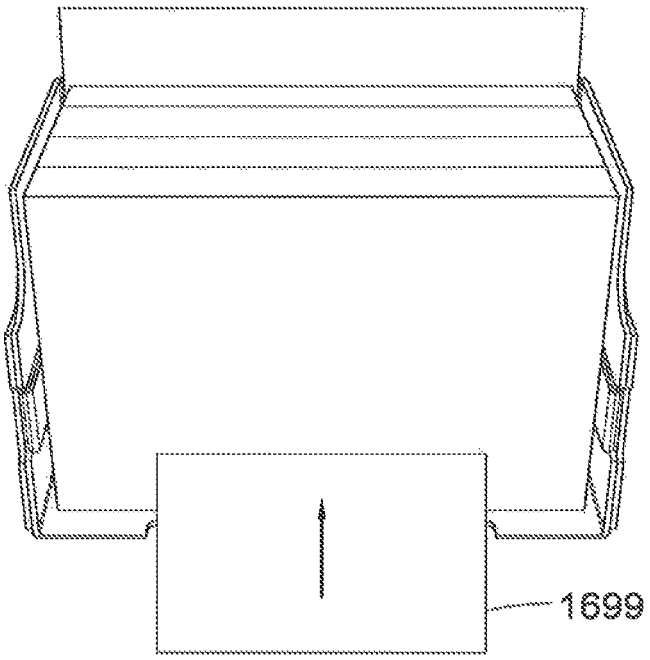
Figure 214:
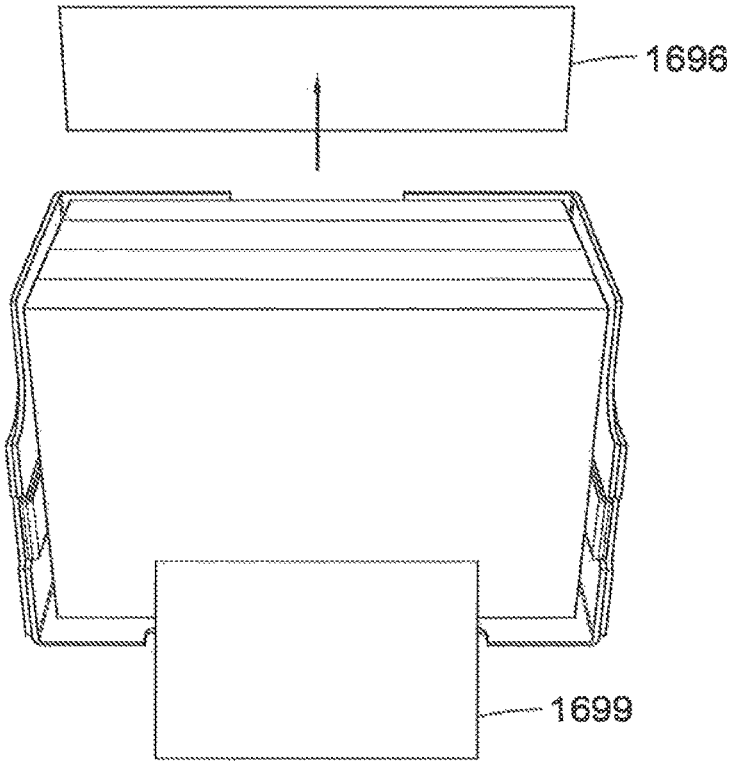
Figure 215:
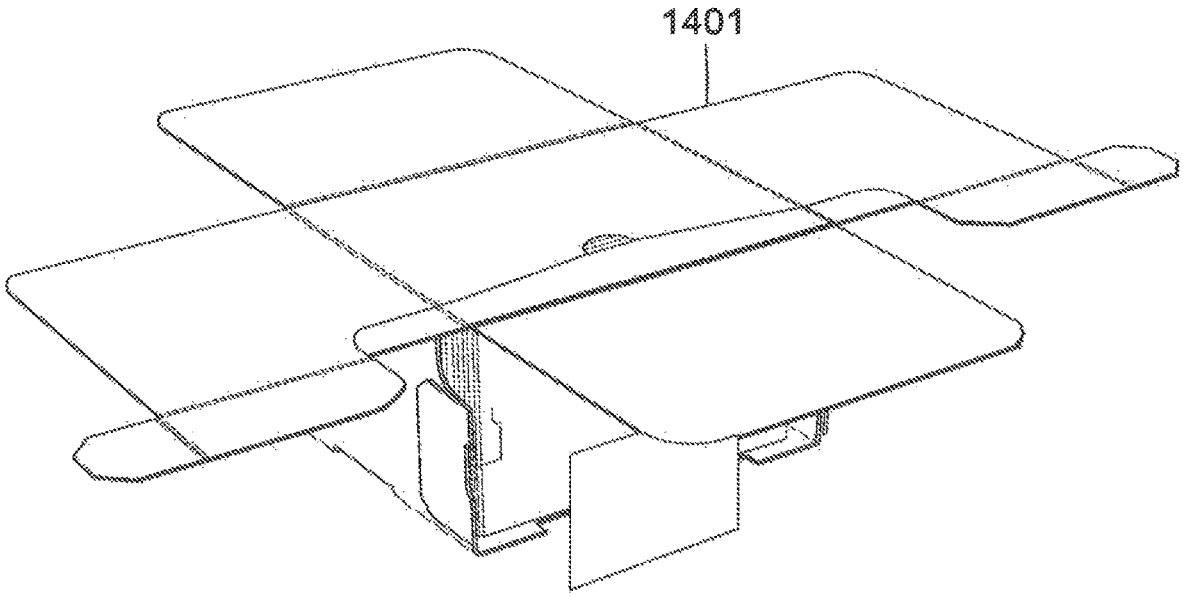

As is best seen in FIG. 211, in which view the auxiliary board is removed for clarity, the sides of the pusher board 1693 each have a recessed portion 1697 provided in them. These were provided by slots in the original blank that frustrated the perforations between that pusher board and the flaps to its side into two distinct lengths of perforations, much like the line of perforations between the pusher board and the base of the tray was frustrated into two lengths by the other slot. The recessed portions are each wider than the width of the pusher 44. They help to guide the pusher 44, or retain it in place with respect to the pusher board. They are optional in that the earlier embodiment did not have them.

Additionally, side walls 1603*a, b* of the tray 20 have recessed portions 1698 at their front ends. These recessed portions 1698 also guide the pusher 44 as it passes around the front ends of the side walls 1603*a, b* from the flaps that were attached to the pusher board. These also are optional.

The pusher 44 is held at the back of the tray 20 by the first auxiliary board 1696 while products 22 are placed within the tray 20. See FIG. 212. Once loaded, the products are then prevented from emerging from the front of the tray 20 by a second auxiliary board 1699 which is held by the user, or a loading machine, in front of the front of the tray 20. See FIG. 213. The second auxiliary board 1699 is held partly above the base 1604 of the tray 20—enough to retain the products, but insufficient to foul against the lid as it is applied. At this time, the first auxiliary board 1696 can then be removed from behind the products 22. See FIG. 214.

A blank 1401 corresponding to the lid 1462 of the tray 20 is then applied to the tray, and is folded in the same manner as described above with reference to previous embodiments with the same lid, except that the second auxiliary board 1699 is being used to hold the products 22 in position in the tray 20. The secondary auxiliary board 1699 can reside in the front recess of the base of the tray if preferred, whereby it will not interfere with the application of the lid even if arranged to be longer, i.e. higher relative to the products, than that shown.

Figure 216:
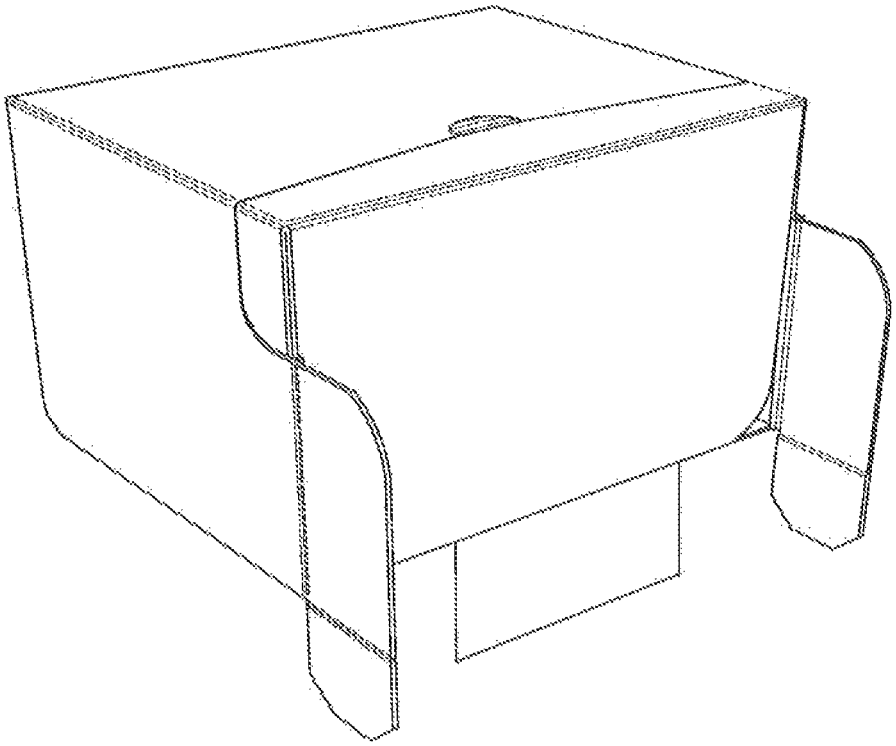
Figure 217:
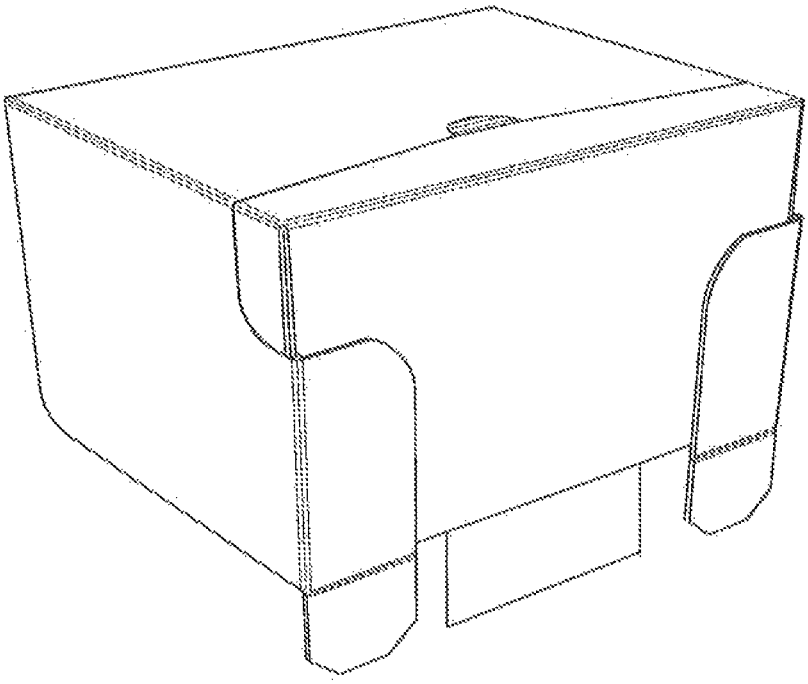
Figure 218:
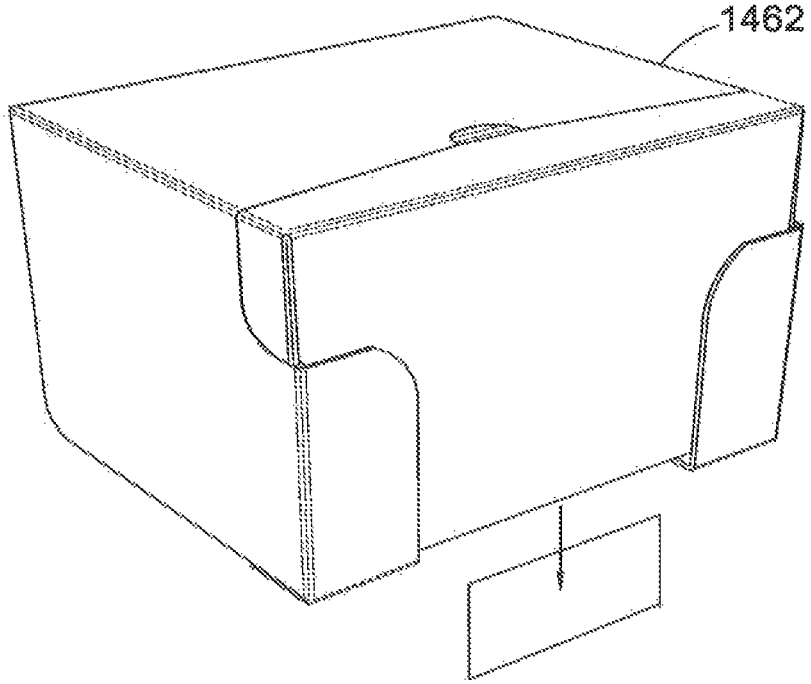
Figure 219:
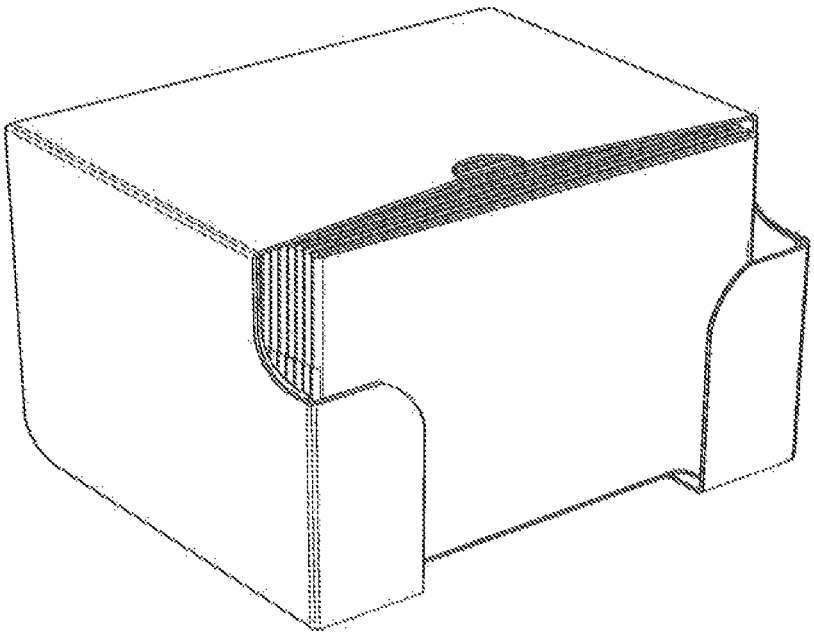
Figure 220:
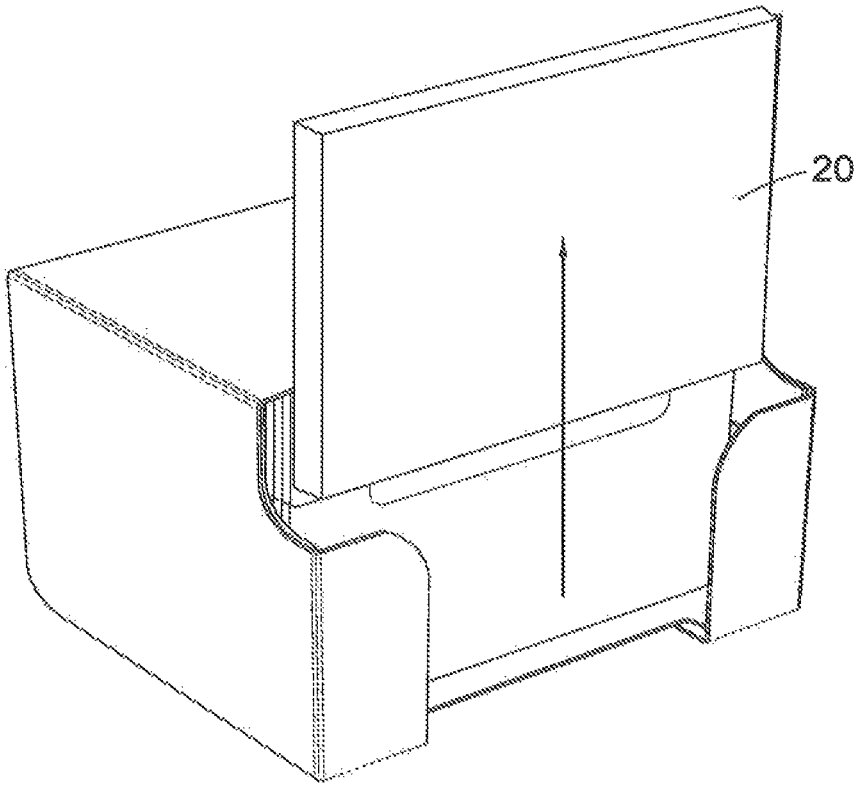

Once the lid is applied to the tray, and folded into its finished condition—see FIGS. 216 to 218, the secondary auxiliary board 1699 can be removed.

The completed box with the tray and lid can then be opened for extraction of products therefrom by removing the front thereof. See FIG. 219, and as with the other embodiments, when the front product 20 is removed (FIG. 220), the remaining products are front stacked by the pusher 44.

Figure 221:
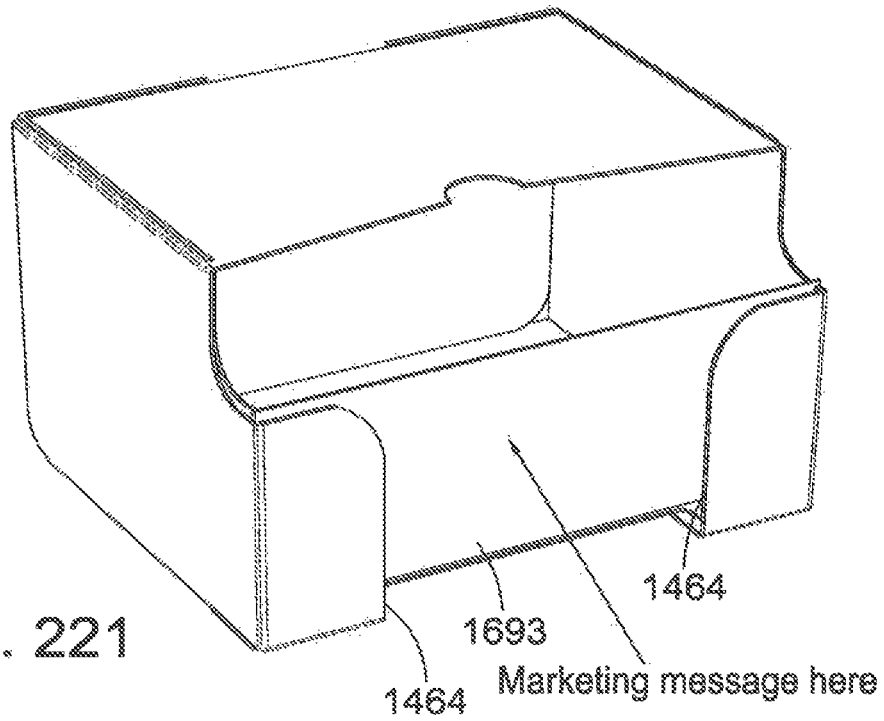

As shown in FIG. 221, once all the products 22 have been removed from the tray 20, the pusher board 1693 sits at the front of the tray 20 behind front side flaps 1464. Information, such as a marketing message, can beneficially be displayed on the pusher board 1693.

Referring finally to FIGS. 222 to 227, a variant of the pusher 44 is shown. Whereas the majority of the previous embodiments has the pusher web 44 extending around the two vertical sides of the products and around the back of the products, this alternative embodiment has the web extending over the top and bottom edges of the products, and around the backs thereof. The processes and applications of the previous embodiments can likewise be adopted for this alternative orientation for the pusher.

Figure 222:
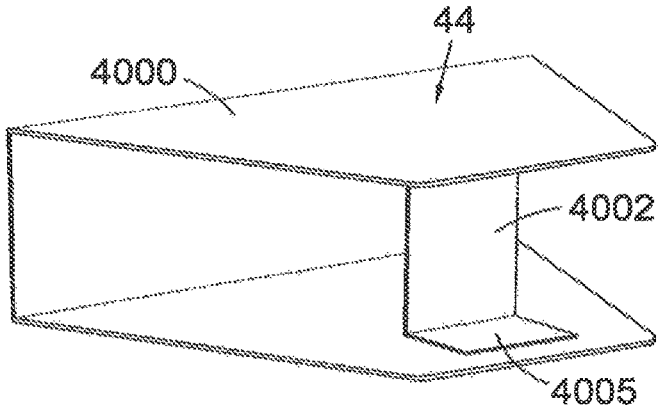
FIGS. 222 to 227 show an alternative "vertical" arrangement for the pusher.
Figure 223:
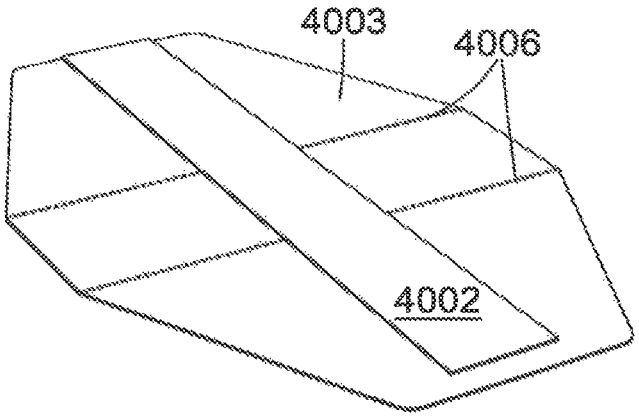

As seen in FIG. 222, the pusher 44 has a cardboard frame 4000 and an elastic tape 4002. This can be applied as shown in FIG. 223, where the cardboard frame is still a flat blank 4003 and the tape 4002 is applied across it from one end to another (or just short thereof as shown) in an elongated condition. For holding it there, glue or staples can be applied to end portions 4005 (see FIG. 222). The blank 4003 is then folded about scored fold lines 4006 that extend perpendicular to the tape, thus relaxing (or mostly relaxing) the tension in the tape when the condition of FIG. 222 is reached, with the two fold lines being perpendicular folds.

Figure 224:
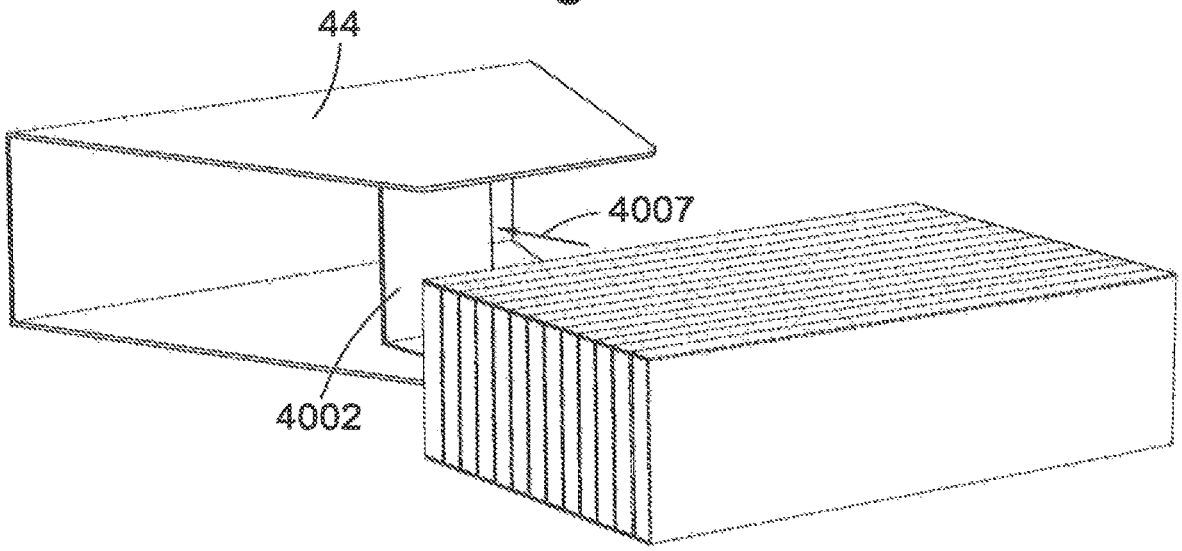
Figure 227:
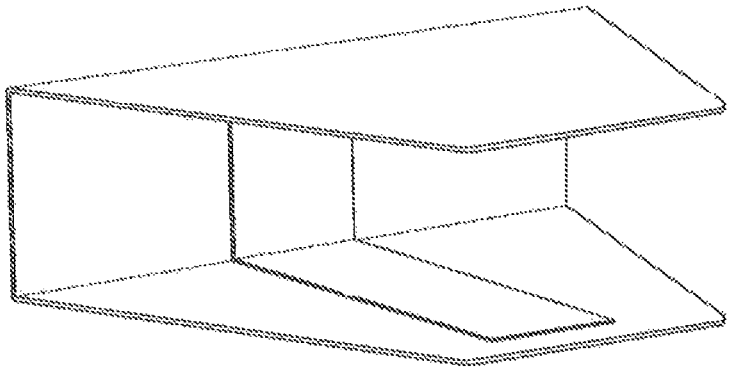

Then, with reference to FIG. 224, products can be front loaded into the pusher 44, thus pushing back 4007 the tape 4002. Alternatively, they can be top loaded if the pusher is instead arranged with this side walls in a vertical condition, as per FIG. 227. In FIG. 227, the tape is additionally pre-tensioned back to the base of the pusher, e.g. by a pusher plate (not shown for this embodiment, but see the earlier embodiments). Pretensioning in this manner is optional, but useful for fragile products that might not benefit from being used to stretch the elastic tape.

Figure 225:
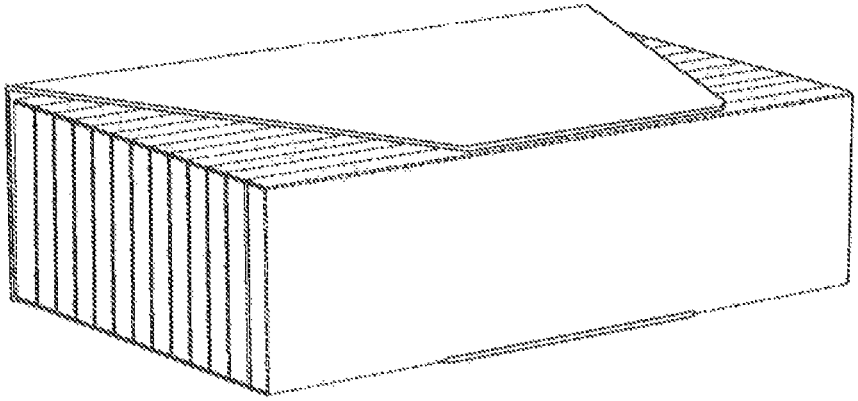
Figure 226:
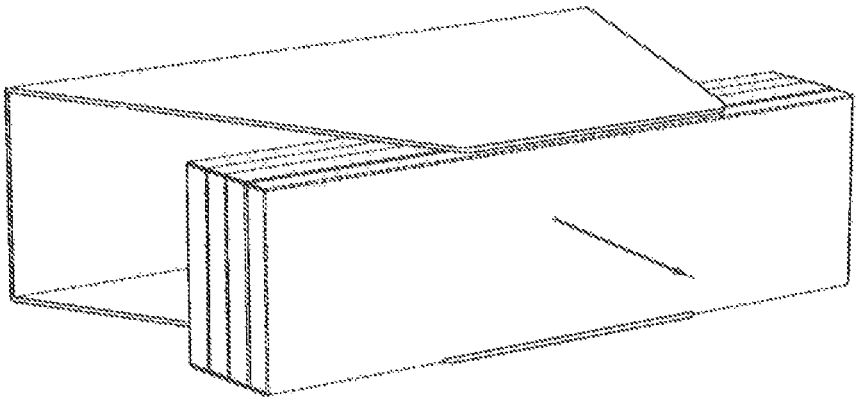

Once fully loaded, as shown in FIG. 225, the loaded products and pusher can be placed in a tray, ready for distribution. Then, as shown in FIG. 226, they can be removed one-by-one, with the bias of the tape biasing the products forwards as shown in FIG. 226 (the tray is not shown for ease of reference).

For the trays of the present invention, they can be open topped more readily with this final embodiment since the pusher 44 itself can define a top, although other embodiments can also have an open topped tray. However, a top for the tray is nevertheless preferred for all embodiments.

For those tops, it is preferred that they be provided with a rip-off front portion. However, instead of just a rip-off front for the lid, the rip-off section may remove the entire lid, or a greater or lesser part of the lid. The locations of the perforated lines can define the shape of the rip-off section.

Instead of a separate blank for the lid, the lid may be an integral part of the tray's blank.

Preferred features of the present invention have been described above purely by way of example. Modifications in detail may be made to the invention within the scope of the claims appended hereto.

We claim:

1. A method of assembling a tray having a product pusher and products therein, the product pusher being formed from a) a board or boards made of cardboard disposed at least partially alongside at least two sides of the tray when assembled within a product receiving cavity of the tray, between the at least two sides of the tray, wherein the board or boards includes two boards of equal length joined along a perforated line, and the two boards of equal length are separated along the perforated line before insertion into thetray to form two separate boards, and b) a length of elastically stretchable fabric or material with two ends which, when loaded with products, is arranged to wrap behind and to the sides of the products to apply a resilient bias force to a rear surface of those products when they are contained within the tray, the fabric or material being attached by gluing at or towards its two ends to the board or boards at locations thereon that are disposed at least partially alongside the sides of the tray, wherein said two separate boards are joined by said fabric or material and are contacting the products, the method comprising:

folding a blank to form at least part of the tray, including the product receiving cavity, inserting products into the product pusher such that the length of fabric or material wraps partially around the products in a stretched state, and inserting the products and the product pusher into the product receiving cavity of the tray.

2. The method of claim 1, wherein the fabric or material of the pusher is attached at or towards its ends to two surfaces of the board or boards that are lying in a common plane at the time of attachment.

3. The method of claim 1, wherein the length of fabric or material is attached to the board or boards in an elongated condition.

4. The method of claim 1, wherein when inserting products into the product pusher, the length of fabric or material of the product pusher is stretched around a top and sides of a stack of products with the board or boards of the product pusher being disposed at either side of the stack of products.

5. The method of claim 1, wherein the length of fabric or material is attached to the board or boards in an elongated condition and the board or boards are folded perpendicularly about scored fold lines that extend perpendicular to the length of the fabric or material, upon insertion into the tray with the products, thus allowing the fabric or material to relax or mostly relax the tension in the fabric or material as the products are removed from the tray.

* * * * *